US010851444B2

(12) United States Patent
Vecchio et al.

(10) Patent No.: US 10,851,444 B2
(45) Date of Patent: Dec. 1, 2020

(54) NON-MAGNETIC, STRONG CARBIDE FORMING ALLOYS FOR POWDER MANUFACTURE

(71) Applicant: Oerlikon Metco (US) Inc., Westbury, NY (US)

(72) Inventors: James Vecchio, San Diego, CA (US); Justin Lee Cheney, Encinitas, CA (US)

(73) Assignee: Oerlikon Metco (US) Inc., Westbury, NY (US)

( * ) Notice: Subject to any disclaimer, the term of this patent is extended or adjusted under 35 U.S.C. 154(b) by 978 days.

(21) Appl. No.: 15/258,710

(22) Filed: Sep. 7, 2016

(65) Prior Publication Data

US 2017/0067138 A1 Mar. 9, 2017

Related U.S. Application Data

(60) Provisional application No. 62/215,319, filed on Sep. 8, 2015.

(51) Int. Cl.
*C22C 38/24* (2006.01)
*C22C 38/36* (2006.01)
(Continued)

(52) U.S. Cl.
CPC ..... *C22C 38/38* (2013.01); *C22C 37/06* (2013.01); *C22C 37/08* (2013.01); *C22C 38/22* (2013.01);
(Continued)

(58) Field of Classification Search
CPC ..... C21D 2211/001; C21D 2211/004; C22C 37/06; C22C 37/08; C22C 38/22;
(Continued)

(56) References Cited

U.S. PATENT DOCUMENTS 2,043,952 A 6/1936 Ffield
2,156,306 A 5/1939 Rapatz
(Continued)

FOREIGN PATENT DOCUMENTS

CN 102233490 A 11/2011
CN 102357750 A 2/2012
(Continued)

OTHER PUBLICATIONS

Audouard, et al.: "Corrosion Performance and Field Experience With Super Duplex and Super Austenitic Stainless Steels in FGD Systems", Corrosion 2000; p. 4, table 2.
(Continued)

*Primary Examiner* — Colleen P Dunn
*Assistant Examiner* — Anthony M Liang
(74) *Attorney, Agent, or Firm* — Knobbe, Martens, Olson & Bear, LLP

(57) ABSTRACT

Disclosed herein are embodiments of non-magnetic, strong carbide forming alloys. In particular, the alloys can be advantageously used for powder manufacturing. Embodiments of the disclosure can have low FCC-BCC transition temperatures in combination with hard particles having a hardness of 1000 Vickers or greater. The alloys can be used in conjunction with, for example, drill pipe tool joints, drill collars, down hole stabilizers, or oilfield components, particularly as a hardbanding component.

19 Claims, 3 Drawing Sheets

(51) Int. Cl.

| | |
|---|---|
| ***C22C 38/38*** | (2006.01) |
| ***E21B 17/00*** | (2006.01) |
| ***C22C 38/44*** | (2006.01) |
| ***C22C 38/56*** | (2006.01) |
| ***C22C 38/46*** | (2006.01) |
| ***C22C 38/58*** | (2006.01) |
| ***C22C 38/26*** | (2006.01) |
| ***C22C 38/22*** | (2006.01) |
| ***C22C 37/08*** | (2006.01) |
| ***C22C 38/28*** | (2006.01) |
| ***C22C 37/06*** | (2006.01) |

(52) U.S. Cl.

CPC ..... *C22C 38/24* (2013.01); *C22C 38/26* (2013.01); *C22C 38/28* (2013.01); *C22C 38/36* (2013.01); *C22C 38/44* (2013.01); *C22C 38/46* (2013.01); *C22C 38/56* (2013.01); *C22C 38/58* (2013.01); *E21B 17/00* (2013.01); *C21D 2211/001* (2013.01); *C21D 2211/004* (2013.01)

(58) Field of Classification Search

CPC ..... C22C 38/24; C22C 38/26; C22C 38/28; C22C 38/36; C22C 38/38; C22C 38/44; C22C 38/46; C22C 38/56; C22C 38/58; E21B 17/00; E21B 17/04; E21B 17/16; E21B 17/1085; E21B 17/1078; E21B 7/04

See application file for complete search history.

(56) References Cited

U.S. PATENT DOCUMENTS

| | | | |
|---|---|---|---|
| 2,608,495 | A | 8/1952 | Barry |
| 2,873,187 | A | 2/1959 | Dyrkaez et al. |
| 2,936,229 | A | 5/1960 | Shepard |
| 3,024,137 | A | 3/1962 | Witherell |
| 3,113,021 | A | 12/1963 | Witherell |
| 3,181,970 | A | 5/1965 | Witherell et al. |
| 3,303,063 | A | 2/1967 | Pietryka et al. |
| 3,448,241 | A | 6/1969 | Buckingham et al. |
| 3,554,792 | A | 1/1971 | Johnson |
| 3,650,734 | A | 3/1972 | Kantor et al. |
| 3,843,359 | A | 10/1974 | Fiene et al. |
| 3,859,060 | A | 1/1975 | Eiselstein et al. |
| 3,942,954 | A | 3/1976 | Frehn |
| 3,975,612 | A | 8/1976 | Nakazaki et al. |
| 4,010,309 | A | 3/1977 | Peterson |
| 4,017,339 | A | 4/1977 | Okuda et al. |
| 4,042,383 | A | 8/1977 | Petersen et al. |
| 4,066,451 | A | 1/1978 | Rudy |
| 4,214,145 | A | 7/1980 | Zvanut et al. |
| 4,235,630 | A | 11/1980 | Babu |
| 4,255,709 | A | 3/1981 | Zatsepium et al. |
| 4,277,108 | A | 7/1981 | Wallace |
| 4,297,135 | A | 10/1981 | Giessen et al. |
| 4,365,994 | A | 12/1982 | Ray |
| 4,415,530 | A | 11/1983 | Hunt |
| 4,419,130 | A | 12/1983 | Slaughter |
| 4,576,653 | A | 3/1986 | Ray |
| 4,596,282 | A | 6/1986 | Maddy et al. |
| 4,606,977 | A | 8/1986 | Dickson et al. |
| 4,635,701 | A | 1/1987 | Sare et al. |
| 4,639,576 | A | 1/1987 | Shoemaker et al. |
| 4,666,797 | A | 5/1987 | Newman et al. |
| 4,673,550 | A | 6/1987 | Dallaire et al. |
| 4,762,681 | A | 8/1988 | Tassen et al. |
| 4,803,045 | A | 2/1989 | Ohriner et al. |
| 4,822,415 | A | 4/1989 | Dorfman et al. |
| 4,919,728 | A | 4/1990 | Kohl et al. |
| 4,981,644 | A | 1/1991 | Chang |
| 5,094,812 | A | 3/1992 | Dulmaine et al. |
| 5,252,149 | A | 10/1993 | Dolman |
| 5,306,358 | A | 4/1994 | Lai et al. |
| 5,375,759 | A | 12/1994 | Hiraishi et al. |
| 5,567,251 | A | 10/1996 | Peker et al. |
| 5,570,636 | A | 11/1996 | Lewis |
| 5,618,451 | A | 4/1997 | Ni |
| 5,820,939 | A | 10/1998 | Popoola et al. |
| 5,858,558 | A | 1/1999 | Zhao et al. |
| 5,861,605 | A | 1/1999 | Ogawa et al. |
| 5,907,017 | A | 5/1999 | Ober et al. |
| 5,935,350 | A | 8/1999 | Raghu et al. |
| 5,942,289 | A | 8/1999 | Jackson |
| 5,988,302 | A | 11/1999 | Sreshta et al. |
| 6,117,493 | A | 9/2000 | North |
| 6,171,222 | B1 | 1/2001 | Lakeland et al. |
| 6,210,635 | B1 | 4/2001 | Jackson et al. |
| 6,232,000 | B1 | 5/2001 | Singh et al. |
| 6,326,582 | B1 | 12/2001 | North |
| 6,331,688 | B1 | 12/2001 | Hallén et al. |
| 6,332,936 | B1 | 12/2001 | Hajaligo et al. |
| 6,375,895 | B1 | 4/2002 | Daemen |
| 6,398,103 | B2 | 6/2002 | Hasz et al. |
| 6,441,334 | B1 | 8/2002 | Aida et al. |
| 6,582,126 | B2 | 6/2003 | North |
| 6,608,286 | B2 | 8/2003 | Jiang |
| 6,669,790 | B1 | 12/2003 | Gundlach et al. |
| 6,689,234 | B2 | 2/2004 | Branagan |
| 6,702,905 | B1 | 3/2004 | Qiao et al. |
| 6,702,906 | B2 | 3/2004 | Ogawa et al. |
| 6,750,430 | B2 | 6/2004 | Kelly |
| 7,052,561 | B2 | 5/2006 | Lu et al. |
| 7,219,727 | B2 | 5/2007 | Slack et al. |
| 7,285,151 | B2 | 10/2007 | Sjodin et al. |
| 7,361,411 | B2 | 4/2008 | Daemen et al. |
| 7,491,910 | B2 | 2/2009 | Kapoor et al. |
| 7,553,382 | B2 | 6/2009 | Branagan et al. |
| 7,569,286 | B2 | 8/2009 | Daemen et al. |
| 7,776,451 | B2 | 8/2010 | Jiang et al. |
| 7,935,198 | B2 | 5/2011 | Branagan et al. |
| 8,070,894 | B2 | 12/2011 | Branagan |
| 8,097,095 | B2 | 1/2012 | Branagan |
| 8,153,935 | B2 | 4/2012 | Jang et al. |
| 8,187,529 | B2 | 5/2012 | Powell |
| 8,187,725 | B2 | 5/2012 | Kiser et al. |
| 8,268,453 | B2 | 9/2012 | Dallaire |
| 8,474,541 | B2 | 7/2013 | Branagan et al. |
| 8,562,759 | B2 | 10/2013 | Cheney et al. |
| 8,562,760 | B2 | 10/2013 | Cheney et al. |
| 8,640,941 | B2 | 2/2014 | Cheney |
| 8,647,449 | B2 | 2/2014 | Cheney et al. |
| 8,658,934 | B2 | 2/2014 | Branagan et al. |
| 8,662,143 | B1 | 3/2014 | Foster |
| 8,702,835 | B2 | 4/2014 | Yu et al. |
| 8,703,046 | B2 | 4/2014 | Hanejko et al. |
| 8,704,134 | B2 | 4/2014 | Branagan et al. |
| 8,777,090 | B2 | 7/2014 | Miller et al. |
| 8,801,872 | B2 | 8/2014 | Wright et al. |
| 8,808,471 | B2 | 8/2014 | Wright et al. |
| 8,858,675 | B2 | 10/2014 | Larsson |
| 8,870,997 | B2 | 10/2014 | Klekovkin et al. |
| 8,911,662 | B2 | 12/2014 | Larsson |
| 8,920,938 | B2 | 12/2014 | Hesse et al. |
| 8,973,806 | B2 | 3/2015 | Cheney |
| 8,992,659 | B2 | 3/2015 | Larsson et al. |
| 9,051,635 | B2 | 6/2015 | Jou |
| 9,095,932 | B2 | 8/2015 | Miller et al. |
| 9,145,598 | B2 | 9/2015 | Oshchepkov |
| 9,174,293 | B2 | 11/2015 | Lee |
| 9,193,011 | B2 | 11/2015 | Mars et al. |
| 9,233,419 | B2 | 1/2016 | Gries |
| 9,255,309 | B2 | 2/2016 | Aimone |
| 9,309,585 | B2 | 4/2016 | Cheney et al. |
| 9,314,848 | B2 | 4/2016 | Larsson |
| 9,340,855 | B2 | 5/2016 | Schade et al. |
| 9,394,591 | B2 | 7/2016 | Deodeshmukh et al. |
| 9,399,907 | B2 | 7/2016 | Mo et al. |
| 2001/0019781 | A1 | 9/2001 | Hasz |
| 2002/0054972 | A1 | 5/2002 | Charpentier et al. |
| 2002/0098298 | A1 | 7/2002 | Bolton et al. |
| 2002/0148533 | A1 | 10/2002 | Kim et al. |
| 2004/0062677 | A1 | 4/2004 | Chabenat et al. |

(56) References Cited

U.S. PATENT DOCUMENTS

| | | | |
|---|---|---|---|
| 2004/0079742 | A1 | 4/2004 | Kelly |
| 2004/0115086 | A1 | 6/2004 | Chabenat et al. |
| 2004/0206726 | A1 | 10/2004 | Daemen et al. |
| 2005/0047952 | A1 | 3/2005 | Coleman |
| 2005/0109431 | A1 | 5/2005 | Kernan et al. |
| 2006/0063020 | A1 | 3/2006 | Barbezat |
| 2006/0093752 | A1 | 5/2006 | Darolia et al. |
| 2006/0191606 | A1 | 8/2006 | Ogawa et al. |
| 2006/0260583 | A1 | 11/2006 | Abi-Akar et al. |
| 2007/0029295 | A1 | 2/2007 | Branagan |
| 2007/0090167 | A1 | 4/2007 | Arjakine et al. |
| 2007/0187369 | A1 | 8/2007 | Menon et al. |
| 2007/0253856 | A1 | 11/2007 | Vecchio et al. |
| 2007/0284018 | A1 | 12/2007 | Hamano et al. |
| 2008/0001115 | A1 | 1/2008 | Qiao et al. |
| 2008/0031769 | A1 | 2/2008 | Yeh |
| 2008/0149397 | A1 | 6/2008 | Branagan |
| 2008/0241580 | A1 | 10/2008 | Kiser et al. |
| 2008/0241584 | A1 | 10/2008 | Daemen et al. |
| 2009/0017328 | A1 | 1/2009 | Katoh et al. |
| 2009/0123765 | A1 | 5/2009 | Branagan |
| 2009/0258250 | A1 | 10/2009 | Daemen et al. |
| 2009/0285715 | A1 | 11/2009 | Arjakine et al. |
| 2010/0009089 | A1 | 1/2010 | Junod et al. |
| 2010/0028706 | A1 | 2/2010 | Hornschu et al. |
| 2010/0044348 | A1 | 2/2010 | Buchmann |
| 2010/0101780 | A1 | 4/2010 | Ballew et al. |
| 2010/0155236 | A1 | 6/2010 | Lee et al. |
| 2010/0166594 | A1 | 7/2010 | Hirata et al. |
| 2010/0189588 | A1 | 7/2010 | Kawatsu et al. |
| 2010/0258217 | A1 | 10/2010 | Kuehmann |
| 2011/0004069 | A1 | 1/2011 | Ochs et al. |
| 2011/0064963 | A1 | 3/2011 | Cheney et al. |
| 2011/0139761 | A1 | 6/2011 | Sugahara et al. |
| 2011/0142713 | A1 | 6/2011 | Kawasaki et al. |
| 2011/0162612 | A1 | 7/2011 | Qiao et al. |
| 2011/0171485 | A1 | 7/2011 | Kawamoto et al. |
| 2011/0220415 | A1 | 9/2011 | Jin et al. |
| 2012/0055903 | A1 | 3/2012 | Izutani et al. |
| 2012/0103456 | A1 | 5/2012 | Smith et al. |
| 2012/0156020 | A1 | 6/2012 | Kottilingam et al. |
| 2012/0160363 | A1 | 6/2012 | Jin et al. |
| 2012/0288400 | A1 | 11/2012 | Hirata et al. |
| 2013/0094900 | A1 | 4/2013 | Folkmann et al. |
| 2013/0167965 | A1 | 4/2013 | Cheney et al. |
| 2013/0224516 | A1 | 8/2013 | Kusinski et al. |
| 2013/0260177 | A1 | 10/2013 | Wallin et al. |
| 2013/0266798 | A1 | 10/2013 | Cheney |
| 2013/0294962 | A1 | 11/2013 | Wallin et al. |
| 2014/0044587 | A1 | 2/2014 | Crook et al. |
| 2014/0044617 | A1 | 2/2014 | Dreisinger |
| 2014/0060707 | A1 | 3/2014 | Wright et al. |
| 2014/0065316 | A1 | 3/2014 | Cheney |
| 2014/0105780 | A1 | 4/2014 | Cheney |
| 2014/0131338 | A1 | 5/2014 | Postle |
| 2014/0171367 | A1 | 6/2014 | Murthy et al. |
| 2014/0219859 | A1 | 8/2014 | Cheney |
| 2014/0234154 | A1 | 8/2014 | Cheney et al. |
| 2014/0248509 | A1 | 9/2014 | Cheney |
| 2014/0263248 | A1 | 9/2014 | Postle |
| 2014/0295194 | A1 | 10/2014 | Yoshitaka et al. |
| 2014/0322064 | A1 | 10/2014 | Gerk et al. |
| 2014/0356223 | A1 | 12/2014 | Nilsson et al. |
| 2015/0004337 | A1 | 1/2015 | Zimmermann et al. |
| 2015/0075681 | A1 | 3/2015 | Wright et al. |
| 2015/0086413 | A1 | 3/2015 | Wolverton et al. |
| 2015/0106035 | A1 | 4/2015 | Vecchio et al. |
| 2015/0147591 | A1 | 5/2015 | Cheney |
| 2015/0152994 | A1 | 6/2015 | Bondil et al. |
| 2015/0252631 | A1 | 9/2015 | Miller |
| 2015/0275341 | A1 | 10/2015 | Cheney |
| 2015/0284817 | A1 | 10/2015 | Snyder et al. |
| 2015/0284829 | A1 | 10/2015 | Cheney |
| 2015/0298986 | A1 | 10/2015 | Billieres et al. |
| 2015/0307968 | A1 | 10/2015 | Mars et al. |
| 2015/0367454 | A1 | 12/2015 | Cheney |
| 2016/0001368 | A1 | 1/2016 | Gries et al. |
| 2016/0002752 | A1 | 1/2016 | Srivastava et al. |
| 2016/0002764 | A1 | 1/2016 | Gries et al. |
| 2016/0017463 | A1 | 1/2016 | Cheney |
| 2016/0024621 | A1 | 1/2016 | Cheney |
| 2016/0024624 | A1 | 1/2016 | Cheney |
| 2016/0024628 | A1 | 1/2016 | Cheney |
| 2016/0040262 | A1 | 2/2016 | Snyder et al. |
| 2016/0083830 | A1 | 3/2016 | Cheney |
| 2016/0114392 | A1 | 4/2016 | Berg et al. |
| 2016/0138144 | A1 | 5/2016 | Olsérius |
| 2016/0168670 | A1 | 6/2016 | Cheney |
| 2016/0195216 | A1 | 7/2016 | Bondil et al. |
| 2016/0201169 | A1 | 7/2016 | Vecchio |
| 2016/0201170 | A1 | 7/2016 | Vecchio |
| 2016/0215374 | A1 | 7/2016 | Schade et al. |
| 2016/0222490 | A1 | 8/2016 | Wright et al. |
| 2016/0243616 | A1 | 8/2016 | Gries |

FOREIGN PATENT DOCUMENTS

| | | | |
|---|---|---|---|
| DE | 27 54 437 | | 7/1979 |
| DE | 33 20 513 | | 12/1983 |
| DE | 42 02 828 | | 8/1993 |
| EP | 0 365 884 | | 5/1990 |
| EP | 1 270 755 | | 1/2003 |
| EP | 1 338 663 | | 8/2003 |
| EP | 2 305 415 | | 8/2003 |
| EP | 1 721 999 | | 11/2006 |
| EP | 1721999 | A1 | 11/2006 |
| EP | 1 857 204 | | 11/2007 |
| EP | 2 064 359 | | 6/2009 |
| EP | 2 388 345 | | 11/2011 |
| EP | 2 660 342 | | 11/2013 |
| EP | 2 072 627 | | 4/2014 |
| EP | 2 730 355 | | 5/2014 |
| EP | 2 743 361 | | 6/2014 |
| EP | 2 104 753 | | 7/2014 |
| EP | 2 778 247 | | 9/2014 |
| EP | 2 563 942 | | 10/2015 |
| EP | 3 034 637 | | 6/2016 |
| GB | 2 153 846 | A | 8/1985 |
| IN | MUMNP-2003-00842 | | 4/2005 |
| JP | 58-132393 | | 8/1983 |
| JP | 60-133996 | A | 7/1985 |
| JP | 63-026205 | A | 2/1988 |
| JP | 03-133593 | A | 6/1991 |
| JP | 2004-149924 | | 5/2004 |
| JP | 2010-138491 | | 6/2010 |
| JP | 2012-000616 | | 1/2012 |
| KR | 10-0935816 | B1 | 1/2010 |
| SU | 1706398 | | 1/1992 |
| TW | 200806801 | A | 2/2008 |
| WO | WO 1984/000385 | | 2/1984 |
| WO | WO 1984/004760 | | 12/1984 |
| WO | WO 2006/086350 | | 8/2006 |
| WO | WO 2008/011448 | | 5/2008 |
| WO | WO 2008/082353 | | 7/2008 |
| WO | WO 2010/044740 | | 4/2010 |
| WO | WO 2010/046224 | | 4/2010 |
| WO | WO 2010/074634 | | 7/2010 |
| WO | WO 2011/021751 | | 2/2011 |
| WO | WO 2011/071054 | | 6/2011 |
| WO | WO 2011/158706 | | 12/2011 |
| WO | WO 2012/021186 | | 2/2012 |
| WO | WO 2012/022874 | | 2/2012 |
| WO | WO 2012/112844 | | 8/2012 |
| WO | WO 2013/055652 | | 4/2013 |
| WO | WO 2013/060839 | | 5/2013 |
| WO | WO 2013/101561 | | 7/2013 |
| WO | WO 2013/102650 | | 7/2013 |
| WO | WO 2013/126134 | | 8/2013 |
| WO | WO 2014/001544 | | 1/2014 |
| WO | WO 2014/023646 | | 2/2014 |
| WO | WO 2014/059177 | | 4/2014 |
| WO | WO 2014/081491 | | 5/2014 |
| WO | WO 2014/083544 | | 6/2014 |
| WO | WO 2014/085319 | | 6/2014 |

(56) References Cited

FOREIGN PATENT DOCUMENTS

| | | |
|---|---|---|
| WO | WO 2014/090922 | 6/2014 |
| WO | WO 2014/114714 | 7/2014 |
| WO | WO 2014/114715 | 7/2014 |
| WO | WO 2014/187867 | 11/2014 |
| WO | WO 2014/197088 | 12/2014 |
| WO | WO 2014/201239 | 12/2014 |
| WO | WO 2014/202488 | 12/2014 |
| WO | WO 2015/028358 | 3/2015 |
| WO | WO 2015/049309 | 4/2015 |
| WO | WO 2015/075122 | 5/2015 |
| WO | WO 2015/183955 | 12/2015 |
| WO | WO 2016/003520 | 1/2016 |
| WO | WO 2016/010599 | 1/2016 |
| WO | WO 2016/124532 | 8/2016 |
| WO | WO 2016/131702 | 8/2016 |

OTHER PUBLICATIONS

Branagan, et al.: Developing extreme hardness (>15GPa) in iron based nanocomosites, Composites Part A: Applied Science and Manufacturing, Elsevier Science Publishers B.V., Amsterdam, NL, vol. 33, No. 6, Jun. 1, 2002, pp. 855-859.

Chen et al.: "Characterization of Microstructure and Mechanical Properties of High Chromium Cast Irons Using SEM and Nanoindentation," JMEPEG 2015 (published online Oct. 30, 2014), vol. 24(1), pp. 98-105.

Cheney, et al.: "Development of quaternary Fe-based bulk metallic glasses," Materials Science and Engineering, vol. 492, No. 1-2, Sep. 25, 2008, pp. 230-235.

Cheney: Modeling the Glass Forming Ability of Metals. A Dissertation submitted in partial satisfaction of the Requirements for the degree of Doctor of Philosophy. University of California, San Diego. Dec. 2007.

Cr-C Phase Diagram [online], [retrieved on Jan. 27, 2015]. Retrieved from the Internet: http://www.azom.com/work/3ud2quvLOU9g4VBMjVEh_files/image002.gif.

Davis, Jr, ed. Stainless steels. ASM International, 1994; p. 447.

http://www.crct.polymtl.ca/fact/documentation/BINARY/C-Nb.jpg>.

International Search Report and Written Opinion re PCT Application No. PCT/US2016/50532, dated Nov. 29, 2016.

Iron-Carbon (Fe—C) Phase diagram [online], [retrieved on Jan. 27, 2014]. Retrieved from the internet: <URL:http://www.calphad.com/iron-carbon.html>.

Khalifa, et al.: "Effect of Mo—Fe substitution on glass forming ability, thermal stability, and hardness of Fe—C—B—Mo—Cr—W bulk amorphous allows," Materials Science and Engineering, vol. 490, No. 1-2, Aug. 25, 2008, pp. 221-228.

Miracle, D.B.: The efficient cluster packing model—An atomic structural model for metallic glasses, Acta Materialia vol. 54, Issue 16, Sep. 2006, pp. 4317-4336.

Mo—C Phase Diagram [online], [retrieved on Jan. 27, 2015]. Retrieved from the Internet: <URL: http://factsage.cn/fact/documentation/SGTE/C-Mo.jpg>.

Nb—C Phase Diagram [online], [retrieved on Jan. 27, 2015]. Retrieved from the Internet: <URL: http://www.crct.polymtl.ca/fact/documentation/BINARY/C-Nb.jpg>.

Tillack, et al.: "Selection of Nickel, Nickel-Copper, Nickel-Cromium, and Nickel-Chromium-Iron Allows", ASM Handbook, Welding, Brazing and Soldering, vol. 6,Dec. 1, 1993 (Dec. 1, 1993) pp. 586-592, XP008097120, p. 589.

Titanium-Boron (TiB) Phase Diagram [online], [retrieved on Jan. 27, 2015]. Retrieved from the internet:<URL:http://www.calphad.com/titaniumboron.html>.

Yoo et al.: "The effect of boron on the wear behavior of iron-based hardfacing alloys for nuclear power plants valves," Journal of Nuclear Materials 352 (2006) 90-96.

Chinese Office Action for Application No. 201680051804.1 dated Mar. 11, 2019, with translation.

Industries Crucible: "Crucible CPM 590V", , Jun. 3, 2010 (Jun. 3, 2010), XP055569238, Retrieved from the Internet: URL:https://www.crucible.com/POFs/0ataSheets2010/dsS90v1%202010.pdf [retrieved on Mar. 14, 2019].

Y Kumashiro et al: "The Vickers micro-hardness of nonstoichiometric niobium carbide and vanadium carbide single crystals up to 1500C", Journal of Materials Science, vol. 15, No. 5, May 31, 1980 (May 31, 1980), pp. 1321-1324, XP055568998.

Kaoru Yamamoto et al: "Influence of Mo and W on High Temperature Hardness of M subT /subC sub3 /subCarbide in High Chromium White Cast Iron", Maierials Transaciions, vol. 55, No. 4, Feb. 21, 2014 (Feb. 21, 2014), pp. 684-689, xP055568999, JP, ISSN: 1345-9678, DOI: 10.2320/matertrans.F-M2014801.

Akiyoshi Miyoshi et al: "High Temperature Hardness of WC, TiC, TaC, NbC and Their Mixed Carbides", Funtai Oyobi Funmatsuyakin—Journal of the Japan Society of Powder and Powder Metallurgy, vol. 12, No. 2,Apr. 25, 1965 (Apr. 25, 1965), pp. 78-84, xP055569002, JP, ISSN: 0532-8799, DOI : 1 0.2497 ljjspm.12.78.

Songji Li et al: "Temperature Dependence of the Hardness of Single-phase Cementite Films Prepared by an Electron-Shower PVD Method", Journal of the Japan Instituie of Metals and Materials, vol. 64, No. 2,Feb. 28, 2000 (Feb. 28, 2000), pp. 134-140, xP055569004, DOI: 1 0.2320/jinstmet1952.64.2_1342.

European search report for Application No. 16844969.2 dated Mar. 26, 2019.

International Preliminary Report on Patentability (IPRP) for International Application No. PCT/US2016/050532 dated Mar. 13, 2008.

Crucible Industries LLC, Jun. 3, 2010, Crucible CPM S90V® data sheet, retrieved from the internet Mar. 14, 2019, https://www.crucible.com/PDFs/DataSheets2010/dsS90v1%202010.pdf, 2 pp.

Gorni, Oct. 9, 2003, Austenite transformation temperatures: ferrite start and finish, in Steel Forming and Heath Treating Handbook, pp. 26-43.

Kumashiro et al., May 31, 1980, The vickers micro-hardness of nonstoichiometric niobium carbide and vanadium carbide single crystals up to 1500c, Journal of Materials Science, 15(5):1321-1324.

Li et al., Feb. 28, 2000, Temperature dependence of the hardness of single-phase cementite films prepared by an electron-shower PVD method, Journal of the Japan Institute of Metals and Materials, 64(2):134-140.

Liu et al., Jan. 14, 2000, Measurement of austenite-to-ferrite transformation temperature after multi-pass deformation of steels, Materials Science and Engineering A, 194(1):L15-L18.

Miyoshi et al., Apr. 25, 1965, High temperature hardness of WC, TiC, TaC, NbC and their mixed carbides, Journal of the Japan Society of Powder and Powder Metallurgy, 12(2):78-84.

Yamamoto et al., 2014, Influence of Mo and W on high temperature hardness of M7C3 carbide in high chromium white cast iron, Materials Transactions, 55(4):684-689.

SEM MAG: 1.00 kx WD: 15.00mm VEGA3 TESCAN
SEM HV: 20.0 kV Det: BSE 50 $\mu$m
VEGA3 SBH Scoperta

NON-MAGNETIC, STRONG CARBIDE FORMING ALLOYS FOR POWDER MANUFACTURE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The disclosure generally relates to non-magnetic alloys which can be produced using common metal powder manufacturing techniques which serve as effective feedstock for plasma transferred arc and laser cladding hardfacing processes.

Description of the Related Art

Abrasive wear is a major concern for operators in applications that involve sand, rock, or other extremely hard media wearing away against a surface. Applications which see severe abrasive wear typically utilize materials of high hardness as a hardfacing coating. Hardfacing materials typically contain carbides and/or borides as hard precipitates which resist abrasion and increase the bulk hardness of the material.

It is well known by metallurgists that certain carbides are significantly harder than other carbides. It is also well known that the hardest carbides and borides also tend to form at elevated temperatures in a liquid alloy during a potential manufacturing process. In the case of powder manufacturing, high temperature carbides and/or borides are undesirable as they can precipitate out of the liquid alloy and onto the atomization nozzle, which creates complications during the manufacturing process, thus making these types of alloys incompatible with this process.

A number of disclosures are directed to non-magnetic alloys for use in forming drilling components including U.S. Pat. No. 4,919,728 which details a method for manufacturing non-magnetic drilling string components, and U.S. Patent Publication No. 2005/0047952, which describes a non-magnetic corrosion resistant high strength steel, the entirety of both of which is hereby incorporated by reference in its entirety. Both the patent and application describe magnetic permeability of less than 1.01. The compositions described have a maximum of 0.15 wt. % carbon, 1 wt. % silicon, and no boron. The low levels and absence of the above mentioned hard particle forming elements suggests that the alloys would not precipitate sufficient, if any, hard particles. It can be further expected that inadequate wear resistance and hardness for high wear environments would be provided.

Further, U.S. Pat. No. 4,919,728 describes alloys which contain carbon levels below 0.25 wt. % while U.S. Patent Publication No. 2005/0047952 details carbon levels below 0.1 wt. %. With these levels of carbon in conjunction with the absence of boron, few hard particles can form which impart wear resistance to a hardband.

U.S. Pat. No. 4,919,728 also discloses a method for cold working at various temperatures to achieve certain properties. However, cold working is not possible in coating applications such as hardfacing. The size and geometry of the parts would require excessive deformations loads as well as currently unknown methods to uniformly cold work specialized parts such as tool joints.

Additionally, U.S. Patent Publication No. 2010/0009089, hereby incorporated by reference in its entirety, details a non-magnetic alloy for coatings adapted for high wear applications where non-magnetic properties are required. The alloys listed in this publication are nickel-based with preformed tungsten carbide hard spherical particles poured into the molten weld material during welding in the amount of 30-60 wt. %.

Also, U.S Patent Publication Nos. 2014/0105780 and 2015/0275341, each of which is hereby incorporated by reference in its entirety, details non-magnetic coatings for high-wear applications where non-magnetic properties are required. However, these alloys are not capable of being manufactured using the powder atomization processes.

Disclosures offering alloying solutions for competing wear mechanisms in oil & gas drilling hardfacing applications include but are not limited to U.S. Pat. Nos. 4,277,108; 4,666,797; 6,117,493; 6,326,582; 6,582,126; 7,219,727; and U.S. Patent Publication No. 2002/0054972. U.S. Publication Nos. 2011/0220415 and 2011/004069 disclose an ultra-low friction coating for drill stem assemblies. U.S. Pat. Nos. 6,375,895, 7,361,411, 7,569,286, 20040206726, 20080241584, and 2011/0100720 disclose the use of hard alloys for the competing wear mechanisms. Each of the patents and patent applications listed in this paragraph are hereby incorporated by reference in their entirety.

SUMMARY

Embodiments of the present application include but are not limited to hardfacing materials, alloy or powder compositions used to make such hardfacing materials, methods of forming the hardfacing materials, and the components or substrates incorporating or protected by these hardfacing materials.

Disclosed herein are embodiments of an article of manufacture comprising an alloy forming or configured to form a material comprising a matrix having a FCC-BCC transition temperature at or below about 950K, and extremely hard particles exhibiting a hardness of about 1000 Vickers or greater, the extremely hard particles having an extremely hard particle fraction greater than about 5 mole % or greater, and an extremely hard particle melt range of about 200K or less.

In some embodiments, the matrix can comprise at least about 7 mole % chromium. In some embodiments, the material can comprise at least about 90% volume fraction austenite in the matrix, a fraction of the extremely hard particles is about 5 volume % or greater, an ASTM G65 abrasion loss of about 1.5 g or less, a relative magnetic permeability of about 1.03μ or lower, and a corrosion resistance of about 5 mpy or less in salt water according to ASTM G31, wherein the matrix does not contain any extremely hard particles that begin to form at a temperature greater than about 200K above a formation temperature of the matrix.

In some embodiments, the article of manufacture can further comprise Fe and, in weight percent C: about 1.8 to about 6, Cr: about 0 to about 24.7, Mn: about 0 to about 18, V: about 6 to about 20, Mo: about 0 to about 4, W: about 0 to about 5.2, Ti: about 0 to about 1, Nb: about 0 to about 1, and Ni: about 0 to about 14.

In some embodiments, the article of manufacture can be a powder. Also disclosed herein are embodiments of a drill pipe tool joint with the article of manufacture described herein applied as a hardfacing layer. Also disclosed herein are embodiments of a drill collar with the article of manufacture described herein applied as a hardfacing layer. Also disclosed herein are embodiments of a down hole stabilizer with the article of manufacture described herein applied as a hardfacing layer. Also disclosed herein are embodiments of an oilfield component used in directional drilling applications with the article of manufacture described herein applied as a hardfacing layer.

In some embodiments, the article of manufacture can comprise Fe and, in weight percent, C: about 2.5 to about 4.5, Cr: about 11.5 to about 16.5, Mn: about 8.5 to about 14.5, and V: about 10.0 to about 16.0. In some embodiments, the article of manufacture can comprise Fe and, in weight %:

C: 3.0, Cr: 12.0, Mn: 12.0, V: 15.0;
C: 4.0, Cr: 16.0, Mn: 12.0, V: 15.0;
C: 4.0, Cr: 16.0, Mn: 13.4, V: 15.1;
C: 3.0, Cr: 12.1, Mn: 9.8, V: 14.9;
C: 3.8, Cr: 16.0, Mn: 13.7, V: 14.7;
C: 2.8, Cr: 12.5, Mn: 10.4, V: 15.3;
C: 3.9, Cr: 16.1, Mn: 14.0, V: 15.6;
C: 2.9, Cr: 12.1, Mn: 9.6, V: 14.4;
C: 2.6, Cr: 11.9, Mn: 11.6, V: 10.0; or
C: 2.6, Cr: 11.9, Mn: 8.5, V: 10.6.

Also disclosed herein are embodiments of an article of manufacture comprising an alloy forming or configured to form a material comprising a matrix comprising at least about 90% volume fraction austenite, extremely hard particles exhibiting a hardness of about 1000 Vickers or greater, the extremely hard particles having a fraction of about 5 volume % or greater, and wherein the matrix does not contain any extremely hard particles that begin to form at a temperature greater than about 200K above a formation temperature of the matrix.

In some embodiments, the matrix can comprise at least about 7 weight % chromium. In some embodiments, the article of manufacture can comprise Fe and, in weight percent, C: about 1.8 to about 6, Cr: about 0 to about 24.7, Mn: about 0 to about 18, V: about 6 to about 20, Mo: about 0 to about 4, W: about 0 to about 5.2, Ti: about 0 to about 1, Nb: about 0 to about 1, and Ni: about 0 to about 14.

In some embodiments, the article of manufacture can be a powder. Also disclosed herein are embodiments of a drill pipe tool joint with the article of manufacture described herein applied as a hardfacing layer. Also disclosed herein are embodiments of a drill collar with the article of manufacture described herein applied as a hardfacing layer. Also disclosed herein are embodiments of a down hole stabilizer with the article of manufacture described herein applied as a hardfacing layer. Also disclosed herein are embodiments of an oilfield component used in directional drilling applications with the article of manufacture described herein applied as a hardfacing layer.

In some embodiments, the article of manufacture can comprise Fe and, in weight percent, C: about 2.5 to about 4.5, Cr: about 11.5 to about 16.5, Mn: about 8.5 to about 14.5, and V: about 10.0 to about 16.0. In some embodiments, the article of manufacture comprises Fe and, in weight %:

C: 3.0, Cr: 12.0, Mn: 12.0, V: 15.0;
C: 4.0, Cr: 16.0, Mn: 12.0, V: 15.0;
C: 4.0, Cr: 16.0, Mn: 13.4, V: 15.1;
C: 3.0, Cr: 12.1, Mn: 9.8, V: 14.9;
C: 3.8, Cr: 16.0, Mn: 13.7, V: 14.7;
C: 2.8, Cr: 12.5, Mn: 10.4, V: 15.3;
C: 3.9, Cr: 16.1, Mn: 14.0, V: 15.6;
C: 2.9, Cr: 12.1, Mn: 9.6, V: 14.4;
C: 2.6, Cr: 11.9, Mn: 11.6, V: 10.0; or
C: 2.6, Cr: 11.9, Mn: 8.5, V: 10.6.

Also disclosed herein are embodiments of an article of manufacture comprising an alloy forming or configured to form a material comprising an ASTM G65 abrasion loss of about 1.5 g or less, a relative magnetic permeability of about 1.03μ or lower, and a corrosion resistance of about 5 mpy or less in salt water according to ASTM G31.

In some embodiments, the material can be formed as an as-welded hardfacing layer does not exhibit any cracking.

In some embodiments, the article of manufacture can further comprise Fe and, in weight percent, C: about 1.8 to about 6, Cr: about 0 to about 24.7, Mn: about 0 to about 18, V: about 6 to about 20, Mo: about 0 to about 4, W: about 0 to about 5.2, Ti: about 0 to about 1, Nb: about 0 to about 1, and Ni: about 0 to about 14.

In some embodiments, the article of manufacture can be a powder. Also disclosed herein are embodiments of a drill pipe tool joint with the article of manufacture described herein applied as a hardfacing layer. Also disclosed herein are embodiments of a drill collar with the article of manufacture described herein applied as a hardfacing layer. Also disclosed herein are embodiments of a down hole stabilizer with the article of manufacture described herein applied as a hardfacing layer. Also disclosed herein are embodiments of an oilfield component used in directional drilling applications with the article of manufacture described herein applied as a hardfacing layer.

In some embodiments, the article of manufacture can comprise Fe and, in weight percent: C: about 2.5 to about 4.5, Cr: about 11.5 to about 16.5, Mn: about 8.5 to about 14.5, and V: about 10.0 to about 16.0. In some embodiments, the article of manufacture can comprise Fe and, in weight %:

C: 3.0, Cr: 12.0, Mn: 12.0, V: 15.0;
C: 4.0, Cr: 16.0, Mn: 12.0, V: 15.0;
C: 4.0, Cr: 16.0, Mn: 13.4, V: 15.1;
C: 3.0, Cr: 12.1, Mn: 9.8, V: 14.9;
C: 3.8, Cr: 16.0, Mn: 13.7, V: 14.7;
C: 2.8, Cr: 12.5, Mn: 10.4, V: 15.3;
C: 3.9, Cr: 16.1, Mn: 14.0, V: 15.6;
C: 2.9, Cr: 12.1, Mn: 9.6, V: 14.4;
C: 2.6, Cr: 11.9, Mn: 11.6, V: 10.0; or
C: 2.6, Cr: 11.9, Mn: 8.5, V: 10.6.

Further disclosed herein are embodiments of a drill pipe tool joint, drill collar, down hole stabilizer or oilfield component used in directional drilling applications with the article of manufacture disclosed herein applied as a hardfacing layer.

DETAILED DESCRIPTION

Figure 1:
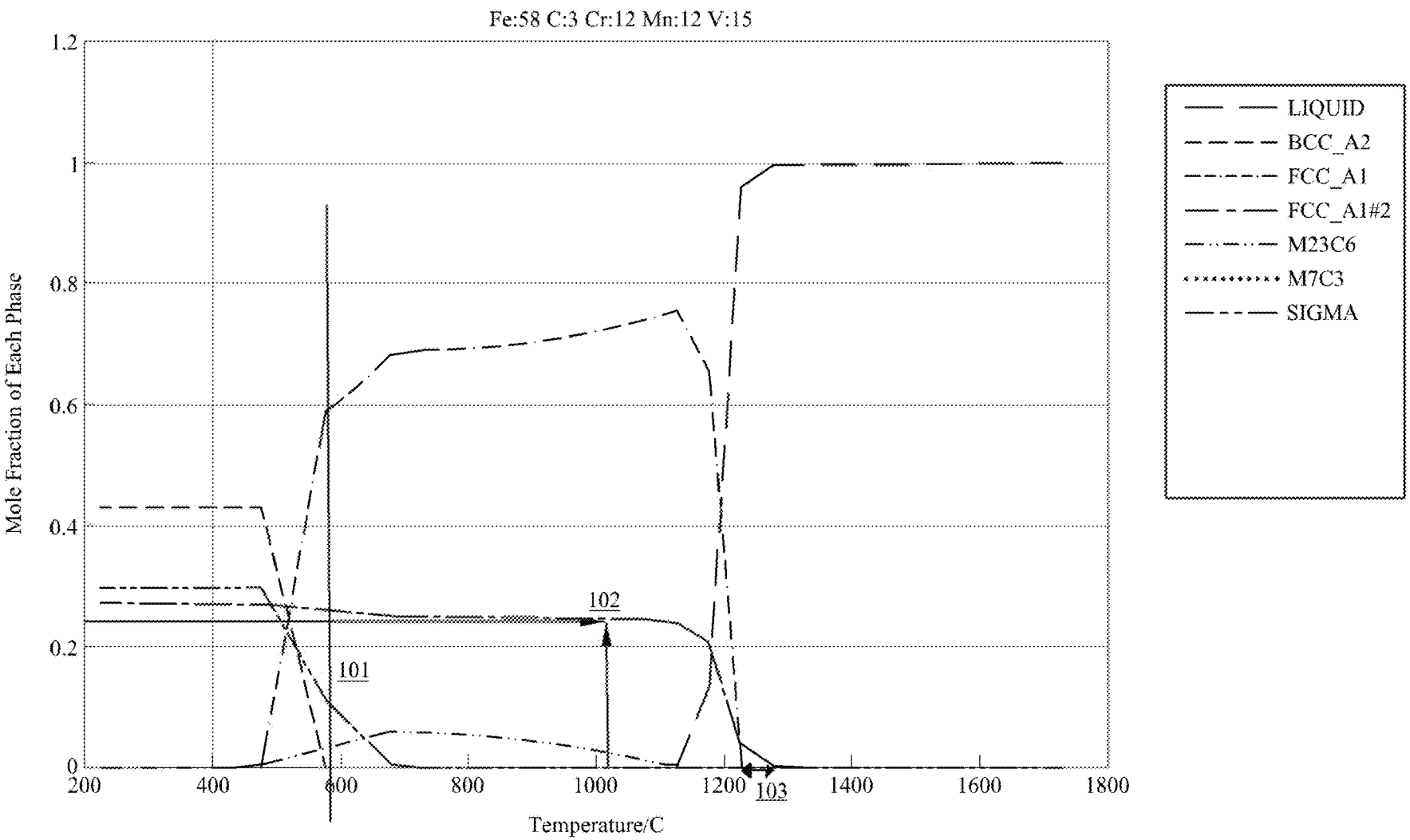
FIG. 1 shows an example equilibrium solidification diagram of an embodiment of a disclosed alloy having the composition of Fe: 58, C:3, Cr: 12, Mn:12, and V:15.

Embodiments of this disclosure generally relates to alloys, and the process of their design, which form extremely hard carbides and borides while remaining austenitic when used in a hardfacing process as hardfacing alloys. Hardfacing alloys generally refer to a class of materials which are deposited onto a substrate for the purpose of producing a hard layer resistant to various wear mechanisms: abrasion, impact, erosion, gouging, etc. Embodiments of the disclosure can relate to hardfacing layers and components protected by hardfacing layers made of the alloys described herein. Further, the alloys can be used in common powder manufacturing technologies such as gas atomization, vacuum atomization, and other like processes which are used to make metal powders.

As disclosed herein, the term alloy can refer to the chemical composition forming the powder disclosed within, the powder itself, and the composition of the metal component formed by the heating and/or deposition of the powder.

Specifically, in some embodiments computational metallurgy is used to identify alloys which form extremely hard carbides and borides at relatively low temperatures, but also form a non-magnetic, austenitic matrix.

Embodiments of the disclosed alloys can be used in abrasive wear applications, e.g., exploration wells in crude oil or natural gas fields such as directional bores and the like, and it can be advantageous for the disclosed alloys incorporated into drilling string components including drill stems to be made of materials with magnetic permeability values below about 1.02 or possibly even less that 1.01 (API Specification 7 regarding drill string components, hereby incorporated by reference in its entirety), in order to be able to follow the exact position of the bore hole and to ascertain and correct deviations from its projected course.

Metal Alloy Composition

In some embodiments, the alloy can be described by specific compositions, in weight % with Fe making the balance, as presented in Table 1 which have been identified using computational metallurgy and experimentally manufactured successfully.

TABLE 1

Alloys Successfully Manufactured into Hardfacing Non-Magnetic Powder

| Alloy | C | Cr | Mn | V |
|---|---|---|---|---|
| 1 | 3.0 | 12.0 | 12.0 | 15.0 |
| 2 | 4.0 | 16.0 | 12.0 | 15.0 |
| 3 | 4.0 | 16.0 | 13.4 | 15.1 |
| 4 | 3.0 | 12.1 | 9.8 | 14.9 |
| 5 | 3.8 | 16.0 | 13.7 | 14.7 |
| 6 | 2.8 | 12.5 | 10.4 | 15.3 |
| 7 | 3.9 | 16.1 | 14.0 | 15.6 |
| 8 | 2.9 | 12.1 | 9.6 | 14.4 |

In some embodiments, the alloy can be described by compositional ranges in weight % at least partially based on the compositions presented in Table 2 and Table 3 which meet the disclosed thermodynamic parameters and are intended to form an austenitic matrix.

Fe: Bal
C: 1.8 to 6 (or about 1.8 to about 6)
Cr: 0 to 24.7 (or about 0 to about 24.7)
Mn: 0 to 18 (or about 0 to about 18)
V: 6 to 20 (or about 6 to about 20)
Mo: 0 to 4 (or about 0 to about 4)
W: 0 to 5.2 (or about 0 to about 5.2)
Ti: 0 to 1 (or about 0 to about 1)
Nb: 0 to 1 (or about 0 to about 1)
Ni: 0 to 14 (or about 0 to about 14)

In some embodiments, the alloy can be described by the compositional ranges in weight %.

Fe: Bal
C: 2.5 to 4 (or about 2.5 to about 4)
Cr: 10.8 to 16 (or about 10.8 to about 16)
Mn: 9.5 to 14 (or about 9.5 to about 14)
V: 13.5 to 15 (or about 13.5 to about 15)

In some embodiments, the alloy can be described by the compositional ranges in weight %.

C: 2.5 to 4.5 (or about 2.5 to about 4.5)
Cr: 11.5 to 16.5 (or about 11.5 to about 16.5)
Mn: 8.5 to 14.5 (or about 8.5 to about 14.5)
V: 10.0 to 16.0 (or about 10.0 to about 16.0)

TABLE 2

Experimental Alloy Chemistries Produced in Ingot Form

| No | C | Mn | Cr | V | Mo | W | Ti | Nb | Ni | Fe |
|---|---|---|---|---|---|---|---|---|---|---|
| X1 | 2.8 | 14 | 20 | 10 | 0 | 0 | 0 | 0 | 0 | 53.2 |
| X2 | 2 | 8 | 12 | 10 | 0 | 0 | 0 | 0 | 0 | 68 |
| X3 | 2.2 | 10 | 14 | 10 | 0 | 0 | 0 | 0 | 0 | 63.8 |
| X4 | 4 | 6 | 20 | 10 | 0 | 0 | 0 | 0 | 0 | 60 |
| X5 | 2 | 14 | 12 | 10 | 0 | 0 | 0 | 0 | 0 | 62 |
| X6 | 2.4 | 12 | 14 | 6 | 0 | 0 | 0 | 0 | 0 | 65.6 |
| X7 | 2 | 14 | 12 | 10 | 2 | 0 | 0 | 0 | 0 | 60 |
| X8 | 2 | 14 | 12 | 10 | 0 | 2 | 0 | 0 | 0 | 60 |
| X9 | 4 | 14 | 12 | 10 | 4 | 0 | 0 | 0 | 0 | 56 |
| X10 | 4 | 14 | 12 | 10 | 0 | 4 | 0 | 0 | 0 | 56 |
| X11 | 4 | 14 | 12 | 10 | 2 | 2 | 0 | 0 | 0 | 56 |
| X12 | 3.2 | 14 | 24 | 10 | 0 | 0 | 0 | 0 | 0 | 48.8 |
| X13 | 3.2 | 14 | 12 | 10 | 0 | 0 | 0 | 0 | 0 | 60.8 |
| X14 | 3.2 | 14 | 24 | 9 | 0 | 0 | 1 | 0 | 0 | 48.8 |
| X15 | 3.2 | 14 | 24 | 9 | 0 | 0 | 0 | 1 | 0 | 49.8 |
| X16 | 4 | 14 | 12 | 20 | 0 | 0 | 0 | 0 | 0 | 50 |
| X17 | 4 | 18 | 12 | 20 | 0 | 0 | 0 | 0 | 0 | 46 |
| X18 | 2.75 | 14 | 0 | 15 | 0 | 0 | 0 | 0 | 0 | 68.25 |
| X19 | 3 | 12.5 | 0 | 15 | 0 | 0 | 0 | 0 | 0 | 69.5 |
| X20 | 3.25 | 11 | 5 | 15 | 0 | 0 | 0 | 0 | 0 | 65.75 |
| X21 | 4 | 12 | 5 | 15 | 0 | 0 | 0 | 0 | 0 | 64 |
| X22 | 3 | 0 | 11 | 15 | 0 | 0 | 0 | 0 | 14 | 57 |
| X23 | 3.5 | 0 | 9 | 15 | 0 | 0 | 0 | 0 | 14 | 58.5 |
| X24 | 3 | 12 | 12 | 15 | 0 | 0 | 0 | 0 | 0 | 58 |
| X25 | 4 | 12 | 16 | 15 | 0 | 0 | 0 | 0 | 0 | 53 |
| X26 | 3 | 10 | 12 | 14 | 2 | 0 | 0 | 0 | 0 | 59 |
| X27 | 3.5 | 14 | 13 | 15 | 2 | 0 | 0 | 0 | 0 | 52.5 |
| X28 | 3.2 | 14 | 24 | 10 | 0 | 0 | 0 | 0 | 0 | 48.8 |
| X29 | 3 | 12 | 12 | 15 | 0 | 0 | 0 | 0 | 0 | 58 |
| X30 | 2.2 | 10.6 | 8.6 | 10.4 | 0.8 | 0 | 0 | 0 | 0 | 67.4 |
| X31 | 2.6 | 10.6 | 8.6 | 12 | 0 | 0 | 0 | 0 | 0 | 66.2 |
| X32 | 4.2 | 12.2 | 8.6 | 6.4 | 2.4 | 0 | 0 | 0 | 0 | 66.2 |
| X33 | 2.1 | 13.5 | 13.3 | 8 | 0 | 0 | 0 | 0 | .5 | 62.6 |
| X34 | 2.1 | 11 | 13.3 | 8.5 | 0 | 0 | 0 | 0 | .5 | 64.6 |

TABLE 3

Measured Alloy Chemistries, via Glow Discharge Spectrometry, for Selected Experimental Ingots

| No | C | Mn | Cr | V | Mo | W | Ti | Nb | Ni | Fe |
|---|---|---|---|---|---|---|---|---|---|---|
| X1 | 2.6 | 14 | 20.6 | 10 | 0 | 0 | 0 | 0 | 0 | 52.8 |
| X2 | 1.9 | 8 | 14 | 10 | 0 | 0 | 0 | 0 | 0 | 66.1 |
| X3 | 2.1 | 9.6 | 15.3 | 10 | 0 | 0 | 0 | 0 | 0 | 63 |
| X4 | 3.6 | 6.2 | 20.8 | 10 | 0 | 0 | 0 | 0 | 0 | 59.4 |
| X5 | 1.8 | 13.6 | 13.4 | 10 | 0 | 0 | 0 | 0 | 0 | 61.2 |
| X6 | 2.2 | 11.4 | 14.5 | 6 | 0 | 0 | 0 | 0 | 0 | 65.9 |
| X7 | 2.2 | 14 | 13 | 10 | 3.2 | 0 | 0 | 0 | 0 | 57.6 |
| X8 | 2.1 | 14.2 | 12.6 | 10 | 0 | 2 | 0 | 0 | 0 | 59.1 |
| X9 | 5.4 | 14.5 | 13 | 10 | 3.3 | 0 | 0 | 0 | 0 | 53.8 |
| X10 | 2.1 | 13.2 | 11.7 | 11 | 0 | 5.2 | 0 | 0 | 0 | 56.8 |
| X11 | 6 | 13.6 | 10.3 | 9.5 | 2.9 | 1.7 | 0 | 0 | 0 | 56 |
| X12 | 3.6 | 16.8 | 17.3 | 10 | 0 | 0 | 0 | 0 | 0 | 52.3 |
| X13 | 3.4 | 15 | 12.2 | 10 | 0 | 0 | 0 | 0 | 0 | 59.4 |
| X14 | 3 | 14.6 | 23.3 | 9 | 0 | 0 | 1 | 0 | 0 | 49.1 |
| X15 | 2.9 | 15.2 | 20 | 9 | 0 | 0 | 0 | 1 | 0 | 51.9 |
| X16 | 3.6 | 12.6 | 11 | 18 | 0 | 0 | 0 | 0 | 0 | 54.8 |
| X17 | 4 | 12.8 | 10 | 20 | 0 | 0 | 0 | 0 | 0 | 53.2 |
| X18 | 1.8 | 13.6 | 0 | 15 | 0 | 0 | 0 | 0 | 0 | 69.6 |
| X19 | 2.7 | 11.2 | 0 | 15 | 0 | 0 | 0 | 0 | 0 | 71.1 |

TABLE 3-continued

Measured Alloy Chemistries, via Glow Discharge Spectrometry, for Selected Experimental Ingots

| No | C | Mn | Cr | V | Mo | W | Ti | Nb | Ni | Fe |
|---|---|---|---|---|---|---|---|---|---|---|
| X20 | 2.7 | 11.2 | 7.4 | 15 | 0 | 0 | 0 | 0 | 0 | 63.7 |
| X21 | 4.1 | 10.5 | 7.2 | 15 | 0 | 0 | 0 | 0 | 0 | 63.2 |
| X22 | 2.8 | 0 | 17.4 | 15 | 0 | 0 | 0 | 0 | 13 | 51.8 |
| X23 | 3.3 | 0 | 8.8 | 15 | 0 | 0 | 0 | 0 | 13 | 59.9 |
| X24 | 3.1 | 12.2 | 13.9 | 13.8 | 0 | 0 | 0 | 0 | 0 | 57 |
| X25 | 3.6 | 12.2 | 16.6 | 12.6 | 0 | 0 | 0 | 0 | 0 | 55 |
| X26 | 3.1 | 10.1 | 14 | 13.1 | 3.6 | 0 | 0 | 0 | 0 | 56.1 |
| X27 | 3.3 | 14.3 | 14.3 | 10.9 | 3.5 | 0 | 0 | 0 | 0 | 53.7 |
| X28 | 3.5 | 12.2 | 24.7 | 10 | 0 | 0 | 0 | 0 | 0 | 49.6 |
| X29 | 3 | 11.7 | 13.8 | 13.3 | 0 | 0 | 0 | 0 | 0 | 58.2 |
| X30 | 2.4 | 9.4 | 10.4 | 9.7 | 2.1 | 0 | 0 | 0 | 0 | 66 |
| X31 | 2.7 | 10.2 | 10.4 | 10.7 | 0 | 0 | 0 | 0 | 0 | 66 |
| X32 | 4.2 | 12.2 | 8.6 | 6.4 | 2.4 | 0 | 0 | 0 | 0 | 66.2 |

The Fe content identified in all of the compositions described in the above paragraphs may be the balance of the composition as indicated above, or alternatively, the balance of the composition may comprise Fe and other elements. In some embodiments, the balance may consist essentially of Fe and may include incidental impurities.

Thermodynamic Criteria

In some embodiments, the alloys can be fully defined by one or more thermodynamic criteria which are used to accurately predict their properties, performance, and manufacturability. These thermodynamic criteria are demonstrated in FIG. 1 for an alloy having the composition of Fe: 58, C:3, Cr: 12, Mn:12, and V:15.

A first thermodynamic criterion is related to the FCC-BCC transition temperature of the ferrous matrix in the alloys. The FCC-BCC transition temperature [101] is defined as the temperature where the mole fraction of the FCC phase (austenite) begins to drop with decreasing temperature, and the mole fraction of the BCC phase (ferrite) is now greater than 0 mole %. The FCC-BCC transition temperature is an indicator of the final phase of the alloy's matrix.

In some embodiments, the FCC-BCC transition temperature can be at or below 950K (or at or below about 950K). In some embodiments, the FCC-BCC transition temperature can be at or below 900K (or at or below about 900K). In some embodiments, the FCC-BCC transition temperature can be at or below 850K (or at or below about 850K).

A second thermodynamic criterion is related to the total concentration of extremely hard particles in the microstructure. Extremely hard particles can be defined as carbides, borides, or borocarbides. As the mole fraction of extremely hard particles [102] is increased, the bulk hardness of the alloy increases, thus the wear resistance will also increase and is can be advantageous for hardfacing applications. For the purposes of this disclosure, extremely hard particles are defined as phases that exhibit a hardness of 1000 Vickers (or about 1000 Vickers) or greater. The total concentration of extremely hard particles is defined as the total mole % of all phases which meets or exceeds a hardness of 1000 Vickers (or about 1000 Vickers) which is thermodynamically stable at 1300K (or about 1300K) in the alloy.

In some embodiments, the hard particle fraction can be 5 mole % (or about 5 mole %) or greater. In some embodiments, the hard particle fraction can be 10 mole % (or about 10 mole %) or greater. In some embodiments, the hard particle fraction can be 15 mole % (or about 15 mole %) or greater.

A third thermodynamic criterion is related to the formation temperature of the extremely hard particles during the solidification process from a 100% liquid state. The extremely hard particles precipitate out of the liquid at elevated temperatures, which creates a variety of problems in the powder manufacturing process including but not limited to powder clogging, increased viscosity, lower yields at desired powder sizes, and improper particle shape. Thus, it can be advantageous for powder manufacturing purposes to reduce the formation temperature of extremely hard particles.

The extremely hard particle formation temperature is defined as the highest temperature at which a hard phase is thermodynamically present in the alloy. This temperature is compared against the formation temperature of the iron matrix phase, and used to calculate the melt range. The melt range [103] is simply defined as the extremely hard particle formation temperature minus the matrix formation temperature. It can be advantageous for the powder manufacturing process to minimize this melt range.

In some embodiments, the melt range can be 200K (or about 200K) or lower. In some embodiments, the melt range can be 150K (or about 150K) or lower. In some embodiments, the melt range can be 100K (or about 100K) or lower.

Figure 2:
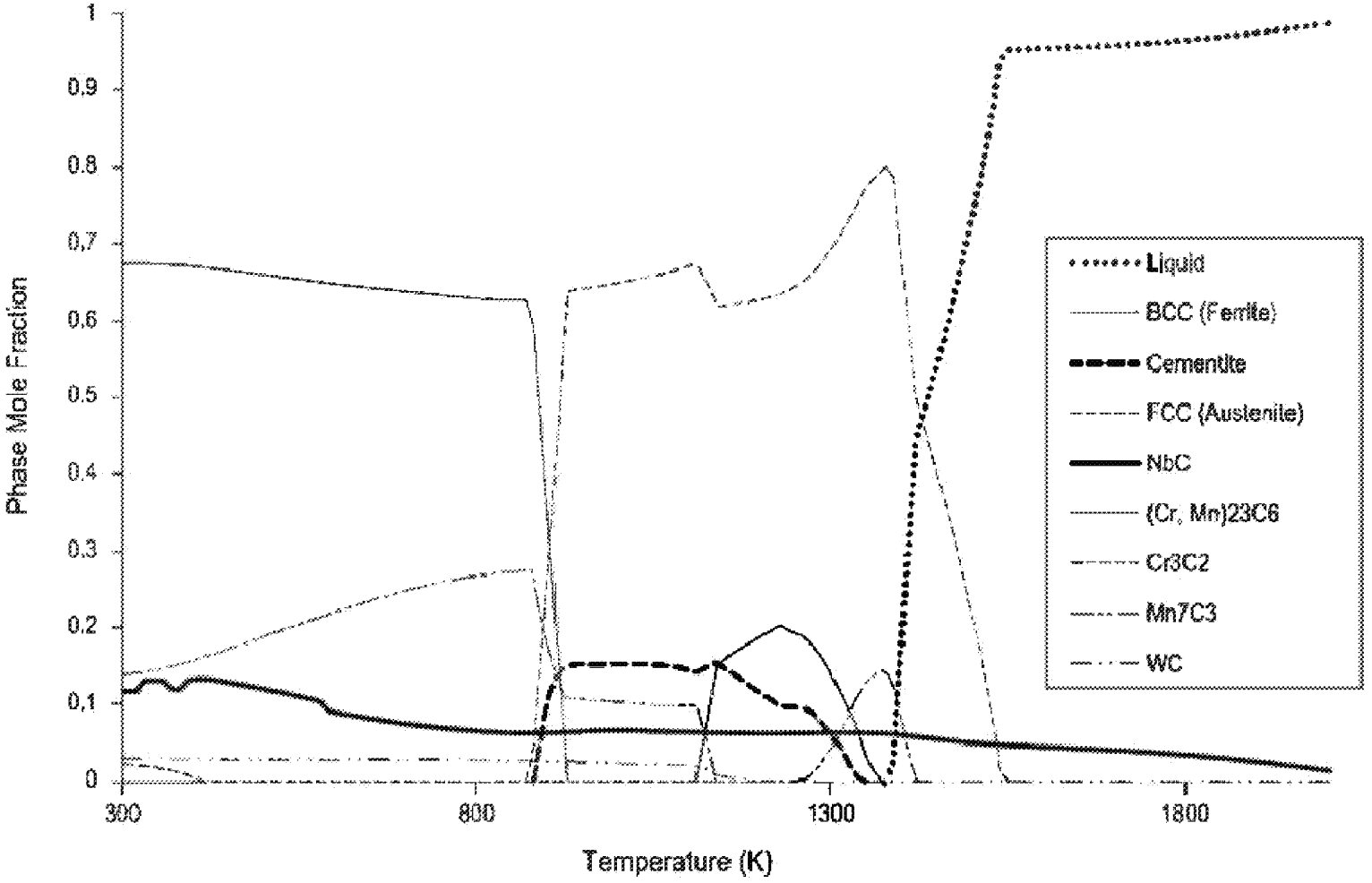
FIG. 2 shows the equilibrium solidification diagram of Alloy 1 from U.S Patent Publication No. 2015/0275341.

FIG. 2 demonstrates the thermodynamic phase diagram for an alloy disclosed in U. S Patent Publication No. 2015/0275341. As shown, the melt range [201] of this alloy is much larger than the melt range thermodynamic criteria disclosed herein. Thus, this alloy may have difficulty for using in a powder atomization process.

In some embodiments, it can be advantageous for the alloy to have an increased resistance to corrosion to prevent rust formation. In such embodiments, an additional thermodynamic criterion can be utilized. This criterion is the chromium content in the Fe-based matrix phase, at 1300K (or about 1300K). This criterion is designated as the matrix chromium content. In some embodiments, the matrix chromium content can be 7 mole % (or about 7 mole %) or greater. In some embodiments, the matrix chromium content can be 10 mole % (or about 10 mole %) or greater. In some embodiments, the matrix chromium content can be 12 mole % (or about 12 mole %) or greater.

Table 4 illustrates a number of different example compositions of this disclosure which satisfy some or all of the above-described thermodynamic criteria. As shown in the table, for the composition in wt. %: C:2-4, Cr: 7-16.6, Fe: 37-71.8, Mn: 0-18, Mo: 0-10, Ni: 0-14, V: 8-20, W:0-10, and thermodynamic properties: FCC-BCC transition temperature (Column A): 700-950K, Matrix Cr Content mole % (Column B): 7.0-17.0, Hard Phase Mole % (Column C): 5.3-34.8, and Hard Phase Melt Range (Column D): −50-200K.

TABLE 4

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M1 | 4 | 16 | 61.2 | 0 | 0 | 3.8 | 15 | 0 | 950 | 10.6% | 22.2% | 0 |
| M2 | 4 | 16 | 60.8 | 0 | 0 | 4.2 | 15 | 0 | 950 | 10.6% | 22.3% | 0 |
| M3 | 4 | 9 | 62.5 | 0 | 0 | 4.5 | 20 | 0 | 950 | 9.9% | 34.7% | 150 |
| M4 | 4 | 12 | 59.5 | 0 | 0 | 4.5 | 20 | 0 | 950 | 12.8% | 33.2% | 150 |
| M5 | 4 | 16 | 60.2 | 0 | 0 | 4.8 | 15 | 0 | 950 | 10.6% | 22.3% | 50 |
| M6 | 3.75 | 9 | 62.25 | 0 | 0 | 5 | 20 | 0 | 950 | 10.1% | 33.3% | 100 |
| M7 | 4 | 11 | 60 | 0 | 0 | 5 | 20 | 0 | 950 | 12.2% | 34.0% | 150 |
| M8 | 4 | 13 | 58 | 0 | 0 | 5 | 20 | 0 | 950 | 13.4% | 32.9% | 100 |
| M9 | 3 | 12 | 64.8 | 0 | 0 | 5.2 | 15 | 0 | 950 | 12.4% | 25.1% | 0 |
| M10 | 4 | 16 | 59.6 | 0 | 0 | 5.4 | 15 | 0 | 950 | 10.5% | 22.4% | 50 |
| M11 | 3.75 | 9 | 61.75 | 0 | 0 | 5.5 | 20 | 0 | 950 | 10.1% | 33.3% | 100 |
| M12 | 4 | 10 | 60.5 | 0 | 0 | 5.5 | 20 | 0 | 950 | 11.0% | 34.8% | 150 |
| M13 | 4 | 12 | 58.5 | 0 | 0 | 5.5 | 20 | 0 | 950 | 12.8% | 33.2% | 150 |
| M14 | 3 | 12 | 64.4 | 0 | 0 | 5.6 | 15 | 0 | 950 | 12.4% | 25.1% | 0 |
| M15 | 4 | 16 | 59.2 | 0 | 0 | 5.8 | 15 | 0 | 900 | 10.8% | 22.4% | 50 |
| M16 | 3.75 | 9 | 61.25 | 0 | 0 | 6 | 20 | 0 | 950 | 10.1% | 33.4% | 100 |
| M17 | 3.75 | 11 | 59.25 | 0 | 0 | 6 | 20 | 0 | 950 | 12.5% | 33.3% | 150 |
| M18 | 3.75 | 12 | 58.25 | 0 | 0 | 6 | 20 | 0 | 950 | 13.6% | 33.0% | 100 |
| M19 | 4 | 13 | 57 | 0 | 0 | 6 | 20 | 0 | 950 | 13.4% | 32.9% | 150 |
| M20 | 3 | 12 | 63.8 | 0 | 0 | 6.2 | 15 | 0 | 950 | 12.4% | 25.1% | 0 |
| M21 | 4 | 16 | 58.6 | 0 | 0 | 6.4 | 15 | 0 | 900 | 10.8% | 22.4% | 50 |
| M22 | 3 | 12 | 63.2 | 0 | 0 | 6.8 | 15 | 0 | 950 | 12.3% | 25.1% | 0 |
| M23 | 4 | 16 | 58 | 0 | 0 | 7 | 15 | 0 | 900 | 10.7% | 22.5% | 50 |
| M24 | 3 | 12 | 62.6 | 0 | 0 | 7.4 | 15 | 0 | 900 | 12.3% | 25.2% | 0 |
| M25 | 4 | 16 | 57.4 | 0 | 0 | 7.6 | 15 | 0 | 900 | 10.7% | 22.5% | 50 |
| M26 | 2.5 | 8 | 66.5 | 0 | 0 | 8 | 15 | 0 | 950 | 8.7% | 23.4% | 0 |
| M27 | 2.5 | 9 | 65.5 | 0 | 0 | 8 | 15 | 0 | 950 | 9.8% | 23.4% | −50 |
| M28 | 4 | 9 | 64 | 0 | 0 | 8 | 15 | 0 | 900 | 7.1% | 28.5% | 150 |
| M29 | 3.5 | 10 | 63.5 | 0 | 0 | 8 | 15 | 0 | 900 | 9.3% | 26.9% | 100 |
| M30 | 3 | 11 | 63 | 0 | 0 | 8 | 15 | 0 | 900 | 11.7% | 25.9% | 50 |
| M31 | 2.5 | 12 | 62.5 | 0 | 0 | 8 | 15 | 0 | 950 | 13.2% | 23.3% | 0 |
| M32 | 3.5 | 12 | 61.5 | 0 | 0 | 8 | 15 | 0 | 900 | 10.4% | 25.3% | 50 |
| M33 | 3.5 | 13 | 60.5 | 0 | 0 | 8 | 15 | 0 | 900 | 10.9% | 24.5% | 50 |
| M34 | 3.5 | 14 | 59.5 | 0 | 0 | 8 | 15 | 0 | 900 | 11.5% | 23.8% | 50 |
| M35 | 3.5 | 15 | 58.5 | 0 | 0 | 8 | 15 | 0 | 900 | 11.9% | 23.0% | 50 |
| M36 | 3.5 | 16 | 57.5 | 0 | 0 | 8 | 15 | 0 | 900 | 12.6% | 22.2% | 0 |
| M37 | 3 | 12 | 61.8 | 0 | 0 | 8.2 | 15 | 0 | 900 | 12.3% | 25.2% | 50 |
| M38 | 4 | 16 | 56.6 | 0 | 0 | 8.4 | 15 | 0 | 900 | 10.6% | 22.6% | 50 |
| M39 | 3.5 | 8 | 65 | 0 | 0 | 8.5 | 15 | 0 | 900 | 7.9% | 28.6% | 50 |
| M40 | 3.5 | 9 | 64 | 0 | 0 | 8.5 | 15 | 0 | 900 | 8.7% | 27.7% | 50 |
| M41 | 3 | 10 | 63.5 | 0 | 0 | 8.5 | 15 | 0 | 900 | 10.6% | 26.7% | 0 |
| M42 | 2.5 | 11 | 63 | 0 | 0 | 8.5 | 15 | 0 | 950 | 12.0% | 23.4% | 0 |
| M43 | 4 | 11 | 61.5 | 0 | 0 | 8.5 | 15 | 0 | 900 | 8.0% | 26.8% | 100 |
| M44 | 3.5 | 12 | 61 | 0 | 0 | 8.5 | 15 | 0 | 900 | 10.3% | 25.3% | 50 |
| M45 | 3 | 13 | 60.5 | 0 | 0 | 8.5 | 15 | 0 | 900 | 12.9% | 24.5% | 0 |
| M46 | 3 | 14 | 59.5 | 0 | 0 | 8.5 | 15 | 0 | 900 | 13.5% | 24.0% | 0 |
| M47 | 3 | 15 | 58.5 | 0 | 0 | 8.5 | 15 | 0 | 900 | 14.2% | 23.6% | 0 |
| M48 | 3 | 16 | 57.5 | 0 | 0 | 8.5 | 15 | 0 | 900 | 14.8% | 22.8% | 0 |
| M49 | 3 | 12 | 61.4 | 0 | 0 | 8.6 | 15 | 0 | 900 | 12.3% | 25.2% | 50 |
| M50 | 4 | 16 | 56.2 | 0 | 0 | 8.8 | 15 | 0 | 850 | 10.6% | 22.7% | 50 |
| M51 | 3.5 | 8 | 64.5 | 0 | 0 | 9 | 15 | 0 | 900 | 7.9% | 28.6% | 100 |
| M52 | 3.5 | 9 | 63.5 | 0 | 0 | 9 | 15 | 0 | 900 | 8.7% | 27.8% | 50 |
| M53 | 3 | 10 | 63 | 0 | 0 | 9 | 15 | 0 | 900 | 10.6% | 26.7% | 0 |
| M54 | 2.5 | 11 | 62.5 | 0 | 0 | 9 | 15 | 0 | 950 | 12.0% | 23.4% | 0 |
| M55 | 4 | 11 | 61 | 0 | 0 | 9 | 15 | 0 | 900 | 8.0% | 26.8% | 100 |
| M56 | 3 | 12 | 61 | 0 | 0 | 9 | 15 | 0 | 900 | 12.3% | 25.2% | 50 |
| M57 | 2.5 | 13 | 60.5 | 0 | 0 | 9 | 15 | 0 | 950 | 14.3% | 23.3% | 0 |
| M58 | 4 | 13 | 59 | 0 | 0 | 9 | 15 | 0 | 900 | 9.0% | 25.1% | 100 |
| M59 | 3.5 | 14 | 58.5 | 0 | 0 | 9 | 15 | 0 | 900 | 11.5% | 23.8% | 50 |
| M60 | 3.5 | 15 | 57.5 | 0 | 0 | 9 | 15 | 0 | 850 | 11.9% | 23.1% | 50 |
| M61 | 3.5 | 16 | 56.5 | 0 | 0 | 9 | 15 | 0 | 850 | 12.5% | 22.3% | 50 |
| M62 | 3 | 12 | 60.8 | 0 | 0 | 9.2 | 15 | 0 | 900 | 12.3% | 25.2% | 50 |
| M63 | 4 | 16 | 55.6 | 0 | 0 | 9.4 | 15 | 0 | 850 | 10.6% | 22.7% | 50 |
| M64 | 3.5 | 8 | 64 | 0 | 0 | 9.5 | 15 | 0 | 900 | 7.9% | 28.6% | 100 |
| M65 | 3.5 | 9 | 63 | 0 | 0 | 9.5 | 15 | 0 | 900 | 8.6% | 27.8% | 50 |
| M66 | 3.5 | 10 | 62 | 0 | 0 | 9.5 | 15 | 0 | 900 | 9.2% | 27.0% | 100 |
| M67 | 3 | 11 | 61.5 | 0 | 0 | 9.5 | 15 | 0 | 900 | 11.7% | 26.0% | 50 |
| M68 | 2.5 | 12 | 61 | 0 | 0 | 9.5 | 15 | 0 | 950 | 13.2% | 23.4% | 0 |
| M69 | 4 | 12 | 59.5 | 0 | 0 | 9.5 | 15 | 0 | 850 | 8.5% | 26.0% | 100 |
| M70 | 3.5 | 13 | 59 | 0 | 0 | 9.5 | 15 | 0 | 850 | 10.9% | 24.6% | 50 |
| M71 | 3 | 14 | 58.5 | 0 | 0 | 9.5 | 15 | 0 | 900 | 13.5% | 23.9% | 0 |
| M72 | 2.5 | 15 | 58 | 0 | 0 | 9.5 | 15 | 0 | 950 | 16.4% | 22.1% | −50 |
| M73 | 4 | 15 | 56.5 | 0 | 0 | 9.5 | 15 | 0 | 850 | 10.0% | 23.5% | 100 |
| M74 | 3.5 | 16 | 56 | 0 | 0 | 9.5 | 15 | 0 | 850 | 12.5% | 22.3% | 50 |
| M75 | 4 | 16 | 55.4 | 0 | 0 | 9.6 | 15 | 0 | 850 | 10.6% | 22.7% | 50 |
| M76 | 2.5 | 8 | 64.5 | 0 | 0 | 10 | 15 | 0 | 900 | 8.7% | 23.5% | 0 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M77 | 2.5 | 9 | 63.5 | 0 | 0 | 10 | 15 | 0 | 900 | 9.8% | 23.5% | 0 |
| M78 | 2.5 | 10 | 62.5 | 0 | 0 | 10 | 15 | 0 | 900 | 10.9% | 23.4% | −50 |
| M79 | 4 | 10 | 61 | 0 | 0 | 10 | 15 | 0 | 850 | 7.4% | 27.8% | 150 |
| M80 | 3.5 | 11 | 60.5 | 0 | 0 | 10 | 15 | 0 | 850 | 9.7% | 26.2% | 100 |
| M81 | 3 | 12 | 60 | 0 | 0 | 10 | 15 | 0 | 900 | 12.2% | 25.3% | 50 |
| M82 | 4 | 12 | 59 | 0 | 0 | 10 | 15 | 0 | 850 | 8.4% | 26.0% | 100 |
| M83 | 3.5 | 13 | 58.5 | 0 | 0 | 10 | 15 | 0 | 850 | 10.9% | 24.7% | 50 |
| M84 | 3 | 14 | 58 | 0 | 0 | 10 | 15 | 0 | 900 | 13.5% | 23.9% | 0 |
| M85 | 2.5 | 15 | 57.5 | 0 | 0 | 10 | 15 | 0 | 950 | 16.4% | 22.2% | −50 |
| M86 | 4 | 15 | 56 | 0 | 0 | 10 | 15 | 0 | 850 | 10.0% | 23.6% | 100 |
| M87 | 3.5 | 16 | 55.5 | 0 | 0 | 10 | 15 | 0 | 850 | 12.5% | 22.4% | 50 |
| M88 | 3 | 12 | 59.8 | 0 | 0 | 10.2 | 15 | 0 | 850 | 12.2% | 25.3% | 50 |
| M89 | 4 | 16 | 54.6 | 0 | 0 | 10.4 | 15 | 0 | 850 | 10.6% | 22.8% | 50 |
| M90 | 3.5 | 8 | 63 | 0 | 0 | 10.5 | 15 | 0 | 850 | 7.9% | 28.7% | 100 |
| M91 | 3.5 | 9 | 62 | 0 | 0 | 10.5 | 15 | 0 | 850 | 8.6% | 27.9% | 50 |
| M92 | 3.5 | 10 | 61 | 0 | 0 | 10.5 | 15 | 0 | 850 | 9.1% | 27.1% | 50 |
| M93 | 3 | 11 | 60.5 | 0 | 0 | 10.5 | 15 | 0 | 850 | 11.7% | 26.0% | 0 |
| M94 | 2.5 | 12 | 60 | 0 | 0 | 10.5 | 15 | 0 | 900 | 13.1% | 23.4% | 0 |
| M95 | 4 | 12 | 58.5 | 0 | 0 | 10.5 | 15 | 0 | 850 | 8.4% | 26.1% | 100 |
| M96 | 3.5 | 13 | 58 | 0 | 0 | 10.5 | 15 | 0 | 850 | 10.8% | 24.7% | 50 |
| M97 | 3 | 14 | 57.5 | 0 | 0 | 10.5 | 15 | 0 | 850 | 13.5% | 23.8% | 0 |
| M98 | 2.5 | 15 | 57 | 0 | 0 | 10.5 | 15 | 0 | 950 | 16.4% | 22.2% | −50 |
| M99 | 4 | 15 | 55.5 | 0 | 0 | 10.5 | 15 | 0 | 850 | 10.0% | 23.6% | 100 |
| M100 | 3.5 | 16 | 55 | 0 | 0 | 10.5 | 15 | 0 | 850 | 12.6% | 22.4% | 50 |
| M101 | 4 | 16 | 54.4 | 0 | 0 | 10.6 | 15 | 0 | 850 | 10.6% | 22.8% | 100 |
| M102 | 2.5 | 8 | 63.5 | 0 | 0 | 11 | 15 | 0 | 900 | 8.7% | 23.5% | 0 |
| M103 | 2.5 | 9 | 62.5 | 0 | 0 | 11 | 15 | 0 | 900 | 9.8% | 23.5% | 0 |
| M104 | 2.5 | 10 | 61.5 | 0 | 0 | 11 | 15 | 0 | 900 | 10.9% | 23.5% | 0 |
| M105 | 4 | 10 | 60 | 0 | 0 | 11 | 15 | 0 | 850 | 7.4% | 27.9% | 150 |
| M106 | 3.5 | 11 | 59.5 | 0 | 0 | 11 | 15 | 0 | 850 | 9.7% | 26.3% | 100 |
| M107 | 3 | 12 | 59 | 0 | 0 | 11 | 15 | 0 | 850 | 12.3% | 25.3% | 50 |
| M108 | 4 | 12 | 58 | 0 | 0 | 11 | 15 | 0 | 850 | 8.4% | 26.1% | 150 |
| M109 | 3.5 | 13 | 57.5 | 0 | 0 | 11 | 15 | 0 | 850 | 10.8% | 24.7% | 100 |
| M110 | 3 | 14 | 57 | 0 | 0 | 11 | 15 | 0 | 850 | 13.5% | 23.8% | 50 |
| M111 | 2.5 | 15 | 56.5 | 0 | 0 | 11 | 15 | 0 | 900 | 16.4% | 22.3% | −50 |
| M112 | 4 | 15 | 55 | 0 | 0 | 11 | 15 | 0 | 850 | 10.0% | 23.7% | 100 |
| M113 | 3.5 | 16 | 54.5 | 0 | 0 | 11 | 15 | 0 | 850 | 12.6% | 22.4% | 50 |
| M114 | 3 | 12 | 58.8 | 0 | 0 | 11.2 | 15 | 0 | 850 | 12.3% | 25.3% | 50 |
| M115 | 4 | 16 | 53.6 | 0 | 0 | 11.4 | 15 | 0 | 850 | 10.5% | 22.9% | 100 |
| M116 | 3.5 | 8 | 62 | 0 | 0 | 11.5 | 15 | 0 | 850 | 7.8% | 28.8% | 100 |
| M117 | 3.5 | 9 | 61 | 0 | 0 | 11.5 | 15 | 0 | 850 | 8.6% | 28.0% | 100 |
| M118 | 3.5 | 10 | 60 | 0 | 0 | 11.5 | 15 | 0 | 850 | 9.1% | 27.1% | 50 |
| M119 | 3 | 11 | 59.5 | 0 | 0 | 11.5 | 15 | 0 | 850 | 11.7% | 26.1% | 0 |
| M120 | 2.5 | 12 | 59 | 0 | 0 | 11.5 | 15 | 0 | 900 | 13.1% | 23.4% | 0 |
| M121 | 4 | 12 | 57.5 | 0 | 0 | 11.5 | 15 | 0 | 850 | 8.4% | 26.2% | 150 |
| M122 | 3.5 | 13 | 57 | 0 | 0 | 11.5 | 15 | 0 | 850 | 10.8% | 24.8% | 100 |
| M123 | 3 | 14 | 56.5 | 0 | 0 | 11.5 | 15 | 0 | 850 | 13.5% | 23.9% | 50 |
| M124 | 2.5 | 15 | 56 | 0 | 0 | 11.5 | 15 | 0 | 900 | 16.4% | 22.3% | 0 |
| M125 | 4 | 15 | 54.5 | 0 | 0 | 11.5 | 15 | 0 | 850 | 10.0% | 23.7% | 100 |
| M126 | 4 | 16 | 53.5 | 0 | 0 | 11.5 | 15 | 0 | 850 | 10.5% | 22.9% | 100 |
| M127 | 3 | 12 | 58.2 | 0 | 0 | 11.8 | 15 | 0 | 850 | 12.3% | 25.4% | 50 |
| M128 | 2.5 | 8 | 62.5 | 0 | 0 | 12 | 15 | 0 | 900 | 8.7% | 23.5% | 0 |
| M129 | 2 | 9 | 62 | 0 | 0 | 12 | 15 | 0 | 950 | 9.8% | 19.7% | −50 |
| M130 | 3.5 | 9 | 60.5 | 0 | 0 | 12 | 15 | 0 | 850 | 8.5% | 28.0% | 100 |
| M131 | 3 | 10 | 60 | 0 | 0 | 12 | 15 | 0 | 850 | 10.6% | 26.9% | 50 |
| M132 | 2 | 11 | 60 | 0 | 0 | 12 | 15 | 0 | 950 | 12.0% | 19.6% | 0 |
| M133 | 3.5 | 11 | 58.5 | 0 | 0 | 12 | 15 | 0 | 850 | 9.6% | 26.4% | 100 |
| M134 | 2.5 | 12 | 58.5 | 0 | 0 | 12 | 15 | 0 | 900 | 13.1% | 23.5% | 0 |
| M135 | 3.5 | 12 | 57.5 | 0 | 0 | 12 | 15 | 0 | 850 | 10.2% | 25.6% | 100 |
| M136 | 2.5 | 13 | 57.5 | 0 | 0 | 12 | 15 | 0 | 900 | 14.3% | 23.4% | 0 |
| M137 | 4 | 13 | 56 | 0 | 0 | 12 | 15 | 0 | 850 | 8.9% | 25.4% | 100 |
| M138 | 3.5 | 14 | 55.5 | 0 | 0 | 12 | 15 | 0 | 850 | 11.4% | 24.0% | 50 |
| M139 | 3 | 15 | 55 | 0 | 0 | 12 | 15 | 0 | 850 | 14.1% | 23.6% | 0 |
| M140 | 2.5 | 16 | 54.5 | 0 | 0 | 12 | 15 | 0 | 900 | 17.0% | 21.5% | −50 |
| M141 | 4 | 16 | 53 | 0 | 0 | 12 | 15 | 0 | 800 | 10.5% | 23.0% | 100 |
| M142 | 4 | 16 | 52.8 | 0 | 0 | 12.2 | 15 | 0 | 800 | 10.5% | 23.0% | 100 |
| M143 | 2 | 8 | 62.5 | 0 | 0 | 12.5 | 15 | 0 | 950 | 8.8% | 19.7% | −50 |
| M144 | 3.5 | 8 | 61 | 0 | 0 | 12.5 | 15 | 0 | 850 | 7.8% | 28.9% | 100 |
| M145 | 3 | 9 | 60.5 | 0 | 0 | 12.5 | 15 | 0 | 850 | 9.5% | 26.9% | 50 |
| M146 | 2.5 | 10 | 60 | 0 | 0 | 12.5 | 15 | 0 | 900 | 10.9% | 23.5% | 0 |
| M147 | 4 | 10 | 58.5 | 0 | 0 | 12.5 | 15 | 0 | 850 | 7.3% | 28.1% | 150 |
| M148 | 3 | 11 | 58.5 | 0 | 0 | 12.5 | 15 | 0 | 850 | 11.6% | 26.1% | 0 |
| M149 | 2 | 12 | 58.5 | 0 | 0 | 12.5 | 15 | 0 | 950 | 13.1% | 19.6% | −50 |
| M150 | 3.5 | 12 | 57 | 0 | 0 | 12.5 | 15 | 0 | 850 | 10.2% | 25.6% | 100 |
| M151 | 2.5 | 13 | 57 | 0 | 0 | 12.5 | 15 | 0 | 900 | 14.3% | 23.5% | 0 |
| M152 | 4 | 13 | 55.5 | 0 | 0 | 12.5 | 15 | 0 | 850 | 8.8% | 25.4% | 150 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M153 | 3 | 14 | 55.5 | 0 | 0 | 12.5 | 15 | 0 | 850 | 13.5% | 23.9% | 50 |
| M154 | 2.5 | 15 | 55 | 0 | 0 | 12.5 | 15 | 0 | 900 | 16.4% | 22.4% | 0 |
| M155 | 4 | 15 | 53.5 | 0 | 0 | 12.5 | 15 | 0 | 800 | 9.9% | 23.8% | 100 |
| M156 | 3.5 | 16 | 53 | 0 | 0 | 12.5 | 15 | 0 | 800 | 12.6% | 22.5% | 50 |
| M157 | 4 | 16 | 52.4 | 0 | 0 | 12.6 | 15 | 0 | 800 | 10.5% | 23.0% | 100 |
| M158 | 2 | 8 | 62 | 0 | 0 | 13 | 15 | 0 | 950 | 8.8% | 19.7% | −50 |
| M159 | 3.5 | 8 | 60.5 | 0 | 0 | 13 | 15 | 0 | 850 | 7.8% | 28.9% | 100 |
| M160 | 3 | 9 | 60 | 0 | 0 | 13 | 15 | 0 | 850 | 9.5% | 26.9% | 50 |
| M161 | 2.5 | 10 | 59.5 | 0 | 0 | 13 | 15 | 0 | 850 | 10.9% | 23.5% | 0 |
| M162 | 4 | 10 | 58 | 0 | 0 | 13 | 15 | 0 | 850 | 7.3% | 28.1% | 150 |
| M163 | 3 | 11 | 58 | 0 | 0 | 13 | 15 | 0 | 850 | 11.6% | 26.2% | 50 |
| M164 | 2 | 12 | 58 | 0 | 0 | 13 | 15 | 0 | 900 | 13.1% | 19.6% | −50 |
| M165 | 3 | 12 | 57 | 0 | 0 | 13 | 15 | 0 | 850 | 12.3% | 25.4% | 0 |
| M166 | 2 | 13 | 57 | 0 | 0 | 13 | 15 | 0 | 900 | 14.3% | 19.6% | −50 |
| M167 | 3.5 | 13 | 55.5 | 0 | 0 | 13 | 15 | 0 | 800 | 10.8% | 24.9% | 100 |
| M168 | 2.5 | 14 | 55.5 | 0 | 0 | 13 | 15 | 0 | 900 | 15.4% | 23.2% | 0 |
| M169 | 4 | 14 | 54 | 0 | 0 | 13 | 15 | 0 | 800 | 9.4% | 24.7% | 100 |
| M170 | 3.5 | 15 | 53.5 | 0 | 0 | 13 | 15 | 0 | 800 | 11.9% | 23.3% | 50 |
| M171 | 3 | 16 | 53 | 0 | 0 | 13 | 15 | 0 | 850 | 14.7% | 23.3% | 0 |
| M172 | 4 | 16 | 52 | 0 | 0 | 13 | 15 | 0 | 800 | 10.5% | 23.0% | 100 |
| M173 | 3 | 12 | 56.6 | 0 | 0 | 13.4 | 15 | 0 | 850 | 12.3% | 25.5% | 0 |
| M174 | 2.5 | 8 | 61 | 0 | 0 | 13.5 | 15 | 0 | 850 | 8.7% | 23.6% | 0 |
| M175 | 2 | 9 | 60.5 | 0 | 0 | 13.5 | 15 | 0 | 900 | 9.8% | 19.7% | −50 |
| M176 | 3.5 | 9 | 59 | 0 | 0 | 13.5 | 15 | 0 | 850 | 8.5% | 28.1% | 100 |
| M177 | 3 | 10 | 58.5 | 0 | 0 | 13.5 | 15 | 0 | 850 | 10.6% | 26.9% | 50 |
| M178 | 2 | 11 | 58.5 | 0 | 0 | 13.5 | 15 | 0 | 900 | 12.0% | 19.6% | −50 |
| M179 | 3.5 | 11 | 57 | 0 | 0 | 13.5 | 15 | 0 | 800 | 9.6% | 26.5% | 50 |
| M180 | 2.5 | 12 | 57 | 0 | 0 | 13.5 | 15 | 0 | 850 | 13.1% | 23.5% | 0 |
| M181 | 4 | 12 | 55.5 | 0 | 0 | 13.5 | 15 | 0 | 800 | 8.3% | 26.4% | 150 |
| M182 | 3 | 13 | 55.5 | 0 | 0 | 13.5 | 15 | 0 | 850 | 12.9% | 24.7% | 50 |
| M183 | 2 | 14 | 55.5 | 0 | 0 | 13.5 | 15 | 0 | 900 | 15.4% | 19.6% | −50 |
| M184 | 3.5 | 14 | 54 | 0 | 0 | 13.5 | 15 | 0 | 800 | 11.3% | 24.1% | 100 |
| M185 | 2.5 | 15 | 54 | 0 | 0 | 13.5 | 15 | 0 | 850 | 16.4% | 22.5% | 0 |
| M186 | 4 | 15 | 52.5 | 0 | 0 | 13.5 | 15 | 0 | 800 | 9.9% | 23.9% | 100 |
| M187 | 3.5 | 16 | 52 | 0 | 0 | 13.5 | 15 | 0 | 800 | 12.5% | 22.6% | 50 |
| M188 | 4 | 16 | 51.4 | 0 | 0 | 13.6 | 15 | 0 | 800 | 10.5% | 23.1% | 100 |
| M189 | 2 | 8 | 61 | 0 | 0 | 14 | 15 | 0 | 900 | 8.8% | 19.7% | −50 |
| M190 | 3.5 | 8 | 59.5 | 0 | 0 | 14 | 15 | 0 | 850 | 7.7% | 29.0% | 100 |
| M191 | 3 | 9 | 59 | 0 | 0 | 14 | 15 | 0 | 850 | 9.5% | 27.0% | 50 |
| M192 | 2.5 | 10 | 58.5 | 0 | 0 | 14 | 15 | 0 | 850 | 10.9% | 23.6% | 0 |
| M193 | 2 | 11 | 58 | 0 | 0 | 14 | 15 | 0 | 900 | 12.0% | 19.6% | −50 |
| M194 | 4 | 11 | 56 | 0 | 0 | 14 | 15 | 0 | 800 | 7.8% | 27.3% | 150 |
| M195 | 3 | 12 | 56 | 0 | 0 | 14 | 15 | 0 | 800 | 12.2% | 25.5% | 0 |
| M196 | 4 | 12 | 55 | 0 | 0 | 14 | 15 | 0 | 800 | 8.3% | 26.5% | 150 |
| M197 | 3 | 13 | 55 | 0 | 0 | 14 | 15 | 0 | 800 | 12.8% | 24.7% | 50 |
| M198 | 2 | 14 | 55 | 0 | 0 | 14 | 15 | 0 | 850 | 15.4% | 19.6% | −50 |
| M199 | 3.5 | 14 | 53.5 | 0 | 0 | 14 | 15 | 0 | 800 | 11.3% | 24.2% | 100 |
| M200 | 2.5 | 15 | 53.5 | 0 | 0 | 14 | 15 | 0 | 850 | 16.4% | 22.5% | 0 |
| M201 | 4 | 15 | 52 | 0 | 0 | 14 | 15 | 0 | 800 | 9.9% | 24.0% | 100 |
| M202 | 3.5 | 16 | 51.5 | 0 | 0 | 14 | 15 | 0 | 800 | 12.5% | 22.6% | 50 |
| M203 | 4 | 16 | 61.6 | 0.2 | 0 | 3.2 | 15 | 0 | 950 | 10.7% | 22.2% | 0 |
| M204 | 4 | 16 | 61 | 0.2 | 0 | 3.8 | 15 | 0 | 950 | 10.6% | 22.2% | 0 |
| M205 | 4 | 16 | 60.4 | 0.2 | 0 | 4.4 | 15 | 0 | 950 | 10.6% | 22.3% | 50 |
| M206 | 3 | 12 | 65 | 0.2 | 0 | 4.8 | 15 | 0 | 950 | 12.4% | 25.1% | 0 |
| M207 | 4 | 16 | 59.8 | 0.2 | 0 | 5 | 15 | 0 | 950 | 10.6% | 22.3% | 50 |
| M208 | 3 | 12 | 64.4 | 0.2 | 0 | 5.4 | 15 | 0 | 950 | 12.4% | 25.1% | 0 |
| M209 | 4 | 16 | 59.2 | 0.2 | 0 | 5.6 | 15 | 0 | 900 | 10.5% | 22.4% | 50 |
| M210 | 3 | 12 | 63.8 | 0.2 | 0 | 6 | 15 | 0 | 950 | 12.4% | 25.1% | 0 |
| M211 | 4 | 16 | 58.6 | 0.2 | 0 | 6.2 | 15 | 0 | 900 | 10.8% | 22.4% | 50 |
| M212 | 3 | 12 | 63.2 | 0.2 | 0 | 6.6 | 15 | 0 | 950 | 12.4% | 25.1% | 0 |
| M213 | 4 | 16 | 58 | 0.2 | 0 | 6.8 | 15 | 0 | 900 | 10.7% | 22.5% | 50 |
| M214 | 3 | 12 | 62.6 | 0.2 | 0 | 7.2 | 15 | 0 | 900 | 12.3% | 25.2% | 0 |
| M215 | 4 | 16 | 57.4 | 0.2 | 0 | 7.4 | 15 | 0 | 900 | 10.7% | 22.5% | 50 |
| M216 | 3 | 12 | 62 | 0.2 | 0 | 7.8 | 15 | 0 | 900 | 12.3% | 25.2% | 0 |
| M217 | 4 | 16 | 56.8 | 0.2 | 0 | 8 | 15 | 0 | 900 | 10.7% | 22.6% | 50 |
| M218 | 3 | 12 | 61.4 | 0.2 | 0 | 8.4 | 15 | 0 | 900 | 12.3% | 25.2% | 50 |
| M219 | 4 | 16 | 56.2 | 0.2 | 0 | 8.6 | 15 | 0 | 850 | 10.6% | 22.6% | 50 |
| M220 | 3 | 12 | 60.8 | 0.2 | 0 | 9 | 15 | 0 | 900 | 12.3% | 25.2% | 50 |
| M221 | 4 | 16 | 55.6 | 0.2 | 0 | 9.2 | 15 | 0 | 850 | 10.6% | 22.7% | 50 |
| M222 | 3 | 12 | 60.2 | 0.2 | 0 | 9.6 | 15 | 0 | 900 | 12.3% | 25.3% | 50 |
| M223 | 4 | 16 | 55 | 0.2 | 0 | 9.8 | 15 | 0 | 850 | 10.6% | 22.7% | 50 |
| M224 | 3 | 12 | 59.6 | 0.2 | 0 | 10.2 | 15 | 0 | 850 | 12.2% | 25.3% | 50 |
| M225 | 4 | 16 | 54.4 | 0.2 | 0 | 10.4 | 15 | 0 | 850 | 10.6% | 22.8% | 100 |
| M226 | 3 | 12 | 59 | 0.2 | 0 | 10.8 | 15 | 0 | 850 | 12.3% | 25.3% | 50 |
| M227 | 4 | 16 | 53.8 | 0.2 | 0 | 11 | 15 | 0 | 850 | 10.5% | 22.8% | 100 |
| M228 | 3 | 12 | 58.4 | 0.2 | 0 | 11.4 | 15 | 0 | 850 | 12.3% | 25.3% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M229 | 4 | 16 | 53.2 | 0.2 | 0 | 11.6 | 15 | 0 | 850 | 10.5% | 22.9% | 100 |
| M230 | 3 | 12 | 57.8 | 0.2 | 0 | 12 | 15 | 0 | 850 | 12.3% | 25.4% | 50 |
| M231 | 4 | 16 | 52.6 | 0.2 | 0 | 12.2 | 15 | 0 | 800 | 10.5% | 23.0% | 100 |
| M232 | 3 | 12 | 57.2 | 0.2 | 0 | 12.6 | 15 | 0 | 850 | 12.3% | 25.4% | 50 |
| M233 | 4 | 16 | 52 | 0.2 | 0 | 12.8 | 15 | 0 | 800 | 10.5% | 23.0% | 100 |
| M234 | 3 | 12 | 56.6 | 0.2 | 0 | 13.2 | 15 | 0 | 850 | 12.2% | 25.4% | 0 |
| M235 | 4 | 16 | 51.4 | 0.2 | 0 | 13.4 | 15 | 0 | 800 | 10.5% | 23.1% | 100 |
| M236 | 3 | 12 | 56 | 0.2 | 0 | 13.8 | 15 | 0 | 850 | 12.2% | 25.5% | 0 |
| M237 | 4 | 16 | 50.8 | 0.2 | 0 | 14 | 15 | 0 | 800 | 10.4% | 23.1% | 100 |
| M238 | 4 | 16 | 61.2 | 0.4 | 0 | 3.4 | 15 | 0 | 950 | 10.7% | 22.2% | 0 |
| M239 | 4 | 16 | 60.6 | 0.4 | 0 | 4 | 15 | 0 | 950 | 10.6% | 22.2% | 0 |
| M240 | 3 | 12 | 65 | 0.4 | 0 | 4.6 | 15 | 0 | 950 | 12.4% | 25.1% | 0 |
| M241 | 4 | 16 | 59.8 | 0.4 | 0 | 4.8 | 15 | 0 | 950 | 10.6% | 22.3% | 50 |
| M242 | 3 | 12 | 64.4 | 0.4 | 0 | 5.2 | 15 | 0 | 950 | 12.4% | 25.1% | 0 |
| M243 | 4 | 16 | 59.2 | 0.4 | 0 | 5.4 | 15 | 0 | 900 | 10.5% | 22.4% | 50 |
| M244 | 3 | 12 | 63.8 | 0.4 | 0 | 5.8 | 15 | 0 | 950 | 12.4% | 25.1% | 0 |
| M245 | 4 | 16 | 58.6 | 0.4 | 0 | 6 | 15 | 0 | 900 | 10.5% | 22.4% | 50 |
| M246 | 3 | 12 | 63.2 | 0.4 | 0 | 6.4 | 15 | 0 | 950 | 12.4% | 25.1% | 0 |
| M247 | 4 | 16 | 58 | 0.4 | 0 | 6.6 | 15 | 0 | 900 | 10.7% | 22.4% | 50 |
| M248 | 3 | 12 | 62.6 | 0.4 | 0 | 7 | 15 | 0 | 900 | 12.3% | 25.1% | 0 |
| M249 | 4 | 16 | 57.4 | 0.4 | 0 | 7.2 | 15 | 0 | 900 | 10.7% | 22.5% | 50 |
| M250 | 3 | 12 | 62 | 0.4 | 0 | 7.6 | 15 | 0 | 900 | 12.3% | 25.2% | 0 |
| M251 | 4 | 16 | 56.8 | 0.4 | 0 | 7.8 | 15 | 0 | 900 | 10.7% | 22.5% | 50 |
| M252 | 3 | 12 | 61.4 | 0.4 | 0 | 8.2 | 15 | 0 | 900 | 12.3% | 25.2% | 50 |
| M253 | 4 | 16 | 56.2 | 0.4 | 0 | 8.4 | 15 | 0 | 850 | 10.6% | 22.6% | 50 |
| M254 | 3 | 12 | 60.8 | 0.4 | 0 | 8.8 | 15 | 0 | 900 | 12.3% | 25.2% | 50 |
| M255 | 4 | 16 | 55.6 | 0.4 | 0 | 9 | 15 | 0 | 850 | 10.6% | 22.6% | 50 |
| M256 | 3 | 12 | 60.2 | 0.4 | 0 | 9.4 | 15 | 0 | 900 | 12.3% | 25.2% | 50 |
| M257 | 4 | 16 | 55 | 0.4 | 0 | 9.6 | 15 | 0 | 850 | 10.6% | 22.7% | 50 |
| M258 | 3 | 12 | 59.6 | 0.4 | 0 | 10 | 15 | 0 | 850 | 12.2% | 25.3% | 50 |
| M259 | 4 | 16 | 54.4 | 0.4 | 0 | 10.2 | 15 | 0 | 850 | 10.6% | 22.8% | 50 |
| M260 | 3 | 12 | 59 | 0.4 | 0 | 10.6 | 15 | 0 | 850 | 12.2% | 25.3% | 50 |
| M261 | 4 | 16 | 53.8 | 0.4 | 0 | 10.8 | 15 | 0 | 850 | 10.5% | 22.8% | 100 |
| M262 | 3 | 12 | 58.4 | 0.4 | 0 | 11.2 | 15 | 0 | 850 | 12.3% | 25.3% | 50 |
| M263 | 4 | 16 | 53.2 | 0.4 | 0 | 11.4 | 15 | 0 | 850 | 10.5% | 22.9% | 100 |
| M264 | 3 | 12 | 57.8 | 0.4 | 0 | 11.8 | 15 | 0 | 850 | 12.3% | 25.4% | 50 |
| M265 | 4 | 16 | 52.6 | 0.4 | 0 | 12 | 15 | 0 | 800 | 10.5% | 22.9% | 100 |
| M266 | 3 | 12 | 57.2 | 0.4 | 0 | 12.4 | 15 | 0 | 850 | 12.3% | 25.4% | 50 |
| M267 | 4 | 16 | 52 | 0.4 | 0 | 12.6 | 15 | 0 | 800 | 10.5% | 23.0% | 100 |
| M268 | 3 | 12 | 56.6 | 0.4 | 0 | 13 | 15 | 0 | 850 | 12.2% | 25.4% | 50 |
| M269 | 4 | 16 | 51.4 | 0.4 | 0 | 13.2 | 15 | 0 | 800 | 10.4% | 23.0% | 100 |
| M270 | 3 | 12 | 56 | 0.4 | 0 | 13.6 | 15 | 0 | 850 | 12.2% | 25.4% | 0 |
| M271 | 4 | 16 | 50.8 | 0.4 | 0 | 13.8 | 15 | 0 | 800 | 10.4% | 23.1% | 100 |
| M272 | 4 | 16 | 61.6 | 0.6 | 0 | 2.8 | 15 | 0 | 950 | 10.7% | 22.1% | 0 |
| M273 | 4 | 16 | 61 | 0.6 | 0 | 3.4 | 15 | 0 | 950 | 10.7% | 22.2% | 0 |
| M274 | 4 | 16 | 60.4 | 0.6 | 0 | 4 | 15 | 0 | 950 | 10.6% | 22.2% | 0 |
| M275 | 4 | 16 | 60 | 0.6 | 0 | 4.4 | 15 | 0 | 950 | 10.6% | 22.3% | 50 |
| M276 | 3 | 12 | 64.6 | 0.6 | 0 | 4.8 | 15 | 0 | 950 | 12.4% | 25.1% | 0 |
| M277 | 4 | 16 | 59.4 | 0.6 | 0 | 5 | 15 | 0 | 950 | 10.6% | 22.3% | 50 |
| M278 | 3 | 12 | 64 | 0.6 | 0 | 5.4 | 15 | 0 | 950 | 12.4% | 25.1% | 0 |
| M279 | 4 | 16 | 58.8 | 0.6 | 0 | 5.6 | 15 | 0 | 900 | 10.5% | 22.4% | 50 |
| M280 | 3 | 12 | 63.4 | 0.6 | 0 | 6 | 15 | 0 | 950 | 12.4% | 25.1% | 0 |
| M281 | 4 | 16 | 58.2 | 0.6 | 0 | 6.2 | 15 | 0 | 900 | 10.5% | 22.4% | 50 |
| M282 | 3 | 12 | 62.8 | 0.6 | 0 | 6.6 | 15 | 0 | 900 | 12.3% | 25.1% | 0 |
| M283 | 4 | 16 | 57.6 | 0.6 | 0 | 6.8 | 15 | 0 | 900 | 10.7% | 22.5% | 50 |
| M284 | 3 | 12 | 62.2 | 0.6 | 0 | 7.2 | 15 | 0 | 900 | 12.3% | 25.1% | 0 |
| M285 | 4 | 16 | 57 | 0.6 | 0 | 7.4 | 15 | 0 | 900 | 10.7% | 22.5% | 50 |
| M286 | 3 | 12 | 61.6 | 0.6 | 0 | 7.8 | 15 | 0 | 900 | 12.3% | 25.2% | 0 |
| M287 | 4 | 16 | 56.4 | 0.6 | 0 | 8 | 15 | 0 | 900 | 10.6% | 22.6% | 50 |
| M288 | 3 | 12 | 61 | 0.6 | 0 | 8.4 | 15 | 0 | 900 | 12.3% | 25.2% | 50 |
| M289 | 4 | 16 | 55.8 | 0.6 | 0 | 8.6 | 15 | 0 | 850 | 10.6% | 22.6% | 50 |
| M290 | 3 | 12 | 60.4 | 0.6 | 0 | 9 | 15 | 0 | 900 | 12.3% | 25.2% | 50 |
| M291 | 4 | 16 | 55.2 | 0.6 | 0 | 9.2 | 15 | 0 | 850 | 10.6% | 22.7% | 50 |
| M292 | 3 | 12 | 59.8 | 0.6 | 0 | 9.6 | 15 | 0 | 900 | 12.2% | 25.2% | 50 |
| M293 | 4 | 16 | 54.6 | 0.6 | 0 | 9.8 | 15 | 0 | 850 | 10.6% | 22.7% | 50 |
| M294 | 3 | 12 | 59.2 | 0.6 | 0 | 10.2 | 15 | 0 | 850 | 12.2% | 25.3% | 50 |
| M295 | 4 | 16 | 54 | 0.6 | 0 | 10.4 | 15 | 0 | 850 | 10.5% | 22.8% | 100 |
| M296 | 3 | 12 | 58.6 | 0.6 | 0 | 10.8 | 15 | 0 | 850 | 12.2% | 25.3% | 50 |
| M297 | 4 | 16 | 53.4 | 0.6 | 0 | 11 | 15 | 0 | 850 | 10.5% | 22.8% | 100 |
| M298 | 3 | 12 | 58 | 0.6 | 0 | 11.4 | 15 | 0 | 850 | 12.3% | 25.3% | 50 |
| M299 | 4 | 16 | 52.8 | 0.6 | 0 | 11.6 | 15 | 0 | 850 | 10.5% | 22.9% | 100 |
| M300 | 3 | 12 | 57.4 | 0.6 | 0 | 12 | 15 | 0 | 850 | 12.3% | 25.4% | 50 |
| M301 | 4 | 16 | 52.2 | 0.6 | 0 | 12.2 | 15 | 0 | 800 | 10.5% | 22.9% | 100 |
| M302 | 3 | 12 | 56.8 | 0.6 | 0 | 12.6 | 15 | 0 | 850 | 12.2% | 25.4% | 50 |
| M303 | 4 | 16 | 51.6 | 0.6 | 0 | 12.8 | 15 | 0 | 800 | 10.4% | 23.0% | 100 |
| M304 | 3 | 12 | 56.2 | 0.6 | 0 | 13.2 | 15 | 0 | 850 | 12.2% | 25.4% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M305 | 4 | 16 | 51 | 0.6 | 0 | 13.4 | 15 | 0 | 800 | 10.4% | 23.0% | 100 |
| M306 | 3 | 12 | 55.6 | 0.6 | 0 | 13.8 | 15 | 0 | 800 | 12.2% | 25.4% | 0 |
| M307 | 4 | 16 | 50.4 | 0.6 | 0 | 14 | 15 | 0 | 800 | 10.4% | 23.1% | 100 |
| M308 | 4 | 16 | 61.2 | 0.8 | 0 | 3 | 15 | 0 | 950 | 10.7% | 22.2% | 0 |
| M309 | 4 | 16 | 60.6 | 0.8 | 0 | 3.6 | 15 | 0 | 950 | 10.6% | 22.2% | 0 |
| M310 | 3 | 12 | 65 | 0.8 | 0 | 4.2 | 15 | 0 | 950 | 12.5% | 25.0% | 0 |
| M311 | 4 | 16 | 59.8 | 0.8 | 0 | 4.4 | 15 | 0 | 950 | 10.6% | 22.3% | 50 |
| M312 | 3 | 12 | 64.4 | 0.8 | 0 | 4.8 | 15 | 0 | 950 | 12.4% | 25.1% | 0 |
| M313 | 4 | 16 | 59.2 | 0.8 | 0 | 5 | 15 | 0 | 900 | 10.6% | 22.3% | 50 |
| M314 | 3 | 12 | 63.8 | 0.8 | 0 | 5.4 | 15 | 0 | 950 | 12.4% | 25.1% | 0 |
| M315 | 4 | 16 | 58.6 | 0.8 | 0 | 5.6 | 15 | 0 | 900 | 10.5% | 22.4% | 50 |
| M316 | 3 | 12 | 63.2 | 0.8 | 0 | 6 | 15 | 0 | 950 | 12.4% | 25.1% | 0 |
| M317 | 4 | 16 | 58 | 0.8 | 0 | 6.2 | 15 | 0 | 900 | 10.5% | 22.4% | 50 |
| M318 | 3 | 12 | 62.6 | 0.8 | 0 | 6.6 | 15 | 0 | 900 | 12.3% | 25.1% | 0 |
| M319 | 4 | 16 | 57.4 | 0.8 | 0 | 6.8 | 15 | 0 | 900 | 10.5% | 22.4% | 50 |
| M320 | 3 | 12 | 62 | 0.8 | 0 | 7.2 | 15 | 0 | 900 | 12.3% | 25.1% | 0 |
| M321 | 4 | 16 | 56.8 | 0.8 | 0 | 7.4 | 15 | 0 | 900 | 10.7% | 22.5% | 50 |
| M322 | 3 | 12 | 61.4 | 0.8 | 0 | 7.8 | 15 | 0 | 900 | 12.3% | 25.2% | 50 |
| M323 | 4 | 16 | 56.2 | 0.8 | 0 | 8 | 15 | 0 | 850 | 10.6% | 22.5% | 50 |
| M324 | 3 | 12 | 60.8 | 0.8 | 0 | 8.4 | 15 | 0 | 900 | 12.3% | 25.2% | 50 |
| M325 | 4 | 16 | 55.6 | 0.8 | 0 | 8.6 | 15 | 0 | 850 | 10.6% | 22.6% | 50 |
| M326 | 3 | 12 | 60.2 | 0.8 | 0 | 9 | 15 | 0 | 900 | 12.3% | 25.2% | 50 |
| M327 | 4 | 16 | 55 | 0.8 | 0 | 9.2 | 15 | 0 | 850 | 10.6% | 22.6% | 50 |
| M328 | 3 | 12 | 59.6 | 0.8 | 0 | 9.6 | 15 | 0 | 900 | 12.2% | 25.2% | 50 |
| M329 | 4 | 16 | 54.4 | 0.8 | 0 | 9.8 | 15 | 0 | 850 | 10.5% | 22.7% | 50 |
| M330 | 3 | 12 | 59 | 0.8 | 0 | 10.2 | 15 | 0 | 850 | 12.2% | 25.3% | 50 |
| M331 | 4 | 16 | 53.8 | 0.8 | 0 | 10.4 | 15 | 0 | 850 | 10.5% | 22.7% | 100 |
| M332 | 3 | 12 | 58.4 | 0.8 | 0 | 10.8 | 15 | 0 | 850 | 12.2% | 25.3% | 50 |
| M333 | 4 | 16 | 53.2 | 0.8 | 0 | 11 | 15 | 0 | 850 | 10.5% | 22.8% | 100 |
| M334 | 3 | 12 | 57.8 | 0.8 | 0 | 11.4 | 15 | 0 | 850 | 12.2% | 25.3% | 50 |
| M335 | 4 | 16 | 52.6 | 0.8 | 0 | 11.6 | 15 | 0 | 850 | 10.5% | 22.9% | 100 |
| M336 | 3 | 12 | 57.2 | 0.8 | 0 | 12 | 15 | 0 | 850 | 12.2% | 25.3% | 50 |
| M337 | 4 | 16 | 52 | 0.8 | 0 | 12.2 | 15 | 0 | 800 | 10.5% | 22.9% | 100 |
| M338 | 3 | 12 | 56.6 | 0.8 | 0 | 12.6 | 15 | 0 | 850 | 12.2% | 25.4% | 50 |
| M339 | 4 | 16 | 51.4 | 0.8 | 0 | 12.8 | 15 | 0 | 800 | 10.4% | 23.0% | 100 |
| M340 | 3 | 12 | 56 | 0.8 | 0 | 13.2 | 15 | 0 | 850 | 12.2% | 25.4% | 50 |
| M341 | 4 | 16 | 50.8 | 0.8 | 0 | 13.4 | 15 | 0 | 800 | 10.4% | 23.0% | 100 |
| M342 | 3 | 12 | 55.4 | 0.8 | 0 | 13.8 | 15 | 0 | 800 | 12.2% | 25.4% | 50 |
| M343 | 4 | 16 | 50.2 | 0.8 | 0 | 14 | 15 | 0 | 800 | 10.4% | 23.1% | 100 |
| M344 | 4 | 16 | 61.2 | 1 | 0 | 2.8 | 15 | 0 | 950 | 10.7% | 22.1% | 0 |
| M345 | 4 | 16 | 60.6 | 1 | 0 | 3.4 | 15 | 0 | 950 | 10.7% | 22.2% | 0 |
| M346 | 3 | 12 | 65 | 1 | 0 | 4 | 15 | 0 | 950 | 12.5% | 25.0% | 0 |
| M347 | 4 | 16 | 59.8 | 1 | 0 | 4.2 | 15 | 0 | 950 | 10.6% | 22.2% | 50 |
| M348 | 3 | 12 | 64.4 | 1 | 0 | 4.6 | 15 | 0 | 950 | 12.4% | 25.0% | 0 |
| M349 | 4 | 16 | 59.2 | 1 | 0 | 4.8 | 15 | 0 | 900 | 10.6% | 22.3% | 50 |
| M350 | 3 | 12 | 63.8 | 1 | 0 | 5.2 | 15 | 0 | 950 | 12.4% | 25.1% | 0 |
| M351 | 4 | 16 | 58.6 | 1 | 0 | 5.4 | 15 | 0 | 900 | 10.5% | 22.3% | 50 |
| M352 | 3 | 12 | 63.2 | 1 | 0 | 5.8 | 15 | 0 | 950 | 12.4% | 25.1% | 0 |
| M353 | 4 | 16 | 58 | 1 | 0 | 6 | 15 | 0 | 900 | 10.5% | 22.4% | 50 |
| M354 | 3 | 12 | 62.6 | 1 | 0 | 6.4 | 15 | 0 | 900 | 12.4% | 25.1% | 0 |
| M355 | 4 | 16 | 57.4 | 1 | 0 | 6.6 | 15 | 0 | 900 | 10.5% | 22.4% | 50 |
| M356 | 3 | 12 | 62 | 1 | 0 | 7 | 15 | 0 | 900 | 12.3% | 25.1% | 0 |
| M357 | 4 | 16 | 56.8 | 1 | 0 | 7.2 | 15 | 0 | 900 | 10.4% | 22.5% | 50 |
| M358 | 3 | 12 | 61.4 | 1 | 0 | 7.6 | 15 | 0 | 900 | 12.3% | 25.1% | 0 |
| M359 | 4 | 16 | 56.2 | 1 | 0 | 7.8 | 15 | 0 | 900 | 10.6% | 22.5% | 50 |
| M360 | 3 | 12 | 60.8 | 1 | 0 | 8.2 | 15 | 0 | 900 | 12.3% | 25.2% | 50 |
| M361 | 4 | 16 | 55.6 | 1 | 0 | 8.4 | 15 | 0 | 850 | 10.6% | 22.6% | 50 |
| M362 | 3 | 12 | 60.2 | 1 | 0 | 8.8 | 15 | 0 | 900 | 12.3% | 25.2% | 50 |
| M363 | 4 | 16 | 55 | 1 | 0 | 9 | 15 | 0 | 850 | 10.6% | 22.6% | 50 |
| M364 | 3 | 12 | 59.6 | 1 | 0 | 9.4 | 15 | 0 | 900 | 12.2% | 25.2% | 50 |
| M365 | 4 | 16 | 54.4 | 1 | 0 | 9.6 | 15 | 0 | 850 | 10.6% | 22.7% | 50 |
| M366 | 3 | 12 | 59 | 1 | 0 | 10 | 15 | 0 | 850 | 12.2% | 25.2% | 50 |
| M367 | 4 | 16 | 53.8 | 1 | 0 | 10.2 | 15 | 0 | 850 | 10.5% | 22.7% | 100 |
| M368 | 3 | 12 | 58.4 | 1 | 0 | 10.6 | 15 | 0 | 850 | 12.2% | 25.3% | 50 |
| M369 | 4 | 16 | 53.2 | 1 | 0 | 10.8 | 15 | 0 | 850 | 10.5% | 22.8% | 100 |
| M370 | 3 | 12 | 57.8 | 1 | 0 | 11.2 | 15 | 0 | 850 | 12.2% | 25.3% | 50 |
| M371 | 4 | 16 | 52.6 | 1 | 0 | 11.4 | 15 | 0 | 850 | 10.5% | 22.8% | 100 |
| M372 | 3 | 12 | 57.2 | 1 | 0 | 11.8 | 15 | 0 | 850 | 12.2% | 25.3% | 50 |
| M373 | 4 | 16 | 52 | 1 | 0 | 12 | 15 | 0 | 800 | 10.4% | 22.9% | 100 |
| M374 | 3 | 12 | 56.6 | 1 | 0 | 12.4 | 15 | 0 | 850 | 12.2% | 25.4% | 50 |
| M375 | 4 | 16 | 51.4 | 1 | 0 | 12.6 | 15 | 0 | 800 | 10.4% | 22.9% | 100 |
| M376 | 3 | 12 | 56 | 1 | 0 | 13 | 15 | 0 | 850 | 12.2% | 25.4% | 50 |
| M377 | 4 | 16 | 50.8 | 1 | 0 | 13.2 | 15 | 0 | 800 | 10.4% | 23.0% | 100 |
| M378 | 3 | 12 | 55.4 | 1 | 0 | 13.6 | 15 | 0 | 850 | 12.2% | 25.4% | 50 |
| M379 | 4 | 16 | 50.2 | 1 | 0 | 13.8 | 15 | 0 | 800 | 10.4% | 23.1% | 100 |
| M380 | 4 | 16 | 61.6 | 1.2 | 0 | 2.2 | 15 | 0 | 950 | 10.8% | 22.1% | 0 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M381 | 4 | 16 | 61 | 1.2 | 0 | 2.8 | 15 | 0 | 950 | 10.7% | 22.1% | 0 |
| M382 | 4 | 16 | 60.4 | 1.2 | 0 | 3.4 | 15 | 0 | 950 | 10.7% | 22.2% | 0 |
| M383 | 4 | 16 | 60 | 1.2 | 0 | 3.8 | 15 | 0 | 950 | 10.6% | 22.2% | 50 |
| M384 | 3 | 12 | 64.6 | 1.2 | 0 | 4.2 | 15 | 0 | 950 | 12.5% | 25.0% | 0 |
| M385 | 4 | 16 | 59.4 | 1.2 | 0 | 4.4 | 15 | 0 | 950 | 10.6% | 22.2% | 50 |
| M386 | 3 | 12 | 64 | 1.2 | 0 | 4.8 | 15 | 0 | 950 | 12.4% | 25.0% | 0 |
| M387 | 4 | 16 | 58.8 | 1.2 | 0 | 5 | 15 | 0 | 900 | 10.6% | 22.3% | 50 |
| M388 | 3 | 12 | 63.4 | 1.2 | 0 | 5.4 | 15 | 0 | 950 | 12.4% | 25.1% | 0 |
| M389 | 4 | 16 | 58.2 | 1.2 | 0 | 5.6 | 15 | 0 | 900 | 10.5% | 22.3% | 50 |
| M390 | 3 | 12 | 62.8 | 1.2 | 0 | 6 | 15 | 0 | 950 | 12.4% | 25.1% | 0 |
| M391 | 4 | 16 | 57.6 | 1.2 | 0 | 6.2 | 15 | 0 | 900 | 10.5% | 22.4% | 50 |
| M392 | 3 | 12 | 62.2 | 1.2 | 0 | 6.6 | 15 | 0 | 900 | 12.3% | 25.1% | 0 |
| M393 | 4 | 16 | 57 | 1.2 | 0 | 6.8 | 15 | 0 | 900 | 10.4% | 22.4% | 50 |
| M394 | 3 | 12 | 61.6 | 1.2 | 0 | 7.2 | 15 | 0 | 900 | 12.3% | 25.1% | 0 |
| M395 | 4 | 16 | 56.4 | 1.2 | 0 | 7.4 | 15 | 0 | 900 | 10.4% | 22.5% | 50 |
| M396 | 3 | 12 | 61 | 1.2 | 0 | 7.8 | 15 | 0 | 900 | 12.3% | 25.1% | 50 |
| M397 | 4 | 16 | 55.8 | 1.2 | 0 | 8 | 15 | 0 | 850 | 10.6% | 22.5% | 50 |
| M398 | 3 | 12 | 60.4 | 1.2 | 0 | 8.4 | 15 | 0 | 900 | 12.3% | 25.2% | 50 |
| M399 | 4 | 16 | 55.2 | 1.2 | 0 | 8.6 | 15 | 0 | 850 | 10.6% | 22.6% | 50 |
| M400 | 3 | 12 | 59.8 | 1.2 | 0 | 9 | 15 | 0 | 900 | 12.2% | 25.2% | 50 |
| M401 | 4 | 16 | 54.6 | 1.2 | 0 | 9.2 | 15 | 0 | 850 | 10.6% | 22.6% | 50 |
| M402 | 3 | 12 | 59.2 | 1.2 | 0 | 9.6 | 15 | 0 | 850 | 12.2% | 25.2% | 50 |
| M403 | 4 | 16 | 54 | 1.2 | 0 | 9.8 | 15 | 0 | 850 | 10.5% | 22.7% | 50 |
| M404 | 3 | 12 | 58.6 | 1.2 | 0 | 10.2 | 15 | 0 | 850 | 12.2% | 25.2% | 50 |
| M405 | 4 | 16 | 53.4 | 1.2 | 0 | 10.4 | 15 | 0 | 850 | 10.5% | 22.7% | 100 |
| M406 | 3 | 12 | 58 | 1.2 | 0 | 10.8 | 15 | 0 | 850 | 12.2% | 25.3% | 50 |
| M407 | 4 | 16 | 52.8 | 1.2 | 0 | 11 | 15 | 0 | 850 | 10.5% | 22.8% | 100 |
| M408 | 3 | 12 | 57.4 | 1.2 | 0 | 11.4 | 15 | 0 | 850 | 12.2% | 25.3% | 50 |
| M409 | 4 | 16 | 52.2 | 1.2 | 0 | 11.6 | 15 | 0 | 800 | 10.5% | 22.8% | 100 |
| M410 | 3 | 12 | 56.8 | 1.2 | 0 | 12 | 15 | 0 | 850 | 12.2% | 25.3% | 50 |
| M411 | 4 | 16 | 51.6 | 1.2 | 0 | 12.2 | 15 | 0 | 800 | 10.4% | 22.9% | 100 |
| M412 | 3 | 12 | 56.2 | 1.2 | 0 | 12.6 | 15 | 0 | 850 | 12.2% | 25.4% | 50 |
| M413 | 4 | 16 | 51 | 1.2 | 0 | 12.8 | 15 | 0 | 800 | 10.4% | 22.9% | 100 |
| M414 | 3 | 12 | 55.6 | 1.2 | 0 | 13.2 | 15 | 0 | 850 | 12.2% | 25.4% | 50 |
| M415 | 4 | 16 | 50.4 | 1.2 | 0 | 13.4 | 15 | 0 | 800 | 10.4% | 23.0% | 100 |
| M416 | 3 | 12 | 55 | 1.2 | 0 | 13.8 | 15 | 0 | 800 | 12.2% | 25.4% | 100 |
| M417 | 4 | 16 | 49.8 | 1.2 | 0 | 14 | 15 | 0 | 800 | 10.4% | 23.1% | 100 |
| M418 | 4 | 16 | 61.2 | 1.4 | 0 | 2.4 | 15 | 0 | 950 | 10.7% | 22.1% | 0 |
| M419 | 4 | 16 | 60.6 | 1.4 | 0 | 3 | 15 | 0 | 950 | 10.7% | 22.1% | 0 |
| M420 | 3 | 12 | 65 | 1.4 | 0 | 3.6 | 15 | 0 | 950 | 12.5% | 25.0% | 0 |
| M421 | 4 | 16 | 59.8 | 1.4 | 0 | 3.8 | 15 | 0 | 950 | 10.6% | 22.2% | 50 |
| M422 | 3 | 12 | 64.4 | 1.4 | 0 | 4.2 | 15 | 0 | 950 | 12.5% | 25.0% | 0 |
| M423 | 4 | 16 | 59.2 | 1.4 | 0 | 4.4 | 15 | 0 | 900 | 10.6% | 22.2% | 50 |
| M424 | 3 | 12 | 63.8 | 1.4 | 0 | 4.8 | 15 | 0 | 950 | 12.4% | 25.0% | 0 |
| M425 | 4 | 16 | 58.6 | 1.4 | 0 | 5 | 15 | 0 | 900 | 10.6% | 22.3% | 50 |
| M426 | 3 | 12 | 63.2 | 1.4 | 0 | 5.4 | 15 | 0 | 950 | 12.4% | 25.1% | 0 |
| M427 | 4 | 16 | 58 | 1.4 | 0 | 5.6 | 15 | 0 | 900 | 10.5% | 22.3% | 50 |
| M428 | 3 | 12 | 62.6 | 1.4 | 0 | 6 | 15 | 0 | 900 | 12.4% | 25.1% | 0 |
| M429 | 4 | 16 | 57.4 | 1.4 | 0 | 6.2 | 15 | 0 | 900 | 10.5% | 22.4% | 50 |
| M430 | 3 | 12 | 62 | 1.4 | 0 | 6.6 | 15 | 0 | 900 | 12.3% | 25.1% | 0 |
| M431 | 4 | 16 | 56.8 | 1.4 | 0 | 6.8 | 15 | 0 | 900 | 10.4% | 22.4% | 50 |
| M432 | 3 | 12 | 61.4 | 1.4 | 0 | 7.2 | 15 | 0 | 900 | 12.3% | 25.1% | 0 |
| M433 | 4 | 16 | 56.2 | 1.4 | 0 | 7.4 | 15 | 0 | 900 | 10.4% | 22.5% | 50 |
| M434 | 3 | 12 | 60.8 | 1.4 | 0 | 7.8 | 15 | 0 | 900 | 12.3% | 25.1% | 50 |
| M435 | 4 | 16 | 55.6 | 1.4 | 0 | 8 | 15 | 0 | 850 | 10.6% | 22.5% | 50 |
| M436 | 3 | 12 | 60.2 | 1.4 | 0 | 8.4 | 15 | 0 | 900 | 12.3% | 25.2% | 50 |
| M437 | 4 | 16 | 55 | 1.4 | 0 | 8.6 | 15 | 0 | 850 | 10.6% | 22.6% | 50 |
| M438 | 3 | 12 | 59.6 | 1.4 | 0 | 9 | 15 | 0 | 900 | 12.2% | 25.2% | 50 |
| M439 | 4 | 16 | 54.4 | 1.4 | 0 | 9.2 | 15 | 0 | 850 | 10.6% | 22.6% | 50 |
| M440 | 3 | 12 | 59 | 1.4 | 0 | 9.6 | 15 | 0 | 850 | 12.2% | 25.2% | 50 |
| M441 | 4 | 16 | 53.8 | 1.4 | 0 | 9.8 | 15 | 0 | 850 | 10.5% | 22.7% | 100 |
| M442 | 3 | 12 | 58.4 | 1.4 | 0 | 10.2 | 15 | 0 | 850 | 12.2% | 25.2% | 50 |
| M443 | 4 | 16 | 53.2 | 1.4 | 0 | 10.4 | 15 | 0 | 850 | 10.5% | 22.7% | 100 |
| M444 | 3 | 12 | 57.8 | 1.4 | 0 | 10.8 | 15 | 0 | 850 | 12.2% | 25.3% | 50 |
| M445 | 4 | 16 | 52.6 | 1.4 | 0 | 11 | 15 | 0 | 850 | 10.5% | 22.8% | 100 |
| M446 | 3 | 12 | 57.2 | 1.4 | 0 | 11.4 | 15 | 0 | 850 | 12.2% | 25.3% | 50 |
| M447 | 4 | 16 | 52 | 1.4 | 0 | 11.6 | 15 | 0 | 800 | 10.4% | 22.8% | 100 |
| M448 | 3 | 12 | 56.6 | 1.4 | 0 | 12 | 15 | 0 | 850 | 12.2% | 25.3% | 50 |
| M449 | 4 | 16 | 51.4 | 1.4 | 0 | 12.2 | 15 | 0 | 800 | 10.4% | 22.9% | 100 |
| M450 | 3 | 12 | 56 | 1.4 | 0 | 12.6 | 15 | 0 | 850 | 12.2% | 25.3% | 50 |
| M451 | 4 | 16 | 50.8 | 1.4 | 0 | 12.8 | 15 | 0 | 800 | 10.4% | 22.9% | 100 |
| M452 | 3 | 12 | 55.4 | 1.4 | 0 | 13.2 | 15 | 0 | 850 | 12.2% | 25.4% | 50 |
| M453 | 4 | 16 | 50.2 | 1.4 | 0 | 13.4 | 15 | 0 | 800 | 10.4% | 23.0% | 100 |
| M454 | 3 | 12 | 54.8 | 1.4 | 0 | 13.8 | 15 | 0 | 800 | 12.2% | 25.4% | 100 |
| M455 | 4 | 16 | 49.6 | 1.4 | 0 | 14 | 15 | 0 | 800 | 10.4% | 23.0% | 100 |
| M456 | 4 | 16 | 61.2 | 1.6 | 0 | 2.2 | 15 | 0 | 950 | 10.8% | 22.1% | 0 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M457 | 4 | 16 | 60.6 | 1.6 | 0 | 2.8 | 15 | 0 | 950 | 10.7% | 22.1% | 0 |
| M458 | 3 | 12 | 65 | 1.6 | 0 | 3.4 | 15 | 0 | 950 | 12.5% | 25.0% | 0 |
| M459 | 4 | 16 | 59.8 | 1.6 | 0 | 3.6 | 15 | 0 | 950 | 10.7% | 22.2% | 50 |
| M460 | 3 | 12 | 64.4 | 1.6 | 0 | 4 | 15 | 0 | 950 | 12.5% | 25.0% | 0 |
| M461 | 4 | 16 | 59.2 | 1.6 | 0 | 4.2 | 15 | 0 | 900 | 10.6% | 22.2% | 50 |
| M462 | 3 | 12 | 63.8 | 1.6 | 0 | 4.6 | 15 | 0 | 950 | 12.4% | 25.0% | 0 |
| M463 | 4 | 16 | 58.6 | 1.6 | 0 | 4.8 | 15 | 0 | 900 | 10.6% | 22.3% | 50 |
| M464 | 3 | 12 | 63.2 | 1.6 | 0 | 5.2 | 15 | 0 | 950 | 12.4% | 25.1% | 0 |
| M465 | 4 | 16 | 58 | 1.6 | 0 | 5.4 | 15 | 0 | 900 | 10.5% | 22.3% | 50 |
| M466 | 3 | 12 | 62.6 | 1.6 | 0 | 5.8 | 15 | 0 | 900 | 12.4% | 25.1% | 0 |
| M467 | 4 | 16 | 57.4 | 1.6 | 0 | 6 | 15 | 0 | 900 | 10.5% | 22.4% | 50 |
| M468 | 3 | 12 | 62 | 1.6 | 0 | 6.4 | 15 | 0 | 900 | 12.3% | 25.1% | 0 |
| M469 | 4 | 16 | 56.8 | 1.6 | 0 | 6.6 | 15 | 0 | 900 | 10.4% | 22.4% | 50 |
| M470 | 3 | 12 | 61.4 | 1.6 | 0 | 7 | 15 | 0 | 900 | 12.3% | 25.1% | 0 |
| M471 | 4 | 16 | 56.2 | 1.6 | 0 | 7.2 | 15 | 0 | 900 | 10.4% | 22.4% | 50 |
| M472 | 3 | 12 | 60.8 | 1.6 | 0 | 7.6 | 15 | 0 | 900 | 12.3% | 25.1% | 50 |
| M473 | 4 | 16 | 55.6 | 1.6 | 0 | 7.8 | 15 | 0 | 850 | 10.4% | 22.5% | 50 |
| M474 | 3 | 12 | 60.2 | 1.6 | 0 | 8.2 | 15 | 0 | 900 | 12.3% | 25.2% | 50 |
| M475 | 4 | 16 | 55 | 1.6 | 0 | 8.4 | 15 | 0 | 850 | 10.6% | 22.5% | 50 |
| M476 | 3 | 12 | 59.6 | 1.6 | 0 | 8.8 | 15 | 0 | 900 | 12.2% | 25.2% | 50 |
| M477 | 4 | 16 | 54.4 | 1.6 | 0 | 9 | 15 | 0 | 850 | 10.6% | 22.6% | 50 |
| M478 | 3 | 12 | 59 | 1.6 | 0 | 9.4 | 15 | 0 | 850 | 12.2% | 25.2% | 50 |
| M479 | 4 | 16 | 53.8 | 1.6 | 0 | 9.6 | 15 | 0 | 850 | 10.5% | 22.6% | 50 |
| M480 | 3 | 12 | 58.4 | 1.6 | 0 | 10 | 15 | 0 | 850 | 12.2% | 25.2% | 50 |
| M481 | 4 | 16 | 53.2 | 1.6 | 0 | 10.2 | 15 | 0 | 850 | 10.5% | 22.7% | 100 |
| M482 | 3 | 12 | 57.8 | 1.6 | 0 | 10.6 | 15 | 0 | 850 | 12.2% | 25.2% | 50 |
| M483 | 4 | 16 | 52.6 | 1.6 | 0 | 10.8 | 15 | 0 | 850 | 10.5% | 22.7% | 100 |
| M484 | 3 | 12 | 57.2 | 1.6 | 0 | 11.2 | 15 | 0 | 850 | 12.2% | 25.3% | 50 |
| M485 | 4 | 16 | 52 | 1.6 | 0 | 11.4 | 15 | 0 | 850 | 10.4% | 22.8% | 100 |
| M486 | 3 | 12 | 56.6 | 1.6 | 0 | 11.8 | 15 | 0 | 850 | 12.2% | 25.3% | 50 |
| M487 | 4 | 16 | 51.4 | 1.6 | 0 | 12 | 15 | 0 | 800 | 10.4% | 22.8% | 100 |
| M488 | 3 | 12 | 56 | 1.6 | 0 | 12.4 | 15 | 0 | 850 | 12.2% | 25.3% | 50 |
| M489 | 4 | 16 | 50.8 | 1.6 | 0 | 12.6 | 15 | 0 | 800 | 10.4% | 22.9% | 100 |
| M490 | 3 | 12 | 55.4 | 1.6 | 0 | 13 | 15 | 0 | 850 | 12.2% | 25.4% | 50 |
| M491 | 4 | 16 | 50.2 | 1.6 | 0 | 13.2 | 15 | 0 | 800 | 10.4% | 23.0% | 100 |
| M492 | 3 | 12 | 54.8 | 1.6 | 0 | 13.6 | 15 | 0 | 800 | 12.2% | 25.4% | 100 |
| M493 | 4 | 16 | 49.6 | 1.6 | 0 | 13.8 | 15 | 0 | 800 | 10.3% | 23.0% | 100 |
| M494 | 4 | 16 | 61.6 | 1.8 | 0 | 1.6 | 15 | 0 | 950 | 10.8% | 22.0% | 0 |
| M495 | 4 | 16 | 61 | 1.8 | 0 | 2.2 | 15 | 0 | 950 | 10.8% | 22.1% | 0 |
| M496 | 4 | 16 | 60.4 | 1.8 | 0 | 2.8 | 15 | 0 | 950 | 10.7% | 22.1% | 0 |
| M497 | 4 | 16 | 60 | 1.8 | 0 | 3.2 | 15 | 0 | 950 | 10.7% | 22.1% | 0 |
| M498 | 3 | 12 | 64.6 | 1.8 | 0 | 3.6 | 15 | 0 | 950 | 12.5% | 25.0% | 0 |
| M499 | 4 | 16 | 59.4 | 1.8 | 0 | 3.8 | 15 | 0 | 950 | 10.6% | 22.2% | 50 |
| M500 | 3 | 12 | 64 | 1.8 | 0 | 4.2 | 15 | 0 | 950 | 12.5% | 25.0% | 0 |
| M501 | 4 | 16 | 58.8 | 1.8 | 0 | 4.4 | 15 | 0 | 900 | 10.6% | 22.2% | 50 |
| M502 | 3 | 12 | 63.4 | 1.8 | 0 | 4.8 | 15 | 0 | 950 | 12.4% | 25.0% | 0 |
| M503 | 4 | 16 | 58.2 | 1.8 | 0 | 5 | 15 | 0 | 900 | 10.6% | 22.3% | 50 |
| M504 | 3 | 12 | 62.8 | 1.8 | 0 | 5.4 | 15 | 0 | 950 | 12.4% | 25.1% | 0 |
| M505 | 4 | 16 | 57.6 | 1.8 | 0 | 5.6 | 15 | 0 | 900 | 10.5% | 22.3% | 50 |
| M506 | 3 | 12 | 62.2 | 1.8 | 0 | 6 | 15 | 0 | 900 | 12.4% | 25.1% | 0 |
| M507 | 4 | 16 | 57 | 1.8 | 0 | 6.2 | 15 | 0 | 900 | 10.5% | 22.4% | 50 |
| M508 | 3 | 12 | 61.6 | 1.8 | 0 | 6.6 | 15 | 0 | 900 | 12.3% | 25.1% | 0 |
| M509 | 4 | 16 | 56.4 | 1.8 | 0 | 6.8 | 15 | 0 | 900 | 10.4% | 22.4% | 50 |
| M510 | 3 | 12 | 61 | 1.8 | 0 | 7.2 | 15 | 0 | 900 | 12.3% | 25.1% | 0 |
| M511 | 4 | 16 | 55.8 | 1.8 | 0 | 7.4 | 15 | 0 | 850 | 10.4% | 22.4% | 50 |
| M512 | 3 | 12 | 60.4 | 1.8 | 0 | 7.8 | 15 | 0 | 900 | 12.3% | 25.1% | 50 |
| M513 | 4 | 16 | 55.2 | 1.8 | 0 | 8 | 15 | 0 | 850 | 10.4% | 22.5% | 50 |
| M514 | 3 | 12 | 59.8 | 1.8 | 0 | 8.4 | 15 | 0 | 900 | 12.3% | 25.2% | 50 |
| M515 | 4 | 16 | 54.6 | 1.8 | 0 | 8.6 | 15 | 0 | 850 | 10.6% | 22.5% | 50 |
| M516 | 3 | 12 | 59.2 | 1.8 | 0 | 9 | 15 | 0 | 900 | 12.2% | 25.2% | 50 |
| M517 | 4 | 16 | 54 | 1.8 | 0 | 9.2 | 15 | 0 | 850 | 10.5% | 22.6% | 50 |
| M518 | 3 | 12 | 58.6 | 1.8 | 0 | 9.6 | 15 | 0 | 850 | 12.2% | 25.2% | 50 |
| M519 | 4 | 16 | 53.4 | 1.8 | 0 | 9.8 | 15 | 0 | 850 | 10.5% | 22.6% | 100 |
| M520 | 3 | 12 | 58 | 1.8 | 0 | 10.2 | 15 | 0 | 850 | 12.2% | 25.2% | 50 |
| M521 | 4 | 16 | 52.8 | 1.8 | 0 | 10.4 | 15 | 0 | 850 | 10.5% | 22.7% | 100 |
| M522 | 3 | 12 | 57.4 | 1.8 | 0 | 10.8 | 15 | 0 | 850 | 12.2% | 25.2% | 50 |
| M523 | 4 | 16 | 52.2 | 1.8 | 0 | 11 | 15 | 0 | 850 | 10.4% | 22.7% | 100 |
| M524 | 3 | 12 | 56.8 | 1.8 | 0 | 11.4 | 15 | 0 | 850 | 12.2% | 25.3% | 50 |
| M525 | 4 | 16 | 51.6 | 1.8 | 0 | 11.6 | 15 | 0 | 800 | 10.4% | 22.8% | 100 |
| M526 | 3 | 12 | 56.2 | 1.8 | 0 | 12 | 15 | 0 | 850 | 12.1% | 25.3% | 50 |
| M527 | 4 | 16 | 51 | 1.8 | 0 | 12.2 | 15 | 0 | 800 | 10.4% | 22.8% | 100 |
| M528 | 3 | 12 | 55.6 | 1.8 | 0 | 12.6 | 15 | 0 | 850 | 12.2% | 25.3% | 50 |
| M529 | 4 | 16 | 50.4 | 1.8 | 0 | 12.8 | 15 | 0 | 800 | 10.4% | 22.9% | 100 |
| M530 | 3 | 12 | 55 | 1.8 | 0 | 13.2 | 15 | 0 | 850 | 12.2% | 25.4% | 50 |
| M531 | 4 | 16 | 49.8 | 1.8 | 0 | 13.4 | 15 | 0 | 800 | 10.3% | 23.0% | 100 |
| M532 | 3 | 12 | 54.4 | 1.8 | 0 | 13.8 | 15 | 0 | 800 | 12.2% | 25.4% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M533 | 4 | 16 | 49.2 | 1.8 | 0 | 14 | 15 | 0 | 800 | 10.3% | 23.0% | 100 |
| M534 | 4 | 16 | 61.2 | 2 | 0 | 1.8 | 15 | 0 | 950 | 10.8% | 22.1% | 0 |
| M535 | 4 | 16 | 60.6 | 2 | 0 | 2.4 | 15 | 0 | 950 | 10.8% | 22.1% | 0 |
| M536 | 3 | 12 | 65 | 2 | 0 | 3 | 15 | 0 | 950 | 12.5% | 25.0% | 0 |
| M537 | 4 | 16 | 59.8 | 2 | 0 | 3.2 | 15 | 0 | 950 | 10.7% | 22.1% | 0 |
| M538 | 3 | 12 | 64.4 | 2 | 0 | 3.6 | 15 | 0 | 950 | 12.5% | 25.0% | 0 |
| M539 | 4 | 16 | 59.2 | 2 | 0 | 3.8 | 15 | 0 | 900 | 10.6% | 22.2% | 50 |
| M540 | 3 | 12 | 63.8 | 2 | 0 | 4.2 | 15 | 0 | 950 | 12.5% | 25.0% | 0 |
| M541 | 4 | 16 | 58.6 | 2 | 0 | 4.4 | 15 | 0 | 900 | 10.6% | 22.2% | 50 |
| M542 | 3 | 12 | 63.2 | 2 | 0 | 4.8 | 15 | 0 | 950 | 12.4% | 25.0% | 0 |
| M543 | 4 | 16 | 58 | 2 | 0 | 5 | 15 | 0 | 900 | 10.6% | 22.3% | 50 |
| M544 | 3 | 12 | 62.6 | 2 | 0 | 5.4 | 15 | 0 | 900 | 12.4% | 25.0% | 0 |
| M545 | 4 | 16 | 57.4 | 2 | 0 | 5.6 | 15 | 0 | 900 | 10.5% | 22.3% | 50 |
| M546 | 3 | 12 | 62 | 2 | 0 | 6 | 15 | 0 | 900 | 12.4% | 25.1% | 0 |
| M547 | 4 | 16 | 56.8 | 2 | 0 | 6.2 | 15 | 0 | 900 | 10.5% | 22.4% | 50 |
| M548 | 3 | 12 | 61.4 | 2 | 0 | 6.6 | 15 | 0 | 900 | 12.3% | 25.1% | 0 |
| M549 | 4 | 16 | 56.2 | 2 | 0 | 6.8 | 15 | 0 | 900 | 10.4% | 22.4% | 50 |
| M550 | 3 | 12 | 60.8 | 2 | 0 | 7.2 | 15 | 0 | 900 | 12.3% | 25.1% | 0 |
| M551 | 4 | 16 | 55.6 | 2 | 0 | 7.4 | 15 | 0 | 850 | 10.4% | 22.4% | 50 |
| M552 | 3 | 12 | 60.2 | 2 | 0 | 7.8 | 15 | 0 | 900 | 12.3% | 25.1% | 50 |
| M553 | 4 | 16 | 55 | 2 | 0 | 8 | 15 | 0 | 850 | 10.4% | 22.5% | 50 |
| M554 | 3 | 12 | 59.6 | 2 | 0 | 8.4 | 15 | 0 | 900 | 12.3% | 25.1% | 50 |
| M555 | 4 | 16 | 54.4 | 2 | 0 | 8.6 | 15 | 0 | 850 | 10.6% | 22.5% | 50 |
| M556 | 3 | 12 | 59 | 2 | 0 | 9 | 15 | 0 | 850 | 12.2% | 25.2% | 50 |
| M557 | 4 | 16 | 53.8 | 2 | 0 | 9.2 | 15 | 0 | 850 | 10.5% | 22.6% | 50 |
| M558 | 3 | 12 | 58.4 | 2 | 0 | 9.6 | 15 | 0 | 850 | 12.2% | 25.2% | 50 |
| M559 | 4 | 16 | 53.2 | 2 | 0 | 9.8 | 15 | 0 | 850 | 10.5% | 22.6% | 100 |
| M560 | 3 | 12 | 57.8 | 2 | 0 | 10.2 | 15 | 0 | 850 | 12.2% | 25.2% | 50 |
| M561 | 4 | 16 | 52.6 | 2 | 0 | 10.4 | 15 | 0 | 850 | 10.5% | 22.7% | 100 |
| M562 | 3 | 12 | 57.2 | 2 | 0 | 10.8 | 15 | 0 | 850 | 12.2% | 25.2% | 50 |
| M563 | 4 | 16 | 52 | 2 | 0 | 11 | 15 | 0 | 850 | 10.4% | 22.7% | 100 |
| M564 | 3 | 12 | 56.6 | 2 | 0 | 11.4 | 15 | 0 | 850 | 12.2% | 25.3% | 50 |
| M565 | 4 | 16 | 51.4 | 2 | 0 | 11.6 | 15 | 0 | 800 | 10.4% | 22.8% | 100 |
| M566 | 3 | 12 | 56 | 2 | 0 | 12 | 15 | 0 | 850 | 12.1% | 25.3% | 50 |
| M567 | 4 | 16 | 50.8 | 2 | 0 | 12.2 | 15 | 0 | 800 | 10.4% | 22.8% | 100 |
| M568 | 3 | 12 | 55.4 | 2 | 0 | 12.6 | 15 | 0 | 850 | 12.1% | 25.3% | 50 |
| M569 | 4 | 16 | 50.2 | 2 | 0 | 12.8 | 15 | 0 | 800 | 10.4% | 22.9% | 100 |
| M570 | 3 | 12 | 54.8 | 2 | 0 | 13.2 | 15 | 0 | 850 | 12.2% | 25.3% | 50 |
| M571 | 4 | 16 | 49.6 | 2 | 0 | 13.4 | 15 | 0 | 800 | 10.3% | 22.9% | 100 |
| M572 | 3 | 12 | 54.2 | 2 | 0 | 13.8 | 15 | 0 | 800 | 12.2% | 25.4% | 100 |
| M573 | 4 | 16 | 49 | 2 | 0 | 14 | 15 | 0 | 800 | 10.3% | 23.0% | 100 |
| M574 | 4 | 16 | 61.2 | 2.2 | 0 | 1.6 | 15 | 0 | 950 | 10.8% | 22.0% | 0 |
| M575 | 4 | 16 | 60.6 | 2.2 | 0 | 2.2 | 15 | 0 | 950 | 10.8% | 22.1% | 0 |
| M576 | 3 | 12 | 65 | 2.2 | 0 | 2.8 | 15 | 0 | 950 | 12.5% | 25.0% | 0 |
| M577 | 4 | 16 | 59.8 | 2.2 | 0 | 3 | 15 | 0 | 950 | 10.7% | 22.1% | 0 |
| M578 | 3 | 12 | 64.4 | 2.2 | 0 | 3.4 | 15 | 0 | 950 | 12.5% | 25.0% | 0 |
| M579 | 4 | 16 | 59.2 | 2.2 | 0 | 3.6 | 15 | 0 | 900 | 10.7% | 22.2% | 50 |
| M580 | 3 | 12 | 63.8 | 2.2 | 0 | 4 | 15 | 0 | 950 | 12.5% | 25.0% | 0 |
| M581 | 4 | 16 | 58.6 | 2.2 | 0 | 4.2 | 15 | 0 | 900 | 10.6% | 22.2% | 50 |
| M582 | 3 | 12 | 63.2 | 2.2 | 0 | 4.6 | 15 | 0 | 950 | 12.4% | 25.0% | 0 |
| M583 | 4 | 16 | 58 | 2.2 | 0 | 4.8 | 15 | 0 | 900 | 10.6% | 22.2% | 50 |
| M584 | 3 | 12 | 62.6 | 2.2 | 0 | 5.2 | 15 | 0 | 900 | 12.4% | 25.0% | 0 |
| M585 | 4 | 16 | 57.4 | 2.2 | 0 | 5.4 | 15 | 0 | 900 | 10.5% | 22.3% | 50 |
| M586 | 3 | 12 | 62 | 2.2 | 0 | 5.8 | 15 | 0 | 900 | 12.4% | 25.1% | 0 |
| M587 | 4 | 16 | 56.8 | 2.2 | 0 | 6 | 15 | 0 | 900 | 10.5% | 22.3% | 50 |
| M588 | 3 | 12 | 61.4 | 2.2 | 0 | 6.4 | 15 | 0 | 900 | 12.3% | 25.1% | 0 |
| M589 | 4 | 16 | 56.2 | 2.2 | 0 | 6.6 | 15 | 0 | 900 | 10.4% | 22.4% | 50 |
| M590 | 3 | 12 | 60.8 | 2.2 | 0 | 7 | 15 | 0 | 900 | 12.3% | 25.1% | 0 |
| M591 | 4 | 16 | 55.6 | 2.2 | 0 | 7.2 | 15 | 0 | 850 | 10.4% | 22.4% | 50 |
| M592 | 3 | 12 | 60.2 | 2.2 | 0 | 7.6 | 15 | 0 | 900 | 12.3% | 25.1% | 50 |
| M593 | 4 | 16 | 55 | 2.2 | 0 | 7.8 | 15 | 0 | 850 | 10.4% | 22.5% | 50 |
| M594 | 3 | 12 | 59.6 | 2.2 | 0 | 8.2 | 15 | 0 | 900 | 12.3% | 25.1% | 50 |
| M595 | 4 | 16 | 54.4 | 2.2 | 0 | 8.4 | 15 | 0 | 850 | 10.3% | 22.5% | 50 |
| M596 | 3 | 12 | 59 | 2.2 | 0 | 8.8 | 15 | 0 | 850 | 12.2% | 25.2% | 50 |
| M597 | 4 | 16 | 53.8 | 2.2 | 0 | 9 | 15 | 0 | 850 | 10.5% | 22.6% | 50 |
| M598 | 3 | 12 | 58.4 | 2.2 | 0 | 9.4 | 15 | 0 | 850 | 12.2% | 25.2% | 50 |
| M599 | 4 | 16 | 53.2 | 2.2 | 0 | 9.6 | 15 | 0 | 850 | 10.5% | 22.6% | 100 |
| M600 | 3 | 12 | 57.8 | 2.2 | 0 | 10 | 15 | 0 | 850 | 12.2% | 25.2% | 50 |
| M601 | 4 | 16 | 52.6 | 2.2 | 0 | 10.2 | 15 | 0 | 850 | 10.5% | 22.6% | 100 |
| M602 | 3 | 12 | 57.2 | 2.2 | 0 | 10.6 | 15 | 0 | 850 | 12.2% | 25.2% | 50 |
| M603 | 4 | 16 | 52 | 2.2 | 0 | 10.8 | 15 | 0 | 850 | 10.4% | 22.7% | 100 |
| M604 | 3 | 12 | 56.6 | 2.2 | 0 | 11.2 | 15 | 0 | 850 | 12.2% | 25.2% | 50 |
| M605 | 4 | 16 | 51.4 | 2.2 | 0 | 11.4 | 15 | 0 | 800 | 10.4% | 22.8% | 100 |
| M606 | 3 | 12 | 56 | 2.2 | 0 | 11.8 | 15 | 0 | 850 | 12.1% | 25.3% | 50 |
| M607 | 4 | 16 | 50.8 | 2.2 | 0 | 12 | 15 | 0 | 800 | 10.4% | 22.8% | 100 |
| M608 | 3 | 12 | 55.4 | 2.2 | 0 | 12.4 | 15 | 0 | 850 | 12.1% | 25.3% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M609 | 4 | 16 | 50.2 | 2.2 | 0 | 12.6 | 15 | 0 | 800 | 10.3% | 22.9% | 100 |
| M610 | 3 | 12 | 54.8 | 2.2 | 0 | 13 | 15 | 0 | 850 | 12.2% | 25.3% | 50 |
| M611 | 4 | 16 | 49.6 | 2.2 | 0 | 13.2 | 15 | 0 | 800 | 10.3% | 22.9% | 100 |
| M612 | 3 | 12 | 54.2 | 2.2 | 0 | 13.6 | 15 | 0 | 800 | 12.1% | 25.3% | 100 |
| M613 | 4 | 16 | 49 | 2.2 | 0 | 13.8 | 15 | 0 | 800 | 10.3% | 23.0% | 100 |
| M614 | 4 | 16 | 61.6 | 2.4 | 0 | 1 | 15 | 0 | 950 | 10.9% | 22.0% | 0 |
| M615 | 4 | 16 | 61 | 2.4 | 0 | 1.6 | 15 | 0 | 950 | 10.8% | 22.0% | 0 |
| M616 | 4 | 16 | 60.4 | 2.4 | 0 | 2.2 | 15 | 0 | 950 | 10.8% | 22.1% | 0 |
| M617 | 4 | 16 | 60 | 2.4 | 0 | 2.6 | 15 | 0 | 950 | 10.8% | 22.1% | 0 |
| M618 | 3 | 12 | 64.6 | 2.4 | 0 | 3 | 15 | 0 | 950 | 12.5% | 25.0% | 0 |
| M619 | 4 | 16 | 59.4 | 2.4 | 0 | 3.2 | 15 | 0 | 950 | 10.7% | 22.1% | 0 |
| M620 | 3 | 12 | 64 | 2.4 | 0 | 3.6 | 15 | 0 | 950 | 12.5% | 25.0% | 0 |
| M621 | 4 | 16 | 58.8 | 2.4 | 0 | 3.8 | 15 | 0 | 900 | 10.6% | 22.2% | 50 |
| M622 | 3 | 12 | 63.4 | 2.4 | 0 | 4.2 | 15 | 0 | 950 | 12.5% | 25.0% | 0 |
| M623 | 4 | 16 | 58.2 | 2.4 | 0 | 4.4 | 15 | 0 | 900 | 10.6% | 22.2% | 50 |
| M624 | 3 | 12 | 62.8 | 2.4 | 0 | 4.8 | 15 | 0 | 950 | 12.4% | 25.0% | 0 |
| M625 | 4 | 16 | 57.6 | 2.4 | 0 | 5 | 15 | 0 | 900 | 10.6% | 22.3% | 50 |
| M626 | 3 | 12 | 62.2 | 2.4 | 0 | 5.4 | 15 | 0 | 900 | 12.4% | 25.0% | 0 |
| M627 | 4 | 16 | 57 | 2.4 | 0 | 5.6 | 15 | 0 | 900 | 10.5% | 22.3% | 50 |
| M628 | 3 | 12 | 61.6 | 2.4 | 0 | 6 | 15 | 0 | 900 | 12.4% | 25.1% | 0 |
| M629 | 4 | 16 | 56.4 | 2.4 | 0 | 6.2 | 15 | 0 | 900 | 10.5% | 22.3% | 50 |
| M630 | 3 | 12 | 61 | 2.4 | 0 | 6.6 | 15 | 0 | 900 | 12.3% | 25.1% | 0 |
| M631 | 4 | 16 | 55.8 | 2.4 | 0 | 6.8 | 15 | 0 | 900 | 10.4% | 22.4% | 50 |
| M632 | 3 | 12 | 60.4 | 2.4 | 0 | 7.2 | 15 | 0 | 900 | 12.3% | 25.1% | 0 |
| M633 | 4 | 16 | 55.2 | 2.4 | 0 | 7.4 | 15 | 0 | 850 | 10.4% | 22.4% | 50 |
| M634 | 3 | 12 | 59.8 | 2.4 | 0 | 7.8 | 15 | 0 | 900 | 12.3% | 25.1% | 50 |
| M635 | 4 | 16 | 54.6 | 2.4 | 0 | 8 | 15 | 0 | 850 | 10.3% | 22.5% | 50 |
| M636 | 3 | 12 | 59.2 | 2.4 | 0 | 8.4 | 15 | 0 | 900 | 12.2% | 25.1% | 50 |
| M637 | 4 | 16 | 54 | 2.4 | 0 | 8.6 | 15 | 0 | 850 | 10.3% | 22.5% | 50 |
| M638 | 3 | 12 | 58.6 | 2.4 | 0 | 9 | 15 | 0 | 850 | 12.2% | 25.2% | 50 |
| M639 | 4 | 16 | 53.4 | 2.4 | 0 | 9.2 | 15 | 0 | 850 | 10.5% | 22.6% | 50 |
| M640 | 3 | 12 | 58 | 2.4 | 0 | 9.6 | 15 | 0 | 850 | 12.2% | 25.2% | 50 |
| M641 | 4 | 16 | 52.8 | 2.4 | 0 | 9.8 | 15 | 0 | 850 | 10.5% | 22.6% | 100 |
| M642 | 3 | 12 | 57.4 | 2.4 | 0 | 10.2 | 15 | 0 | 850 | 12.2% | 25.2% | 50 |
| M643 | 4 | 16 | 52.2 | 2.4 | 0 | 10.4 | 15 | 0 | 850 | 10.4% | 22.7% | 100 |
| M644 | 3 | 12 | 56.8 | 2.4 | 0 | 10.8 | 15 | 0 | 850 | 12.2% | 25.2% | 50 |
| M645 | 4 | 16 | 51.6 | 2.4 | 0 | 11 | 15 | 0 | 850 | 10.4% | 22.7% | 100 |
| M646 | 3 | 12 | 56.2 | 2.4 | 0 | 11.4 | 15 | 0 | 850 | 12.1% | 25.2% | 50 |
| M647 | 4 | 16 | 51 | 2.4 | 0 | 11.6 | 15 | 0 | 800 | 10.4% | 22.8% | 100 |
| M648 | 3 | 12 | 55.6 | 2.4 | 0 | 12 | 15 | 0 | 850 | 12.1% | 25.3% | 50 |
| M649 | 4 | 16 | 50.4 | 2.4 | 0 | 12.2 | 15 | 0 | 800 | 10.4% | 22.8% | 100 |
| M650 | 3 | 12 | 55 | 2.4 | 0 | 12.6 | 15 | 0 | 850 | 12.1% | 25.3% | 50 |
| M651 | 4 | 16 | 49.8 | 2.4 | 0 | 12.8 | 15 | 0 | 800 | 10.3% | 22.9% | 100 |
| M652 | 3 | 12 | 54.4 | 2.4 | 0 | 13.2 | 15 | 0 | 850 | 12.2% | 25.3% | 100 |
| M653 | 4 | 16 | 49.2 | 2.4 | 0 | 13.4 | 15 | 0 | 800 | 10.3% | 22.9% | 100 |
| M654 | 3 | 12 | 53.8 | 2.4 | 0 | 13.8 | 15 | 0 | 800 | 12.1% | 25.3% | 100 |
| M655 | 4 | 16 | 48.6 | 2.4 | 0 | 14 | 15 | 0 | 800 | 10.3% | 23.0% | 100 |
| M656 | 4 | 16 | 61.2 | 2.6 | 0 | 1.2 | 15 | 0 | 950 | 10.9% | 22.0% | 0 |
| M657 | 4 | 16 | 60.6 | 2.6 | 0 | 1.8 | 15 | 0 | 950 | 10.8% | 22.0% | 0 |
| M658 | 3 | 12 | 65 | 2.6 | 0 | 2.4 | 15 | 0 | 950 | 12.6% | 25.0% | 0 |
| M659 | 4 | 16 | 59.8 | 2.6 | 0 | 2.6 | 15 | 0 | 950 | 10.8% | 22.1% | 0 |
| M660 | 3 | 12 | 64.4 | 2.6 | 0 | 3 | 15 | 0 | 950 | 12.5% | 25.0% | 0 |
| M661 | 4 | 16 | 59.2 | 2.6 | 0 | 3.2 | 15 | 0 | 900 | 10.7% | 22.1% | 50 |
| M662 | 3 | 12 | 63.8 | 2.6 | 0 | 3.6 | 15 | 0 | 950 | 12.5% | 25.0% | 0 |
| M663 | 4 | 16 | 58.6 | 2.6 | 0 | 3.8 | 15 | 0 | 900 | 10.7% | 22.2% | 50 |
| M664 | 3 | 12 | 63.2 | 2.6 | 0 | 4.2 | 15 | 0 | 950 | 12.5% | 25.0% | 0 |
| M665 | 4 | 16 | 58 | 2.6 | 0 | 4.4 | 15 | 0 | 900 | 10.6% | 22.2% | 50 |
| M666 | 3 | 12 | 62.6 | 2.6 | 0 | 4.8 | 15 | 0 | 900 | 12.4% | 25.0% | 0 |
| M667 | 4 | 16 | 57.4 | 2.6 | 0 | 5 | 15 | 0 | 900 | 10.6% | 22.2% | 50 |
| M668 | 3 | 12 | 62 | 2.6 | 0 | 5.4 | 15 | 0 | 900 | 12.4% | 25.0% | 0 |
| M669 | 4 | 16 | 56.8 | 2.6 | 0 | 5.6 | 15 | 0 | 900 | 10.5% | 22.3% | 50 |
| M670 | 3 | 12 | 61.4 | 2.6 | 0 | 6 | 15 | 0 | 900 | 12.4% | 25.1% | 0 |
| M671 | 4 | 16 | 56.2 | 2.6 | 0 | 6.2 | 15 | 0 | 900 | 10.5% | 22.3% | 50 |
| M672 | 3 | 12 | 60.8 | 2.6 | 0 | 6.6 | 15 | 0 | 900 | 12.3% | 25.1% | 0 |
| M673 | 4 | 16 | 55.6 | 2.6 | 0 | 6.8 | 15 | 0 | 850 | 10.4% | 22.4% | 50 |
| M674 | 3 | 12 | 60.2 | 2.6 | 0 | 7.2 | 15 | 0 | 900 | 12.3% | 25.1% | 0 |
| M675 | 4 | 16 | 55 | 2.6 | 0 | 7.4 | 15 | 0 | 850 | 10.4% | 22.4% | 50 |
| M676 | 3 | 12 | 59.6 | 2.6 | 0 | 7.8 | 15 | 0 | 900 | 12.3% | 25.1% | 50 |
| M677 | 4 | 16 | 54.4 | 2.6 | 0 | 8 | 15 | 0 | 850 | 10.3% | 22.5% | 50 |
| M678 | 3 | 12 | 59 | 2.6 | 0 | 8.4 | 15 | 0 | 850 | 12.2% | 25.1% | 50 |
| M679 | 4 | 16 | 53.8 | 2.6 | 0 | 8.6 | 15 | 0 | 850 | 10.3% | 22.5% | 50 |
| M680 | 3 | 12 | 58.4 | 2.6 | 0 | 9 | 15 | 0 | 850 | 12.2% | 25.1% | 50 |
| M681 | 4 | 16 | 53.2 | 2.6 | 0 | 9.2 | 15 | 0 | 850 | 10.3% | 22.5% | 100 |
| M682 | 3 | 12 | 57.8 | 2.6 | 0 | 9.6 | 15 | 0 | 850 | 12.2% | 25.2% | 50 |
| M683 | 4 | 16 | 52.6 | 2.6 | 0 | 9.8 | 15 | 0 | 850 | 10.5% | 22.6% | 100 |
| M684 | 3 | 12 | 57.2 | 2.6 | 0 | 10.2 | 15 | 0 | 850 | 12.2% | 25.2% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M685 | 4 | 16 | 52 | 2.6 | 0 | 10.4 | 15 | 0 | 850 | 10.4% | 22.6% | 100 |
| M686 | 3 | 12 | 56.6 | 2.6 | 0 | 10.8 | 15 | 0 | 850 | 12.2% | 25.2% | 50 |
| M687 | 4 | 16 | 51.4 | 2.6 | 0 | 11 | 15 | 0 | 850 | 10.4% | 22.7% | 100 |
| M688 | 3 | 12 | 56 | 2.6 | 0 | 11.4 | 15 | 0 | 850 | 12.1% | 25.2% | 50 |
| M689 | 4 | 16 | 50.8 | 2.6 | 0 | 11.6 | 15 | 0 | 800 | 10.4% | 22.7% | 100 |
| M690 | 3 | 12 | 55.4 | 2.6 | 0 | 12 | 15 | 0 | 850 | 12.1% | 25.3% | 50 |
| M691 | 4 | 16 | 50.2 | 2.6 | 0 | 12.2 | 15 | 0 | 800 | 10.3% | 22.8% | 100 |
| M692 | 3 | 12 | 54.8 | 2.6 | 0 | 12.6 | 15 | 0 | 850 | 12.1% | 25.3% | 50 |
| M693 | 4 | 16 | 49.6 | 2.6 | 0 | 12.8 | 15 | 0 | 800 | 10.3% | 22.8% | 100 |
| M694 | 3 | 12 | 54.2 | 2.6 | 0 | 13.2 | 15 | 0 | 800 | 12.1% | 25.3% | 100 |
| M695 | 4 | 16 | 49 | 2.6 | 0 | 13.4 | 15 | 0 | 800 | 10.3% | 22.9% | 100 |
| M696 | 3 | 12 | 53.6 | 2.6 | 0 | 13.8 | 15 | 0 | 800 | 12.1% | 25.3% | 100 |
| M697 | 4 | 16 | 48.4 | 2.6 | 0 | 14 | 15 | 0 | 800 | 10.3% | 23.0% | 100 |
| M698 | 4 | 16 | 61.2 | 2.8 | 0 | 1 | 15 | 0 | 950 | 10.9% | 22.0% | 50 |
| M699 | 4 | 16 | 60.6 | 2.8 | 0 | 1.6 | 15 | 0 | 950 | 10.9% | 22.0% | 0 |
| M700 | 3 | 12 | 65 | 2.8 | 0 | 2.2 | 15 | 0 | 950 | 12.6% | 25.1% | 0 |
| M701 | 4 | 16 | 59.8 | 2.8 | 0 | 2.4 | 15 | 0 | 950 | 10.8% | 22.1% | 0 |
| M702 | 3 | 12 | 64.4 | 2.8 | 0 | 2.8 | 15 | 0 | 950 | 12.6% | 25.0% | 0 |
| M703 | 4 | 16 | 59.2 | 2.8 | 0 | 3 | 15 | 0 | 900 | 10.7% | 22.1% | 0 |
| M704 | 3 | 12 | 63.8 | 2.8 | 0 | 3.4 | 15 | 0 | 950 | 12.5% | 25.0% | 0 |
| M705 | 4 | 16 | 58.6 | 2.8 | 0 | 3.6 | 15 | 0 | 900 | 10.7% | 22.1% | 50 |
| M706 | 3 | 12 | 63.2 | 2.8 | 0 | 4 | 15 | 0 | 950 | 12.5% | 25.0% | 0 |
| M707 | 4 | 16 | 58 | 2.8 | 0 | 4.2 | 15 | 0 | 900 | 10.6% | 22.2% | 50 |
| M708 | 3 | 12 | 62.6 | 2.8 | 0 | 4.6 | 15 | 0 | 900 | 12.4% | 25.0% | 0 |
| M709 | 4 | 16 | 57.4 | 2.8 | 0 | 4.8 | 15 | 0 | 900 | 10.6% | 22.2% | 50 |
| M710 | 3 | 12 | 62 | 2.8 | 0 | 5.2 | 15 | 0 | 900 | 12.4% | 25.0% | 0 |
| M711 | 4 | 16 | 56.8 | 2.8 | 0 | 5.4 | 15 | 0 | 900 | 10.5% | 22.3% | 50 |
| M712 | 3 | 12 | 61.4 | 2.8 | 0 | 5.8 | 15 | 0 | 900 | 12.4% | 25.0% | 0 |
| M713 | 4 | 16 | 56.2 | 2.8 | 0 | 6 | 15 | 0 | 900 | 10.5% | 22.3% | 50 |
| M714 | 3 | 12 | 60.8 | 2.8 | 0 | 6.4 | 15 | 0 | 900 | 12.3% | 25.1% | 0 |
| M715 | 4 | 16 | 55.6 | 2.8 | 0 | 6.6 | 15 | 0 | 850 | 10.4% | 22.3% | 50 |
| M716 | 3 | 12 | 60.2 | 2.8 | 0 | 7 | 15 | 0 | 900 | 12.3% | 25.1% | 0 |
| M717 | 4 | 16 | 55 | 2.8 | 0 | 7.2 | 15 | 0 | 850 | 10.4% | 22.4% | 50 |
| M718 | 3 | 12 | 59.6 | 2.8 | 0 | 7.6 | 15 | 0 | 900 | 12.3% | 25.1% | 50 |
| M719 | 4 | 16 | 54.4 | 2.8 | 0 | 7.8 | 15 | 0 | 850 | 10.3% | 22.4% | 50 |
| M720 | 3 | 12 | 59 | 2.8 | 0 | 8.2 | 15 | 0 | 850 | 12.3% | 25.1% | 50 |
| M721 | 4 | 16 | 53.8 | 2.8 | 0 | 8.4 | 15 | 0 | 850 | 10.3% | 22.5% | 50 |
| M722 | 3 | 12 | 58.4 | 2.8 | 0 | 8.8 | 15 | 0 | 850 | 12.2% | 25.1% | 50 |
| M723 | 4 | 16 | 53.2 | 2.8 | 0 | 9 | 15 | 0 | 850 | 10.3% | 22.5% | 50 |
| M724 | 3 | 12 | 57.8 | 2.8 | 0 | 9.4 | 15 | 0 | 850 | 12.2% | 25.2% | 50 |
| M725 | 4 | 16 | 52.6 | 2.8 | 0 | 9.6 | 15 | 0 | 850 | 10.5% | 22.6% | 100 |
| M726 | 3 | 12 | 57.2 | 2.8 | 0 | 10 | 15 | 0 | 850 | 12.2% | 25.2% | 50 |
| M727 | 4 | 16 | 52 | 2.8 | 0 | 10.2 | 15 | 0 | 850 | 10.4% | 22.6% | 100 |
| M728 | 3 | 12 | 56.6 | 2.8 | 0 | 10.6 | 15 | 0 | 850 | 12.2% | 25.2% | 50 |
| M729 | 4 | 16 | 51.4 | 2.8 | 0 | 10.8 | 15 | 0 | 850 | 10.4% | 22.7% | 100 |
| M730 | 3 | 12 | 56 | 2.8 | 0 | 11.2 | 15 | 0 | 850 | 12.1% | 25.2% | 50 |
| M731 | 4 | 16 | 50.8 | 2.8 | 0 | 11.4 | 15 | 0 | 800 | 10.4% | 22.7% | 100 |
| M732 | 3 | 12 | 55.4 | 2.8 | 0 | 11.8 | 15 | 0 | 850 | 12.1% | 25.2% | 50 |
| M733 | 4 | 16 | 50.2 | 2.8 | 0 | 12 | 15 | 0 | 800 | 10.3% | 22.8% | 100 |
| M734 | 3 | 12 | 54.8 | 2.8 | 0 | 12.4 | 15 | 0 | 850 | 12.1% | 25.3% | 50 |
| M735 | 4 | 16 | 49.6 | 2.8 | 0 | 12.6 | 15 | 0 | 800 | 10.3% | 22.8% | 100 |
| M736 | 3 | 12 | 54.2 | 2.8 | 0 | 13 | 15 | 0 | 850 | 12.1% | 25.3% | 50 |
| M737 | 4 | 16 | 49 | 2.8 | 0 | 13.2 | 15 | 0 | 800 | 10.3% | 22.9% | 100 |
| M738 | 3 | 12 | 53.6 | 2.8 | 0 | 13.6 | 15 | 0 | 800 | 12.1% | 25.3% | 100 |
| M739 | 4 | 16 | 48.4 | 2.8 | 0 | 13.8 | 15 | 0 | 800 | 10.3% | 22.9% | 100 |
| M740 | 4 | 16 | 61.6 | 3 | 0 | 0.4 | 15 | 0 | 950 | 11.0% | 21.9% | 50 |
| M741 | 4 | 16 | 61 | 3 | 0 | 1 | 15 | 0 | 950 | 10.9% | 22.0% | 50 |
| M742 | 4 | 16 | 60.4 | 3 | 0 | 1.6 | 15 | 0 | 950 | 10.9% | 22.0% | 50 |
| M743 | 4 | 16 | 60 | 3 | 0 | 2 | 15 | 0 | 950 | 10.8% | 22.0% | 0 |
| M744 | 3 | 12 | 64.6 | 3 | 0 | 2.4 | 15 | 0 | 950 | 12.6% | 25.1% | 0 |
| M745 | 4 | 16 | 59.4 | 3 | 0 | 2.6 | 15 | 0 | 950 | 10.8% | 22.1% | 0 |
| M746 | 3 | 12 | 64 | 3 | 0 | 3 | 15 | 0 | 950 | 12.5% | 25.0% | 0 |
| M747 | 4 | 16 | 58.8 | 3 | 0 | 3.2 | 15 | 0 | 900 | 10.7% | 22.1% | 50 |
| M748 | 3 | 12 | 63.4 | 3 | 0 | 3.6 | 15 | 0 | 950 | 12.5% | 25.0% | 0 |
| M749 | 4 | 16 | 58.2 | 3 | 0 | 3.8 | 15 | 0 | 900 | 10.7% | 22.2% | 50 |
| M750 | 3 | 12 | 62.8 | 3 | 0 | 4.2 | 15 | 0 | 900 | 12.5% | 25.0% | 0 |
| M751 | 4 | 16 | 57.6 | 3 | 0 | 4.4 | 15 | 0 | 900 | 10.6% | 22.2% | 50 |
| M752 | 3 | 12 | 62.2 | 3 | 0 | 4.8 | 15 | 0 | 900 | 12.4% | 25.0% | 0 |
| M753 | 4 | 16 | 57 | 3 | 0 | 5 | 15 | 0 | 900 | 10.6% | 22.2% | 50 |
| M754 | 3 | 12 | 61.6 | 3 | 0 | 5.4 | 15 | 0 | 900 | 12.4% | 25.0% | 0 |
| M755 | 4 | 16 | 56.4 | 3 | 0 | 5.6 | 15 | 0 | 900 | 10.5% | 22.3% | 50 |
| M756 | 3 | 12 | 61 | 3 | 0 | 6 | 15 | 0 | 900 | 12.4% | 25.0% | 0 |
| M757 | 4 | 16 | 55.8 | 3 | 0 | 6.2 | 15 | 0 | 900 | 10.5% | 22.3% | 50 |
| M758 | 3 | 12 | 60.4 | 3 | 0 | 6.6 | 15 | 0 | 900 | 12.3% | 25.1% | 0 |
| M759 | 4 | 16 | 55.2 | 3 | 0 | 6.8 | 15 | 0 | 850 | 10.4% | 22.4% | 50 |
| M760 | 3 | 12 | 59.8 | 3 | 0 | 7.2 | 15 | 0 | 900 | 12.3% | 25.1% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M761 | 4 | 16 | 54.6 | 3 | 0 | 7.4 | 15 | 0 | 850 | 10.4% | 22.4% | 50 |
| M762 | 3 | 12 | 59.2 | 3 | 0 | 7.8 | 15 | 0 | 900 | 12.3% | 25.1% | 50 |
| M763 | 4 | 16 | 54 | 3 | 0 | 8 | 15 | 0 | 850 | 10.3% | 22.4% | 50 |
| M764 | 3 | 12 | 58.6 | 3 | 0 | 8.4 | 15 | 0 | 850 | 12.2% | 25.1% | 50 |
| M765 | 4 | 16 | 53.4 | 3 | 0 | 8.6 | 15 | 0 | 850 | 10.3% | 22.5% | 50 |
| M766 | 3 | 12 | 58 | 3 | 0 | 9 | 15 | 0 | 850 | 12.2% | 25.1% | 50 |
| M767 | 4 | 16 | 52.8 | 3 | 0 | 9.2 | 15 | 0 | 850 | 10.3% | 22.5% | 100 |
| M768 | 3 | 12 | 57.4 | 3 | 0 | 9.6 | 15 | 0 | 850 | 12.2% | 25.2% | 50 |
| M769 | 4 | 16 | 52.2 | 3 | 0 | 9.8 | 15 | 0 | 850 | 10.5% | 22.6% | 100 |
| M770 | 3 | 12 | 56.8 | 3 | 0 | 10.2 | 15 | 0 | 850 | 12.2% | 25.2% | 50 |
| M771 | 4 | 16 | 51.6 | 3 | 0 | 10.4 | 15 | 0 | 850 | 10.4% | 22.6% | 100 |
| M772 | 3 | 12 | 56.2 | 3 | 0 | 10.8 | 15 | 0 | 850 | 12.1% | 25.2% | 50 |
| M773 | 4 | 16 | 51 | 3 | 0 | 11 | 15 | 0 | 850 | 10.4% | 22.7% | 100 |
| M774 | 3 | 12 | 55.6 | 3 | 0 | 11.4 | 15 | 0 | 850 | 12.1% | 25.2% | 50 |
| M775 | 4 | 16 | 50.4 | 3 | 0 | 11.6 | 15 | 0 | 800 | 10.4% | 22.7% | 100 |
| M776 | 3 | 12 | 55 | 3 | 0 | 12 | 15 | 0 | 850 | 12.1% | 25.2% | 50 |
| M777 | 4 | 16 | 49.8 | 3 | 0 | 12.2 | 15 | 0 | 800 | 10.3% | 22.8% | 100 |
| M778 | 3 | 12 | 54.4 | 3 | 0 | 12.6 | 15 | 0 | 850 | 12.1% | 25.3% | 50 |
| M779 | 4 | 16 | 49.2 | 3 | 0 | 12.8 | 15 | 0 | 800 | 10.3% | 22.8% | 100 |
| M780 | 3 | 12 | 53.8 | 3 | 0 | 13.2 | 15 | 0 | 800 | 12.1% | 25.3% | 100 |
| M781 | 4 | 16 | 48.6 | 3 | 0 | 13.4 | 15 | 0 | 800 | 10.3% | 22.9% | 100 |
| M782 | 3 | 12 | 53.2 | 3 | 0 | 13.8 | 15 | 0 | 800 | 12.1% | 25.3% | 100 |
| M783 | 4 | 16 | 48 | 3 | 0 | 14 | 15 | 0 | 800 | 10.2% | 22.9% | 100 |
| M784 | 4 | 16 | 61.2 | 3.2 | 0 | 0.6 | 15 | 0 | 950 | 11.0% | 22.0% | 50 |
| M785 | 4 | 16 | 60.6 | 3.2 | 0 | 1.2 | 15 | 0 | 950 | 10.9% | 22.0% | 50 |
| M786 | 4 | 16 | 60.2 | 3.2 | 0 | 1.6 | 15 | 0 | 950 | 10.9% | 22.0% | 50 |
| M787 | 3 | 12 | 64.8 | 3.2 | 0 | 2 | 15 | 0 | 950 | 12.6% | 25.2% | 0 |
| M788 | 4 | 16 | 59.6 | 3.2 | 0 | 2.2 | 15 | 0 | 950 | 10.8% | 22.1% | 50 |
| M789 | 3 | 12 | 64.2 | 3.2 | 0 | 2.6 | 15 | 0 | 950 | 12.6% | 25.1% | 0 |
| M790 | 4 | 16 | 59 | 3.2 | 0 | 2.8 | 15 | 0 | 900 | 10.7% | 22.1% | 0 |
| M791 | 3 | 12 | 63.6 | 3.2 | 0 | 3.2 | 15 | 0 | 950 | 12.5% | 25.0% | 0 |
| M792 | 4 | 16 | 58.4 | 3.2 | 0 | 3.4 | 15 | 0 | 900 | 10.7% | 22.1% | 50 |
| M793 | 3 | 12 | 63 | 3.2 | 0 | 3.8 | 15 | 0 | 950 | 12.5% | 25.0% | 0 |
| M794 | 4 | 16 | 57.8 | 3.2 | 0 | 4 | 15 | 0 | 900 | 10.6% | 22.2% | 50 |
| M795 | 3 | 12 | 62.4 | 3.2 | 0 | 4.4 | 15 | 0 | 900 | 12.5% | 25.0% | 0 |
| M796 | 4 | 16 | 57.2 | 3.2 | 0 | 4.6 | 15 | 0 | 900 | 10.6% | 22.2% | 50 |
| M797 | 3 | 12 | 61.8 | 3.2 | 0 | 5 | 15 | 0 | 900 | 12.4% | 25.0% | 0 |
| M798 | 4 | 16 | 56.6 | 3.2 | 0 | 5.2 | 15 | 0 | 900 | 10.5% | 22.2% | 50 |
| M799 | 3 | 12 | 61.2 | 3.2 | 0 | 5.6 | 15 | 0 | 900 | 12.4% | 25.0% | 0 |
| M800 | 4 | 16 | 56 | 3.2 | 0 | 5.8 | 15 | 0 | 900 | 10.5% | 22.3% | 50 |
| M801 | 3 | 12 | 60.6 | 3.2 | 0 | 6.2 | 15 | 0 | 900 | 12.3% | 25.0% | 0 |
| M802 | 4 | 16 | 55.4 | 3.2 | 0 | 6.4 | 15 | 0 | 850 | 10.4% | 22.3% | 50 |
| M803 | 3 | 12 | 60 | 3.2 | 0 | 6.8 | 15 | 0 | 900 | 12.3% | 25.1% | 0 |
| M804 | 4 | 16 | 54.8 | 3.2 | 0 | 7 | 15 | 0 | 850 | 10.4% | 22.4% | 50 |
| M805 | 3 | 12 | 59.4 | 3.2 | 0 | 7.4 | 15 | 0 | 900 | 12.3% | 25.1% | 50 |
| M806 | 4 | 16 | 54.2 | 3.2 | 0 | 7.6 | 15 | 0 | 850 | 10.4% | 22.4% | 50 |
| M807 | 3 | 12 | 58.8 | 3.2 | 0 | 8 | 15 | 0 | 850 | 12.3% | 25.1% | 50 |
| M808 | 4 | 16 | 53.6 | 3.2 | 0 | 8.2 | 15 | 0 | 850 | 10.3% | 22.4% | 50 |
| M809 | 3 | 12 | 58.2 | 3.2 | 0 | 8.6 | 15 | 0 | 850 | 12.2% | 25.1% | 50 |
| M810 | 4 | 16 | 53 | 3.2 | 0 | 8.8 | 15 | 0 | 850 | 10.3% | 22.5% | 50 |
| M811 | 3 | 12 | 57.6 | 3.2 | 0 | 9.2 | 15 | 0 | 850 | 12.2% | 25.1% | 50 |
| M812 | 4 | 16 | 52.4 | 3.2 | 0 | 9.4 | 15 | 0 | 850 | 10.2% | 22.5% | 100 |
| M813 | 3 | 12 | 57 | 3.2 | 0 | 9.8 | 15 | 0 | 850 | 12.2% | 25.2% | 50 |
| M814 | 4 | 16 | 51.8 | 3.2 | 0 | 10 | 15 | 0 | 850 | 10.4% | 22.6% | 100 |
| M815 | 3 | 12 | 56.4 | 3.2 | 0 | 10.4 | 15 | 0 | 850 | 12.1% | 25.2% | 50 |
| M816 | 4 | 16 | 51.2 | 3.2 | 0 | 10.6 | 15 | 0 | 850 | 10.4% | 22.6% | 100 |
| M817 | 3 | 12 | 55.8 | 3.2 | 0 | 11 | 15 | 0 | 850 | 12.1% | 25.2% | 50 |
| M818 | 4 | 16 | 50.6 | 3.2 | 0 | 11.2 | 15 | 0 | 800 | 10.4% | 22.7% | 100 |
| M819 | 3 | 12 | 55.2 | 3.2 | 0 | 11.6 | 15 | 0 | 850 | 12.1% | 25.2% | 50 |
| M820 | 4 | 16 | 50 | 3.2 | 0 | 11.8 | 15 | 0 | 800 | 10.3% | 22.7% | 100 |
| M821 | 3 | 12 | 54.6 | 3.2 | 0 | 12.2 | 15 | 0 | 850 | 12.1% | 25.2% | 50 |
| M822 | 4 | 16 | 49.4 | 3.2 | 0 | 12.4 | 15 | 0 | 800 | 10.3% | 22.8% | 100 |
| M823 | 3 | 12 | 54 | 3.2 | 0 | 12.8 | 15 | 0 | 850 | 12.1% | 25.3% | 50 |
| M824 | 4 | 16 | 48.8 | 3.2 | 0 | 13 | 15 | 0 | 800 | 10.3% | 22.8% | 100 |
| M825 | 3 | 12 | 53.4 | 3.2 | 0 | 13.4 | 15 | 0 | 800 | 12.1% | 25.3% | 100 |
| M826 | 4 | 16 | 48.2 | 3.2 | 0 | 13.6 | 15 | 0 | 800 | 10.2% | 22.9% | 100 |
| M827 | 3 | 12 | 52.8 | 3.2 | 0 | 14 | 15 | 0 | 800 | 12.1% | 25.3% | 100 |
| M828 | 4 | 16 | 61.4 | 3.4 | 0 | 0.2 | 15 | 0 | 950 | 11.0% | 21.9% | 50 |
| M829 | 4 | 16 | 60.8 | 3.4 | 0 | 0.8 | 15 | 0 | 950 | 11.0% | 22.0% | 50 |
| M830 | 3 | 12 | 65.2 | 3.4 | 0 | 1.4 | 15 | 0 | 950 | 12.7% | 25.1% | 0 |
| M831 | 4 | 16 | 60 | 3.4 | 0 | 1.6 | 15 | 0 | 950 | 10.9% | 22.0% | 50 |
| M832 | 3 | 12 | 64.6 | 3.4 | 0 | 2 | 15 | 0 | 950 | 12.6% | 25.2% | 0 |
| M833 | 4 | 16 | 59.4 | 3.4 | 0 | 2.2 | 15 | 0 | 950 | 10.8% | 22.0% | 50 |
| M834 | 3 | 12 | 64 | 3.4 | 0 | 2.6 | 15 | 0 | 950 | 12.6% | 25.1% | 0 |
| M835 | 4 | 16 | 58.8 | 3.4 | 0 | 2.8 | 15 | 0 | 900 | 10.8% | 22.1% | 50 |
| M836 | 3 | 12 | 63.4 | 3.4 | 0 | 3.2 | 15 | 0 | 950 | 12.5% | 25.0% | 0 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M837 | 4 | 16 | 58.2 | 3.4 | 0 | 3.4 | 15 | 0 | 900 | 10.7% | 22.1% | 50 |
| M838 | 3 | 12 | 62.8 | 3.4 | 0 | 3.8 | 15 | 0 | 900 | 12.5% | 25.0% | 0 |
| M839 | 4 | 16 | 57.6 | 3.4 | 0 | 4 | 15 | 0 | 900 | 10.6% | 22.2% | 50 |
| M840 | 3 | 12 | 62.2 | 3.4 | 0 | 4.4 | 15 | 0 | 900 | 12.5% | 25.0% | 0 |
| M841 | 4 | 16 | 57 | 3.4 | 0 | 4.6 | 15 | 0 | 900 | 10.6% | 22.2% | 50 |
| M842 | 3 | 12 | 61.6 | 3.4 | 0 | 5 | 15 | 0 | 900 | 12.4% | 25.0% | 0 |
| M843 | 4 | 16 | 56.4 | 3.4 | 0 | 5.2 | 15 | 0 | 900 | 10.5% | 22.2% | 50 |
| M844 | 3 | 12 | 61 | 3.4 | 0 | 5.6 | 15 | 0 | 900 | 12.4% | 25.0% | 0 |
| M845 | 4 | 16 | 55.8 | 3.4 | 0 | 5.8 | 15 | 0 | 900 | 10.5% | 22.3% | 50 |
| M846 | 3 | 12 | 60.4 | 3.4 | 0 | 6.2 | 15 | 0 | 900 | 12.3% | 25.0% | 0 |
| M847 | 4 | 16 | 55.2 | 3.4 | 0 | 6.4 | 15 | 0 | 850 | 10.4% | 22.3% | 50 |
| M848 | 3 | 12 | 59.8 | 3.4 | 0 | 6.8 | 15 | 0 | 900 | 12.3% | 25.1% | 0 |
| M849 | 4 | 16 | 54.6 | 3.4 | 0 | 7 | 15 | 0 | 850 | 10.4% | 22.4% | 50 |
| M850 | 3 | 12 | 59.2 | 3.4 | 0 | 7.4 | 15 | 0 | 900 | 12.3% | 25.1% | 50 |
| M851 | 4 | 16 | 54 | 3.4 | 0 | 7.6 | 15 | 0 | 850 | 10.3% | 22.4% | 50 |
| M852 | 3 | 12 | 58.6 | 3.4 | 0 | 8 | 15 | 0 | 850 | 12.2% | 25.1% | 50 |
| M853 | 4 | 16 | 53.4 | 3.4 | 0 | 8.2 | 15 | 0 | 850 | 10.3% | 22.4% | 50 |
| M854 | 3 | 12 | 58 | 3.4 | 0 | 8.6 | 15 | 0 | 850 | 12.2% | 25.1% | 50 |
| M855 | 4 | 16 | 52.8 | 3.4 | 0 | 8.8 | 15 | 0 | 850 | 10.3% | 22.5% | 100 |
| M856 | 3 | 12 | 57.4 | 3.4 | 0 | 9.2 | 15 | 0 | 850 | 12.2% | 25.1% | 50 |
| M857 | 4 | 16 | 52.2 | 3.4 | 0 | 9.4 | 15 | 0 | 850 | 10.2% | 22.5% | 100 |
| M858 | 3 | 12 | 56.8 | 3.4 | 0 | 9.8 | 15 | 0 | 850 | 12.2% | 25.1% | 50 |
| M859 | 4 | 16 | 51.6 | 3.4 | 0 | 10 | 15 | 0 | 850 | 10.2% | 22.6% | 100 |
| M860 | 3 | 12 | 56.2 | 3.4 | 0 | 10.4 | 15 | 0 | 850 | 12.1% | 25.2% | 50 |
| M861 | 4 | 16 | 51 | 3.4 | 0 | 10.6 | 15 | 0 | 850 | 10.4% | 22.6% | 100 |
| M862 | 3 | 12 | 55.6 | 3.4 | 0 | 11 | 15 | 0 | 850 | 12.1% | 25.2% | 50 |
| M863 | 4 | 16 | 50.4 | 3.4 | 0 | 11.2 | 15 | 0 | 800 | 10.4% | 22.7% | 100 |
| M864 | 3 | 12 | 55 | 3.4 | 0 | 11.6 | 15 | 0 | 850 | 12.1% | 25.2% | 50 |
| M865 | 4 | 16 | 49.8 | 3.4 | 0 | 11.8 | 15 | 0 | 800 | 10.3% | 22.7% | 100 |
| M866 | 3 | 12 | 54.4 | 3.4 | 0 | 12.2 | 15 | 0 | 850 | 12.1% | 25.2% | 50 |
| M867 | 4 | 16 | 49.2 | 3.4 | 0 | 12.4 | 15 | 0 | 800 | 10.3% | 22.8% | 100 |
| M868 | 3 | 12 | 53.8 | 3.4 | 0 | 12.8 | 15 | 0 | 800 | 12.1% | 25.3% | 100 |
| M869 | 4 | 16 | 48.6 | 3.4 | 0 | 13 | 15 | 0 | 800 | 10.3% | 22.8% | 100 |
| M870 | 3 | 12 | 53.2 | 3.4 | 0 | 13.4 | 15 | 0 | 800 | 12.0% | 25.3% | 100 |
| M871 | 4 | 16 | 48 | 3.4 | 0 | 13.6 | 15 | 0 | 800 | 10.2% | 22.9% | 100 |
| M872 | 3 | 12 | 52.6 | 3.4 | 0 | 14 | 15 | 0 | 800 | 12.1% | 25.3% | 100 |
| M873 | 4 | 16 | 61.2 | 3.6 | 0 | 0.2 | 15 | 0 | 950 | 11.0% | 21.9% | 50 |
| M874 | 4 | 16 | 60.6 | 3.6 | 0 | 0.8 | 15 | 0 | 950 | 11.0% | 22.0% | 50 |
| M875 | 4 | 16 | 60.2 | 3.6 | 0 | 1.2 | 15 | 0 | 950 | 10.9% | 22.0% | 50 |
| M876 | 3 | 12 | 64.8 | 3.6 | 0 | 1.6 | 15 | 0 | 950 | 12.7% | 25.1% | 0 |
| M877 | 4 | 16 | 59.6 | 3.6 | 0 | 1.8 | 15 | 0 | 950 | 10.9% | 22.0% | 50 |
| M878 | 3 | 12 | 64.2 | 3.6 | 0 | 2.2 | 15 | 0 | 950 | 12.6% | 25.2% | 0 |
| M879 | 4 | 16 | 59 | 3.6 | 0 | 2.4 | 15 | 0 | 900 | 10.8% | 22.1% | 50 |
| M880 | 3 | 12 | 63.6 | 3.6 | 0 | 2.8 | 15 | 0 | 950 | 12.6% | 25.1% | 0 |
| M881 | 4 | 16 | 58.4 | 3.6 | 0 | 3 | 15 | 0 | 900 | 10.7% | 22.1% | 100 |
| M882 | 3 | 12 | 63 | 3.6 | 0 | 3.4 | 15 | 0 | 900 | 12.5% | 25.0% | 0 |
| M883 | 4 | 16 | 57.8 | 3.6 | 0 | 3.6 | 15 | 0 | 900 | 10.7% | 22.1% | 50 |
| M884 | 3 | 12 | 62.4 | 3.6 | 0 | 4 | 15 | 0 | 900 | 12.5% | 25.0% | 0 |
| M885 | 4 | 16 | 57.2 | 3.6 | 0 | 4.2 | 15 | 0 | 900 | 10.6% | 22.2% | 50 |
| M886 | 3 | 12 | 61.8 | 3.6 | 0 | 4.6 | 15 | 0 | 900 | 12.4% | 25.0% | 0 |
| M887 | 4 | 16 | 56.6 | 3.6 | 0 | 4.8 | 15 | 0 | 900 | 10.6% | 22.2% | 50 |
| M888 | 3 | 12 | 61.2 | 3.6 | 0 | 5.2 | 15 | 0 | 900 | 12.4% | 25.0% | 0 |
| M889 | 4 | 16 | 56 | 3.6 | 0 | 5.4 | 15 | 0 | 900 | 10.5% | 22.2% | 50 |
| M890 | 3 | 12 | 60.6 | 3.6 | 0 | 5.8 | 15 | 0 | 900 | 12.4% | 25.0% | 0 |
| M891 | 4 | 16 | 55.4 | 3.6 | 0 | 6 | 15 | 0 | 850 | 10.5% | 22.3% | 50 |
| M892 | 3 | 12 | 60 | 3.6 | 0 | 6.4 | 15 | 0 | 900 | 12.3% | 25.0% | 0 |
| M893 | 4 | 16 | 54.8 | 3.6 | 0 | 6.6 | 15 | 0 | 850 | 10.4% | 22.3% | 50 |
| M894 | 3 | 12 | 59.4 | 3.6 | 0 | 7 | 15 | 0 | 900 | 12.3% | 25.1% | 50 |
| M895 | 4 | 16 | 54.2 | 3.6 | 0 | 7.2 | 15 | 0 | 850 | 10.4% | 22.4% | 50 |
| M896 | 3 | 12 | 58.8 | 3.6 | 0 | 7.6 | 15 | 0 | 850 | 12.3% | 25.1% | 50 |
| M897 | 4 | 16 | 53.6 | 3.6 | 0 | 7.8 | 15 | 0 | 850 | 10.3% | 22.4% | 50 |
| M898 | 3 | 12 | 58.2 | 3.6 | 0 | 8.2 | 15 | 0 | 850 | 12.2% | 25.1% | 50 |
| M899 | 4 | 16 | 53 | 3.6 | 0 | 8.4 | 15 | 0 | 850 | 10.3% | 22.4% | 50 |
| M900 | 3 | 12 | 57.6 | 3.6 | 0 | 8.8 | 15 | 0 | 850 | 12.2% | 25.1% | 50 |
| M901 | 4 | 16 | 52.4 | 3.6 | 0 | 9 | 15 | 0 | 850 | 10.2% | 22.5% | 100 |
| M902 | 3 | 12 | 57 | 3.6 | 0 | 9.4 | 15 | 0 | 850 | 12.2% | 25.1% | 50 |
| M903 | 4 | 16 | 51.8 | 3.6 | 0 | 9.6 | 15 | 0 | 850 | 10.2% | 22.5% | 100 |
| M904 | 3 | 12 | 56.4 | 3.6 | 0 | 10 | 15 | 0 | 850 | 12.2% | 25.1% | 50 |
| M905 | 4 | 16 | 51.2 | 3.6 | 0 | 10.2 | 15 | 0 | 850 | 10.2% | 22.6% | 100 |
| M906 | 3 | 12 | 55.8 | 3.6 | 0 | 10.6 | 15 | 0 | 850 | 12.1% | 25.2% | 50 |
| M907 | 4 | 16 | 50.6 | 3.6 | 0 | 10.8 | 15 | 0 | 800 | 10.4% | 22.6% | 100 |
| M908 | 3 | 12 | 55.2 | 3.6 | 0 | 11.2 | 15 | 0 | 850 | 12.1% | 25.2% | 50 |
| M909 | 4 | 16 | 50 | 3.6 | 0 | 11.4 | 15 | 0 | 800 | 10.3% | 22.7% | 100 |
| M910 | 3 | 12 | 54.6 | 3.6 | 0 | 11.8 | 15 | 0 | 850 | 12.1% | 25.2% | 50 |
| M911 | 4 | 16 | 49.4 | 3.6 | 0 | 12 | 15 | 0 | 800 | 10.3% | 22.7% | 100 |
| M912 | 3 | 12 | 54 | 3.6 | 0 | 12.4 | 15 | 0 | 850 | 12.1% | 25.2% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M913 | 4 | 16 | 48.8 | 3.6 | 0 | 12.6 | 15 | 0 | 800 | 10.3% | 22.8% | 100 |
| M914 | 3 | 12 | 53.4 | 3.6 | 0 | 13 | 15 | 0 | 800 | 12.0% | 25.3% | 100 |
| M915 | 4 | 16 | 48.2 | 3.6 | 0 | 13.2 | 15 | 0 | 800 | 10.2% | 22.8% | 100 |
| M916 | 3 | 12 | 52.8 | 3.6 | 0 | 13.6 | 15 | 0 | 800 | 12.0% | 25.3% | 100 |
| M917 | 4 | 16 | 47.6 | 3.6 | 0 | 13.8 | 15 | 0 | 800 | 10.2% | 22.9% | 100 |
| M918 | 4 | 16 | 61.2 | 3.8 | 0 | 0 | 15 | 0 | 950 | 11.1% | 21.9% | 50 |
| M919 | 4 | 16 | 60.6 | 3.8 | 0 | 0.6 | 15 | 0 | 950 | 11.0% | 21.9% | 50 |
| M920 | 4 | 16 | 60.2 | 3.8 | 0 | 1 | 15 | 0 | 950 | 10.9% | 22.0% | 50 |
| M921 | 3 | 12 | 64.8 | 3.8 | 0 | 1.4 | 15 | 0 | 950 | 12.7% | 25.1% | 0 |
| M922 | 4 | 16 | 59.6 | 3.8 | 0 | 1.6 | 15 | 0 | 950 | 10.9% | 22.0% | 50 |
| M923 | 3 | 12 | 64.2 | 3.8 | 0 | 2 | 15 | 0 | 950 | 12.6% | 25.2% | 0 |
| M924 | 4 | 16 | 59 | 3.8 | 0 | 2.2 | 15 | 0 | 900 | 10.8% | 22.0% | 50 |
| M925 | 3 | 12 | 63.6 | 3.8 | 0 | 2.6 | 15 | 0 | 950 | 12.6% | 25.1% | 0 |
| M926 | 4 | 16 | 58.4 | 3.8 | 0 | 2.8 | 15 | 0 | 900 | 10.8% | 22.1% | 100 |
| M927 | 3 | 12 | 63 | 3.8 | 0 | 3.2 | 15 | 0 | 900 | 12.5% | 25.1% | 0 |
| M928 | 4 | 16 | 57.8 | 3.8 | 0 | 3.4 | 15 | 0 | 900 | 10.7% | 22.1% | 100 |
| M929 | 3 | 12 | 62.4 | 3.8 | 0 | 3.8 | 15 | 0 | 900 | 12.5% | 25.0% | 0 |
| M930 | 4 | 16 | 57.2 | 3.8 | 0 | 4 | 15 | 0 | 900 | 10.6% | 22.1% | 50 |
| M931 | 3 | 12 | 61.8 | 3.8 | 0 | 4.4 | 15 | 0 | 900 | 12.5% | 25.0% | 0 |
| M932 | 4 | 16 | 56.6 | 3.8 | 0 | 4.6 | 15 | 0 | 900 | 10.6% | 22.2% | 50 |
| M933 | 3 | 12 | 61.2 | 3.8 | 0 | 5 | 15 | 0 | 900 | 12.4% | 25.0% | 0 |
| M934 | 4 | 16 | 56 | 3.8 | 0 | 5.2 | 15 | 0 | 900 | 10.5% | 22.2% | 50 |
| M935 | 3 | 12 | 60.6 | 3.8 | 0 | 5.6 | 15 | 0 | 900 | 12.4% | 25.0% | 0 |
| M936 | 4 | 16 | 55.4 | 3.8 | 0 | 5.8 | 15 | 0 | 850 | 10.5% | 22.3% | 50 |
| M937 | 3 | 12 | 60 | 3.8 | 0 | 6.2 | 15 | 0 | 900 | 12.3% | 25.0% | 0 |
| M938 | 4 | 16 | 54.8 | 3.8 | 0 | 6.4 | 15 | 0 | 850 | 10.4% | 22.3% | 50 |
| M939 | 3 | 12 | 59.4 | 3.8 | 0 | 6.8 | 15 | 0 | 900 | 12.3% | 25.0% | 0 |
| M940 | 4 | 16 | 54.2 | 3.8 | 0 | 7 | 15 | 0 | 850 | 10.4% | 22.3% | 50 |
| M941 | 3 | 12 | 58.8 | 3.8 | 0 | 7.4 | 15 | 0 | 850 | 12.3% | 25.1% | 50 |
| M942 | 4 | 16 | 53.6 | 3.8 | 0 | 7.6 | 15 | 0 | 850 | 10.3% | 22.4% | 50 |
| M943 | 3 | 12 | 58.2 | 3.8 | 0 | 8 | 15 | 0 | 850 | 12.2% | 25.1% | 50 |
| M944 | 4 | 16 | 53 | 3.8 | 0 | 8.2 | 15 | 0 | 850 | 10.3% | 22.4% | 50 |
| M945 | 3 | 12 | 57.6 | 3.8 | 0 | 8.6 | 15 | 0 | 850 | 12.2% | 25.1% | 50 |
| M946 | 4 | 16 | 52.4 | 3.8 | 0 | 8.8 | 15 | 0 | 850 | 10.3% | 22.5% | 100 |
| M947 | 3 | 12 | 57 | 3.8 | 0 | 9.2 | 15 | 0 | 850 | 12.2% | 25.1% | 50 |
| M948 | 4 | 16 | 51.8 | 3.8 | 0 | 9.4 | 15 | 0 | 850 | 10.2% | 22.5% | 100 |
| M949 | 3 | 12 | 56.4 | 3.8 | 0 | 9.8 | 15 | 0 | 850 | 12.2% | 25.1% | 50 |
| M950 | 4 | 16 | 51.2 | 3.8 | 0 | 10 | 15 | 0 | 850 | 10.2% | 22.5% | 100 |
| M951 | 3 | 12 | 55.8 | 3.8 | 0 | 10.4 | 15 | 0 | 850 | 12.1% | 25.1% | 50 |
| M952 | 4 | 16 | 50.6 | 3.8 | 0 | 10.6 | 15 | 0 | 850 | 10.4% | 22.6% | 100 |
| M953 | 3 | 12 | 55.2 | 3.8 | 0 | 11 | 15 | 0 | 850 | 12.1% | 25.2% | 50 |
| M954 | 4 | 16 | 50 | 3.8 | 0 | 11.2 | 15 | 0 | 800 | 10.3% | 22.6% | 100 |
| M955 | 3 | 12 | 54.6 | 3.8 | 0 | 11.6 | 15 | 0 | 850 | 12.1% | 25.2% | 50 |
| M956 | 4 | 16 | 49.4 | 3.8 | 0 | 11.8 | 15 | 0 | 800 | 10.3% | 22.7% | 100 |
| M957 | 3 | 12 | 54 | 3.8 | 0 | 12.2 | 15 | 0 | 850 | 12.1% | 25.2% | 50 |
| M958 | 4 | 16 | 48.8 | 3.8 | 0 | 12.4 | 15 | 0 | 800 | 10.3% | 22.7% | 100 |
| M959 | 3 | 12 | 53.4 | 3.8 | 0 | 12.8 | 15 | 0 | 800 | 12.0% | 25.2% | 100 |
| M960 | 4 | 16 | 48.2 | 3.8 | 0 | 13 | 15 | 0 | 800 | 10.2% | 22.8% | 100 |
| M961 | 3 | 12 | 52.8 | 3.8 | 0 | 13.4 | 15 | 0 | 800 | 12.0% | 25.3% | 100 |
| M962 | 4 | 16 | 47.6 | 3.8 | 0 | 13.6 | 15 | 0 | 800 | 10.2% | 22.8% | 100 |
| M963 | 3 | 12 | 52.2 | 3.8 | 0 | 14 | 15 | 0 | 800 | 12.0% | 25.3% | 100 |
| M964 | 4 | 16 | 60.8 | 4 | 0 | 0.2 | 15 | 0 | 950 | 11.0% | 21.9% | 50 |
| M965 | 3 | 12 | 65.2 | 4 | 0 | 0.8 | 15 | 0 | 950 | 12.7% | 25.1% | −50 |
| M966 | 4 | 16 | 60 | 4 | 0 | 1 | 15 | 0 | 950 | 11.0% | 22.0% | 50 |
| M967 | 3 | 12 | 64.6 | 4 | 0 | 1.4 | 15 | 0 | 950 | 12.7% | 25.1% | 0 |
| M968 | 4 | 16 | 59.4 | 4 | 0 | 1.6 | 15 | 0 | 900 | 10.9% | 22.0% | 50 |
| M969 | 3 | 12 | 64 | 4 | 0 | 2 | 15 | 0 | 950 | 12.6% | 25.2% | 0 |
| M970 | 4 | 16 | 58.8 | 4 | 0 | 2.2 | 15 | 0 | 900 | 10.8% | 22.0% | 50 |
| M971 | 3 | 12 | 63.4 | 4 | 0 | 2.6 | 15 | 0 | 950 | 12.6% | 25.2% | 0 |
| M972 | 4 | 16 | 58.2 | 4 | 0 | 2.8 | 15 | 0 | 900 | 10.8% | 22.1% | 100 |
| M973 | 3 | 12 | 62.8 | 4 | 0 | 3.2 | 15 | 0 | 900 | 12.5% | 25.1% | 0 |
| M974 | 4 | 16 | 57.6 | 4 | 0 | 3.4 | 15 | 0 | 900 | 10.7% | 22.1% | 100 |
| M975 | 3 | 12 | 62.2 | 4 | 0 | 3.8 | 15 | 0 | 900 | 12.5% | 25.0% | 0 |
| M976 | 4 | 16 | 57 | 4 | 0 | 4 | 15 | 0 | 900 | 10.6% | 22.1% | 100 |
| M977 | 3 | 12 | 61.6 | 4 | 0 | 4.4 | 15 | 0 | 900 | 12.5% | 25.0% | 0 |
| M978 | 4 | 16 | 56.4 | 4 | 0 | 4.6 | 15 | 0 | 900 | 10.6% | 22.2% | 50 |
| M979 | 3 | 12 | 61 | 4 | 0 | 5 | 15 | 0 | 900 | 12.4% | 25.0% | 0 |
| M980 | 4 | 16 | 55.8 | 4 | 0 | 5.2 | 15 | 0 | 900 | 10.5% | 22.2% | 50 |
| M981 | 3 | 12 | 60.4 | 4 | 0 | 5.6 | 15 | 0 | 900 | 12.4% | 25.0% | 0 |
| M982 | 4 | 16 | 55.2 | 4 | 0 | 5.8 | 15 | 0 | 850 | 10.5% | 22.3% | 50 |
| M983 | 3 | 12 | 59.8 | 4 | 0 | 6.2 | 15 | 0 | 900 | 12.3% | 25.0% | 0 |
| M984 | 4 | 16 | 54.6 | 4 | 0 | 6.4 | 15 | 0 | 850 | 10.4% | 22.3% | 50 |
| M985 | 3 | 12 | 59.2 | 4 | 0 | 6.8 | 15 | 0 | 900 | 12.3% | 25.0% | 0 |
| M986 | 4 | 16 | 54 | 4 | 0 | 7 | 15 | 0 | 850 | 10.4% | 22.3% | 50 |
| M987 | 3 | 12 | 58.6 | 4 | 0 | 7.4 | 15 | 0 | 850 | 12.3% | 25.1% | 50 |
| M988 | 4 | 16 | 53.4 | 4 | 0 | 7.6 | 15 | 0 | 850 | 10.3% | 22.4% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M989 | 3 | 12 | 58 | 4 | 0 | 8 | 15 | 0 | 850 | 12.2% | 25.1% | 50 |
| M990 | 4 | 16 | 52.8 | 4 | 0 | 8.2 | 15 | 0 | 850 | 10.3% | 22.4% | 50 |
| M991 | 3 | 12 | 57.4 | 4 | 0 | 8.6 | 15 | 0 | 850 | 12.2% | 25.1% | 50 |
| M992 | 4 | 16 | 52.2 | 4 | 0 | 8.8 | 15 | 0 | 850 | 10.2% | 22.4% | 100 |
| M993 | 3 | 12 | 56.8 | 4 | 0 | 9.2 | 15 | 0 | 850 | 12.2% | 25.1% | 50 |
| M994 | 4 | 16 | 51.6 | 4 | 0 | 9.4 | 15 | 0 | 850 | 10.2% | 22.5% | 100 |
| M995 | 3 | 12 | 56.2 | 4 | 0 | 9.8 | 15 | 0 | 850 | 12.2% | 25.1% | 50 |
| M996 | 4 | 16 | 51 | 4 | 0 | 10 | 15 | 0 | 850 | 10.2% | 22.5% | 100 |
| M997 | 3 | 12 | 55.6 | 4 | 0 | 10.4 | 15 | 0 | 850 | 12.1% | 25.1% | 50 |
| M998 | 4 | 16 | 50.4 | 4 | 0 | 10.6 | 15 | 0 | 800 | 10.1% | 22.6% | 100 |
| M999 | 3 | 12 | 55 | 4 | 0 | 11 | 15 | 0 | 850 | 12.1% | 25.2% | 50 |
| M1000 | 4 | 16 | 49.8 | 4 | 0 | 11.2 | 15 | 0 | 800 | 10.3% | 22.6% | 100 |
| M1001 | 3 | 12 | 54.4 | 4 | 0 | 11.6 | 15 | 0 | 850 | 12.1% | 25.2% | 50 |
| M1002 | 4 | 16 | 49.2 | 4 | 0 | 11.8 | 15 | 0 | 800 | 10.3% | 22.7% | 100 |
| M1003 | 3 | 12 | 53.8 | 4 | 0 | 12.2 | 15 | 0 | 850 | 12.1% | 25.2% | 50 |
| M1004 | 4 | 16 | 48.6 | 4 | 0 | 12.4 | 15 | 0 | 800 | 10.3% | 22.7% | 100 |
| M1005 | 3 | 12 | 53.2 | 4 | 0 | 12.8 | 15 | 0 | 800 | 12.0% | 25.2% | 100 |
| M1006 | 4 | 16 | 48 | 4 | 0 | 13 | 15 | 0 | 800 | 10.2% | 22.8% | 100 |
| M1007 | 3 | 12 | 52.6 | 4 | 0 | 13.4 | 15 | 0 | 800 | 12.0% | 25.2% | 100 |
| M1008 | 4 | 16 | 47.4 | 4 | 0 | 13.6 | 15 | 0 | 800 | 10.2% | 22.8% | 100 |
| M1009 | 3 | 12 | 52 | 4 | 0 | 14 | 15 | 0 | 800 | 12.0% | 25.3% | 100 |
| M1010 | 4 | 16 | 60.6 | 4.2 | 0 | 0.2 | 15 | 0 | 950 | 11.1% | 21.9% | 50 |
| M1011 | 4 | 16 | 60.2 | 4.2 | 0 | 0.6 | 15 | 0 | 950 | 11.0% | 21.9% | 50 |
| M1012 | 3 | 12 | 64.8 | 4.2 | 0 | 1 | 15 | 0 | 950 | 12.7% | 25.1% | 0 |
| M1013 | 4 | 16 | 59.6 | 4.2 | 0 | 1.2 | 15 | 0 | 950 | 10.9% | 22.0% | 50 |
| M1014 | 3 | 12 | 64.2 | 4.2 | 0 | 1.6 | 15 | 0 | 950 | 12.7% | 25.1% | 0 |
| M1015 | 4 | 16 | 59 | 4.2 | 0 | 1.8 | 15 | 0 | 900 | 10.9% | 22.0% | 50 |
| M1016 | 3 | 12 | 63.6 | 4.2 | 0 | 2.2 | 15 | 0 | 950 | 12.6% | 25.2% | 0 |
| M1017 | 4 | 16 | 58.4 | 4.2 | 0 | 2.4 | 15 | 0 | 900 | 10.8% | 22.0% | 50 |
| M1018 | 3 | 12 | 63 | 4.2 | 0 | 2.8 | 15 | 0 | 900 | 12.6% | 25.2% | 0 |
| M1019 | 4 | 16 | 57.8 | 4.2 | 0 | 3 | 15 | 0 | 900 | 10.7% | 22.1% | 100 |
| M1020 | 3 | 12 | 62.4 | 4.2 | 0 | 3.4 | 15 | 0 | 900 | 12.5% | 25.1% | 0 |
| M1021 | 4 | 16 | 57.2 | 4.2 | 0 | 3.6 | 15 | 0 | 900 | 10.7% | 22.1% | 100 |
| M1022 | 3 | 12 | 61.8 | 4.2 | 0 | 4 | 15 | 0 | 900 | 12.5% | 25.0% | 0 |
| M1023 | 4 | 16 | 56.6 | 4.2 | 0 | 4.2 | 15 | 0 | 900 | 10.6% | 22.1% | 100 |
| M1024 | 3 | 12 | 61.2 | 4.2 | 0 | 4.6 | 15 | 0 | 900 | 12.4% | 25.0% | 0 |
| M1025 | 4 | 16 | 56 | 4.2 | 0 | 4.8 | 15 | 0 | 900 | 10.6% | 22.2% | 50 |
| M1026 | 3 | 12 | 60.6 | 4.2 | 0 | 5.2 | 15 | 0 | 900 | 12.4% | 25.0% | 0 |
| M1027 | 4 | 16 | 55.4 | 4.2 | 0 | 5.4 | 15 | 0 | 850 | 10.5% | 22.2% | 50 |
| M1028 | 3 | 12 | 60 | 4.2 | 0 | 5.8 | 15 | 0 | 900 | 12.4% | 25.0% | 0 |
| M1029 | 4 | 16 | 54.8 | 4.2 | 0 | 6 | 15 | 0 | 850 | 10.5% | 22.3% | 50 |
| M1030 | 3 | 12 | 59.4 | 4.2 | 0 | 6.4 | 15 | 0 | 900 | 12.3% | 25.0% | 0 |
| M1031 | 4 | 16 | 54.2 | 4.2 | 0 | 6.6 | 15 | 0 | 850 | 10.4% | 22.3% | 50 |
| M1032 | 3 | 12 | 58.8 | 4.2 | 0 | 7 | 15 | 0 | 850 | 12.3% | 25.0% | 50 |
| M1033 | 4 | 16 | 53.6 | 4.2 | 0 | 7.2 | 15 | 0 | 850 | 10.4% | 22.3% | 50 |
| M1034 | 3 | 12 | 58.2 | 4.2 | 0 | 7.6 | 15 | 0 | 850 | 12.3% | 25.1% | 50 |
| M1035 | 4 | 16 | 53 | 4.2 | 0 | 7.8 | 15 | 0 | 850 | 10.3% | 22.4% | 50 |
| M1036 | 3 | 12 | 57.6 | 4.2 | 0 | 8.2 | 15 | 0 | 850 | 12.2% | 25.1% | 50 |
| M1037 | 4 | 16 | 52.4 | 4.2 | 0 | 8.4 | 15 | 0 | 850 | 10.3% | 22.4% | 100 |
| M1038 | 3 | 12 | 57 | 4.2 | 0 | 8.8 | 15 | 0 | 850 | 12.2% | 25.1% | 50 |
| M1039 | 4 | 16 | 51.8 | 4.2 | 0 | 9 | 15 | 0 | 850 | 10.2% | 22.5% | 100 |
| M1040 | 3 | 12 | 56.4 | 4.2 | 0 | 9.4 | 15 | 0 | 850 | 12.2% | 25.1% | 50 |
| M1041 | 4 | 16 | 51.2 | 4.2 | 0 | 9.6 | 15 | 0 | 850 | 10.2% | 22.5% | 100 |
| M1042 | 3 | 12 | 55.8 | 4.2 | 0 | 10 | 15 | 0 | 850 | 12.1% | 25.1% | 50 |
| M1043 | 4 | 16 | 50.6 | 4.2 | 0 | 10.2 | 15 | 0 | 850 | 10.1% | 22.5% | 100 |
| M1044 | 3 | 12 | 55.2 | 4.2 | 0 | 10.6 | 15 | 0 | 850 | 12.1% | 25.1% | 50 |
| M1045 | 4 | 16 | 50 | 4.2 | 0 | 10.8 | 15 | 0 | 800 | 10.1% | 22.6% | 100 |
| M1046 | 3 | 12 | 54.6 | 4.2 | 0 | 11.2 | 15 | 0 | 850 | 12.1% | 25.2% | 50 |
| M1047 | 4 | 16 | 49.4 | 4.2 | 0 | 11.4 | 15 | 0 | 800 | 10.3% | 22.6% | 100 |
| M1048 | 3 | 12 | 54 | 4.2 | 0 | 11.8 | 15 | 0 | 850 | 12.1% | 25.2% | 50 |
| M1049 | 4 | 16 | 48.8 | 4.2 | 0 | 12 | 15 | 0 | 800 | 10.3% | 22.7% | 100 |
| M1050 | 3 | 12 | 53.4 | 4.2 | 0 | 12.4 | 15 | 0 | 800 | 12.0% | 25.2% | 50 |
| M1051 | 4 | 16 | 48.2 | 4.2 | 0 | 12.6 | 15 | 0 | 800 | 10.2% | 22.7% | 100 |
| M1052 | 3 | 12 | 52.8 | 4.2 | 0 | 13 | 15 | 0 | 800 | 12.0% | 25.2% | 100 |
| M1053 | 4 | 16 | 47.6 | 4.2 | 0 | 13.2 | 15 | 0 | 800 | 10.2% | 22.8% | 100 |
| M1054 | 3 | 12 | 52.2 | 4.2 | 0 | 13.6 | 15 | 0 | 800 | 12.0% | 25.2% | 100 |
| M1055 | 4 | 16 | 47 | 4.2 | 0 | 13.8 | 15 | 0 | 800 | 10.2% | 22.8% | 100 |
| M1056 | 4 | 16 | 60.6 | 4.4 | 0 | 0 | 15 | 0 | 950 | 11.1% | 21.9% | 50 |
| M1057 | 4 | 16 | 60.2 | 4.4 | 0 | 0.4 | 15 | 0 | 950 | 11.0% | 21.9% | 50 |
| M1058 | 3 | 12 | 64.8 | 4.4 | 0 | 0.8 | 15 | 0 | 950 | 12.7% | 25.1% | −50 |
| M1059 | 4 | 16 | 59.6 | 4.4 | 0 | 1 | 15 | 0 | 950 | 11.0% | 22.0% | 50 |
| M1060 | 3 | 12 | 64.2 | 4.4 | 0 | 1.4 | 15 | 0 | 950 | 12.7% | 25.1% | 0 |
| M1061 | 4 | 16 | 59 | 4.4 | 0 | 1.6 | 15 | 0 | 900 | 10.9% | 22.0% | 50 |
| M1062 | 3 | 12 | 63.6 | 4.4 | 0 | 2 | 15 | 0 | 950 | 12.6% | 25.1% | 0 |
| M1063 | 4 | 16 | 58.4 | 4.4 | 0 | 2.2 | 15 | 0 | 900 | 10.8% | 22.0% | 50 |
| M1064 | 3 | 12 | 63 | 4.4 | 0 | 2.6 | 15 | 0 | 900 | 12.6% | 25.2% | 0 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M1065 | 4 | 16 | 57.8 | 4.4 | 0 | 2.8 | 15 | 0 | 900 | 10.8% | 22.1% | 100 |
| M1066 | 3 | 12 | 62.4 | 4.4 | 0 | 3.2 | 15 | 0 | 900 | 12.5% | 25.1% | 0 |
| M1067 | 4 | 16 | 57.2 | 4.4 | 0 | 3.4 | 15 | 0 | 900 | 10.7% | 22.1% | 100 |
| M1068 | 3 | 12 | 61.8 | 4.4 | 0 | 3.8 | 15 | 0 | 900 | 12.5% | 25.1% | 0 |
| M1069 | 4 | 16 | 56.6 | 4.4 | 0 | 4 | 15 | 0 | 900 | 10.6% | 22.1% | 100 |
| M1070 | 3 | 12 | 61.2 | 4.4 | 0 | 4.4 | 15 | 0 | 900 | 12.5% | 25.0% | 0 |
| M1071 | 4 | 16 | 56 | 4.4 | 0 | 4.6 | 15 | 0 | 900 | 10.6% | 22.2% | 100 |
| M1072 | 3 | 12 | 60.6 | 4.4 | 0 | 5 | 15 | 0 | 900 | 12.4% | 25.0% | 0 |
| M1073 | 4 | 16 | 55.4 | 4.4 | 0 | 5.2 | 15 | 0 | 850 | 10.5% | 22.2% | 50 |
| M1074 | 3 | 12 | 60 | 4.4 | 0 | 5.6 | 15 | 0 | 900 | 12.4% | 25.0% | 0 |
| M1075 | 4 | 16 | 54.8 | 4.4 | 0 | 5.8 | 15 | 0 | 850 | 10.5% | 22.2% | 50 |
| M1076 | 3 | 12 | 59.4 | 4.4 | 0 | 6.2 | 15 | 0 | 900 | 12.3% | 25.0% | 0 |
| M1077 | 4 | 16 | 54.2 | 4.4 | 0 | 6.4 | 15 | 0 | 850 | 10.4% | 22.3% | 50 |
| M1078 | 3 | 12 | 58.8 | 4.4 | 0 | 6.8 | 15 | 0 | 850 | 12.3% | 25.0% | 50 |
| M1079 | 4 | 16 | 53.6 | 4.4 | 0 | 7 | 15 | 0 | 850 | 10.4% | 22.3% | 50 |
| M1080 | 3 | 12 | 58.2 | 4.4 | 0 | 7.4 | 15 | 0 | 850 | 12.3% | 25.0% | 50 |
| M1081 | 4 | 16 | 53 | 4.4 | 0 | 7.6 | 15 | 0 | 850 | 10.3% | 22.4% | 50 |
| M1082 | 3 | 12 | 57.6 | 4.4 | 0 | 8 | 15 | 0 | 850 | 12.2% | 25.1% | 50 |
| M1083 | 4 | 16 | 52.4 | 4.4 | 0 | 8.2 | 15 | 0 | 850 | 10.3% | 22.4% | 50 |
| M1084 | 3 | 12 | 57 | 4.4 | 0 | 8.6 | 15 | 0 | 850 | 12.2% | 25.1% | 50 |
| M1085 | 4 | 16 | 51.8 | 4.4 | 0 | 8.8 | 15 | 0 | 850 | 10.2% | 22.4% | 100 |
| M1086 | 3 | 12 | 56.4 | 4.4 | 0 | 9.2 | 15 | 0 | 850 | 12.2% | 25.1% | 50 |
| M1087 | 4 | 16 | 51.2 | 4.4 | 0 | 9.4 | 15 | 0 | 850 | 10.2% | 22.5% | 100 |
| M1088 | 3 | 12 | 55.8 | 4.4 | 0 | 9.8 | 15 | 0 | 850 | 12.1% | 25.1% | 50 |
| M1089 | 4 | 16 | 50.6 | 4.4 | 0 | 10 | 15 | 0 | 850 | 10.2% | 22.5% | 100 |
| M1090 | 3 | 12 | 55.2 | 4.4 | 0 | 10.4 | 15 | 0 | 850 | 12.1% | 25.1% | 50 |
| M1091 | 4 | 16 | 50 | 4.4 | 0 | 10.6 | 15 | 0 | 800 | 10.1% | 22.6% | 100 |
| M1092 | 3 | 12 | 54.6 | 4.4 | 0 | 11 | 15 | 0 | 850 | 12.1% | 25.1% | 50 |
| M1093 | 4 | 16 | 49.4 | 4.4 | 0 | 11.2 | 15 | 0 | 800 | 10.3% | 22.6% | 100 |
| M1094 | 3 | 12 | 54 | 4.4 | 0 | 11.6 | 15 | 0 | 850 | 12.1% | 25.2% | 50 |
| M1095 | 4 | 16 | 48.8 | 4.4 | 0 | 11.8 | 15 | 0 | 800 | 10.3% | 22.6% | 100 |
| M1096 | 3 | 12 | 53.4 | 4.4 | 0 | 12.2 | 15 | 0 | 800 | 12.0% | 25.2% | 50 |
| M1097 | 4 | 16 | 48.2 | 4.4 | 0 | 12.4 | 15 | 0 | 800 | 10.2% | 22.7% | 100 |
| M1098 | 3 | 12 | 52.8 | 4.4 | 0 | 12.8 | 15 | 0 | 800 | 12.0% | 25.2% | 100 |
| M1099 | 4 | 16 | 47.6 | 4.4 | 0 | 13 | 15 | 0 | 800 | 10.2% | 22.7% | 100 |
| M1100 | 3 | 12 | 52.2 | 4.4 | 0 | 13.4 | 15 | 0 | 800 | 12.0% | 25.2% | 100 |
| M1101 | 4 | 16 | 47 | 4.4 | 0 | 13.6 | 15 | 0 | 800 | 10.2% | 22.8% | 100 |
| M1102 | 3 | 12 | 51.6 | 4.4 | 0 | 14 | 15 | 0 | 800 | 12.0% | 25.2% | 100 |
| M1103 | 3 | 12 | 65.2 | 4.6 | 0 | 0.2 | 15 | 0 | 950 | 12.8% | 25.0% | −50 |
| M1104 | 4 | 16 | 60 | 4.6 | 0 | 0.4 | 15 | 0 | 950 | 11.0% | 21.9% | 50 |
| M1105 | 3 | 12 | 64.6 | 4.6 | 0 | 0.8 | 15 | 0 | 950 | 12.7% | 25.0% | −50 |
| M1106 | 4 | 16 | 59.4 | 4.6 | 0 | 1 | 15 | 0 | 900 | 11.0% | 22.0% | 50 |
| M1107 | 3 | 12 | 64 | 4.6 | 0 | 1.4 | 15 | 0 | 950 | 12.7% | 25.1% | 0 |
| M1108 | 4 | 16 | 58.8 | 4.6 | 0 | 1.6 | 15 | 0 | 900 | 10.9% | 22.0% | 50 |
| M1109 | 3 | 12 | 63.4 | 4.6 | 0 | 2 | 15 | 0 | 900 | 12.6% | 25.1% | 0 |
| M1110 | 4 | 16 | 58.2 | 4.6 | 0 | 2.2 | 15 | 0 | 900 | 10.8% | 22.0% | 50 |
| M1111 | 3 | 12 | 62.8 | 4.6 | 0 | 2.6 | 15 | 0 | 900 | 12.6% | 25.2% | 0 |
| M1112 | 4 | 16 | 57.6 | 4.6 | 0 | 2.8 | 15 | 0 | 900 | 10.8% | 22.1% | 100 |
| M1113 | 3 | 12 | 62.2 | 4.6 | 0 | 3.2 | 15 | 0 | 900 | 12.5% | 25.2% | 0 |
| M1114 | 4 | 16 | 57 | 4.6 | 0 | 3.4 | 15 | 0 | 900 | 10.7% | 22.1% | 100 |
| M1115 | 3 | 12 | 61.6 | 4.6 | 0 | 3.8 | 15 | 0 | 900 | 12.5% | 25.1% | 0 |
| M1116 | 4 | 16 | 56.4 | 4.6 | 0 | 4 | 15 | 0 | 900 | 10.6% | 22.1% | 100 |
| M1117 | 3 | 12 | 61 | 4.6 | 0 | 4.4 | 15 | 0 | 900 | 12.5% | 25.0% | 0 |
| M1118 | 4 | 16 | 55.8 | 4.6 | 0 | 4.6 | 15 | 0 | 900 | 10.6% | 22.2% | 100 |
| M1119 | 3 | 12 | 60.4 | 4.6 | 0 | 5 | 15 | 0 | 900 | 12.4% | 25.0% | 0 |
| M1120 | 4 | 16 | 55.2 | 4.6 | 0 | 5.2 | 15 | 0 | 850 | 10.5% | 22.2% | 100 |
| M1121 | 3 | 12 | 59.8 | 4.6 | 0 | 5.6 | 15 | 0 | 900 | 12.4% | 25.0% | 0 |
| M1122 | 4 | 16 | 54.6 | 4.6 | 0 | 5.8 | 15 | 0 | 850 | 10.5% | 22.2% | 50 |
| M1123 | 3 | 12 | 59.2 | 4.6 | 0 | 6.2 | 15 | 0 | 850 | 12.3% | 25.0% | 0 |
| M1124 | 4 | 16 | 54 | 4.6 | 0 | 6.4 | 15 | 0 | 850 | 10.4% | 22.3% | 50 |
| M1125 | 3 | 12 | 58.6 | 4.6 | 0 | 6.8 | 15 | 0 | 850 | 12.3% | 25.0% | 50 |
| M1126 | 4 | 16 | 53.4 | 4.6 | 0 | 7 | 15 | 0 | 850 | 10.4% | 22.3% | 50 |
| M1127 | 3 | 12 | 58 | 4.6 | 0 | 7.4 | 15 | 0 | 850 | 12.3% | 25.0% | 50 |
| M1128 | 4 | 16 | 52.8 | 4.6 | 0 | 7.6 | 15 | 0 | 850 | 10.3% | 22.3% | 50 |
| M1129 | 3 | 12 | 57.4 | 4.6 | 0 | 8 | 15 | 0 | 850 | 12.2% | 25.1% | 50 |
| M1130 | 4 | 16 | 52.2 | 4.6 | 0 | 8.2 | 15 | 0 | 850 | 10.3% | 22.4% | 100 |
| M1131 | 3 | 12 | 56.8 | 4.6 | 0 | 8.6 | 15 | 0 | 850 | 12.2% | 25.1% | 50 |
| M1132 | 4 | 16 | 51.6 | 4.6 | 0 | 8.8 | 15 | 0 | 850 | 10.2% | 22.4% | 100 |
| M1133 | 3 | 12 | 56.2 | 4.6 | 0 | 9.2 | 15 | 0 | 850 | 12.2% | 25.1% | 50 |
| M1134 | 4 | 16 | 51 | 4.6 | 0 | 9.4 | 15 | 0 | 850 | 10.2% | 22.5% | 100 |
| M1135 | 3 | 12 | 55.6 | 4.6 | 0 | 9.8 | 15 | 0 | 850 | 12.1% | 25.1% | 50 |
| M1136 | 4 | 16 | 50.4 | 4.6 | 0 | 10 | 15 | 0 | 850 | 10.1% | 22.5% | 100 |
| M1137 | 3 | 12 | 55 | 4.6 | 0 | 10.4 | 15 | 0 | 850 | 12.1% | 25.1% | 50 |
| M1138 | 4 | 16 | 49.8 | 4.6 | 0 | 10.6 | 15 | 0 | 800 | 10.1% | 22.5% | 100 |
| M1139 | 3 | 12 | 54.4 | 4.6 | 0 | 11 | 15 | 0 | 850 | 12.1% | 25.1% | 50 |
| M1140 | 4 | 16 | 49.2 | 4.6 | 0 | 11.2 | 15 | 0 | 800 | 10.1% | 22.6% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M1141 | 3 | 12 | 53.8 | 4.6 | 0 | 11.6 | 15 | 0 | 850 | 12.1% | 25.2% | 50 |
| M1142 | 4 | 16 | 48.6 | 4.6 | 0 | 11.8 | 15 | 0 | 800 | 10.3% | 22.6% | 100 |
| M1143 | 3 | 12 | 53.2 | 4.6 | 0 | 12.2 | 15 | 0 | 800 | 12.0% | 25.2% | 50 |
| M1144 | 4 | 16 | 48 | 4.6 | 0 | 12.4 | 15 | 0 | 800 | 10.2% | 22.7% | 100 |
| M1145 | 3 | 12 | 52.6 | 4.6 | 0 | 12.8 | 15 | 0 | 800 | 12.0% | 25.2% | 100 |
| M1146 | 4 | 16 | 47.4 | 4.6 | 0 | 13 | 15 | 0 | 800 | 10.2% | 22.7% | 100 |
| M1147 | 3 | 12 | 52 | 4.6 | 0 | 13.4 | 15 | 0 | 800 | 12.0% | 25.2% | 100 |
| M1148 | 4 | 16 | 46.8 | 4.6 | 0 | 13.6 | 15 | 0 | 800 | 10.2% | 22.8% | 100 |
| M1149 | 3 | 12 | 51.4 | 4.6 | 0 | 14 | 15 | 0 | 800 | 12.0% | 25.2% | 100 |
| M1150 | 4 | 16 | 60.2 | 4.8 | 0 | 0 | 15 | 0 | 950 | 11.1% | 21.9% | 50 |
| M1151 | 3 | 12 | 64.8 | 4.8 | 0 | 0.4 | 15 | 0 | 950 | 12.8% | 25.0% | −50 |
| M1152 | 4 | 16 | 59.6 | 4.8 | 0 | 0.6 | 15 | 0 | 950 | 11.0% | 21.9% | 50 |
| M1153 | 3 | 12 | 64.2 | 4.8 | 0 | 1 | 15 | 0 | 950 | 12.7% | 25.1% | 0 |
| M1154 | 4 | 16 | 59 | 4.8 | 0 | 1.2 | 15 | 0 | 900 | 11.0% | 22.0% | 50 |
| M1155 | 3 | 12 | 63.6 | 4.8 | 0 | 1.6 | 15 | 0 | 950 | 12.7% | 25.1% | 0 |
| M1156 | 4 | 16 | 58.4 | 4.8 | 0 | 1.8 | 15 | 0 | 900 | 10.9% | 22.0% | 50 |
| M1157 | 3 | 12 | 63 | 4.8 | 0 | 2.2 | 15 | 0 | 900 | 12.6% | 25.1% | 0 |
| M1158 | 4 | 16 | 57.8 | 4.8 | 0 | 2.4 | 15 | 0 | 900 | 10.8% | 22.0% | 100 |
| M1159 | 3 | 12 | 62.4 | 4.8 | 0 | 2.8 | 15 | 0 | 900 | 12.6% | 25.2% | 0 |
| M1160 | 4 | 16 | 57.2 | 4.8 | 0 | 3 | 15 | 0 | 900 | 10.8% | 22.1% | 100 |
| M1161 | 3 | 12 | 61.8 | 4.8 | 0 | 3.4 | 15 | 0 | 900 | 12.5% | 25.2% | 0 |
| M1162 | 4 | 16 | 56.6 | 4.8 | 0 | 3.6 | 15 | 0 | 900 | 10.7% | 22.1% | 100 |
| M1163 | 3 | 12 | 61.2 | 4.8 | 0 | 4 | 15 | 0 | 900 | 12.5% | 25.1% | 0 |
| M1164 | 4 | 16 | 56 | 4.8 | 0 | 4.2 | 15 | 0 | 900 | 10.6% | 22.1% | 100 |
| M1165 | 3 | 12 | 60.6 | 4.8 | 0 | 4.6 | 15 | 0 | 900 | 12.4% | 25.0% | 0 |
| M1166 | 4 | 16 | 55.4 | 4.8 | 0 | 4.8 | 15 | 0 | 850 | 10.6% | 22.2% | 100 |
| M1167 | 3 | 12 | 60 | 4.8 | 0 | 5.2 | 15 | 0 | 900 | 12.4% | 25.0% | 0 |
| M1168 | 4 | 16 | 54.8 | 4.8 | 0 | 5.4 | 15 | 0 | 850 | 10.5% | 22.2% | 100 |
| M1169 | 3 | 12 | 59.4 | 4.8 | 0 | 5.8 | 15 | 0 | 850 | 12.4% | 25.0% | 0 |
| M1170 | 4 | 16 | 54.2 | 4.8 | 0 | 6 | 15 | 0 | 850 | 10.5% | 22.2% | 50 |
| M1171 | 3 | 12 | 58.8 | 4.8 | 0 | 6.4 | 15 | 0 | 850 | 12.3% | 25.0% | 0 |
| M1172 | 4 | 16 | 53.6 | 4.8 | 0 | 6.6 | 15 | 0 | 850 | 10.4% | 22.3% | 50 |
| M1173 | 3 | 12 | 58.2 | 4.8 | 0 | 7 | 15 | 0 | 850 | 12.3% | 25.0% | 50 |
| M1174 | 4 | 16 | 53 | 4.8 | 0 | 7.2 | 15 | 0 | 850 | 10.4% | 22.3% | 50 |
| M1175 | 3 | 12 | 57.6 | 4.8 | 0 | 7.6 | 15 | 0 | 850 | 12.3% | 25.0% | 50 |
| M1176 | 4 | 16 | 52.4 | 4.8 | 0 | 7.8 | 15 | 0 | 850 | 10.3% | 22.3% | 50 |
| M1177 | 3 | 12 | 57 | 4.8 | 0 | 8.2 | 15 | 0 | 850 | 12.2% | 25.1% | 50 |
| M1178 | 4 | 16 | 51.8 | 4.8 | 0 | 8.4 | 15 | 0 | 850 | 10.3% | 22.4% | 100 |
| M1179 | 3 | 12 | 56.4 | 4.8 | 0 | 8.8 | 15 | 0 | 850 | 12.2% | 25.1% | 100 |
| M1180 | 4 | 16 | 51.2 | 4.8 | 0 | 9 | 15 | 0 | 850 | 10.2% | 22.4% | 100 |
| M1181 | 3 | 12 | 55.8 | 4.8 | 0 | 9.4 | 15 | 0 | 850 | 12.2% | 25.1% | 50 |
| M1182 | 4 | 16 | 50.6 | 4.8 | 0 | 9.6 | 15 | 0 | 850 | 10.2% | 22.5% | 100 |
| M1183 | 3 | 12 | 55.2 | 4.8 | 0 | 10 | 15 | 0 | 850 | 12.1% | 25.1% | 50 |
| M1184 | 4 | 16 | 50 | 4.8 | 0 | 10.2 | 15 | 0 | 800 | 10.1% | 22.5% | 100 |
| M1185 | 3 | 12 | 54.6 | 4.8 | 0 | 10.6 | 15 | 0 | 850 | 12.1% | 25.1% | 50 |
| M1186 | 4 | 16 | 49.4 | 4.8 | 0 | 10.8 | 15 | 0 | 800 | 10.1% | 22.6% | 100 |
| M1187 | 3 | 12 | 54 | 4.8 | 0 | 11.2 | 15 | 0 | 850 | 12.1% | 25.1% | 50 |
| M1188 | 4 | 16 | 48.8 | 4.8 | 0 | 11.4 | 15 | 0 | 800 | 10.0% | 22.6% | 100 |
| M1189 | 3 | 12 | 53.4 | 4.8 | 0 | 11.8 | 15 | 0 | 800 | 12.0% | 25.2% | 50 |
| M1190 | 4 | 16 | 48.2 | 4.8 | 0 | 12 | 15 | 0 | 800 | 10.2% | 22.6% | 100 |
| M1191 | 3 | 12 | 52.8 | 4.8 | 0 | 12.4 | 15 | 0 | 800 | 12.0% | 25.2% | 100 |
| M1192 | 4 | 16 | 47.6 | 4.8 | 0 | 12.6 | 15 | 0 | 800 | 10.2% | 22.7% | 100 |
| M1193 | 3 | 12 | 52.2 | 4.8 | 0 | 13 | 15 | 0 | 800 | 12.0% | 25.2% | 100 |
| M1194 | 4 | 16 | 47 | 4.8 | 0 | 13.2 | 15 | 0 | 800 | 10.2% | 22.7% | 100 |
| M1195 | 3 | 12 | 51.6 | 4.8 | 0 | 13.6 | 15 | 0 | 800 | 12.0% | 25.2% | 100 |
| M1196 | 4 | 16 | 46.4 | 4.8 | 0 | 13.8 | 15 | 0 | 800 | 10.1% | 22.8% | 100 |
| M1197 | 3 | 12 | 65 | 5 | 0 | 0 | 15 | 0 | 950 | 12.8% | 25.0% | −50 |
| M1198 | 4 | 16 | 59.8 | 5 | 0 | 0.2 | 15 | 0 | 950 | 11.1% | 21.9% | 50 |
| M1199 | 3 | 12 | 64.4 | 5 | 0 | 0.6 | 15 | 0 | 950 | 12.8% | 25.0% | −50 |
| M1200 | 4 | 16 | 59.2 | 5 | 0 | 0.8 | 15 | 0 | 900 | 11.0% | 21.9% | 50 |
| M1201 | 3 | 12 | 63.8 | 5 | 0 | 1.2 | 15 | 0 | 950 | 12.7% | 25.1% | 0 |
| M1202 | 4 | 16 | 58.6 | 5 | 0 | 1.4 | 15 | 0 | 900 | 10.9% | 22.0% | 50 |
| M1203 | 3 | 12 | 63.2 | 5 | 0 | 1.8 | 15 | 0 | 900 | 12.7% | 25.1% | 0 |
| M1204 | 4 | 16 | 58 | 5 | 0 | 2 | 15 | 0 | 900 | 10.9% | 22.0% | 50 |
| M1205 | 3 | 12 | 62.6 | 5 | 0 | 2.4 | 15 | 0 | 900 | 12.6% | 25.1% | 0 |
| M1206 | 4 | 16 | 57.4 | 5 | 0 | 2.6 | 15 | 0 | 900 | 10.8% | 22.0% | 100 |
| M1207 | 3 | 12 | 62 | 5 | 0 | 3 | 15 | 0 | 900 | 12.6% | 25.2% | 0 |
| M1208 | 4 | 16 | 56.8 | 5 | 0 | 3.2 | 15 | 0 | 900 | 10.7% | 22.1% | 100 |
| M1209 | 3 | 12 | 61.4 | 5 | 0 | 3.6 | 15 | 0 | 900 | 12.5% | 25.2% | 0 |
| M1210 | 4 | 16 | 56.2 | 5 | 0 | 3.8 | 15 | 0 | 900 | 10.7% | 22.1% | 100 |
| M1211 | 3 | 12 | 60.8 | 5 | 0 | 4.2 | 15 | 0 | 900 | 12.5% | 25.1% | 0 |
| M1212 | 4 | 16 | 55.6 | 5 | 0 | 4.4 | 15 | 0 | 850 | 10.6% | 22.1% | 100 |
| M1213 | 3 | 12 | 60.2 | 5 | 0 | 4.8 | 15 | 0 | 900 | 12.4% | 25.0% | 0 |
| M1214 | 4 | 16 | 55 | 5 | 0 | 5 | 15 | 0 | 850 | 10.6% | 22.2% | 100 |
| M1215 | 3 | 12 | 59.6 | 5 | 0 | 5.4 | 15 | 0 | 900 | 12.4% | 25.0% | 0 |
| M1216 | 4 | 16 | 54.4 | 5 | 0 | 5.6 | 15 | 0 | 850 | 10.5% | 22.2% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M1217 | 3 | 12 | 59 | 5 | 0 | 6 | 15 | 0 | 850 | 12.3% | 25.0% | 0 |
| M1218 | 4 | 16 | 53.8 | 5 | 0 | 6.2 | 15 | 0 | 850 | 10.4% | 22.2% | 50 |
| M1219 | 3 | 12 | 58.4 | 5 | 0 | 6.6 | 15 | 0 | 850 | 12.3% | 25.0% | 50 |
| M1220 | 4 | 16 | 53.2 | 5 | 0 | 6.8 | 15 | 0 | 850 | 10.4% | 22.3% | 50 |
| M1221 | 3 | 12 | 57.8 | 5 | 0 | 7.2 | 15 | 0 | 850 | 12.3% | 25.0% | 50 |
| M1222 | 4 | 16 | 52.6 | 5 | 0 | 7.4 | 15 | 0 | 850 | 10.3% | 22.3% | 50 |
| M1223 | 3 | 12 | 57.2 | 5 | 0 | 7.8 | 15 | 0 | 850 | 12.2% | 25.0% | 50 |
| M1224 | 4 | 16 | 52 | 5 | 0 | 8 | 15 | 0 | 850 | 10.3% | 22.4% | 50 |
| M1225 | 3 | 12 | 56.6 | 5 | 0 | 8.4 | 15 | 0 | 850 | 12.2% | 25.1% | 50 |
| M1226 | 4 | 16 | 51.4 | 5 | 0 | 8.6 | 15 | 0 | 850 | 10.2% | 22.4% | 100 |
| M1227 | 3 | 12 | 56 | 5 | 0 | 9 | 15 | 0 | 850 | 12.2% | 25.1% | 100 |
| M1228 | 4 | 16 | 50.8 | 5 | 0 | 9.2 | 15 | 0 | 850 | 10.2% | 22.4% | 100 |
| M1229 | 3 | 12 | 55.4 | 5 | 0 | 9.6 | 15 | 0 | 850 | 12.1% | 25.1% | 50 |
| M1230 | 4 | 16 | 50.2 | 5 | 0 | 9.8 | 15 | 0 | 850 | 10.1% | 22.5% | 100 |
| M1231 | 3 | 12 | 54.8 | 5 | 0 | 10.2 | 15 | 0 | 850 | 12.1% | 25.1% | 50 |
| M1232 | 4 | 16 | 49.6 | 5 | 0 | 10.4 | 15 | 0 | 800 | 10.1% | 22.5% | 100 |
| M1233 | 3 | 12 | 54.2 | 5 | 0 | 10.8 | 15 | 0 | 850 | 12.1% | 25.1% | 50 |
| M1234 | 4 | 16 | 49 | 5 | 0 | 11 | 15 | 0 | 800 | 10.1% | 22.6% | 100 |
| M1235 | 3 | 12 | 53.6 | 5 | 0 | 11.4 | 15 | 0 | 850 | 12.1% | 25.1% | 50 |
| M1236 | 4 | 16 | 48.4 | 5 | 0 | 11.6 | 15 | 0 | 800 | 10.2% | 22.6% | 100 |
| M1237 | 3 | 12 | 53 | 5 | 0 | 12 | 15 | 0 | 800 | 12.0% | 25.2% | 50 |
| M1238 | 4 | 16 | 47.8 | 5 | 0 | 12.2 | 15 | 0 | 800 | 10.2% | 22.6% | 100 |
| M1239 | 3 | 12 | 52.4 | 5 | 0 | 12.6 | 15 | 0 | 800 | 12.0% | 25.2% | 100 |
| M1240 | 4 | 16 | 47.2 | 5 | 0 | 12.8 | 15 | 0 | 800 | 10.2% | 22.7% | 100 |
| M1241 | 3 | 12 | 51.8 | 5 | 0 | 13.2 | 15 | 0 | 800 | 12.0% | 25.2% | 100 |
| M1242 | 4 | 16 | 46.6 | 5 | 0 | 13.4 | 15 | 0 | 800 | 10.1% | 22.7% | 100 |
| M1243 | 3 | 12 | 51.2 | 5 | 0 | 13.8 | 15 | 0 | 800 | 12.0% | 25.2% | 100 |
| M1244 | 4 | 16 | 46 | 5 | 0 | 14 | 15 | 0 | 800 | 10.1% | 22.8% | 150 |
| M1245 | 3 | 12 | 64.6 | 5.2 | 0 | 0.2 | 15 | 0 | 950 | 12.8% | 25.0% | −50 |
| M1246 | 4 | 16 | 59.4 | 5.2 | 0 | 0.4 | 15 | 0 | 900 | 11.1% | 21.9% | 50 |
| M1247 | 3 | 12 | 64 | 5.2 | 0 | 0.8 | 15 | 0 | 950 | 12.8% | 25.0% | 0 |
| M1248 | 4 | 16 | 58.8 | 5.2 | 0 | 1 | 15 | 0 | 900 | 11.0% | 21.9% | 50 |
| M1249 | 3 | 12 | 63.4 | 5.2 | 0 | 1.4 | 15 | 0 | 900 | 12.7% | 25.1% | 0 |
| M1250 | 4 | 16 | 58.2 | 5.2 | 0 | 1.6 | 15 | 0 | 900 | 10.9% | 22.0% | 50 |
| M1251 | 3 | 12 | 62.8 | 5.2 | 0 | 2 | 15 | 0 | 900 | 12.7% | 25.1% | 0 |
| M1252 | 4 | 16 | 57.6 | 5.2 | 0 | 2.2 | 15 | 0 | 900 | 10.9% | 22.0% | 100 |
| M1253 | 3 | 12 | 62.2 | 5.2 | 0 | 2.6 | 15 | 0 | 900 | 12.6% | 25.1% | 0 |
| M1254 | 4 | 16 | 57 | 5.2 | 0 | 2.8 | 15 | 0 | 900 | 10.8% | 22.0% | 100 |
| M1255 | 3 | 12 | 61.6 | 5.2 | 0 | 3.2 | 15 | 0 | 900 | 12.6% | 25.2% | 0 |
| M1256 | 4 | 16 | 56.4 | 5.2 | 0 | 3.4 | 15 | 0 | 900 | 10.7% | 22.1% | 100 |
| M1257 | 3 | 12 | 61 | 5.2 | 0 | 3.8 | 15 | 0 | 900 | 12.5% | 25.1% | 0 |
| M1258 | 4 | 16 | 55.8 | 5.2 | 0 | 4 | 15 | 0 | 850 | 10.7% | 22.1% | 100 |
| M1259 | 3 | 12 | 60.4 | 5.2 | 0 | 4.4 | 15 | 0 | 900 | 12.5% | 25.1% | 0 |
| M1260 | 4 | 16 | 55.2 | 5.2 | 0 | 4.6 | 15 | 0 | 850 | 10.6% | 22.1% | 100 |
| M1261 | 3 | 12 | 59.8 | 5.2 | 0 | 5 | 15 | 0 | 900 | 12.4% | 25.0% | 0 |
| M1262 | 4 | 16 | 54.6 | 5.2 | 0 | 5.2 | 15 | 0 | 850 | 10.5% | 22.2% | 100 |
| M1263 | 3 | 12 | 59.2 | 5.2 | 0 | 5.6 | 15 | 0 | 850 | 12.4% | 25.0% | 0 |
| M1264 | 4 | 16 | 54 | 5.2 | 0 | 5.8 | 15 | 0 | 850 | 10.5% | 22.2% | 100 |
| M1265 | 3 | 12 | 58.6 | 5.2 | 0 | 6.2 | 15 | 0 | 850 | 12.3% | 25.0% | 0 |
| M1266 | 4 | 16 | 53.4 | 5.2 | 0 | 6.4 | 15 | 0 | 850 | 10.4% | 22.2% | 100 |
| M1267 | 3 | 12 | 58 | 5.2 | 0 | 6.8 | 15 | 0 | 850 | 12.3% | 25.0% | 50 |
| M1268 | 4 | 16 | 52.8 | 5.2 | 0 | 7 | 15 | 0 | 850 | 10.4% | 22.3% | 50 |
| M1269 | 3 | 12 | 57.4 | 5.2 | 0 | 7.4 | 15 | 0 | 850 | 12.3% | 25.0% | 50 |
| M1270 | 4 | 16 | 52.2 | 5.2 | 0 | 7.6 | 15 | 0 | 850 | 10.3% | 22.3% | 50 |
| M1271 | 3 | 12 | 56.8 | 5.2 | 0 | 8 | 15 | 0 | 850 | 12.2% | 25.0% | 50 |
| M1272 | 4 | 16 | 51.6 | 5.2 | 0 | 8.2 | 15 | 0 | 850 | 10.3% | 22.4% | 100 |
| M1273 | 3 | 12 | 56.2 | 5.2 | 0 | 8.6 | 15 | 0 | 850 | 12.2% | 25.1% | 100 |
| M1274 | 4 | 16 | 51 | 5.2 | 0 | 8.8 | 15 | 0 | 850 | 10.2% | 22.4% | 100 |
| M1275 | 3 | 12 | 55.6 | 5.2 | 0 | 9.2 | 15 | 0 | 850 | 12.2% | 25.1% | 100 |
| M1276 | 4 | 16 | 50.4 | 5.2 | 0 | 9.4 | 15 | 0 | 850 | 10.2% | 22.4% | 100 |
| M1277 | 3 | 12 | 55 | 5.2 | 0 | 9.8 | 15 | 0 | 850 | 12.1% | 25.1% | 50 |
| M1278 | 4 | 16 | 49.8 | 5.2 | 0 | 10 | 15 | 0 | 800 | 10.1% | 22.5% | 100 |
| M1279 | 3 | 12 | 54.4 | 5.2 | 0 | 10.4 | 15 | 0 | 850 | 12.1% | 25.1% | 50 |
| M1280 | 4 | 16 | 49.2 | 5.2 | 0 | 10.6 | 15 | 0 | 800 | 10.1% | 22.5% | 100 |
| M1281 | 3 | 12 | 53.8 | 5.2 | 0 | 11 | 15 | 0 | 850 | 12.1% | 25.1% | 50 |
| M1282 | 4 | 16 | 48.6 | 5.2 | 0 | 11.2 | 15 | 0 | 800 | 10.0% | 22.6% | 100 |
| M1283 | 3 | 12 | 53.2 | 5.2 | 0 | 11.6 | 15 | 0 | 800 | 12.0% | 25.1% | 50 |
| M1284 | 4 | 16 | 48 | 5.2 | 0 | 11.8 | 15 | 0 | 800 | 10.2% | 22.6% | 100 |
| M1285 | 3 | 12 | 52.6 | 5.2 | 0 | 12.2 | 15 | 0 | 800 | 12.0% | 25.1% | 100 |
| M1286 | 4 | 16 | 47.4 | 5.2 | 0 | 12.4 | 15 | 0 | 800 | 10.2% | 22.6% | 100 |
| M1287 | 3 | 12 | 52 | 5.2 | 0 | 12.8 | 15 | 0 | 800 | 12.0% | 25.2% | 100 |
| M1288 | 4 | 16 | 46.8 | 5.2 | 0 | 13 | 15 | 0 | 800 | 10.2% | 22.7% | 100 |
| M1289 | 3 | 12 | 51.4 | 5.2 | 0 | 13.4 | 15 | 0 | 800 | 12.0% | 25.2% | 100 |
| M1290 | 4 | 16 | 46.2 | 5.2 | 0 | 13.6 | 15 | 0 | 800 | 10.1% | 22.7% | 100 |
| M1291 | 3 | 12 | 50.8 | 5.2 | 0 | 14 | 15 | 0 | 800 | 12.0% | 25.2% | 100 |
| M1292 | 4 | 16 | 59.6 | 5.4 | 0 | 0 | 15 | 0 | 900 | 11.1% | 21.9% | 50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M1293 | 3 | 12 | 64.2 | 5.4 | 0 | 0.4 | 15 | 0 | 950 | 12.8% | 25.0% | −50 |
| M1294 | 4 | 16 | 59 | 5.4 | 0 | 0.6 | 15 | 0 | 900 | 11.1% | 21.9% | 50 |
| M1295 | 3 | 12 | 63.6 | 5.4 | 0 | 1 | 15 | 0 | 900 | 12.7% | 25.0% | 0 |
| M1296 | 4 | 16 | 58.4 | 5.4 | 0 | 1.2 | 15 | 0 | 900 | 11.0% | 22.0% | 50 |
| M1297 | 3 | 12 | 63 | 5.4 | 0 | 1.6 | 15 | 0 | 900 | 12.7% | 25.1% | 0 |
| M1298 | 4 | 16 | 57.8 | 5.4 | 0 | 1.8 | 15 | 0 | 900 | 10.9% | 22.0% | 50 |
| M1299 | 3 | 12 | 62.4 | 5.4 | 0 | 2.2 | 15 | 0 | 900 | 12.6% | 25.1% | 0 |
| M1300 | 4 | 16 | 57.2 | 5.4 | 0 | 2.4 | 15 | 0 | 900 | 10.8% | 22.0% | 100 |
| M1301 | 3 | 12 | 61.8 | 5.4 | 0 | 2.8 | 15 | 0 | 900 | 12.6% | 25.2% | 0 |
| M1302 | 4 | 16 | 56.6 | 5.4 | 0 | 3 | 15 | 0 | 900 | 10.8% | 22.0% | 100 |
| M1303 | 3 | 12 | 61.2 | 5.4 | 0 | 3.4 | 15 | 0 | 900 | 12.5% | 25.2% | 0 |
| M1304 | 4 | 16 | 56 | 5.4 | 0 | 3.6 | 15 | 0 | 900 | 10.7% | 22.1% | 100 |
| M1305 | 3 | 12 | 60.6 | 5.4 | 0 | 4 | 15 | 0 | 900 | 12.5% | 25.1% | 0 |
| M1306 | 4 | 16 | 55.4 | 5.4 | 0 | 4.2 | 15 | 0 | 850 | 10.6% | 22.1% | 100 |
| M1307 | 3 | 12 | 60 | 5.4 | 0 | 4.6 | 15 | 0 | 900 | 12.4% | 25.1% | 0 |
| M1308 | 4 | 16 | 54.8 | 5.4 | 0 | 4.8 | 15 | 0 | 850 | 10.6% | 22.1% | 100 |
| M1309 | 3 | 12 | 59.4 | 5.4 | 0 | 5.2 | 15 | 0 | 850 | 12.4% | 25.0% | 0 |
| M1310 | 4 | 16 | 54.2 | 5.4 | 0 | 5.4 | 15 | 0 | 850 | 10.5% | 22.2% | 100 |
| M1311 | 3 | 12 | 58.8 | 5.4 | 0 | 5.8 | 15 | 0 | 850 | 12.4% | 25.0% | 0 |
| M1312 | 4 | 16 | 53.6 | 5.4 | 0 | 6 | 15 | 0 | 850 | 10.5% | 22.2% | 100 |
| M1313 | 3 | 12 | 58.2 | 5.4 | 0 | 6.4 | 15 | 0 | 850 | 12.3% | 25.0% | 0 |
| M1314 | 4 | 16 | 53 | 5.4 | 0 | 6.6 | 15 | 0 | 850 | 10.4% | 22.2% | 100 |
| M1315 | 3 | 12 | 57.6 | 5.4 | 0 | 7 | 15 | 0 | 850 | 12.3% | 25.0% | 50 |
| M1316 | 4 | 16 | 52.4 | 5.4 | 0 | 7.2 | 15 | 0 | 850 | 10.3% | 22.3% | 50 |
| M1317 | 3 | 12 | 57 | 5.4 | 0 | 7.6 | 15 | 0 | 850 | 12.2% | 25.0% | 50 |
| M1318 | 4 | 16 | 51.8 | 5.4 | 0 | 7.8 | 15 | 0 | 850 | 10.3% | 22.3% | 50 |
| M1319 | 3 | 12 | 56.4 | 5.4 | 0 | 8.2 | 15 | 0 | 850 | 12.2% | 25.0% | 100 |
| M1320 | 4 | 16 | 51.2 | 5.4 | 0 | 8.4 | 15 | 0 | 850 | 10.2% | 22.4% | 100 |
| M1321 | 3 | 12 | 55.8 | 5.4 | 0 | 8.8 | 15 | 0 | 850 | 12.2% | 25.0% | 100 |
| M1322 | 4 | 16 | 50.6 | 5.4 | 0 | 9 | 15 | 0 | 850 | 10.2% | 22.4% | 100 |
| M1323 | 3 | 12 | 55.2 | 5.4 | 0 | 9.4 | 15 | 0 | 850 | 12.1% | 25.1% | 50 |
| M1324 | 4 | 16 | 50 | 5.4 | 0 | 9.6 | 15 | 0 | 800 | 10.1% | 22.4% | 100 |
| M1325 | 3 | 12 | 54.6 | 5.4 | 0 | 10 | 15 | 0 | 850 | 12.1% | 25.1% | 50 |
| M1326 | 4 | 16 | 49.4 | 5.4 | 0 | 10.2 | 15 | 0 | 800 | 10.1% | 22.5% | 100 |
| M1327 | 3 | 12 | 54 | 5.4 | 0 | 10.6 | 15 | 0 | 850 | 12.1% | 25.1% | 50 |
| M1328 | 4 | 16 | 48.8 | 5.4 | 0 | 10.8 | 15 | 0 | 800 | 10.1% | 22.5% | 100 |
| M1329 | 3 | 12 | 53.4 | 5.4 | 0 | 11.2 | 15 | 0 | 800 | 12.1% | 25.1% | 50 |
| M1330 | 4 | 16 | 48.2 | 5.4 | 0 | 11.4 | 15 | 0 | 800 | 10.0% | 22.6% | 100 |
| M1331 | 3 | 12 | 52.8 | 5.4 | 0 | 11.8 | 15 | 0 | 800 | 12.0% | 25.1% | 50 |
| M1332 | 4 | 16 | 47.6 | 5.4 | 0 | 12 | 15 | 0 | 800 | 10.2% | 22.6% | 100 |
| M1333 | 3 | 12 | 52.2 | 5.4 | 0 | 12.4 | 15 | 0 | 800 | 12.0% | 25.1% | 100 |
| M1334 | 4 | 16 | 47 | 5.4 | 0 | 12.6 | 15 | 0 | 800 | 10.2% | 22.7% | 100 |
| M1335 | 3 | 12 | 51.6 | 5.4 | 0 | 13 | 15 | 0 | 800 | 12.0% | 25.2% | 100 |
| M1336 | 4 | 16 | 46.4 | 5.4 | 0 | 13.2 | 15 | 0 | 800 | 10.1% | 22.7% | 100 |
| M1337 | 3 | 12 | 51 | 5.4 | 0 | 13.6 | 15 | 0 | 800 | 12.0% | 25.2% | 100 |
| M1338 | 4 | 16 | 45.8 | 5.4 | 0 | 13.8 | 15 | 0 | 800 | 10.1% | 22.7% | 150 |
| M1339 | 3 | 12 | 64.4 | 5.6 | 0 | 0 | 15 | 0 | 950 | 12.8% | 25.0% | −50 |
| M1340 | 4 | 16 | 59.2 | 5.6 | 0 | 0.2 | 15 | 0 | 900 | 11.1% | 21.9% | 50 |
| M1341 | 3 | 12 | 63.8 | 5.6 | 0 | 0.6 | 15 | 0 | 900 | 12.8% | 25.0% | −50 |
| M1342 | 4 | 16 | 58.6 | 5.6 | 0 | 0.8 | 15 | 0 | 900 | 11.0% | 21.9% | 50 |
| M1343 | 3 | 12 | 63.2 | 5.6 | 0 | 1.2 | 15 | 0 | 900 | 12.7% | 25.0% | 0 |
| M1344 | 4 | 16 | 58 | 5.6 | 0 | 1.4 | 15 | 0 | 900 | 11.0% | 22.0% | 50 |
| M1345 | 3 | 12 | 62.6 | 5.6 | 0 | 1.8 | 15 | 0 | 900 | 12.7% | 25.1% | 0 |
| M1346 | 4 | 16 | 57.4 | 5.6 | 0 | 2 | 15 | 0 | 900 | 10.9% | 22.0% | 50 |
| M1347 | 3 | 12 | 62 | 5.6 | 0 | 2.4 | 15 | 0 | 900 | 12.6% | 25.1% | 0 |
| M1348 | 4 | 16 | 56.8 | 5.6 | 0 | 2.6 | 15 | 0 | 900 | 10.8% | 22.0% | 100 |
| M1349 | 3 | 12 | 61.4 | 5.6 | 0 | 3 | 15 | 0 | 900 | 12.6% | 25.2% | 0 |
| M1350 | 4 | 16 | 56.2 | 5.6 | 0 | 3.2 | 15 | 0 | 900 | 10.7% | 22.1% | 100 |
| M1351 | 3 | 12 | 60.8 | 5.6 | 0 | 3.6 | 15 | 0 | 900 | 12.5% | 25.2% | 0 |
| M1352 | 4 | 16 | 55.6 | 5.6 | 0 | 3.8 | 15 | 0 | 850 | 10.7% | 22.1% | 100 |
| M1353 | 3 | 12 | 60.2 | 5.6 | 0 | 4.2 | 15 | 0 | 900 | 12.5% | 25.1% | 0 |
| M1354 | 4 | 16 | 55 | 5.6 | 0 | 4.4 | 15 | 0 | 850 | 10.6% | 22.1% | 100 |
| M1355 | 3 | 12 | 59.6 | 5.6 | 0 | 4.8 | 15 | 0 | 850 | 12.4% | 25.1% | 0 |
| M1356 | 4 | 16 | 54.4 | 5.6 | 0 | 5 | 15 | 0 | 850 | 10.6% | 22.2% | 100 |
| M1357 | 3 | 12 | 59 | 5.6 | 0 | 5.4 | 15 | 0 | 850 | 12.4% | 25.0% | 0 |
| M1358 | 4 | 16 | 53.8 | 5.6 | 0 | 5.6 | 15 | 0 | 850 | 10.5% | 22.2% | 100 |
| M1359 | 3 | 12 | 58.4 | 5.6 | 0 | 6 | 15 | 0 | 850 | 12.3% | 25.0% | 0 |
| M1360 | 4 | 16 | 53.2 | 5.6 | 0 | 6.2 | 15 | 0 | 850 | 10.4% | 22.2% | 100 |
| M1361 | 3 | 12 | 57.8 | 5.6 | 0 | 6.6 | 15 | 0 | 850 | 12.3% | 25.0% | 50 |
| M1362 | 4 | 16 | 52.6 | 5.6 | 0 | 6.8 | 15 | 0 | 850 | 10.4% | 22.3% | 100 |
| M1363 | 3 | 12 | 57.2 | 5.6 | 0 | 7.2 | 15 | 0 | 850 | 12.3% | 25.0% | 50 |
| M1364 | 4 | 16 | 52 | 5.6 | 0 | 7.4 | 15 | 0 | 850 | 10.3% | 22.3% | 50 |
| M1365 | 3 | 12 | 56.6 | 5.6 | 0 | 7.8 | 15 | 0 | 850 | 12.2% | 25.0% | 50 |
| M1366 | 4 | 16 | 51.4 | 5.6 | 0 | 8 | 15 | 0 | 850 | 10.3% | 22.3% | 100 |
| M1367 | 3 | 12 | 56 | 5.6 | 0 | 8.4 | 15 | 0 | 850 | 12.2% | 25.0% | 100 |
| M1368 | 4 | 16 | 50.8 | 5.6 | 0 | 8.6 | 15 | 0 | 850 | 10.2% | 22.4% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M1369 | 3 | 12 | 55.4 | 5.6 | 0 | 9 | 15 | 0 | 850 | 12.2% | 25.0% | 100 |
| M1370 | 4 | 16 | 50.2 | 5.6 | 0 | 9.2 | 15 | 0 | 850 | 10.2% | 22.4% | 100 |
| M1371 | 3 | 12 | 54.8 | 5.6 | 0 | 9.6 | 15 | 0 | 850 | 12.1% | 25.1% | 50 |
| M1372 | 4 | 16 | 49.6 | 5.6 | 0 | 9.8 | 15 | 0 | 800 | 10.1% | 22.4% | 100 |
| M1373 | 3 | 12 | 54.2 | 5.6 | 0 | 10.2 | 15 | 0 | 850 | 12.1% | 25.1% | 50 |
| M1374 | 4 | 16 | 49 | 5.6 | 0 | 10.4 | 15 | 0 | 800 | 10.1% | 22.5% | 100 |
| M1375 | 3 | 12 | 53.6 | 5.6 | 0 | 10.8 | 15 | 0 | 850 | 12.1% | 25.1% | 50 |
| M1376 | 4 | 16 | 48.4 | 5.6 | 0 | 11 | 15 | 0 | 800 | 10.0% | 22.5% | 100 |
| M1377 | 3 | 12 | 53 | 5.6 | 0 | 11.4 | 15 | 0 | 800 | 12.0% | 25.1% | 50 |
| M1378 | 4 | 16 | 47.8 | 5.6 | 0 | 11.6 | 15 | 0 | 800 | 10.0% | 22.6% | 100 |
| M1379 | 3 | 12 | 52.4 | 5.6 | 0 | 12 | 15 | 0 | 800 | 12.0% | 25.1% | 100 |
| M1380 | 4 | 16 | 47.2 | 5.6 | 0 | 12.2 | 15 | 0 | 800 | 10.2% | 22.6% | 100 |
| M1381 | 3 | 12 | 51.8 | 5.6 | 0 | 12.6 | 15 | 0 | 800 | 12.0% | 25.1% | 100 |
| M1382 | 4 | 16 | 46.6 | 5.6 | 0 | 12.8 | 15 | 0 | 800 | 10.1% | 22.7% | 100 |
| M1383 | 3 | 12 | 51.2 | 5.6 | 0 | 13.2 | 15 | 0 | 800 | 12.0% | 25.2% | 100 |
| M1384 | 4 | 16 | 46 | 5.6 | 0 | 13.4 | 15 | 0 | 800 | 10.1% | 22.7% | 100 |
| M1385 | 3 | 12 | 50.6 | 5.6 | 0 | 13.8 | 15 | 0 | 800 | 11.9% | 25.2% | 100 |
| M1386 | 4 | 16 | 45.4 | 5.6 | 0 | 14 | 15 | 0 | 800 | 10.1% | 22.7% | 150 |
| M1387 | 3 | 12 | 64 | 5.8 | 0 | 0.2 | 15 | 0 | 950 | 12.8% | 25.0% | −50 |
| M1388 | 4 | 16 | 58.8 | 5.8 | 0 | 0.4 | 15 | 0 | 900 | 11.1% | 21.9% | 50 |
| M1389 | 3 | 12 | 63.4 | 5.8 | 0 | 0.8 | 15 | 0 | 900 | 12.8% | 25.0% | 0 |
| M1390 | 4 | 16 | 58.2 | 5.8 | 0 | 1 | 15 | 0 | 900 | 11.0% | 21.9% | 50 |
| M1391 | 3 | 12 | 62.8 | 5.8 | 0 | 1.4 | 15 | 0 | 900 | 12.7% | 25.0% | 0 |
| M1392 | 4 | 16 | 57.6 | 5.8 | 0 | 1.6 | 15 | 0 | 900 | 10.9% | 22.0% | 50 |
| M1393 | 3 | 12 | 62.2 | 5.8 | 0 | 2 | 15 | 0 | 900 | 12.7% | 25.1% | 0 |
| M1394 | 4 | 16 | 57 | 5.8 | 0 | 2.2 | 15 | 0 | 900 | 10.9% | 22.0% | 100 |
| M1395 | 3 | 12 | 61.6 | 5.8 | 0 | 2.6 | 15 | 0 | 900 | 12.6% | 25.1% | 0 |
| M1396 | 4 | 16 | 56.4 | 5.8 | 0 | 2.8 | 15 | 0 | 900 | 10.8% | 22.0% | 100 |
| M1397 | 3 | 12 | 61 | 5.8 | 0 | 3.2 | 15 | 0 | 900 | 12.6% | 25.2% | 0 |
| M1398 | 4 | 16 | 55.8 | 5.8 | 0 | 3.4 | 15 | 0 | 850 | 10.7% | 22.1% | 100 |
| M1399 | 3 | 12 | 60.4 | 5.8 | 0 | 3.8 | 15 | 0 | 900 | 12.5% | 25.2% | 0 |
| M1400 | 4 | 16 | 55.2 | 5.8 | 0 | 4 | 15 | 0 | 850 | 10.7% | 22.1% | 100 |
| M1401 | 3 | 12 | 59.8 | 5.8 | 0 | 4.4 | 15 | 0 | 850 | 12.5% | 25.1% | 0 |
| M1402 | 4 | 16 | 54.6 | 5.8 | 0 | 4.6 | 15 | 0 | 850 | 10.6% | 22.1% | 100 |
| M1403 | 3 | 12 | 59.2 | 5.8 | 0 | 5 | 15 | 0 | 850 | 12.4% | 25.1% | 0 |
| M1404 | 4 | 16 | 54 | 5.8 | 0 | 5.2 | 15 | 0 | 850 | 10.5% | 22.2% | 100 |
| M1405 | 3 | 12 | 58.6 | 5.8 | 0 | 5.6 | 15 | 0 | 850 | 12.4% | 25.0% | 0 |
| M1406 | 4 | 16 | 53.4 | 5.8 | 0 | 5.8 | 15 | 0 | 850 | 10.5% | 22.2% | 100 |
| M1407 | 3 | 12 | 58 | 5.8 | 0 | 6.2 | 15 | 0 | 850 | 12.3% | 25.0% | 0 |
| M1408 | 4 | 16 | 52.8 | 5.8 | 0 | 6.4 | 15 | 0 | 850 | 10.4% | 22.2% | 100 |
| M1409 | 3 | 12 | 57.4 | 5.8 | 0 | 6.8 | 15 | 0 | 850 | 12.3% | 25.0% | 50 |
| M1410 | 4 | 16 | 52.2 | 5.8 | 0 | 7 | 15 | 0 | 850 | 10.4% | 22.3% | 100 |
| M1411 | 3 | 12 | 56.8 | 5.8 | 0 | 7.4 | 15 | 0 | 850 | 12.3% | 25.0% | 50 |
| M1412 | 4 | 16 | 51.6 | 5.8 | 0 | 7.6 | 15 | 0 | 850 | 10.3% | 22.3% | 50 |
| M1413 | 3 | 12 | 56.2 | 5.8 | 0 | 8 | 15 | 0 | 850 | 12.2% | 25.0% | 100 |
| M1414 | 4 | 16 | 51 | 5.8 | 0 | 8.2 | 15 | 0 | 850 | 10.2% | 22.3% | 100 |
| M1415 | 3 | 12 | 55.6 | 5.8 | 0 | 8.6 | 15 | 0 | 850 | 12.2% | 25.0% | 100 |
| M1416 | 4 | 16 | 50.4 | 5.8 | 0 | 8.8 | 15 | 0 | 850 | 10.2% | 22.4% | 100 |
| M1417 | 3 | 12 | 55 | 5.8 | 0 | 9.2 | 15 | 0 | 850 | 12.1% | 25.0% | 100 |
| M1418 | 4 | 16 | 49.8 | 5.8 | 0 | 9.4 | 15 | 0 | 800 | 10.1% | 22.4% | 100 |
| M1419 | 3 | 12 | 54.4 | 5.8 | 0 | 9.8 | 15 | 0 | 850 | 12.1% | 25.1% | 50 |
| M1420 | 4 | 16 | 49.2 | 5.8 | 0 | 10 | 15 | 0 | 800 | 10.1% | 22.4% | 100 |
| M1421 | 3 | 12 | 53.8 | 5.8 | 0 | 10.4 | 15 | 0 | 850 | 12.1% | 25.1% | 50 |
| M1422 | 4 | 16 | 48.6 | 5.8 | 0 | 10.6 | 15 | 0 | 800 | 10.1% | 22.5% | 100 |
| M1423 | 3 | 12 | 53.2 | 5.8 | 0 | 11 | 15 | 0 | 800 | 12.1% | 25.1% | 50 |
| M1424 | 4 | 16 | 48 | 5.8 | 0 | 11.2 | 15 | 0 | 800 | 10.0% | 22.5% | 100 |
| M1425 | 3 | 12 | 52.6 | 5.8 | 0 | 11.6 | 15 | 0 | 800 | 12.0% | 25.1% | 50 |
| M1426 | 4 | 16 | 47.4 | 5.8 | 0 | 11.8 | 15 | 0 | 800 | 10.0% | 22.6% | 100 |
| M1427 | 3 | 12 | 52 | 5.8 | 0 | 12.2 | 15 | 0 | 800 | 12.0% | 25.1% | 100 |
| M1428 | 4 | 16 | 46.8 | 5.8 | 0 | 12.4 | 15 | 0 | 800 | 10.2% | 22.6% | 100 |
| M1429 | 3 | 12 | 51.4 | 5.8 | 0 | 12.8 | 15 | 0 | 800 | 12.0% | 25.1% | 100 |
| M1430 | 4 | 16 | 46.2 | 5.8 | 0 | 13 | 15 | 0 | 800 | 10.1% | 22.7% | 100 |
| M1431 | 3 | 12 | 50.8 | 5.8 | 0 | 13.4 | 15 | 0 | 800 | 12.0% | 25.2% | 100 |
| M1432 | 4 | 16 | 45.6 | 5.8 | 0 | 13.6 | 15 | 0 | 800 | 10.1% | 22.7% | 150 |
| M1433 | 3 | 12 | 50.2 | 5.8 | 0 | 14 | 15 | 0 | 800 | 11.9% | 25.2% | 100 |
| M1434 | 2.2 | 10 | 71.8 | 6 | 0 | 0 | 10 | 0 | 900 | 10.4% | 17.3% | −50 |
| M1435 | 2.6 | 10 | 71.4 | 6 | 0 | 0 | 10 | 0 | 900 | 9.0% | 17.2% | −50 |
| M1436 | 2 | 10 | 71.5 | 6 | 0 | 0 | 10.5 | 0 | 950 | 10.5% | 17.4% | −50 |
| M1437 | 2.5 | 10 | 70.5 | 6 | 0 | 0 | 11 | 0 | 900 | 10.2% | 19.1% | −50 |
| M1438 | 3 | 10 | 69.5 | 6 | 0 | 0 | 11.5 | 0 | 900 | 8.8% | 20.0% | −50 |
| M1439 | 2 | 10.2 | 71.8 | 6 | 0 | 0 | 10 | 0 | 950 | 10.7% | 17.0% | −50 |
| M1440 | 2.5 | 10.2 | 71.3 | 6 | 0 | 0 | 10 | 0 | 900 | 9.5% | 17.1% | −50 |
| M1441 | 3 | 10.2 | 70.8 | 6 | 0 | 0 | 10 | 0 | 900 | 7.8% | 17.1% | −50 |
| M1442 | 3 | 10.2 | 70.3 | 6 | 0 | 0 | 10.5 | 0 | 900 | 8.1% | 18.0% | −50 |
| M1443 | 2.5 | 10.2 | 69.8 | 6 | 0 | 0 | 11.5 | 0 | 900 | 10.7% | 19.9% | −50 |
| M1444 | 3 | 10.2 | 68.8 | 6 | 0 | 0 | 12 | 0 | 900 | 9.2% | 20.8% | −50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M1445 | 2.4 | 10.4 | 71.2 | 6 | 0 | 0 | 10 | 0 | 900 | 10.0% | 17.0% | −50 |
| M1446 | 2.8 | 10.4 | 70.8 | 6 | 0 | 0 | 10 | 0 | 900 | 8.5% | 16.9% | −50 |
| M1447 | 2.5 | 10.4 | 70.6 | 6 | 0 | 0 | 10.5 | 0 | 900 | 10.0% | 17.9% | −50 |
| M1448 | 3 | 10.4 | 69.6 | 6 | 0 | 0 | 11 | 0 | 900 | 8.6% | 18.8% | −50 |
| M1449 | 2.5 | 10.4 | 69.1 | 6 | 0 | 0 | 12 | 0 | 900 | 11.0% | 20.7% | −50 |
| M1450 | 2.2 | 10.6 | 71.2 | 6 | 0 | 0 | 10 | 0 | 900 | 10.9% | 16.9% | −50 |
| M1451 | 2.6 | 10.6 | 70.8 | 6 | 0 | 0 | 10 | 0 | 900 | 9.3% | 16.8% | −50 |
| M1452 | 2 | 10.6 | 70.9 | 6 | 0 | 0 | 10.5 | 0 | 950 | 11.2% | 17.4% | −50 |
| M1453 | 2.5 | 10.6 | 69.9 | 6 | 0 | 0 | 11 | 0 | 900 | 10.5% | 18.7% | −50 |
| M1454 | 3 | 10.6 | 68.9 | 6 | 0 | 0 | 11.5 | 0 | 900 | 9.1% | 19.6% | −50 |
| M1455 | 2 | 10.8 | 71.2 | 6 | 0 | 0 | 10 | 0 | 950 | 11.3% | 16.9% | −50 |
| M1456 | 2.5 | 10.8 | 70.7 | 6 | 0 | 0 | 10 | 0 | 900 | 9.8% | 16.7% | −50 |
| M1457 | 3 | 10.8 | 70.2 | 6 | 0 | 0 | 10 | 0 | 900 | 8.1% | 16.7% | −50 |
| M1458 | 3 | 10.8 | 69.7 | 6 | 0 | 0 | 10.5 | 0 | 900 | 8.4% | 17.6% | −50 |
| M1459 | 2.5 | 10.8 | 69.2 | 6 | 0 | 0 | 11.5 | 0 | 900 | 11.1% | 19.5% | −50 |
| M1460 | 3 | 10.8 | 68.2 | 6 | 0 | 0 | 12 | 0 | 900 | 9.6% | 20.3% | −50 |
| M1461 | 2.4 | 11 | 70.6 | 6 | 0 | 0 | 10 | 0 | 900 | 10.3% | 16.6% | −50 |
| M1462 | 2.8 | 11 | 70.2 | 6 | 0 | 0 | 10 | 0 | 900 | 8.9% | 16.5% | −50 |
| M1463 | 2.5 | 11 | 70 | 6 | 0 | 0 | 10.5 | 0 | 900 | 10.3% | 17.5% | −50 |
| M1464 | 3 | 11 | 69 | 6 | 0 | 0 | 11 | 0 | 900 | 8.9% | 18.4% | −50 |
| M1465 | 2.5 | 11 | 68.5 | 6 | 0 | 0 | 12 | 0 | 900 | 11.6% | 20.3% | −50 |
| M1466 | 2.2 | 11.2 | 70.6 | 6 | 0 | 0 | 10 | 0 | 900 | 11.2% | 16.5% | −50 |
| M1467 | 2.6 | 11.2 | 70.2 | 6 | 0 | 0 | 10 | 0 | 900 | 9.7% | 16.4% | −50 |
| M1468 | 2.5 | 11.2 | 69.8 | 6 | 0 | 0 | 10.5 | 0 | 900 | 10.5% | 17.4% | −50 |
| M1469 | 3 | 11.2 | 68.8 | 6 | 0 | 0 | 11 | 0 | 900 | 9.0% | 18.3% | −50 |
| M1470 | 2.5 | 11.2 | 68.3 | 6 | 0 | 0 | 12 | 0 | 900 | 11.7% | 20.2% | −50 |
| M1471 | 2.2 | 11.4 | 70.4 | 6 | 0 | 0 | 10 | 0 | 900 | 11.3% | 16.4% | −50 |
| M1472 | 2.6 | 11.4 | 70 | 6 | 0 | 0 | 10 | 0 | 900 | 9.8% | 16.3% | −50 |
| M1473 | 2.5 | 11.4 | 69.6 | 6 | 0 | 0 | 10.5 | 0 | 900 | 10.6% | 17.2% | −50 |
| M1474 | 3 | 11.4 | 68.6 | 6 | 0 | 0 | 11 | 0 | 900 | 9.1% | 18.1% | −50 |
| M1475 | 2.5 | 11.4 | 68.1 | 6 | 0 | 0 | 12 | 0 | 900 | 11.9% | 20.1% | −50 |
| M1476 | 2.2 | 11.6 | 70.2 | 6 | 0 | 0 | 10 | 0 | 900 | 11.4% | 16.3% | −50 |
| M1477 | 2.6 | 11.6 | 69.8 | 6 | 0 | 0 | 10 | 0 | 900 | 9.9% | 16.1% | −50 |
| M1478 | 2.5 | 11.6 | 69.4 | 6 | 0 | 0 | 10.5 | 0 | 900 | 10.7% | 17.1% | −50 |
| M1479 | 3 | 11.6 | 68.4 | 6 | 0 | 0 | 11 | 0 | 900 | 9.2% | 18.0% | −50 |
| M1480 | 2.5 | 11.6 | 67.9 | 6 | 0 | 0 | 12 | 0 | 900 | 12.0% | 19.9% | −50 |
| M1481 | 2.2 | 11.8 | 70 | 6 | 0 | 0 | 10 | 0 | 900 | 11.6% | 16.1% | −50 |
| M1482 | 2.6 | 11.8 | 69.6 | 6 | 0 | 0 | 10 | 0 | 900 | 10.0% | 16.0% | −50 |
| M1483 | 2.5 | 11.8 | 69.2 | 6 | 0 | 0 | 10.5 | 0 | 900 | 10.8% | 17.0% | −50 |
| M1484 | 3 | 11.8 | 68.2 | 6 | 0 | 0 | 11 | 0 | 900 | 9.3% | 17.8% | −50 |
| M1485 | 2.5 | 11.8 | 67.7 | 6 | 0 | 0 | 12 | 0 | 900 | 12.1% | 19.8% | −50 |
| M1486 | 2.2 | 12 | 69.8 | 6 | 0 | 0 | 10 | 0 | 900 | 11.7% | 16.0% | −50 |
| M1487 | 2.6 | 12 | 69.4 | 6 | 0 | 0 | 10 | 0 | 900 | 10.1% | 15.9% | −50 |
| M1488 | 2.5 | 12 | 69 | 6 | 0 | 0 | 10.5 | 0 | 900 | 10.9% | 16.8% | −50 |
| M1489 | 3 | 12 | 68 | 6 | 0 | 0 | 11 | 0 | 900 | 9.4% | 17.7% | −50 |
| M1490 | 2.5 | 12 | 67.5 | 6 | 0 | 0 | 12 | 0 | 900 | 12.2% | 19.7% | −50 |
| M1491 | 2.5 | 12.2 | 69.3 | 6 | 0 | 0 | 10 | 0 | 900 | 10.6% | 15.7% | −50 |
| M1492 | 3 | 12.2 | 68.3 | 6 | 0 | 0 | 10.5 | 0 | 900 | 9.2% | 16.7% | −50 |
| M1493 | 2.5 | 12.2 | 67.8 | 6 | 0 | 0 | 11.5 | 0 | 900 | 11.9% | 18.6% | −50 |
| M1494 | 3 | 12.2 | 66.8 | 6 | 0 | 0 | 12 | 0 | 900 | 10.3% | 19.4% | −50 |
| M1495 | 2.5 | 12.4 | 68.6 | 6 | 0 | 0 | 10.5 | 0 | 900 | 11.1% | 16.6% | −50 |
| M1496 | 3 | 12.4 | 67.6 | 6 | 0 | 0 | 11 | 0 | 900 | 9.7% | 17.4% | −50 |
| M1497 | 2.5 | 12.4 | 67.1 | 6 | 0 | 0 | 12 | 0 | 900 | 12.5% | 19.7% | −50 |
| M1498 | 3 | 12.6 | 68.4 | 6 | 0 | 0 | 10 | 0 | 900 | 9.0% | 15.5% | −50 |
| M1499 | 2.5 | 12.6 | 67.9 | 6 | 0 | 0 | 11 | 0 | 900 | 11.7% | 17.4% | −50 |
| M1500 | 3 | 12.6 | 66.9 | 6 | 0 | 0 | 11.5 | 0 | 900 | 10.2% | 18.2% | −50 |
| M1501 | 2.5 | 12.8 | 68.7 | 6 | 0 | 0 | 10 | 0 | 900 | 11.0% | 15.3% | −50 |
| M1502 | 3 | 12.8 | 67.7 | 6 | 0 | 0 | 10.5 | 0 | 900 | 9.5% | 16.2% | −50 |
| M1503 | 2.5 | 12.8 | 67.2 | 6 | 0 | 0 | 11.5 | 0 | 900 | 12.3% | 18.2% | −50 |
| M1504 | 3 | 12.8 | 66.2 | 6 | 0 | 0 | 12 | 0 | 900 | 10.7% | 18.9% | −50 |
| M1505 | 2.5 | 13 | 68 | 6 | 0 | 0 | 10.5 | 0 | 900 | 11.5% | 16.1% | −50 |
| M1506 | 3 | 13 | 67 | 6 | 0 | 0 | 11 | 0 | 900 | 10.0% | 17.0% | −50 |
| M1507 | 2.5 | 13 | 66.5 | 6 | 0 | 0 | 12 | 0 | 950 | 12.8% | 19.3% | −50 |
| M1508 | 3 | 13.2 | 67.8 | 6 | 0 | 0 | 10 | 0 | 900 | 9.3% | 15.1% | −50 |
| M1509 | 2.5 | 13.2 | 67.3 | 6 | 0 | 0 | 11 | 0 | 900 | 12.1% | 17.0% | −50 |
| M1510 | 3 | 13.2 | 66.3 | 6 | 0 | 0 | 11.5 | 0 | 900 | 10.5% | 17.8% | −50 |
| M1511 | 2.5 | 13.4 | 68.1 | 6 | 0 | 0 | 10 | 0 | 900 | 11.3% | 14.9% | −50 |
| M1512 | 3 | 13.4 | 67.1 | 6 | 0 | 0 | 10.5 | 0 | 900 | 9.8% | 15.8% | −50 |
| M1513 | 2.5 | 13.4 | 66.6 | 6 | 0 | 0 | 11.5 | 0 | 900 | 12.6% | 18.2% | −50 |
| M1514 | 3 | 13.4 | 65.6 | 6 | 0 | 0 | 12 | 0 | 900 | 11.0% | 18.5% | −50 |
| M1515 | 2.5 | 13.6 | 67.4 | 6 | 0 | 0 | 10.5 | 0 | 900 | 11.8% | 15.7% | −50 |
| M1516 | 3 | 13.6 | 66.4 | 6 | 0 | 0 | 11 | 0 | 900 | 10.3% | 16.6% | −50 |
| M1517 | 2.5 | 13.6 | 65.9 | 6 | 0 | 0 | 12 | 0 | 950 | 13.2% | 18.9% | −50 |
| M1518 | 3 | 13.8 | 67.2 | 6 | 0 | 0 | 10 | 0 | 900 | 9.6% | 14.6% | −50 |
| M1519 | 2.5 | 13.8 | 66.7 | 6 | 0 | 0 | 11 | 0 | 900 | 12.4% | 16.7% | −50 |
| M1520 | 3 | 13.8 | 65.7 | 6 | 0 | 0 | 11.5 | 0 | 900 | 10.8% | 17.3% | −50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M1521 | 3 | 14 | 67 | 6 | 0 | 0 | 10 | 0 | 900 | 9.8% | 14.5% | −50 |
| M1522 | 2.5 | 14 | 66.5 | 6 | 0 | 0 | 11 | 0 | 900 | 12.5% | 16.7% | −50 |
| M1523 | 3 | 14 | 65.5 | 6 | 0 | 0 | 11.5 | 0 | 900 | 11.0% | 17.2% | −50 |
| M1524 | 3 | 12 | 63.8 | 6 | 0 | 0.2 | 15 | 0 | 900 | 12.8% | 25.0% | −50 |
| M1525 | 4 | 16 | 58.6 | 6 | 0 | 0.4 | 15 | 0 | 900 | 11.1% | 21.9% | 50 |
| M1526 | 3 | 12 | 63.2 | 6 | 0 | 0.8 | 15 | 0 | 900 | 12.8% | 25.0% | 0 |
| M1527 | 4 | 16 | 58 | 6 | 0 | 1 | 15 | 0 | 900 | 11.0% | 21.9% | 50 |
| M1528 | 3 | 12 | 62.6 | 6 | 0 | 1.4 | 15 | 0 | 900 | 12.7% | 25.0% | 0 |
| M1529 | 4 | 16 | 57.4 | 6 | 0 | 1.6 | 15 | 0 | 900 | 10.9% | 22.0% | 50 |
| M1530 | 3 | 12 | 62 | 6 | 0 | 2 | 15 | 0 | 900 | 12.7% | 25.1% | 0 |
| M1531 | 4 | 16 | 56.8 | 6 | 0 | 2.2 | 15 | 0 | 900 | 10.9% | 22.0% | 100 |
| M1532 | 3 | 12 | 61.4 | 6 | 0 | 2.6 | 15 | 0 | 900 | 12.6% | 25.1% | 0 |
| M1533 | 4 | 16 | 56.2 | 6 | 0 | 2.8 | 15 | 0 | 900 | 10.8% | 22.0% | 100 |
| M1534 | 3 | 12 | 60.8 | 6 | 0 | 3.2 | 15 | 0 | 900 | 12.6% | 25.2% | 0 |
| M1535 | 4 | 16 | 55.6 | 6 | 0 | 3.4 | 15 | 0 | 850 | 10.7% | 22.1% | 100 |
| M1536 | 3 | 12 | 60.2 | 6 | 0 | 3.8 | 15 | 0 | 850 | 12.5% | 25.2% | 0 |
| M1537 | 4 | 16 | 55 | 6 | 0 | 4 | 15 | 0 | 850 | 10.7% | 22.1% | 100 |
| M1538 | 3 | 12 | 59.6 | 6 | 0 | 4.4 | 15 | 0 | 850 | 12.5% | 25.2% | 0 |
| M1539 | 4 | 16 | 54.4 | 6 | 0 | 4.6 | 15 | 0 | 850 | 10.6% | 22.1% | 100 |
| M1540 | 3 | 12 | 59 | 6 | 0 | 5 | 15 | 0 | 850 | 12.4% | 25.1% | 0 |
| M1541 | 4 | 16 | 53.8 | 6 | 0 | 5.2 | 15 | 0 | 850 | 10.5% | 22.1% | 100 |
| M1542 | 3 | 12 | 58.4 | 6 | 0 | 5.6 | 15 | 0 | 850 | 12.4% | 25.0% | 0 |
| M1543 | 4 | 16 | 53.2 | 6 | 0 | 5.8 | 15 | 0 | 850 | 10.5% | 22.2% | 100 |
| M1544 | 3 | 12 | 57.8 | 6 | 0 | 6.2 | 15 | 0 | 850 | 12.3% | 25.0% | 0 |
| M1545 | 4 | 16 | 52.6 | 6 | 0 | 6.4 | 15 | 0 | 850 | 10.4% | 22.2% | 100 |
| M1546 | 3 | 12 | 57.2 | 6 | 0 | 6.8 | 15 | 0 | 850 | 12.3% | 25.0% | 50 |
| M1547 | 4 | 16 | 52 | 6 | 0 | 7 | 15 | 0 | 850 | 10.3% | 22.2% | 100 |
| M1548 | 3 | 12 | 56.6 | 6 | 0 | 7.4 | 15 | 0 | 850 | 12.2% | 25.0% | 50 |
| M1549 | 3 | 12 | 56.2 | 6 | 0 | 7.8 | 15 | 0 | 850 | 12.2% | 25.0% | 100 |
| M1550 | 4 | 16 | 51 | 6 | 0 | 8 | 15 | 0 | 850 | 10.3% | 22.3% | 100 |
| M1551 | 3 | 12 | 55.6 | 6 | 0 | 8.4 | 15 | 0 | 850 | 12.2% | 25.0% | 100 |
| M1552 | 4 | 16 | 50.4 | 6 | 0 | 8.6 | 15 | 0 | 850 | 10.2% | 22.3% | 100 |
| M1553 | 3 | 12 | 55 | 6 | 0 | 9 | 15 | 0 | 850 | 12.2% | 25.0% | 100 |
| M1554 | 4 | 16 | 49.8 | 6 | 0 | 9.2 | 15 | 0 | 800 | 10.2% | 22.4% | 100 |
| M1555 | 3 | 12 | 54.4 | 6 | 0 | 9.6 | 15 | 0 | 850 | 12.1% | 25.0% | 50 |
| M1556 | 4 | 16 | 49.2 | 6 | 0 | 9.8 | 15 | 0 | 800 | 10.1% | 22.4% | 100 |
| M1557 | 3 | 12 | 53.8 | 6 | 0 | 10.2 | 15 | 0 | 850 | 12.1% | 25.1% | 50 |
| M1558 | 4 | 16 | 48.6 | 6 | 0 | 10.4 | 15 | 0 | 800 | 10.1% | 22.5% | 100 |
| M1559 | 3 | 12 | 53.2 | 6 | 0 | 10.8 | 15 | 0 | 800 | 12.1% | 25.1% | 50 |
| M1560 | 4 | 16 | 48 | 6 | 0 | 11 | 15 | 0 | 800 | 10.0% | 22.5% | 100 |
| M1561 | 3 | 12 | 52.6 | 6 | 0 | 11.4 | 15 | 0 | 800 | 12.0% | 25.1% | 50 |
| M1562 | 4 | 16 | 47.4 | 6 | 0 | 11.6 | 15 | 0 | 800 | 10.0% | 22.5% | 100 |
| M1563 | 3 | 12 | 52 | 6 | 0 | 12 | 15 | 0 | 800 | 12.0% | 25.1% | 100 |
| M1564 | 4 | 16 | 46.8 | 6 | 0 | 12.2 | 15 | 0 | 800 | 9.9% | 22.6% | 100 |
| M1565 | 3 | 12 | 51.4 | 6 | 0 | 12.6 | 15 | 0 | 800 | 12.0% | 25.1% | 100 |
| M1566 | 4 | 16 | 46.2 | 6 | 0 | 12.8 | 15 | 0 | 800 | 10.1% | 22.6% | 100 |
| M1567 | 3 | 12 | 50.8 | 6 | 0 | 13.2 | 15 | 0 | 800 | 12.0% | 25.1% | 100 |
| M1568 | 4 | 16 | 45.6 | 6 | 0 | 13.4 | 15 | 0 | 800 | 10.1% | 22.7% | 150 |
| M1569 | 3 | 12 | 50.2 | 6 | 0 | 13.8 | 15 | 0 | 800 | 11.9% | 25.2% | 100 |
| M1570 | 4 | 16 | 45 | 6 | 0 | 14 | 15 | 0 | 800 | 10.1% | 22.7% | 150 |
| M1571 | 3 | 12 | 63.6 | 6.2 | 0 | 0.2 | 15 | 0 | 900 | 12.8% | 25.0% | −50 |
| M1572 | 4 | 16 | 58.4 | 6.2 | 0 | 0.4 | 15 | 0 | 900 | 11.1% | 21.9% | 50 |
| M1573 | 3 | 12 | 63 | 6.2 | 0 | 0.8 | 15 | 0 | 900 | 12.8% | 25.0% | 0 |
| M1574 | 4 | 16 | 57.8 | 6.2 | 0 | 1 | 15 | 0 | 900 | 11.0% | 21.9% | 50 |
| M1575 | 3 | 12 | 62.4 | 6.2 | 0 | 1.4 | 15 | 0 | 900 | 12.7% | 25.0% | 0 |
| M1576 | 4 | 16 | 57.2 | 6.2 | 0 | 1.6 | 15 | 0 | 900 | 11.0% | 22.0% | 50 |
| M1577 | 3 | 12 | 61.8 | 6.2 | 0 | 2 | 15 | 0 | 900 | 12.7% | 25.1% | 0 |
| M1578 | 4 | 16 | 56.6 | 6.2 | 0 | 2.2 | 15 | 0 | 900 | 10.9% | 22.0% | 100 |
| M1579 | 3 | 12 | 61.2 | 6.2 | 0 | 2.6 | 15 | 0 | 900 | 12.6% | 25.1% | 0 |
| M1580 | 4 | 16 | 56 | 6.2 | 0 | 2.8 | 15 | 0 | 850 | 10.8% | 22.0% | 100 |
| M1581 | 3 | 12 | 60.6 | 6.2 | 0 | 3.2 | 15 | 0 | 900 | 12.6% | 25.1% | 0 |
| M1582 | 4 | 16 | 55.4 | 6.2 | 0 | 3.4 | 15 | 0 | 850 | 10.7% | 22.0% | 100 |
| M1583 | 3 | 12 | 60 | 6.2 | 0 | 3.8 | 15 | 0 | 850 | 12.5% | 25.2% | 0 |
| M1584 | 4 | 16 | 54.8 | 6.2 | 0 | 4 | 15 | 0 | 850 | 10.7% | 22.1% | 100 |
| M1585 | 3 | 12 | 59.4 | 6.2 | 0 | 4.4 | 15 | 0 | 850 | 12.5% | 25.2% | 0 |
| M1586 | 4 | 16 | 54.2 | 6.2 | 0 | 4.6 | 15 | 0 | 850 | 10.6% | 22.1% | 100 |
| M1587 | 3 | 12 | 58.8 | 6.2 | 0 | 5 | 15 | 0 | 850 | 12.4% | 25.1% | 0 |
| M1588 | 4 | 16 | 53.6 | 6.2 | 0 | 5.2 | 15 | 0 | 850 | 10.5% | 22.1% | 100 |
| M1589 | 3 | 12 | 58.2 | 6.2 | 0 | 5.6 | 15 | 0 | 850 | 12.4% | 25.0% | 0 |
| M1590 | 4 | 16 | 53 | 6.2 | 0 | 5.8 | 15 | 0 | 850 | 10.5% | 22.2% | 100 |
| M1591 | 3 | 12 | 57.6 | 6.2 | 0 | 6.2 | 15 | 0 | 850 | 12.3% | 25.0% | 50 |
| M1592 | 4 | 16 | 52.4 | 6.2 | 0 | 6.4 | 15 | 0 | 850 | 10.4% | 22.2% | 100 |
| M1593 | 3 | 12 | 57 | 6.2 | 0 | 6.8 | 15 | 0 | 850 | 12.3% | 25.0% | 50 |
| M1594 | 4 | 16 | 51.8 | 6.2 | 0 | 7 | 15 | 0 | 850 | 10.3% | 22.2% | 100 |
| M1595 | 4 | 16 | 51.4 | 6.2 | 0 | 7.4 | 15 | 0 | 850 | 10.3% | 22.3% | 100 |
| M1596 | 4 | 16 | 50.8 | 6.2 | 0 | 8 | 15 | 0 | 850 | 10.3% | 22.3% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M1597 | 3 | 12 | 55.4 | 6.2 | 0 | 8.4 | 15 | 0 | 850 | 12.2% | 25.0% | 100 |
| M1598 | 4 | 16 | 50.2 | 6.2 | 0 | 8.6 | 15 | 0 | 850 | 10.2% | 22.3% | 100 |
| M1599 | 3 | 12 | 54.8 | 6.2 | 0 | 9 | 15 | 0 | 850 | 12.1% | 25.0% | 100 |
| M1600 | 4 | 16 | 49.6 | 6.2 | 0 | 9.2 | 15 | 0 | 800 | 10.1% | 22.4% | 100 |
| M1601 | 3 | 12 | 54.2 | 6.2 | 0 | 9.6 | 15 | 0 | 850 | 12.1% | 25.0% | 50 |
| M1602 | 4 | 16 | 49 | 6.2 | 0 | 9.8 | 15 | 0 | 800 | 10.1% | 22.4% | 100 |
| M1603 | 3 | 12 | 53.6 | 6.2 | 0 | 10.2 | 15 | 0 | 850 | 12.1% | 25.1% | 50 |
| M1604 | 4 | 16 | 48.4 | 6.2 | 0 | 10.4 | 15 | 0 | 800 | 10.1% | 22.4% | 100 |
| M1605 | 3 | 12 | 53 | 6.2 | 0 | 10.8 | 15 | 0 | 800 | 12.1% | 25.1% | 50 |
| M1606 | 4 | 16 | 47.8 | 6.2 | 0 | 11 | 15 | 0 | 800 | 10.0% | 22.5% | 100 |
| M1607 | 3 | 12 | 52.4 | 6.2 | 0 | 11.4 | 15 | 0 | 800 | 12.0% | 25.1% | 50 |
| M1608 | 4 | 16 | 47.2 | 6.2 | 0 | 11.6 | 15 | 0 | 800 | 10.0% | 22.5% | 100 |
| M1609 | 3 | 12 | 51.8 | 6.2 | 0 | 12 | 15 | 0 | 800 | 12.0% | 25.1% | 100 |
| M1610 | 4 | 16 | 46.6 | 6.2 | 0 | 12.2 | 15 | 0 | 800 | 9.9% | 22.6% | 100 |
| M1611 | 3 | 12 | 51.2 | 6.2 | 0 | 12.6 | 15 | 0 | 800 | 12.0% | 25.1% | 100 |
| M1612 | 4 | 16 | 46 | 6.2 | 0 | 12.8 | 15 | 0 | 800 | 10.1% | 22.6% | 100 |
| M1613 | 3 | 12 | 50.6 | 6.2 | 0 | 13.2 | 15 | 0 | 800 | 11.9% | 25.1% | 100 |
| M1614 | 4 | 16 | 45.4 | 6.2 | 0 | 13.4 | 15 | 0 | 800 | 10.1% | 22.7% | 150 |
| M1615 | 3 | 12 | 50 | 6.2 | 0 | 13.8 | 15 | 0 | 800 | 11.9% | 25.2% | 100 |
| M1616 | 4 | 16 | 44.8 | 6.2 | 0 | 14 | 15 | 0 | 800 | 10.0% | 22.7% | 150 |
| M1617 | 3 | 12 | 63.4 | 6.4 | 0 | 0.2 | 15 | 0 | 900 | 12.9% | 24.9% | −50 |
| M1618 | 4 | 16 | 58.2 | 6.4 | 0 | 0.4 | 15 | 0 | 900 | 11.1% | 21.9% | 50 |
| M1619 | 3 | 12 | 62.8 | 6.4 | 0 | 0.8 | 15 | 0 | 900 | 12.8% | 25.0% | 0 |
| M1620 | 4 | 16 | 57.6 | 6.4 | 0 | 1 | 15 | 0 | 900 | 11.0% | 21.9% | 50 |
| M1621 | 3 | 12 | 62.2 | 6.4 | 0 | 1.4 | 15 | 0 | 900 | 12.7% | 25.0% | 0 |
| M1622 | 4 | 16 | 57 | 6.4 | 0 | 1.6 | 15 | 0 | 900 | 11.0% | 22.0% | 50 |
| M1623 | 3 | 12 | 61.6 | 6.4 | 0 | 2 | 15 | 0 | 900 | 12.7% | 25.1% | 0 |
| M1624 | 4 | 16 | 56.4 | 6.4 | 0 | 2.2 | 15 | 0 | 900 | 10.9% | 22.0% | 100 |
| M1625 | 3 | 12 | 61 | 6.4 | 0 | 2.6 | 15 | 0 | 900 | 12.6% | 25.1% | 0 |
| M1626 | 4 | 16 | 55.8 | 6.4 | 0 | 2.8 | 15 | 0 | 850 | 10.8% | 22.0% | 100 |
| M1627 | 3 | 12 | 60.4 | 6.4 | 0 | 3.2 | 15 | 0 | 850 | 12.6% | 25.1% | 0 |
| M1628 | 4 | 16 | 55.2 | 6.4 | 0 | 3.4 | 15 | 0 | 850 | 10.7% | 22.0% | 100 |
| M1629 | 3 | 12 | 59.8 | 6.4 | 0 | 3.8 | 15 | 0 | 850 | 12.5% | 25.2% | 0 |
| M1630 | 4 | 16 | 54.6 | 6.4 | 0 | 4 | 15 | 0 | 850 | 10.7% | 22.1% | 100 |
| M1631 | 3 | 12 | 59.2 | 6.4 | 0 | 4.4 | 15 | 0 | 850 | 12.5% | 25.2% | 0 |
| M1632 | 4 | 16 | 54 | 6.4 | 0 | 4.6 | 15 | 0 | 850 | 10.6% | 22.1% | 100 |
| M1633 | 3 | 12 | 58.6 | 6.4 | 0 | 5 | 15 | 0 | 850 | 12.4% | 25.1% | 0 |
| M1634 | 4 | 16 | 53.4 | 6.4 | 0 | 5.2 | 15 | 0 | 850 | 10.5% | 22.1% | 100 |
| M1635 | 3 | 12 | 58 | 6.4 | 0 | 5.6 | 15 | 0 | 850 | 12.4% | 25.1% | 0 |
| M1636 | 4 | 16 | 52.8 | 6.4 | 0 | 5.8 | 15 | 0 | 850 | 10.5% | 22.2% | 100 |
| M1637 | 3 | 12 | 57.4 | 6.4 | 0 | 6.2 | 15 | 0 | 850 | 12.3% | 25.0% | 50 |
| M1638 | 4 | 16 | 52.2 | 6.4 | 0 | 6.4 | 15 | 0 | 850 | 10.4% | 22.2% | 100 |
| M1639 | 3 | 12 | 56.8 | 6.4 | 0 | 6.8 | 15 | 0 | 850 | 12.3% | 25.0% | 50 |
| M1640 | 4 | 16 | 51.6 | 6.4 | 0 | 7 | 15 | 0 | 850 | 10.3% | 22.2% | 100 |
| M1641 | 4 | 16 | 51.2 | 6.4 | 0 | 7.4 | 15 | 0 | 850 | 10.3% | 22.3% | 150 |
| M1642 | 4 | 16 | 50.4 | 6.4 | 0 | 8.2 | 15 | 0 | 850 | 10.2% | 22.3% | 100 |
| M1643 | 3 | 12 | 54.8 | 6.4 | 0 | 8.8 | 15 | 0 | 850 | 12.2% | 25.0% | 100 |
| M1644 | 4 | 16 | 49.6 | 6.4 | 0 | 9 | 15 | 0 | 800 | 10.2% | 22.4% | 100 |
| M1645 | 3 | 12 | 54.2 | 6.4 | 0 | 9.4 | 15 | 0 | 850 | 12.1% | 25.0% | 100 |
| M1646 | 4 | 16 | 49 | 6.4 | 0 | 9.6 | 15 | 0 | 800 | 10.1% | 22.4% | 100 |
| M1647 | 3 | 12 | 53.6 | 6.4 | 0 | 10 | 15 | 0 | 850 | 12.1% | 25.0% | 50 |
| M1648 | 4 | 16 | 48.4 | 6.4 | 0 | 10.2 | 15 | 0 | 800 | 10.1% | 22.4% | 100 |
| M1649 | 3 | 12 | 53 | 6.4 | 0 | 10.6 | 15 | 0 | 800 | 12.1% | 25.1% | 50 |
| M1650 | 4 | 16 | 47.8 | 6.4 | 0 | 10.8 | 15 | 0 | 800 | 10.0% | 22.5% | 100 |
| M1651 | 3 | 12 | 52.4 | 6.4 | 0 | 11.2 | 15 | 0 | 800 | 12.0% | 25.1% | 50 |
| M1652 | 4 | 16 | 47.2 | 6.4 | 0 | 11.4 | 15 | 0 | 800 | 10.0% | 22.5% | 100 |
| M1653 | 3 | 12 | 51.8 | 6.4 | 0 | 11.8 | 15 | 0 | 800 | 12.0% | 25.1% | 100 |
| M1654 | 4 | 16 | 46.6 | 6.4 | 0 | 12 | 15 | 0 | 800 | 9.9% | 22.5% | 100 |
| M1655 | 3 | 12 | 51.2 | 6.4 | 0 | 12.4 | 15 | 0 | 800 | 12.0% | 25.1% | 100 |
| M1656 | 4 | 16 | 46 | 6.4 | 0 | 12.6 | 15 | 0 | 800 | 9.9% | 22.6% | 100 |
| M1657 | 3 | 12 | 50.6 | 6.4 | 0 | 13 | 15 | 0 | 800 | 11.9% | 25.1% | 100 |
| M1658 | 4 | 16 | 45.4 | 6.4 | 0 | 13.2 | 15 | 0 | 800 | 10.1% | 22.6% | 150 |
| M1659 | 3 | 12 | 50 | 6.4 | 0 | 13.6 | 15 | 0 | 800 | 11.9% | 25.1% | 100 |
| M1660 | 4 | 16 | 44.8 | 6.4 | 0 | 13.8 | 15 | 0 | 800 | 10.0% | 22.7% | 150 |
| M1661 | 2 | 10 | 71.5 | 6.5 | 0 | 0 | 10 | 0 | 900 | 10.5% | 17.0% | −50 |
| M1662 | 2.6 | 10 | 70.9 | 6.5 | 0 | 0 | 10 | 0 | 900 | 9.0% | 17.2% | −50 |
| M1663 | 2 | 10.2 | 71.3 | 6.5 | 0 | 0 | 10 | 0 | 900 | 10.7% | 17.0% | −50 |
| M1664 | 2.6 | 10.2 | 70.7 | 6.5 | 0 | 0 | 10 | 0 | 900 | 9.1% | 17.1% | −50 |
| M1665 | 2 | 10.4 | 71.1 | 6.5 | 0 | 0 | 10 | 0 | 900 | 10.9% | 17.0% | −50 |
| M1666 | 2.6 | 10.4 | 70.5 | 6.5 | 0 | 0 | 10 | 0 | 900 | 9.3% | 16.9% | −50 |
| M1667 | 2 | 10.6 | 70.9 | 6.5 | 0 | 0 | 10 | 0 | 900 | 11.1% | 17.0% | −50 |
| M1668 | 2.6 | 10.6 | 70.3 | 6.5 | 0 | 0 | 10 | 0 | 900 | 9.4% | 16.8% | −50 |
| M1669 | 2 | 10.8 | 70.7 | 6.5 | 0 | 0 | 10 | 0 | 900 | 11.3% | 16.9% | −50 |
| M1670 | 2.6 | 10.8 | 70.1 | 6.5 | 0 | 0 | 10 | 0 | 900 | 9.5% | 16.6% | −50 |
| M1671 | 2 | 11 | 70.5 | 6.5 | 0 | 0 | 10 | 0 | 900 | 11.5% | 16.8% | −50 |
| M1672 | 2.6 | 11 | 69.9 | 6.5 | 0 | 0 | 10 | 0 | 900 | 9.6% | 16.5% | −50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M1673 | 2 | 11.2 | 70.3 | 6.5 | 0 | 0 | 10 | 0 | 900 | 11.7% | 16.7% | −50 |
| M1674 | 2.6 | 11.2 | 69.7 | 6.5 | 0 | 0 | 10 | 0 | 900 | 9.7% | 16.4% | −50 |
| M1675 | 2 | 11.4 | 70.1 | 6.5 | 0 | 0 | 10 | 0 | 900 | 11.9% | 16.5% | −50 |
| M1676 | 2.6 | 11.4 | 69.5 | 6.5 | 0 | 0 | 10 | 0 | 900 | 9.8% | 16.2% | −50 |
| M1677 | 2 | 11.6 | 69.9 | 6.5 | 0 | 0 | 10 | 0 | 900 | 12.2% | 16.5% | −50 |
| M1678 | 2.6 | 11.6 | 69.3 | 6.5 | 0 | 0 | 10 | 0 | 900 | 9.9% | 16.1% | −50 |
| M1679 | 2 | 11.8 | 69.7 | 6.5 | 0 | 0 | 10 | 0 | 900 | 12.4% | 16.4% | −50 |
| M1680 | 2.6 | 11.8 | 69.1 | 6.5 | 0 | 0 | 10 | 0 | 900 | 10.0% | 16.0% | −50 |
| M1681 | 2 | 12 | 69.5 | 6.5 | 0 | 0 | 10 | 0 | 900 | 12.5% | 16.2% | −50 |
| M1682 | 2.6 | 12 | 68.9 | 6.5 | 0 | 0 | 10 | 0 | 900 | 10.1% | 15.8% | −50 |
| M1683 | 3 | 12 | 63.4 | 6.6 | 0 | 0 | 15 | 0 | 900 | 12.9% | 24.9% | −50 |
| M1684 | 4 | 16 | 58.2 | 6.6 | 0 | 0.2 | 15 | 0 | 900 | 11.2% | 21.9% | 50 |
| M1685 | 3 | 12 | 62.8 | 6.6 | 0 | 0.6 | 15 | 0 | 900 | 12.8% | 25.0% | 0 |
| M1686 | 4 | 16 | 57.6 | 6.6 | 0 | 0.8 | 15 | 0 | 900 | 11.1% | 21.9% | 50 |
| M1687 | 3 | 12 | 62.2 | 6.6 | 0 | 1.2 | 15 | 0 | 900 | 12.8% | 25.0% | 0 |
| M1688 | 4 | 16 | 57 | 6.6 | 0 | 1.4 | 15 | 0 | 900 | 11.0% | 21.9% | 50 |
| M1689 | 3 | 12 | 61.6 | 6.6 | 0 | 1.8 | 15 | 0 | 900 | 12.7% | 25.0% | 0 |
| M1690 | 4 | 16 | 56.4 | 6.6 | 0 | 2 | 15 | 0 | 850 | 10.9% | 22.0% | 100 |
| M1691 | 3 | 12 | 61 | 6.6 | 0 | 2.4 | 15 | 0 | 900 | 12.6% | 25.1% | 0 |
| M1692 | 4 | 16 | 55.8 | 6.6 | 0 | 2.6 | 15 | 0 | 850 | 10.8% | 22.0% | 100 |
| M1693 | 3 | 12 | 60.4 | 6.6 | 0 | 3 | 15 | 0 | 850 | 12.6% | 25.1% | 0 |
| M1694 | 4 | 16 | 55.2 | 6.6 | 0 | 3.2 | 15 | 0 | 850 | 10.8% | 22.0% | 100 |
| M1695 | 3 | 12 | 59.8 | 6.6 | 0 | 3.6 | 15 | 0 | 850 | 12.5% | 25.2% | 0 |
| M1696 | 4 | 16 | 54.6 | 6.6 | 0 | 3.8 | 15 | 0 | 850 | 10.7% | 22.1% | 100 |
| M1697 | 3 | 12 | 59.2 | 6.6 | 0 | 4.2 | 15 | 0 | 850 | 12.5% | 25.2% | 0 |
| M1698 | 4 | 16 | 54 | 6.6 | 0 | 4.4 | 15 | 0 | 850 | 10.6% | 22.1% | 100 |
| M1699 | 3 | 12 | 58.6 | 6.6 | 0 | 4.8 | 15 | 0 | 850 | 12.4% | 25.2% | 0 |
| M1700 | 4 | 16 | 53.4 | 6.6 | 0 | 5 | 15 | 0 | 850 | 10.6% | 22.1% | 100 |
| M1701 | 3 | 12 | 58 | 6.6 | 0 | 5.4 | 15 | 0 | 850 | 12.4% | 25.1% | 0 |
| M1702 | 4 | 16 | 52.8 | 6.6 | 0 | 5.6 | 15 | 0 | 850 | 10.5% | 22.1% | 100 |
| M1703 | 3 | 12 | 57.4 | 6.6 | 0 | 6 | 15 | 0 | 850 | 12.3% | 25.0% | 0 |
| M1704 | 4 | 16 | 52.2 | 6.6 | 0 | 6.2 | 15 | 0 | 850 | 10.4% | 22.2% | 100 |
| M1705 | 3 | 12 | 56.8 | 6.6 | 0 | 6.6 | 15 | 0 | 850 | 12.3% | 25.0% | 50 |
| M1706 | 4 | 16 | 51.6 | 6.6 | 0 | 6.8 | 15 | 0 | 850 | 10.4% | 22.2% | 100 |
| M1707 | 4 | 16 | 51.2 | 6.6 | 0 | 7.2 | 15 | 0 | 850 | 10.3% | 22.2% | 100 |
| M1708 | 4 | 16 | 50 | 6.6 | 0 | 8.4 | 15 | 0 | 800 | 10.2% | 22.3% | 100 |
| M1709 | 4 | 16 | 49.4 | 6.6 | 0 | 9 | 15 | 0 | 800 | 10.2% | 22.3% | 100 |
| M1710 | 3 | 12 | 54 | 6.6 | 0 | 9.4 | 15 | 0 | 850 | 12.1% | 25.0% | 100 |
| M1711 | 4 | 16 | 48.8 | 6.6 | 0 | 9.6 | 15 | 0 | 800 | 10.1% | 22.4% | 100 |
| M1712 | 3 | 12 | 53.4 | 6.6 | 0 | 10 | 15 | 0 | 800 | 12.1% | 25.0% | 50 |
| M1713 | 4 | 16 | 48.2 | 6.6 | 0 | 10.2 | 15 | 0 | 800 | 10.1% | 22.4% | 100 |
| M1714 | 3 | 12 | 52.8 | 6.6 | 0 | 10.6 | 15 | 0 | 800 | 12.1% | 25.0% | 50 |
| M1715 | 4 | 16 | 47.6 | 6.6 | 0 | 10.8 | 15 | 0 | 800 | 10.0% | 22.5% | 100 |
| M1716 | 3 | 12 | 52.2 | 6.6 | 0 | 11.2 | 15 | 0 | 800 | 12.0% | 25.1% | 50 |
| M1717 | 4 | 16 | 47 | 6.6 | 0 | 11.4 | 15 | 0 | 800 | 10.0% | 22.5% | 100 |
| M1718 | 3 | 12 | 51.6 | 6.6 | 0 | 11.8 | 15 | 0 | 800 | 12.0% | 25.1% | 100 |
| M1719 | 4 | 16 | 46.4 | 6.6 | 0 | 12 | 15 | 0 | 800 | 9.9% | 22.5% | 100 |
| M1720 | 3 | 12 | 51 | 6.6 | 0 | 12.4 | 15 | 0 | 800 | 12.0% | 25.1% | 100 |
| M1721 | 4 | 16 | 45.8 | 6.6 | 0 | 12.6 | 15 | 0 | 800 | 9.9% | 22.6% | 100 |
| M1722 | 3 | 12 | 50.4 | 6.6 | 0 | 13 | 15 | 0 | 800 | 11.9% | 25.1% | 100 |
| M1723 | 4 | 16 | 45.2 | 6.6 | 0 | 13.2 | 15 | 0 | 800 | 10.1% | 22.6% | 150 |
| M1724 | 3 | 12 | 49.8 | 6.6 | 0 | 13.6 | 15 | 0 | 800 | 11.9% | 25.1% | 100 |
| M1725 | 4 | 16 | 44.6 | 6.6 | 0 | 13.8 | 15 | 0 | 800 | 10.0% | 22.7% | 150 |
| M1726 | 3 | 12 | 63.2 | 6.8 | 0 | 0 | 15 | 0 | 900 | 12.9% | 24.9% | −50 |
| M1727 | 4 | 16 | 58 | 6.8 | 0 | 0.2 | 15 | 0 | 900 | 11.2% | 21.9% | 50 |
| M1728 | 3 | 12 | 62.6 | 6.8 | 0 | 0.6 | 15 | 0 | 900 | 12.8% | 25.0% | 0 |
| M1729 | 4 | 16 | 57.4 | 6.8 | 0 | 0.8 | 15 | 0 | 900 | 11.1% | 21.9% | 50 |
| M1730 | 3 | 12 | 62 | 6.8 | 0 | 1.2 | 15 | 0 | 900 | 12.8% | 25.0% | 0 |
| M1731 | 4 | 16 | 56.8 | 6.8 | 0 | 1.4 | 15 | 0 | 900 | 11.0% | 21.9% | 50 |
| M1732 | 3 | 12 | 61.4 | 6.8 | 0 | 1.8 | 15 | 0 | 900 | 12.7% | 25.0% | 0 |
| M1733 | 4 | 16 | 56.2 | 6.8 | 0 | 2 | 15 | 0 | 850 | 10.9% | 22.0% | 100 |
| M1734 | 3 | 12 | 60.8 | 6.8 | 0 | 2.4 | 15 | 0 | 850 | 12.6% | 25.1% | 0 |
| M1735 | 4 | 16 | 55.6 | 6.8 | 0 | 2.6 | 15 | 0 | 850 | 10.8% | 22.0% | 100 |
| M1736 | 3 | 12 | 60.2 | 6.8 | 0 | 3 | 15 | 0 | 850 | 12.6% | 25.1% | 0 |
| M1737 | 4 | 16 | 55 | 6.8 | 0 | 3.2 | 15 | 0 | 850 | 10.8% | 22.0% | 100 |
| M1738 | 3 | 12 | 59.6 | 6.8 | 0 | 3.6 | 15 | 0 | 850 | 12.5% | 25.1% | 0 |
| M1739 | 4 | 16 | 54.4 | 6.8 | 0 | 3.8 | 15 | 0 | 850 | 10.7% | 22.1% | 100 |
| M1740 | 3 | 12 | 59 | 6.8 | 0 | 4.2 | 15 | 0 | 850 | 12.5% | 25.2% | 0 |
| M1741 | 4 | 16 | 53.8 | 6.8 | 0 | 4.4 | 15 | 0 | 850 | 10.6% | 22.1% | 100 |
| M1742 | 3 | 12 | 58.4 | 6.8 | 0 | 4.8 | 15 | 0 | 850 | 12.4% | 25.2% | 0 |
| M1743 | 4 | 16 | 53.2 | 6.8 | 0 | 5 | 15 | 0 | 850 | 10.6% | 22.1% | 100 |
| M1744 | 3 | 12 | 57.8 | 6.8 | 0 | 5.4 | 15 | 0 | 850 | 12.4% | 25.1% | 0 |
| M1745 | 4 | 16 | 52.6 | 6.8 | 0 | 5.6 | 15 | 0 | 850 | 10.5% | 22.1% | 100 |
| M1746 | 3 | 12 | 57.2 | 6.8 | 0 | 6 | 15 | 0 | 850 | 12.3% | 25.1% | 0 |
| M1747 | 4 | 16 | 52 | 6.8 | 0 | 6.2 | 15 | 0 | 850 | 10.4% | 22.2% | 100 |
| M1748 | 3 | 12 | 56.6 | 6.8 | 0 | 6.6 | 15 | 0 | 850 | 12.3% | 25.0% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M1749 | 4 | 16 | 51.4 | 6.8 | 0 | 6.8 | 15 | 0 | 850 | 10.4% | 22.2% | 100 |
| M1750 | 4 | 16 | 50 | 6.8 | 0 | 8.2 | 15 | 0 | 800 | 10.2% | 22.3% | 150 |
| M1751 | 4 | 16 | 49.4 | 6.8 | 0 | 8.8 | 15 | 0 | 800 | 10.2% | 22.3% | 100 |
| M1752 | 4 | 16 | 48.8 | 6.8 | 0 | 9.4 | 15 | 0 | 800 | 10.1% | 22.4% | 100 |
| M1753 | 3 | 12 | 53.4 | 6.8 | 0 | 9.8 | 15 | 0 | 800 | 12.1% | 25.0% | 50 |
| M1754 | 4 | 16 | 48.2 | 6.8 | 0 | 10 | 15 | 0 | 800 | 10.1% | 22.4% | 100 |
| M1755 | 3 | 12 | 52.8 | 6.8 | 0 | 10.4 | 15 | 0 | 800 | 12.1% | 25.0% | 50 |
| M1756 | 4 | 16 | 47.6 | 6.8 | 0 | 10.6 | 15 | 0 | 800 | 10.0% | 22.4% | 100 |
| M1757 | 3 | 12 | 52.2 | 6.8 | 0 | 11 | 15 | 0 | 800 | 12.0% | 25.0% | 50 |
| M1758 | 4 | 16 | 47 | 6.8 | 0 | 11.2 | 15 | 0 | 800 | 10.0% | 22.5% | 100 |
| M1759 | 3 | 12 | 51.6 | 6.8 | 0 | 11.6 | 15 | 0 | 800 | 12.0% | 25.1% | 100 |
| M1760 | 4 | 16 | 46.4 | 6.8 | 0 | 11.8 | 15 | 0 | 800 | 9.9% | 22.5% | 100 |
| M1761 | 3 | 12 | 51 | 6.8 | 0 | 12.2 | 15 | 0 | 800 | 12.0% | 25.1% | 100 |
| M1762 | 4 | 16 | 45.8 | 6.8 | 0 | 12.4 | 15 | 0 | 800 | 9.9% | 22.6% | 100 |
| M1763 | 3 | 12 | 50.4 | 6.8 | 0 | 12.8 | 15 | 0 | 800 | 11.9% | 25.1% | 100 |
| M1764 | 4 | 16 | 45.2 | 6.8 | 0 | 13 | 15 | 0 | 800 | 10.1% | 22.6% | 150 |
| M1765 | 3 | 12 | 49.8 | 6.8 | 0 | 13.4 | 15 | 0 | 800 | 11.9% | 25.1% | 100 |
| M1766 | 4 | 16 | 44.6 | 6.8 | 0 | 13.6 | 15 | 0 | 800 | 10.0% | 22.6% | 150 |
| M1767 | 3 | 12 | 49.2 | 6.8 | 0 | 14 | 15 | 0 | 800 | 11.9% | 25.1% | 100 |
| M1768 | 2.2 | 10 | 70.8 | 7 | 0 | 0 | 10 | 0 | 900 | 10.4% | 17.3% | −50 |
| M1769 | 2.6 | 10 | 70.4 | 7 | 0 | 0 | 10 | 0 | 900 | 9.1% | 17.2% | −50 |
| M1770 | 2 | 10 | 70.5 | 7 | 0 | 0 | 10.5 | 0 | 900 | 10.5% | 17.4% | −50 |
| M1771 | 2.5 | 10 | 69.5 | 7 | 0 | 0 | 11 | 0 | 900 | 10.2% | 19.1% | −50 |
| M1772 | 3 | 10 | 68.5 | 7 | 0 | 0 | 11.5 | 0 | 900 | 8.8% | 20.0% | −50 |
| M1773 | 2 | 10.2 | 70.8 | 7 | 0 | 0 | 10 | 0 | 900 | 10.7% | 17.0% | −50 |
| M1774 | 2.5 | 10.2 | 70.3 | 7 | 0 | 0 | 10 | 0 | 900 | 9.5% | 17.1% | −50 |
| M1775 | 3 | 10.2 | 69.8 | 7 | 0 | 0 | 10 | 0 | 900 | 7.8% | 17.1% | −50 |
| M1776 | 3 | 10.2 | 69.3 | 7 | 0 | 0 | 10.5 | 0 | 900 | 8.2% | 18.0% | −50 |
| M1777 | 2.5 | 10.2 | 68.8 | 7 | 0 | 0 | 11.5 | 0 | 900 | 10.7% | 19.9% | −50 |
| M1778 | 3 | 10.2 | 67.8 | 7 | 0 | 0 | 12 | 0 | 900 | 9.3% | 20.7% | −50 |
| M1779 | 2.4 | 10.4 | 70.2 | 7 | 0 | 0 | 10 | 0 | 900 | 10.0% | 16.9% | −50 |
| M1780 | 2.8 | 10.4 | 69.8 | 7 | 0 | 0 | 10 | 0 | 900 | 8.6% | 16.9% | −50 |
| M1781 | 2.5 | 10.4 | 69.6 | 7 | 0 | 0 | 10.5 | 0 | 900 | 10.0% | 17.9% | −50 |
| M1782 | 3 | 10.4 | 68.6 | 7 | 0 | 0 | 11 | 0 | 900 | 8.6% | 18.8% | −50 |
| M1783 | 2.5 | 10.4 | 68.1 | 7 | 0 | 0 | 12 | 0 | 900 | 11.0% | 20.7% | −50 |
| M1784 | 2.2 | 10.6 | 70.2 | 7 | 0 | 0 | 10 | 0 | 900 | 10.9% | 16.9% | −50 |
| M1785 | 2.6 | 10.6 | 69.8 | 7 | 0 | 0 | 10 | 0 | 900 | 9.4% | 16.8% | −50 |
| M1786 | 2 | 10.6 | 69.9 | 7 | 0 | 0 | 10.5 | 0 | 900 | 11.2% | 17.3% | −50 |
| M1787 | 2.5 | 10.6 | 68.9 | 7 | 0 | 0 | 11 | 0 | 900 | 10.6% | 18.7% | −50 |
| M1788 | 3 | 10.6 | 67.9 | 7 | 0 | 0 | 11.5 | 0 | 900 | 9.1% | 19.6% | −50 |
| M1789 | 2 | 10.8 | 70.2 | 7 | 0 | 0 | 10 | 0 | 900 | 11.3% | 16.9% | −50 |
| M1790 | 2.5 | 10.8 | 69.7 | 7 | 0 | 0 | 10 | 0 | 900 | 9.9% | 16.7% | −50 |
| M1791 | 3 | 10.8 | 69.2 | 7 | 0 | 0 | 10 | 0 | 900 | 8.1% | 16.7% | −50 |
| M1792 | 3 | 10.8 | 68.7 | 7 | 0 | 0 | 10.5 | 0 | 900 | 8.5% | 17.6% | −50 |
| M1793 | 2.5 | 10.8 | 68.2 | 7 | 0 | 0 | 11.5 | 0 | 900 | 11.1% | 19.5% | −50 |
| M1794 | 3 | 10.8 | 67.2 | 7 | 0 | 0 | 12 | 0 | 900 | 9.6% | 20.3% | −50 |
| M1795 | 2.4 | 11 | 69.6 | 7 | 0 | 0 | 10 | 0 | 900 | 10.3% | 16.6% | −50 |
| M1796 | 2.8 | 11 | 69.2 | 7 | 0 | 0 | 10 | 0 | 900 | 8.9% | 16.5% | −50 |
| M1797 | 3 | 11 | 68.5 | 7 | 0 | 0 | 10.5 | 0 | 900 | 8.6% | 17.5% | −50 |
| M1798 | 2.5 | 11 | 68 | 7 | 0 | 0 | 11.5 | 0 | 900 | 11.2% | 19.4% | −50 |
| M1799 | 3 | 11 | 67 | 7 | 0 | 0 | 12 | 0 | 900 | 9.7% | 20.2% | −50 |
| M1800 | 2.4 | 11.2 | 69.4 | 7 | 0 | 0 | 10 | 0 | 900 | 10.5% | 16.4% | −50 |
| M1801 | 2.8 | 11.2 | 69 | 7 | 0 | 0 | 10 | 0 | 900 | 9.0% | 16.4% | −50 |
| M1802 | 3 | 11.2 | 68.3 | 7 | 0 | 0 | 10.5 | 0 | 900 | 8.7% | 17.3% | −50 |
| M1803 | 2.5 | 11.2 | 67.8 | 7 | 0 | 0 | 11.5 | 0 | 900 | 11.3% | 19.3% | −50 |
| M1804 | 3 | 11.2 | 66.8 | 7 | 0 | 0 | 12 | 0 | 900 | 9.8% | 20.0% | −50 |
| M1805 | 2.4 | 11.4 | 69.2 | 7 | 0 | 0 | 10 | 0 | 900 | 10.6% | 16.3% | −50 |
| M1806 | 2.8 | 11.4 | 68.8 | 7 | 0 | 0 | 10 | 0 | 900 | 9.1% | 16.2% | −50 |
| M1807 | 3 | 11.4 | 68.1 | 7 | 0 | 0 | 10.5 | 0 | 900 | 8.8% | 17.2% | −50 |
| M1808 | 2.5 | 11.4 | 67.6 | 7 | 0 | 0 | 11.5 | 0 | 900 | 11.5% | 19.1% | −50 |
| M1809 | 3 | 11.4 | 66.6 | 7 | 0 | 0 | 12 | 0 | 900 | 9.9% | 19.9% | −50 |
| M1810 | 2.4 | 11.6 | 69 | 7 | 0 | 0 | 10 | 0 | 900 | 10.7% | 16.2% | −50 |
| M1811 | 2.8 | 11.6 | 68.6 | 7 | 0 | 0 | 10 | 0 | 900 | 9.2% | 16.1% | −50 |
| M1812 | 3 | 11.6 | 67.9 | 7 | 0 | 0 | 10.5 | 0 | 900 | 8.9% | 17.1% | −50 |
| M1813 | 2.5 | 11.6 | 67.4 | 7 | 0 | 0 | 11.5 | 0 | 900 | 11.6% | 19.0% | −50 |
| M1814 | 3 | 11.6 | 66.4 | 7 | 0 | 0 | 12 | 0 | 900 | 10.0% | 19.8% | −50 |
| M1815 | 2.4 | 11.8 | 68.8 | 7 | 0 | 0 | 10 | 0 | 900 | 10.8% | 16.0% | −50 |
| M1816 | 2.8 | 11.8 | 68.4 | 7 | 0 | 0 | 10 | 0 | 900 | 9.3% | 16.0% | −50 |
| M1817 | 3 | 11.8 | 67.7 | 7 | 0 | 0 | 10.5 | 0 | 900 | 9.0% | 16.9% | −50 |
| M1818 | 2.5 | 11.8 | 67.2 | 7 | 0 | 0 | 11.5 | 0 | 900 | 11.7% | 18.9% | −50 |
| M1819 | 3 | 11.8 | 66.2 | 7 | 0 | 0 | 12 | 0 | 900 | 10.2% | 19.6% | −50 |
| M1820 | 2.4 | 12 | 68.6 | 7 | 0 | 0 | 10 | 0 | 900 | 10.9% | 15.9% | −50 |
| M1821 | 2.8 | 12 | 68.2 | 7 | 0 | 0 | 10 | 0 | 900 | 9.4% | 15.8% | −50 |
| M1822 | 3 | 12 | 67.5 | 7 | 0 | 0 | 10.5 | 0 | 900 | 9.1% | 16.8% | −50 |
| M1823 | 2.5 | 12 | 67 | 7 | 0 | 0 | 11.5 | 0 | 900 | 11.8% | 18.7% | −50 |
| M1824 | 3 | 12 | 66 | 7 | 0 | 0 | 12 | 0 | 900 | 10.3% | 19.5% | −50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M1825 | 3 | 12.2 | 67.8 | 7 | 0 | 0 | 10 | 0 | 900 | 8.9% | 15.7% | −50 |
| M1826 | 2.5 | 12.2 | 67.3 | 7 | 0 | 0 | 11 | 0 | 900 | 11.5% | 17.6% | −50 |
| M1827 | 3 | 12.2 | 66.3 | 7 | 0 | 0 | 11.5 | 0 | 900 | 10.0% | 18.5% | −50 |
| M1828 | 2.5 | 12.4 | 68.1 | 7 | 0 | 0 | 10 | 0 | 900 | 10.8% | 15.6% | −50 |
| M1829 | 3 | 12.4 | 67.1 | 7 | 0 | 0 | 10.5 | 0 | 900 | 9.3% | 16.5% | −50 |
| M1830 | 2.5 | 12.4 | 66.6 | 7 | 0 | 0 | 11.5 | 0 | 900 | 12.0% | 18.4% | −50 |
| M1831 | 3 | 12.4 | 65.6 | 7 | 0 | 0 | 12 | 0 | 900 | 10.5% | 19.2% | −50 |
| M1832 | 2.5 | 12.6 | 67.4 | 7 | 0 | 0 | 10.5 | 0 | 900 | 11.3% | 16.4% | −50 |
| M1833 | 3 | 12.6 | 66.4 | 7 | 0 | 0 | 11 | 0 | 900 | 9.8% | 17.3% | −50 |
| M1834 | 2.5 | 12.6 | 65.9 | 7 | 0 | 0 | 12 | 0 | 900 | 12.6% | 19.6% | −50 |
| M1835 | 3 | 12.8 | 67.2 | 7 | 0 | 0 | 10 | 0 | 900 | 9.2% | 15.3% | −50 |
| M1836 | 2.5 | 12.8 | 66.7 | 7 | 0 | 0 | 11 | 0 | 900 | 11.8% | 17.2% | −50 |
| M1837 | 3 | 12.8 | 65.7 | 7 | 0 | 0 | 11.5 | 0 | 900 | 10.3% | 18.0% | −50 |
| M1838 | 2.5 | 13 | 67.5 | 7 | 0 | 0 | 10 | 0 | 900 | 11.1% | 15.2% | −50 |
| M1839 | 3 | 13 | 66.5 | 7 | 0 | 0 | 10.5 | 0 | 900 | 9.6% | 16.1% | −50 |
| M1840 | 2.5 | 13 | 66 | 7 | 0 | 0 | 11.5 | 0 | 900 | 12.4% | 18.3% | −50 |
| M1841 | 3 | 13 | 65 | 7 | 0 | 0 | 12 | 0 | 900 | 10.8% | 18.8% | −50 |
| M1842 | 2.5 | 13.2 | 66.8 | 7 | 0 | 0 | 10.5 | 0 | 900 | 11.6% | 16.0% | −50 |
| M1843 | 3 | 13.2 | 65.8 | 7 | 0 | 0 | 11 | 0 | 900 | 10.1% | 16.9% | −50 |
| M1844 | 2.5 | 13.2 | 65.3 | 7 | 0 | 0 | 12 | 0 | 900 | 13.0% | 19.2% | −50 |
| M1845 | 3 | 13.4 | 66.6 | 7 | 0 | 0 | 10 | 0 | 900 | 9.5% | 14.9% | −50 |
| M1846 | 2.5 | 13.4 | 66.1 | 7 | 0 | 0 | 11 | 0 | 900 | 12.2% | 16.8% | −50 |
| M1847 | 3 | 13.4 | 65.1 | 7 | 0 | 0 | 11.5 | 0 | 900 | 10.7% | 17.6% | −50 |
| M1848 | 2.5 | 13.6 | 66.9 | 7 | 0 | 0 | 10 | 0 | 900 | 11.5% | 14.8% | −50 |
| M1849 | 3 | 13.6 | 65.9 | 7 | 0 | 0 | 10.5 | 0 | 900 | 10.0% | 15.7% | −50 |
| M1850 | 2.5 | 13.6 | 65.4 | 7 | 0 | 0 | 11.5 | 0 | 900 | 12.8% | 18.2% | −50 |
| M1851 | 3 | 13.6 | 64.4 | 7 | 0 | 0 | 12 | 0 | 900 | 11.2% | 18.4% | −50 |
| M1852 | 2.5 | 13.8 | 66.2 | 7 | 0 | 0 | 10.5 | 0 | 900 | 12.0% | 15.6% | −50 |
| M1853 | 3 | 13.8 | 65.2 | 7 | 0 | 0 | 11 | 0 | 900 | 10.5% | 16.4% | −50 |
| M1854 | 3 | 13.8 | 64.2 | 7 | 0 | 0 | 12 | 0 | 900 | 11.3% | 18.2% | −50 |
| M1855 | 2.5 | 14 | 66 | 7 | 0 | 0 | 10.5 | 0 | 900 | 12.1% | 15.5% | −50 |
| M1856 | 3 | 14 | 65 | 7 | 0 | 0 | 11 | 0 | 900 | 10.6% | 16.3% | −50 |
| M1857 | 3 | 14 | 64 | 7 | 0 | 0 | 12 | 0 | 900 | 11.4% | 18.1% | −50 |
| M1858 | 4 | 16 | 57.8 | 7 | 0 | 0.2 | 15 | 0 | 900 | 11.2% | 21.9% | 50 |
| M1859 | 3 | 12 | 62.4 | 7 | 0 | 0.6 | 15 | 0 | 900 | 12.8% | 25.0% | 0 |
| M1860 | 4 | 16 | 57.2 | 7 | 0 | 0.8 | 15 | 0 | 900 | 11.1% | 21.9% | 50 |
| M1861 | 3 | 12 | 61.8 | 7 | 0 | 1.2 | 15 | 0 | 900 | 12.8% | 25.0% | 0 |
| M1862 | 4 | 16 | 56.6 | 7 | 0 | 1.4 | 15 | 0 | 850 | 11.0% | 21.9% | 50 |
| M1863 | 3 | 12 | 61.2 | 7 | 0 | 1.8 | 15 | 0 | 900 | 12.7% | 25.0% | 0 |
| M1864 | 4 | 16 | 56 | 7 | 0 | 2 | 15 | 0 | 850 | 10.9% | 22.0% | 100 |
| M1865 | 3 | 12 | 60.6 | 7 | 0 | 2.4 | 15 | 0 | 850 | 12.6% | 25.1% | 0 |
| M1866 | 4 | 16 | 55.4 | 7 | 0 | 2.6 | 15 | 0 | 850 | 10.8% | 22.0% | 100 |
| M1867 | 3 | 12 | 60 | 7 | 0 | 3 | 15 | 0 | 850 | 12.6% | 25.1% | 0 |
| M1868 | 4 | 16 | 54.8 | 7 | 0 | 3.2 | 15 | 0 | 850 | 10.8% | 22.0% | 100 |
| M1869 | 3 | 12 | 59.4 | 7 | 0 | 3.6 | 15 | 0 | 850 | 12.5% | 25.1% | 0 |
| M1870 | 4 | 16 | 54.2 | 7 | 0 | 3.8 | 15 | 0 | 850 | 10.7% | 22.0% | 100 |
| M1871 | 3 | 12 | 58.8 | 7 | 0 | 4.2 | 15 | 0 | 850 | 12.5% | 25.2% | 0 |
| M1872 | 4 | 16 | 53.6 | 7 | 0 | 4.4 | 15 | 0 | 850 | 10.6% | 22.1% | 100 |
| M1873 | 3 | 12 | 58.2 | 7 | 0 | 4.8 | 15 | 0 | 850 | 12.4% | 25.2% | 0 |
| M1874 | 4 | 16 | 53 | 7 | 0 | 5 | 15 | 0 | 850 | 10.6% | 22.1% | 100 |
| M1875 | 3 | 12 | 57.6 | 7 | 0 | 5.4 | 15 | 0 | 850 | 12.4% | 25.2% | 0 |
| M1876 | 4 | 16 | 52.4 | 7 | 0 | 5.6 | 15 | 0 | 850 | 10.5% | 22.1% | 100 |
| M1877 | 3 | 12 | 57 | 7 | 0 | 6 | 15 | 0 | 850 | 12.3% | 25.1% | 50 |
| M1878 | 4 | 16 | 51.8 | 7 | 0 | 6.2 | 15 | 0 | 850 | 10.4% | 22.2% | 100 |
| M1879 | 3 | 12 | 56.4 | 7 | 0 | 6.6 | 15 | 0 | 850 | 12.3% | 25.0% | 50 |
| M1880 | 4 | 16 | 51 | 7 | 0 | 7 | 15 | 0 | 850 | 10.3% | 22.2% | 100 |
| M1881 | 4 | 16 | 49.4 | 7 | 0 | 8.6 | 15 | 0 | 800 | 10.2% | 22.3% | 150 |
| M1882 | 4 | 16 | 48.8 | 7 | 0 | 9.2 | 15 | 0 | 800 | 10.1% | 22.3% | 100 |
| M1883 | 3 | 12 | 53.2 | 7 | 0 | 9.8 | 15 | 0 | 800 | 12.1% | 25.0% | 50 |
| M1884 | 4 | 16 | 48 | 7 | 0 | 10 | 15 | 0 | 800 | 10.1% | 22.4% | 100 |
| M1885 | 3 | 12 | 52.6 | 7 | 0 | 10.4 | 15 | 0 | 800 | 12.1% | 25.0% | 50 |
| M1886 | 4 | 16 | 47.4 | 7 | 0 | 10.6 | 15 | 0 | 800 | 10.0% | 22.4% | 100 |
| M1887 | 3 | 12 | 52 | 7 | 0 | 11 | 15 | 0 | 800 | 12.0% | 25.0% | 50 |
| M1888 | 4 | 16 | 46.8 | 7 | 0 | 11.2 | 15 | 0 | 800 | 10.0% | 22.5% | 100 |
| M1889 | 3 | 12 | 51.4 | 7 | 0 | 11.6 | 15 | 0 | 800 | 12.0% | 25.1% | 100 |
| M1890 | 4 | 16 | 46.2 | 7 | 0 | 11.8 | 15 | 0 | 800 | 9.9% | 22.5% | 100 |
| M1891 | 3 | 12 | 50.8 | 7 | 0 | 12.2 | 15 | 0 | 800 | 12.0% | 25.1% | 100 |
| M1892 | 4 | 16 | 45.6 | 7 | 0 | 12.4 | 15 | 0 | 800 | 9.9% | 22.5% | 100 |
| M1893 | 3 | 12 | 50.2 | 7 | 0 | 12.8 | 15 | 0 | 800 | 11.9% | 25.1% | 100 |
| M1894 | 4 | 16 | 45 | 7 | 0 | 13 | 15 | 0 | 800 | 9.8% | 22.6% | 150 |
| M1895 | 3 | 12 | 49.6 | 7 | 0 | 13.4 | 15 | 0 | 800 | 11.9% | 25.1% | 100 |
| M1896 | 4 | 16 | 44.4 | 7 | 0 | 13.6 | 15 | 0 | 800 | 10.0% | 22.6% | 150 |
| M1897 | 3 | 12 | 49 | 7 | 0 | 14 | 15 | 0 | 800 | 11.9% | 25.1% | 100 |
| M1898 | 4 | 16 | 57.8 | 7.2 | 0 | 0 | 15 | 0 | 900 | 11.2% | 21.9% | 50 |
| M1899 | 3 | 12 | 62.4 | 7.2 | 0 | 0.4 | 15 | 0 | 900 | 12.9% | 24.9% | 0 |
| M1900 | 4 | 16 | 57.2 | 7.2 | 0 | 0.6 | 15 | 0 | 900 | 11.1% | 21.9% | 50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M1901 | 3 | 12 | 61.8 | 7.2 | 0 | 1 | 15 | 0 | 900 | 12.8% | 25.0% | 0 |
| M1902 | 4 | 16 | 56.6 | 7.2 | 0 | 1.2 | 15 | 0 | 850 | 11.0% | 21.9% | 50 |
| M1903 | 3 | 12 | 61.2 | 7.2 | 0 | 1.6 | 15 | 0 | 850 | 12.7% | 25.0% | 0 |
| M1904 | 4 | 16 | 56 | 7.2 | 0 | 1.8 | 15 | 0 | 850 | 11.0% | 22.0% | 100 |
| M1905 | 3 | 12 | 60.6 | 7.2 | 0 | 2.2 | 15 | 0 | 850 | 12.7% | 25.0% | 0 |
| M1906 | 4 | 16 | 55.4 | 7.2 | 0 | 2.4 | 15 | 0 | 850 | 10.9% | 22.0% | 100 |
| M1907 | 3 | 12 | 60 | 7.2 | 0 | 2.8 | 15 | 0 | 850 | 12.6% | 25.1% | 0 |
| M1908 | 4 | 16 | 54.8 | 7.2 | 0 | 3 | 15 | 0 | 850 | 10.8% | 22.0% | 100 |
| M1909 | 3 | 12 | 59.4 | 7.2 | 0 | 3.4 | 15 | 0 | 850 | 12.6% | 25.1% | 0 |
| M1910 | 4 | 16 | 54.2 | 7.2 | 0 | 3.6 | 15 | 0 | 850 | 10.7% | 22.0% | 100 |
| M1911 | 3 | 12 | 58.8 | 7.2 | 0 | 4 | 15 | 0 | 850 | 12.5% | 25.2% | 0 |
| M1912 | 4 | 16 | 53.6 | 7.2 | 0 | 4.2 | 15 | 0 | 850 | 10.6% | 22.1% | 100 |
| M1913 | 3 | 12 | 58.2 | 7.2 | 0 | 4.6 | 15 | 0 | 850 | 12.5% | 25.2% | 0 |
| M1914 | 4 | 16 | 53 | 7.2 | 0 | 4.8 | 15 | 0 | 850 | 10.6% | 22.1% | 100 |
| M1915 | 3 | 12 | 57.6 | 7.2 | 0 | 5.2 | 15 | 0 | 850 | 12.4% | 25.2% | 0 |
| M1916 | 4 | 16 | 52.4 | 7.2 | 0 | 5.4 | 15 | 0 | 850 | 10.5% | 22.1% | 100 |
| M1917 | 3 | 12 | 57 | 7.2 | 0 | 5.8 | 15 | 0 | 850 | 12.4% | 25.1% | 0 |
| M1918 | 4 | 16 | 51.8 | 7.2 | 0 | 6 | 15 | 0 | 850 | 10.4% | 22.2% | 100 |
| M1919 | 3 | 12 | 56.4 | 7.2 | 0 | 6.4 | 15 | 0 | 850 | 12.3% | 25.1% | 50 |
| M1920 | 4 | 16 | 51 | 7.2 | 0 | 6.8 | 15 | 0 | 850 | 10.4% | 22.2% | 100 |
| M1921 | 4 | 16 | 49.2 | 7.2 | 0 | 8.6 | 15 | 0 | 800 | 10.2% | 22.3% | 150 |
| M1922 | 4 | 16 | 48.6 | 7.2 | 0 | 9.2 | 15 | 0 | 800 | 10.1% | 22.3% | 100 |
| M1923 | 4 | 16 | 48 | 7.2 | 0 | 9.8 | 15 | 0 | 800 | 10.1% | 22.4% | 100 |
| M1924 | 3 | 12 | 52.6 | 7.2 | 0 | 10.2 | 15 | 0 | 800 | 12.1% | 25.0% | 50 |
| M1925 | 4 | 16 | 47.4 | 7.2 | 0 | 10.4 | 15 | 0 | 800 | 10.0% | 22.4% | 100 |
| M1926 | 3 | 12 | 52 | 7.2 | 0 | 10.8 | 15 | 0 | 800 | 12.0% | 25.0% | 50 |
| M1927 | 4 | 16 | 46.8 | 7.2 | 0 | 11 | 15 | 0 | 800 | 10.0% | 22.4% | 100 |
| M1928 | 3 | 12 | 51.4 | 7.2 | 0 | 11.4 | 15 | 0 | 800 | 12.0% | 25.0% | 100 |
| M1929 | 4 | 16 | 46.2 | 7.2 | 0 | 11.6 | 15 | 0 | 800 | 9.9% | 22.5% | 100 |
| M1930 | 3 | 12 | 50.8 | 7.2 | 0 | 12 | 15 | 0 | 800 | 12.0% | 25.1% | 100 |
| M1931 | 4 | 16 | 45.6 | 7.2 | 0 | 12.2 | 15 | 0 | 800 | 9.9% | 22.5% | 100 |
| M1932 | 3 | 12 | 50.2 | 7.2 | 0 | 12.6 | 15 | 0 | 800 | 11.9% | 25.1% | 100 |
| M1933 | 4 | 16 | 45 | 7.2 | 0 | 12.8 | 15 | 0 | 800 | 9.8% | 22.6% | 150 |
| M1934 | 3 | 12 | 49.6 | 7.2 | 0 | 13.2 | 15 | 0 | 800 | 11.9% | 25.1% | 100 |
| M1935 | 4 | 16 | 44.4 | 7.2 | 0 | 13.4 | 15 | 0 | 800 | 10.0% | 22.6% | 150 |
| M1936 | 3 | 12 | 49 | 7.2 | 0 | 13.8 | 15 | 0 | 800 | 11.9% | 25.1% | 100 |
| M1937 | 4 | 16 | 43.8 | 7.2 | 0 | 14 | 15 | 0 | 800 | 10.0% | 22.7% | 150 |
| M1938 | 3 | 12 | 62.4 | 7.4 | 0 | 0.2 | 15 | 0 | 900 | 12.9% | 24.9% | −50 |
| M1939 | 4 | 16 | 57.2 | 7.4 | 0 | 0.4 | 15 | 0 | 900 | 11.2% | 21.9% | 50 |
| M1940 | 3 | 12 | 61.8 | 7.4 | 0 | 0.8 | 15 | 0 | 900 | 12.8% | 24.9% | 0 |
| M1941 | 4 | 16 | 56.6 | 7.4 | 0 | 1 | 15 | 0 | 850 | 11.1% | 21.9% | 50 |
| M1942 | 3 | 12 | 61.2 | 7.4 | 0 | 1.4 | 15 | 0 | 850 | 12.8% | 25.0% | 0 |
| M1943 | 4 | 16 | 56 | 7.4 | 0 | 1.6 | 15 | 0 | 850 | 11.0% | 21.9% | 100 |
| M1944 | 3 | 12 | 60.6 | 7.4 | 0 | 2 | 15 | 0 | 850 | 12.7% | 25.0% | 0 |
| M1945 | 4 | 16 | 55.4 | 7.4 | 0 | 2.2 | 15 | 0 | 850 | 10.9% | 22.0% | 100 |
| M1946 | 3 | 12 | 60 | 7.4 | 0 | 2.6 | 15 | 0 | 850 | 12.6% | 25.1% | 0 |
| M1947 | 4 | 16 | 54.8 | 7.4 | 0 | 2.8 | 15 | 0 | 850 | 10.8% | 22.0% | 100 |
| M1948 | 3 | 12 | 59.4 | 7.4 | 0 | 3.2 | 15 | 0 | 850 | 12.6% | 25.1% | 0 |
| M1949 | 4 | 16 | 54.2 | 7.4 | 0 | 3.4 | 15 | 0 | 850 | 10.7% | 22.0% | 100 |
| M1950 | 3 | 12 | 58.8 | 7.4 | 0 | 3.8 | 15 | 0 | 850 | 12.5% | 25.1% | 0 |
| M1951 | 4 | 16 | 53.6 | 7.4 | 0 | 4 | 15 | 0 | 850 | 10.7% | 22.0% | 100 |
| M1952 | 3 | 12 | 58.2 | 7.4 | 0 | 4.4 | 15 | 0 | 850 | 12.5% | 25.2% | 0 |
| M1953 | 4 | 16 | 53 | 7.4 | 0 | 4.6 | 15 | 0 | 850 | 10.6% | 22.1% | 100 |
| M1954 | 3 | 12 | 57.6 | 7.4 | 0 | 5 | 15 | 0 | 850 | 12.4% | 25.2% | 0 |
| M1955 | 4 | 16 | 52.4 | 7.4 | 0 | 5.2 | 15 | 0 | 850 | 10.5% | 22.1% | 100 |
| M1956 | 3 | 12 | 57 | 7.4 | 0 | 5.6 | 15 | 0 | 850 | 12.4% | 25.2% | 0 |
| M1957 | 4 | 16 | 51.8 | 7.4 | 0 | 5.8 | 15 | 0 | 850 | 10.5% | 22.1% | 100 |
| M1958 | 3 | 12 | 56.4 | 7.4 | 0 | 6.2 | 15 | 0 | 850 | 12.3% | 25.1% | 50 |
| M1959 | 4 | 16 | 51.2 | 7.4 | 0 | 6.4 | 15 | 0 | 850 | 10.4% | 22.2% | 100 |
| M1960 | 4 | 16 | 49 | 7.4 | 0 | 8.6 | 15 | 0 | 800 | 10.2% | 22.3% | 150 |
| M1961 | 4 | 16 | 48.4 | 7.4 | 0 | 9.2 | 15 | 0 | 800 | 10.1% | 22.3% | 150 |
| M1962 | 4 | 16 | 47.8 | 7.4 | 0 | 9.8 | 15 | 0 | 800 | 10.1% | 22.4% | 100 |
| M1963 | 3 | 12 | 52.4 | 7.4 | 0 | 10.2 | 15 | 0 | 800 | 12.1% | 25.0% | 50 |
| M1964 | 4 | 16 | 47.2 | 7.4 | 0 | 10.4 | 15 | 0 | 800 | 10.0% | 22.4% | 100 |
| M1965 | 3 | 12 | 51.8 | 7.4 | 0 | 10.8 | 15 | 0 | 800 | 12.0% | 25.0% | 50 |
| M1966 | 4 | 16 | 46.6 | 7.4 | 0 | 11 | 15 | 0 | 800 | 10.0% | 22.4% | 100 |
| M1967 | 3 | 12 | 51.2 | 7.4 | 0 | 11.4 | 15 | 0 | 800 | 12.0% | 25.0% | 100 |
| M1968 | 4 | 16 | 46 | 7.4 | 0 | 11.6 | 15 | 0 | 800 | 9.9% | 22.5% | 100 |
| M1969 | 3 | 12 | 50.6 | 7.4 | 0 | 12 | 15 | 0 | 800 | 12.0% | 25.0% | 100 |
| M1970 | 4 | 16 | 45.4 | 7.4 | 0 | 12.2 | 15 | 0 | 800 | 9.9% | 22.5% | 100 |
| M1971 | 3 | 12 | 50 | 7.4 | 0 | 12.6 | 15 | 0 | 800 | 11.9% | 25.1% | 100 |
| M1972 | 4 | 16 | 44.8 | 7.4 | 0 | 12.8 | 15 | 0 | 800 | 9.8% | 22.6% | 150 |
| M1973 | 3 | 12 | 49.4 | 7.4 | 0 | 13.2 | 15 | 0 | 800 | 11.9% | 25.1% | 100 |
| M1974 | 4 | 16 | 44.2 | 7.4 | 0 | 13.4 | 15 | 0 | 800 | 9.8% | 22.6% | 150 |
| M1975 | 3 | 12 | 48.8 | 7.4 | 0 | 13.8 | 15 | 0 | 800 | 11.9% | 25.1% | 100 |
| M1976 | 4 | 16 | 43.6 | 7.4 | 0 | 14 | 15 | 0 | 800 | 10.0% | 22.6% | 150 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M1977 | 2.4 | 10 | 70.1 | 7.5 | 0 | 0 | 10 | 0 | 900 | 9.8% | 17.2% | −50 |
| M1978 | 3 | 10 | 69.5 | 7.5 | 0 | 0 | 10 | 0 | 900 | 7.8% | 17.2% | −50 |
| M1979 | 2.4 | 10.2 | 69.9 | 7.5 | 0 | 0 | 10 | 0 | 900 | 9.9% | 17.1% | −50 |
| M1980 | 3 | 10.2 | 69.3 | 7.5 | 0 | 0 | 10 | 0 | 900 | 7.9% | 17.1% | −50 |
| M1981 | 2.4 | 10.4 | 69.7 | 7.5 | 0 | 0 | 10 | 0 | 900 | 10.0% | 16.9% | −50 |
| M1982 | 3 | 10.4 | 69.1 | 7.5 | 0 | 0 | 10 | 0 | 900 | 8.0% | 16.9% | −50 |
| M1983 | 2.4 | 10.6 | 69.5 | 7.5 | 0 | 0 | 10 | 0 | 900 | 10.1% | 16.8% | −50 |
| M1984 | 3 | 10.6 | 68.9 | 7.5 | 0 | 0 | 10 | 0 | 900 | 8.1% | 16.8% | −50 |
| M1985 | 2.4 | 10.8 | 69.3 | 7.5 | 0 | 0 | 10 | 0 | 900 | 10.2% | 16.7% | −50 |
| M1986 | 3 | 10.8 | 68.7 | 7.5 | 0 | 0 | 10 | 0 | 900 | 8.2% | 16.7% | −50 |
| M1987 | 2.4 | 11 | 69.1 | 7.5 | 0 | 0 | 10 | 0 | 900 | 10.4% | 16.6% | −50 |
| M1988 | 3 | 11 | 68.5 | 7.5 | 0 | 0 | 10 | 0 | 900 | 8.3% | 16.5% | −50 |
| M1989 | 2.4 | 11.2 | 68.9 | 7.5 | 0 | 0 | 10 | 0 | 900 | 10.5% | 16.4% | −50 |
| M1990 | 3 | 11.2 | 68.3 | 7.5 | 0 | 0 | 10 | 0 | 900 | 8.4% | 16.4% | −50 |
| M1991 | 2.4 | 11.4 | 68.7 | 7.5 | 0 | 0 | 10 | 0 | 900 | 10.6% | 16.3% | −50 |
| M1992 | 3 | 11.4 | 68.1 | 7.5 | 0 | 0 | 10 | 0 | 900 | 8.5% | 16.3% | −50 |
| M1993 | 2.4 | 11.6 | 68.5 | 7.5 | 0 | 0 | 10 | 0 | 900 | 10.7% | 16.2% | −50 |
| M1994 | 3 | 11.6 | 67.9 | 7.5 | 0 | 0 | 10 | 0 | 900 | 8.6% | 16.1% | −50 |
| M1995 | 2.4 | 11.8 | 68.3 | 7.5 | 0 | 0 | 10 | 0 | 900 | 10.8% | 16.0% | −50 |
| M1996 | 3 | 11.8 | 67.7 | 7.5 | 0 | 0 | 10 | 0 | 900 | 8.7% | 16.0% | −50 |
| M1997 | 2.6 | 12 | 67.9 | 7.5 | 0 | 0 | 10 | 0 | 900 | 10.2% | 15.8% | −50 |
| M1998 | 3 | 12 | 62.4 | 7.6 | 0 | 0 | 15 | 0 | 900 | 12.9% | 24.9% | −50 |
| M1999 | 4 | 16 | 57.2 | 7.6 | 0 | 0.2 | 15 | 0 | 900 | 11.2% | 21.9% | 50 |
| M2000 | 3 | 12 | 61.8 | 7.6 | 0 | 0.6 | 15 | 0 | 850 | 12.8% | 24.9% | 0 |
| M2001 | 4 | 16 | 56.6 | 7.6 | 0 | 0.8 | 15 | 0 | 850 | 11.1% | 21.9% | 50 |
| M2002 | 3 | 12 | 61.2 | 7.6 | 0 | 1.2 | 15 | 0 | 850 | 12.8% | 25.0% | 0 |
| M2003 | 4 | 16 | 56 | 7.6 | 0 | 1.4 | 15 | 0 | 850 | 11.0% | 21.9% | 100 |
| M2004 | 3 | 12 | 60.6 | 7.6 | 0 | 1.8 | 15 | 0 | 850 | 12.7% | 25.0% | 0 |
| M2005 | 4 | 16 | 55.4 | 7.6 | 0 | 2 | 15 | 0 | 850 | 10.9% | 22.0% | 100 |
| M2006 | 3 | 12 | 60 | 7.6 | 0 | 2.4 | 15 | 0 | 850 | 12.7% | 25.0% | 0 |
| M2007 | 4 | 16 | 54.8 | 7.6 | 0 | 2.6 | 15 | 0 | 850 | 10.9% | 22.0% | 100 |
| M2008 | 3 | 12 | 59.4 | 7.6 | 0 | 3 | 15 | 0 | 850 | 12.6% | 25.1% | 0 |
| M2009 | 4 | 16 | 54.2 | 7.6 | 0 | 3.2 | 15 | 0 | 850 | 10.8% | 22.0% | 100 |
| M2010 | 3 | 12 | 58.8 | 7.6 | 0 | 3.6 | 15 | 0 | 850 | 12.5% | 25.1% | 0 |
| M2011 | 4 | 16 | 53.6 | 7.6 | 0 | 3.8 | 15 | 0 | 850 | 10.7% | 22.0% | 100 |
| M2012 | 3 | 12 | 58.2 | 7.6 | 0 | 4.2 | 15 | 0 | 850 | 12.5% | 25.1% | 0 |
| M2013 | 4 | 16 | 53 | 7.6 | 0 | 4.4 | 15 | 0 | 850 | 10.6% | 22.1% | 100 |
| M2014 | 3 | 12 | 57.6 | 7.6 | 0 | 4.8 | 15 | 0 | 850 | 12.4% | 25.2% | 0 |
| M2015 | 4 | 16 | 52.4 | 7.6 | 0 | 5 | 15 | 0 | 850 | 10.6% | 22.1% | 100 |
| M2016 | 3 | 12 | 57 | 7.6 | 0 | 5.4 | 15 | 0 | 850 | 12.4% | 25.2% | 0 |
| M2017 | 4 | 16 | 51.8 | 7.6 | 0 | 5.6 | 15 | 0 | 850 | 10.5% | 22.1% | 100 |
| M2018 | 3 | 12 | 56.4 | 7.6 | 0 | 6 | 15 | 0 | 850 | 12.3% | 25.2% | 50 |
| M2019 | 4 | 16 | 51.2 | 7.6 | 0 | 6.2 | 15 | 0 | 850 | 10.4% | 22.1% | 100 |
| M2020 | 4 | 16 | 48.8 | 7.6 | 0 | 8.6 | 15 | 0 | 800 | 10.2% | 22.3% | 150 |
| M2021 | 4 | 16 | 48.2 | 7.6 | 0 | 9.2 | 15 | 0 | 800 | 10.1% | 22.3% | 150 |
| M2022 | 4 | 16 | 47.6 | 7.6 | 0 | 9.8 | 15 | 0 | 800 | 10.1% | 22.3% | 100 |
| M2023 | 3 | 12 | 52.2 | 7.6 | 0 | 10.2 | 15 | 0 | 800 | 12.0% | 25.0% | 50 |
| M2024 | 4 | 16 | 47 | 7.6 | 0 | 10.4 | 15 | 0 | 800 | 10.0% | 22.4% | 100 |
| M2025 | 3 | 12 | 51.6 | 7.6 | 0 | 10.8 | 15 | 0 | 800 | 12.0% | 25.0% | 50 |
| M2026 | 4 | 16 | 46.4 | 7.6 | 0 | 11 | 15 | 0 | 800 | 10.0% | 22.4% | 100 |
| M2027 | 3 | 12 | 51 | 7.6 | 0 | 11.4 | 15 | 0 | 800 | 12.0% | 25.0% | 100 |
| M2028 | 4 | 16 | 45.8 | 7.6 | 0 | 11.6 | 15 | 0 | 800 | 9.9% | 22.5% | 100 |
| M2029 | 3 | 12 | 50.4 | 7.6 | 0 | 12 | 15 | 0 | 800 | 12.0% | 25.0% | 100 |
| M2030 | 4 | 16 | 45.2 | 7.6 | 0 | 12.2 | 15 | 0 | 800 | 9.9% | 22.5% | 100 |
| M2031 | 3 | 12 | 49.8 | 7.6 | 0 | 12.6 | 15 | 0 | 800 | 11.9% | 25.1% | 100 |
| M2032 | 4 | 16 | 44.6 | 7.6 | 0 | 12.8 | 15 | 0 | 800 | 9.8% | 22.5% | 150 |
| M2033 | 3 | 12 | 49.2 | 7.6 | 0 | 13.2 | 15 | 0 | 800 | 11.9% | 25.1% | 100 |
| M2034 | 4 | 16 | 44 | 7.6 | 0 | 13.4 | 15 | 0 | 800 | 9.8% | 22.6% | 150 |
| M2035 | 3 | 12 | 48.6 | 7.6 | 0 | 13.8 | 15 | 0 | 800 | 11.9% | 25.1% | 100 |
| M2036 | 4 | 16 | 43.4 | 7.6 | 0 | 14 | 15 | 0 | 800 | 10.0% | 22.6% | 150 |
| M2037 | 3 | 12 | 62 | 7.8 | 0 | 0.2 | 15 | 0 | 850 | 12.9% | 24.9% | −50 |
| M2038 | 4 | 16 | 56.8 | 7.8 | 0 | 0.4 | 15 | 0 | 850 | 11.2% | 21.9% | 50 |
| M2039 | 3 | 12 | 61.4 | 7.8 | 0 | 0.8 | 15 | 0 | 850 | 12.8% | 24.9% | 0 |
| M2040 | 4 | 16 | 56.2 | 7.8 | 0 | 1 | 15 | 0 | 850 | 11.1% | 21.9% | 50 |
| M2041 | 3 | 12 | 60.8 | 7.8 | 0 | 1.4 | 15 | 0 | 850 | 12.8% | 25.0% | 0 |
| M2042 | 4 | 16 | 55.6 | 7.8 | 0 | 1.6 | 15 | 0 | 850 | 11.0% | 21.9% | 100 |
| M2043 | 3 | 12 | 60.2 | 7.8 | 0 | 2 | 15 | 0 | 850 | 12.7% | 25.0% | 0 |
| M2044 | 4 | 16 | 55 | 7.8 | 0 | 2.2 | 15 | 0 | 850 | 10.9% | 22.0% | 100 |
| M2045 | 3 | 12 | 59.6 | 7.8 | 0 | 2.6 | 15 | 0 | 850 | 12.6% | 25.0% | 0 |
| M2046 | 4 | 16 | 54.4 | 7.8 | 0 | 2.8 | 15 | 0 | 850 | 10.8% | 22.0% | 100 |
| M2047 | 3 | 12 | 59 | 7.8 | 0 | 3.2 | 15 | 0 | 850 | 12.6% | 25.1% | 0 |
| M2048 | 4 | 16 | 53.8 | 7.8 | 0 | 3.4 | 15 | 0 | 850 | 10.8% | 22.0% | 100 |
| M2049 | 3 | 12 | 58.4 | 7.8 | 0 | 3.8 | 15 | 0 | 850 | 12.5% | 25.1% | 0 |
| M2050 | 4 | 16 | 53.2 | 7.8 | 0 | 4 | 15 | 0 | 850 | 10.7% | 22.0% | 100 |
| M2051 | 3 | 12 | 57.8 | 7.8 | 0 | 4.4 | 15 | 0 | 850 | 12.5% | 25.1% | 0 |
| M2052 | 4 | 16 | 52.6 | 7.8 | 0 | 4.6 | 15 | 0 | 850 | 10.6% | 22.1% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2053 | 3 | 12 | 57.2 | 7.8 | 0 | 5 | 15 | 0 | 850 | 12.4% | 25.2% | 0 |
| M2054 | 4 | 16 | 52 | 7.8 | 0 | 5.2 | 15 | 0 | 850 | 10.5% | 22.1% | 100 |
| M2055 | 3 | 12 | 56.6 | 7.8 | 0 | 5.6 | 15 | 0 | 850 | 12.4% | 25.2% | 0 |
| M2056 | 4 | 16 | 51.4 | 7.8 | 0 | 5.8 | 15 | 0 | 850 | 10.5% | 22.1% | 100 |
| M2057 | 4 | 16 | 51 | 7.8 | 0 | 6.2 | 15 | 0 | 850 | 10.4% | 22.1% | 100 |
| M2058 | 4 | 16 | 48.6 | 7.8 | 0 | 8.6 | 15 | 0 | 800 | 10.2% | 22.3% | 150 |
| M2059 | 4 | 16 | 48 | 7.8 | 0 | 9.2 | 15 | 0 | 800 | 10.1% | 22.3% | 150 |
| M2060 | 4 | 16 | 47.4 | 7.8 | 0 | 9.8 | 15 | 0 | 800 | 10.0% | 22.3% | 100 |
| M2061 | 4 | 16 | 47 | 7.8 | 0 | 10.2 | 15 | 0 | 800 | 10.0% | 22.4% | 100 |
| M2062 | 3 | 12 | 51.6 | 7.8 | 0 | 10.6 | 15 | 0 | 800 | 12.0% | 25.0% | 50 |
| M2063 | 4 | 16 | 46.4 | 7.8 | 0 | 10.8 | 15 | 0 | 800 | 10.0% | 22.4% | 100 |
| M2064 | 3 | 12 | 51 | 7.8 | 0 | 11.2 | 15 | 0 | 800 | 12.0% | 25.0% | 100 |
| M2065 | 4 | 16 | 45.8 | 7.8 | 0 | 11.4 | 15 | 0 | 800 | 9.9% | 22.4% | 100 |
| M2066 | 3 | 12 | 50.4 | 7.8 | 0 | 11.8 | 15 | 0 | 800 | 12.0% | 25.0% | 100 |
| M2067 | 4 | 16 | 45.2 | 7.8 | 0 | 12 | 15 | 0 | 800 | 9.9% | 22.5% | 100 |
| M2068 | 3 | 12 | 49.8 | 7.8 | 0 | 12.4 | 15 | 0 | 800 | 11.9% | 25.0% | 100 |
| M2069 | 4 | 16 | 44.6 | 7.8 | 0 | 12.6 | 15 | 0 | 800 | 9.8% | 22.5% | 150 |
| M2070 | 3 | 12 | 49.2 | 7.8 | 0 | 13 | 15 | 0 | 800 | 11.9% | 25.1% | 100 |
| M2071 | 4 | 16 | 44 | 7.8 | 0 | 13.2 | 15 | 0 | 800 | 9.8% | 22.6% | 150 |
| M2072 | 3 | 12 | 48.6 | 7.8 | 0 | 13.6 | 15 | 0 | 800 | 11.9% | 25.1% | 100 |
| M2073 | 4 | 16 | 43.4 | 7.8 | 0 | 13.8 | 15 | 0 | 800 | 10.0% | 22.6% | 150 |
| M2074 | 3.75 | 7 | 61.25 | 8 | 0 | 0 | 20 | 0 | 850 | 8.0% | 32.9% | 150 |
| M2075 | 4 | 8 | 60 | 8 | 0 | 0 | 20 | 0 | 850 | 9.0% | 34.2% | 200 |
| M2076 | 2 | 10 | 70 | 8 | 0 | 0 | 10 | 0 | 900 | 10.5% | 17.0% | −50 |
| M2077 | 2.5 | 10 | 69.5 | 8 | 0 | 0 | 10 | 0 | 900 | 9.4% | 17.2% | −50 |
| M2078 | 3 | 10 | 69 | 8 | 0 | 0 | 10 | 0 | 900 | 7.8% | 17.2% | −50 |
| M2079 | 3 | 10 | 68.5 | 8 | 0 | 0 | 10.5 | 0 | 900 | 8.1% | 18.1% | −50 |
| M2080 | 2.5 | 10 | 68 | 8 | 0 | 0 | 11.5 | 0 | 900 | 10.5% | 20.0% | −50 |
| M2081 | 3 | 10 | 67 | 8 | 0 | 0 | 12 | 0 | 900 | 9.2% | 20.8% | −50 |
| M2082 | 2.2 | 10.2 | 69.6 | 8 | 0 | 0 | 10 | 0 | 900 | 10.6% | 17.2% | −50 |
| M2083 | 2.6 | 10.2 | 69.2 | 8 | 0 | 0 | 10 | 0 | 900 | 9.2% | 17.0% | −50 |
| M2084 | 2 | 10.2 | 69.3 | 8 | 0 | 0 | 10.5 | 0 | 900 | 10.7% | 17.3% | −50 |
| M2085 | 2.5 | 10.2 | 68.3 | 8 | 0 | 0 | 11 | 0 | 900 | 10.4% | 19.0% | −50 |
| M2086 | 3 | 10.2 | 67.3 | 8 | 0 | 0 | 11.5 | 0 | 900 | 8.9% | 19.8% | −50 |
| M2087 | 2 | 10.4 | 69.6 | 8 | 0 | 0 | 10 | 0 | 900 | 10.9% | 16.9% | −50 |
| M2088 | 2.5 | 10.4 | 69.1 | 8 | 0 | 0 | 10 | 0 | 900 | 9.7% | 16.9% | −50 |
| M2089 | 3 | 10.4 | 68.6 | 8 | 0 | 0 | 10 | 0 | 900 | 8.0% | 16.9% | −50 |
| M2090 | 3 | 10.4 | 68.1 | 8 | 0 | 0 | 10.5 | 0 | 900 | 8.3% | 17.8% | −50 |
| M2091 | 2.5 | 10.4 | 67.6 | 8 | 0 | 0 | 11.5 | 0 | 900 | 10.9% | 19.8% | −50 |
| M2092 | 3 | 10.4 | 66.6 | 8 | 0 | 0 | 12 | 0 | 900 | 9.4% | 20.6% | −50 |
| M2093 | 2.4 | 10.6 | 69 | 8 | 0 | 0 | 10 | 0 | 900 | 10.2% | 16.8% | −50 |
| M2094 | 2.8 | 10.6 | 68.6 | 8 | 0 | 0 | 10 | 0 | 900 | 8.7% | 16.7% | −50 |
| M2095 | 2.5 | 10.6 | 68.4 | 8 | 0 | 0 | 10.5 | 0 | 900 | 10.2% | 17.7% | −50 |
| M2096 | 3 | 10.6 | 67.4 | 8 | 0 | 0 | 11 | 0 | 900 | 8.8% | 18.6% | −50 |
| M2097 | 2.5 | 10.6 | 66.9 | 8 | 0 | 0 | 12 | 0 | 900 | 11.2% | 20.6% | −50 |
| M2098 | 2 | 10.8 | 69.2 | 8 | 0 | 0 | 10 | 0 | 900 | 11.3% | 16.9% | −50 |
| M2099 | 2.5 | 10.8 | 68.7 | 8 | 0 | 0 | 10 | 0 | 900 | 9.9% | 16.6% | −50 |
| M2100 | 3 | 10.8 | 68.2 | 8 | 0 | 0 | 10 | 0 | 900 | 8.2% | 16.6% | −50 |
| M2101 | 2.5 | 10.8 | 67.7 | 8 | 0 | 0 | 11 | 0 | 900 | 10.7% | 18.6% | −50 |
| M2102 | 2.5 | 10.8 | 67.2 | 8 | 0 | 0 | 11.5 | 0 | 900 | 11.1% | 19.5% | −50 |
| M2103 | 3 | 10.8 | 66.2 | 8 | 0 | 0 | 12 | 0 | 900 | 9.6% | 20.3% | −50 |
| M2104 | 3.5 | 10.8 | 64.7 | 8 | 0 | 0 | 13 | 0 | 900 | 8.6% | 22.1% | 0 |
| M2105 | 3.5 | 10.8 | 63.7 | 8 | 0 | 0 | 14 | 0 | 900 | 9.4% | 23.9% | 0 |
| M2106 | 3.5 | 10.8 | 62.7 | 8 | 0 | 0 | 15 | 0 | 850 | 10.2% | 25.6% | 50 |
| M2107 | 2 | 11 | 69 | 8 | 0 | 0 | 10 | 0 | 900 | 11.5% | 16.8% | −50 |
| M2108 | 2.5 | 11 | 68.5 | 8 | 0 | 0 | 10 | 0 | 900 | 10.0% | 16.5% | −50 |
| M2109 | 3 | 11 | 68 | 8 | 0 | 0 | 10 | 0 | 900 | 8.3% | 16.5% | −50 |
| M2110 | 2.5 | 11 | 67.5 | 8 | 0 | 0 | 11 | 0 | 900 | 10.8% | 18.4% | −50 |
| M2111 | 2.5 | 11 | 67 | 8 | 0 | 0 | 11.5 | 0 | 900 | 11.2% | 19.4% | −50 |
| M2112 | 3 | 11 | 66 | 8 | 0 | 0 | 12 | 0 | 900 | 9.7% | 20.2% | −50 |
| M2113 | 3.5 | 11 | 64.5 | 8 | 0 | 0 | 13 | 0 | 900 | 8.7% | 22.0% | 0 |
| M2114 | 3.5 | 11 | 63.5 | 8 | 0 | 0 | 14 | 0 | 900 | 9.5% | 23.7% | 0 |
| M2115 | 3.5 | 11 | 62.5 | 8 | 0 | 0 | 15 | 0 | 850 | 10.3% | 25.4% | 50 |
| M2116 | 3 | 11.2 | 69.8 | 8 | 0 | 0 | 8 | 0 | 900 | 7.1% | 12.6% | −50 |
| M2117 | 2.2 | 11.2 | 68.6 | 8 | 0 | 0 | 10 | 0 | 900 | 11.3% | 16.5% | −50 |
| M2118 | 2.6 | 11.2 | 68.2 | 8 | 0 | 0 | 10 | 0 | 900 | 9.7% | 16.4% | −50 |
| M2119 | 2.5 | 11.2 | 67.8 | 8 | 0 | 0 | 10.5 | 0 | 900 | 10.5% | 17.3% | −50 |
| M2120 | 3 | 11.2 | 66.8 | 8 | 0 | 0 | 11 | 0 | 900 | 9.1% | 18.2% | −50 |
| M2121 | 3 | 11.2 | 66.3 | 8 | 0 | 0 | 11.5 | 0 | 900 | 9.5% | 19.1% | −50 |
| M2122 | 3.5 | 11.2 | 65.3 | 8 | 0 | 0 | 12 | 0 | 900 | 8.2% | 20.1% | 0 |
| M2123 | 4 | 11.2 | 63.8 | 8 | 0 | 0 | 13 | 0 | 900 | 7.3% | 22.1% | 100 |
| M2124 | 4 | 11.2 | 62.8 | 8 | 0 | 0 | 14 | 0 | 900 | 7.9% | 23.8% | 100 |
| M2125 | 4 | 11.2 | 61.8 | 8 | 0 | 0 | 15 | 0 | 900 | 8.6% | 25.4% | 100 |
| M2126 | 2 | 11.4 | 68.6 | 8 | 0 | 0 | 10 | 0 | 900 | 12.0% | 16.6% | −50 |
| M2127 | 2.5 | 11.4 | 68.1 | 8 | 0 | 0 | 10 | 0 | 900 | 10.2% | 16.3% | −50 |
| M2128 | 3 | 11.4 | 67.6 | 8 | 0 | 0 | 10 | 0 | 900 | 8.5% | 16.2% | −50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2129 | 3 | 11.4 | 67.1 | 8 | 0 | 0 | 10.5 | 0 | 900 | 8.8% | 17.2% | −50 |
| M2130 | 3.5 | 11.4 | 66.1 | 8 | 0 | 0 | 11 | 0 | 900 | 7.6% | 18.2% | 0 |
| M2131 | 2.5 | 11.4 | 66.1 | 8 | 0 | 0 | 12 | 0 | 900 | 11.9% | 20.1% | −50 |
| M2132 | 3 | 11.4 | 64.6 | 8 | 0 | 0 | 13 | 0 | 850 | 10.8% | 21.7% | −50 |
| M2133 | 3 | 11.4 | 63.6 | 8 | 0 | 0 | 14 | 0 | 850 | 11.6% | 23.5% | −50 |
| M2134 | 3 | 11.4 | 62.6 | 8 | 0 | 0 | 15 | 0 | 850 | 12.4% | 25.3% | 0 |
| M2135 | 3 | 11.6 | 69.4 | 8 | 0 | 0 | 8 | 0 | 900 | 7.3% | 12.4% | −50 |
| M2136 | 2.2 | 11.6 | 68.2 | 8 | 0 | 0 | 10 | 0 | 900 | 11.5% | 16.3% | −50 |
| M2137 | 2.6 | 11.6 | 67.8 | 8 | 0 | 0 | 10 | 0 | 900 | 10.0% | 16.1% | −50 |
| M2138 | 3.5 | 11.6 | 66.9 | 8 | 0 | 0 | 10 | 0 | 900 | 7.1% | 16.3% | 0 |
| M2139 | 2.5 | 11.6 | 66.9 | 8 | 0 | 0 | 11 | 0 | 900 | 11.2% | 18.0% | −50 |
| M2140 | 2.5 | 11.6 | 66.4 | 8 | 0 | 0 | 11.5 | 0 | 900 | 11.6% | 19.0% | −50 |
| M2141 | 3 | 11.6 | 65.4 | 8 | 0 | 0 | 12 | 0 | 900 | 10.1% | 19.8% | −50 |
| M2142 | 3.5 | 11.6 | 63.9 | 8 | 0 | 0 | 13 | 0 | 900 | 9.1% | 21.6% | 0 |
| M2143 | 3.5 | 11.6 | 62.9 | 8 | 0 | 0 | 14 | 0 | 900 | 9.8% | 23.3% | 0 |
| M2144 | 3.5 | 11.6 | 61.9 | 8 | 0 | 0 | 15 | 0 | 850 | 10.6% | 25.0% | 0 |
| M2145 | 3 | 11.8 | 68.2 | 8 | 0 | 0 | 9 | 0 | 900 | 8.0% | 14.1% | −50 |
| M2146 | 2.4 | 11.8 | 67.8 | 8 | 0 | 0 | 10 | 0 | 900 | 10.8% | 16.0% | −50 |
| M2147 | 2.8 | 11.8 | 67.4 | 8 | 0 | 0 | 10 | 0 | 900 | 9.4% | 15.9% | −50 |
| M2148 | 2.5 | 11.8 | 67.2 | 8 | 0 | 0 | 10.5 | 0 | 900 | 10.9% | 16.9% | −50 |
| M2149 | 3 | 11.8 | 66.2 | 8 | 0 | 0 | 11 | 0 | 900 | 9.4% | 17.8% | −50 |
| M2150 | 3 | 11.8 | 65.7 | 8 | 0 | 0 | 11.5 | 0 | 900 | 9.8% | 18.7% | −50 |
| M2151 | 3.5 | 11.8 | 64.7 | 8 | 0 | 0 | 12 | 0 | 900 | 8.5% | 19.7% | 50 |
| M2152 | 3.5 | 11.8 | 63.7 | 8 | 0 | 0 | 13 | 0 | 900 | 9.2% | 21.4% | 0 |
| M2153 | 3.5 | 11.8 | 62.7 | 8 | 0 | 0 | 14 | 0 | 900 | 9.9% | 23.1% | 0 |
| M2154 | 3.5 | 11.8 | 61.7 | 8 | 0 | 0 | 15 | 0 | 850 | 10.7% | 24.9% | 0 |
| M2155 | 3 | 12 | 68 | 8 | 0 | 0 | 9 | 0 | 900 | 8.1% | 14.0% | −50 |
| M2156 | 2.5 | 12 | 67.5 | 8 | 0 | 0 | 10 | 0 | 900 | 10.6% | 15.9% | −50 |
| M2157 | 3 | 12 | 67 | 8 | 0 | 0 | 10 | 0 | 900 | 8.8% | 15.8% | −50 |
| M2158 | 3 | 12 | 66.5 | 8 | 0 | 0 | 10.5 | 0 | 900 | 9.1% | 16.8% | −50 |
| M2159 | 3.5 | 12 | 65.5 | 8 | 0 | 0 | 11 | 0 | 900 | 7.9% | 17.8% | 0 |
| M2160 | 2.5 | 12 | 65.5 | 8 | 0 | 0 | 12 | 0 | 900 | 12.3% | 19.9% | −50 |
| M2161 | 4 | 12 | 64 | 8 | 0 | 0 | 12 | 0 | 900 | 7.1% | 19.8% | 50 |
| M2162 | 4 | 12 | 63 | 8 | 0 | 0 | 13 | 0 | 900 | 7.7% | 21.5% | 100 |
| M2163 | 4 | 12 | 62 | 8 | 0 | 0 | 14 | 0 | 900 | 8.3% | 23.2% | 100 |
| M2164 | 3.5 | 12 | 61.5 | 8 | 0 | 0 | 15 | 0 | 850 | 10.9% | 24.7% | 0 |
| M2165 | 3 | 12.2 | 66.8 | 8 | 0 | 0 | 10 | 0 | 900 | 8.9% | 15.7% | −50 |
| M2166 | 2.5 | 12.2 | 66.3 | 8 | 0 | 0 | 11 | 0 | 900 | 11.5% | 17.6% | −50 |
| M2167 | 3 | 12.2 | 65.3 | 8 | 0 | 0 | 11.5 | 0 | 900 | 10.0% | 18.4% | −50 |
| M2168 | 2.5 | 12.4 | 67.1 | 8 | 0 | 0 | 10 | 0 | 900 | 10.8% | 15.6% | −50 |
| M2169 | 3 | 12.4 | 66.1 | 8 | 0 | 0 | 10.5 | 0 | 900 | 9.4% | 16.5% | −50 |
| M2170 | 2.5 | 12.4 | 65.6 | 8 | 0 | 0 | 11.5 | 0 | 900 | 12.1% | 18.4% | −50 |
| M2171 | 3 | 12.4 | 64.6 | 8 | 0 | 0 | 12 | 0 | 900 | 10.5% | 19.2% | −50 |
| M2172 | 2.5 | 12.6 | 66.4 | 8 | 0 | 0 | 10.5 | 0 | 900 | 11.3% | 16.4% | −50 |
| M2173 | 3 | 12.6 | 65.4 | 8 | 0 | 0 | 11 | 0 | 900 | 9.8% | 17.3% | −50 |
| M2174 | 2.5 | 12.6 | 64.9 | 8 | 0 | 0 | 12 | 0 | 900 | 12.7% | 19.6% | −50 |
| M2175 | 3 | 12.8 | 66.2 | 8 | 0 | 0 | 10 | 0 | 900 | 9.2% | 15.3% | −50 |
| M2176 | 2.5 | 12.8 | 65.7 | 8 | 0 | 0 | 11 | 0 | 900 | 11.9% | 17.2% | −50 |
| M2177 | 3 | 12.8 | 64.7 | 8 | 0 | 0 | 11.5 | 0 | 900 | 10.4% | 18.0% | −50 |
| M2178 | 2.5 | 13 | 66.5 | 8 | 0 | 0 | 10 | 0 | 900 | 11.1% | 15.2% | −50 |
| M2179 | 3 | 13 | 65.5 | 8 | 0 | 0 | 10.5 | 0 | 900 | 9.7% | 16.1% | −50 |
| M2180 | 2.5 | 13 | 65 | 8 | 0 | 0 | 11.5 | 0 | 900 | 12.4% | 18.4% | −50 |
| M2181 | 3 | 13 | 64 | 8 | 0 | 0 | 12 | 0 | 900 | 10.9% | 18.8% | 0 |
| M2182 | 2.5 | 13.2 | 65.8 | 8 | 0 | 0 | 10.5 | 0 | 900 | 11.7% | 16.0% | −50 |
| M2183 | 3 | 13.2 | 64.8 | 8 | 0 | 0 | 11 | 0 | 900 | 10.2% | 16.8% | −50 |
| M2184 | 2.5 | 13.2 | 64.3 | 8 | 0 | 0 | 12 | 0 | 900 | 13.0% | 19.1% | −50 |
| M2185 | 3 | 13.4 | 65.6 | 8 | 0 | 0 | 10 | 0 | 900 | 9.5% | 14.9% | −50 |
| M2186 | 2.5 | 13.4 | 65.1 | 8 | 0 | 0 | 11 | 0 | 900 | 12.2% | 16.9% | −50 |
| M2187 | 3 | 13.4 | 64.1 | 8 | 0 | 0 | 11.5 | 0 | 900 | 10.7% | 17.6% | −50 |
| M2188 | 2.5 | 13.6 | 65.9 | 8 | 0 | 0 | 10 | 0 | 900 | 11.5% | 14.8% | −50 |
| M2189 | 3 | 13.6 | 64.9 | 8 | 0 | 0 | 10.5 | 0 | 900 | 10.0% | 15.7% | −50 |
| M2190 | 2.5 | 13.6 | 64.4 | 8 | 0 | 0 | 11.5 | 0 | 900 | 12.8% | 18.2% | −50 |
| M2191 | 3 | 13.6 | 63.4 | 8 | 0 | 0 | 12 | 0 | 850 | 11.2% | 18.4% | −50 |
| M2192 | 2.5 | 13.8 | 65.2 | 8 | 0 | 0 | 10.5 | 0 | 900 | 12.0% | 15.6% | −50 |
| M2193 | 3 | 13.8 | 64.2 | 8 | 0 | 0 | 11 | 0 | 900 | 10.5% | 16.4% | −50 |
| M2194 | 3 | 13.8 | 63.2 | 8 | 0 | 0 | 12 | 0 | 850 | 11.3% | 18.2% | −50 |
| M2195 | 2.5 | 14 | 65 | 8 | 0 | 0 | 10.5 | 0 | 900 | 12.2% | 15.5% | −50 |
| M2196 | 3 | 14 | 64 | 8 | 0 | 0 | 11 | 0 | 900 | 10.6% | 16.3% | −50 |
| M2197 | 3 | 14 | 63 | 8 | 0 | 0 | 12 | 0 | 850 | 11.5% | 18.1% | −50 |
| M2198 | 4 | 16 | 56.8 | 8 | 0 | 0.2 | 15 | 0 | 850 | 11.2% | 21.9% | 50 |
| M2199 | 3 | 12 | 61.4 | 8 | 0 | 0.6 | 15 | 0 | 850 | 12.9% | 24.9% | 0 |
| M2200 | 4 | 16 | 56.2 | 8 | 0 | 0.8 | 15 | 0 | 850 | 11.1% | 21.9% | 50 |
| M2201 | 3 | 12 | 60.8 | 8 | 0 | 1.2 | 15 | 0 | 850 | 12.8% | 25.0% | 0 |
| M2202 | 4 | 16 | 55.6 | 8 | 0 | 1.4 | 15 | 0 | 850 | 11.0% | 21.9% | 100 |
| M2203 | 3 | 12 | 60.2 | 8 | 0 | 1.8 | 15 | 0 | 850 | 12.7% | 25.0% | 0 |
| M2204 | 4 | 16 | 55 | 8 | 0 | 2 | 15 | 0 | 850 | 11.0% | 21.9% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2205 | 3 | 12 | 59.6 | 8 | 0 | 2.4 | 15 | 0 | 850 | 12.7% | 25.0% | 0 |
| M2206 | 4 | 16 | 54.4 | 8 | 0 | 2.6 | 15 | 0 | 850 | 10.9% | 22.0% | 100 |
| M2207 | 3 | 12 | 59 | 8 | 0 | 3 | 15 | 0 | 850 | 12.6% | 25.1% | 0 |
| M2208 | 4 | 16 | 53.8 | 8 | 0 | 3.2 | 15 | 0 | 850 | 10.8% | 22.0% | 100 |
| M2209 | 3 | 12 | 58.4 | 8 | 0 | 3.6 | 15 | 0 | 850 | 12.5% | 25.1% | 0 |
| M2210 | 4 | 16 | 53.2 | 8 | 0 | 3.8 | 15 | 0 | 850 | 10.7% | 22.0% | 100 |
| M2211 | 3 | 12 | 57.8 | 8 | 0 | 4.2 | 15 | 0 | 850 | 12.5% | 25.1% | 0 |
| M2212 | 4 | 16 | 52.6 | 8 | 0 | 4.4 | 15 | 0 | 850 | 10.6% | 22.0% | 100 |
| M2213 | 3 | 12 | 57.2 | 8 | 0 | 4.8 | 15 | 0 | 850 | 12.4% | 25.2% | 0 |
| M2214 | 4 | 16 | 52 | 8 | 0 | 5 | 15 | 0 | 850 | 10.6% | 22.1% | 100 |
| M2215 | 3 | 12 | 56.6 | 8 | 0 | 5.4 | 15 | 0 | 850 | 12.4% | 25.2% | 0 |
| M2216 | 4 | 16 | 51.4 | 8 | 0 | 5.6 | 15 | 0 | 850 | 10.5% | 22.1% | 100 |
| M2217 | 3 | 12 | 56 | 8 | 0 | 6 | 15 | 0 | 850 | 12.3% | 25.2% | 50 |
| M2218 | 4 | 16 | 50.6 | 8 | 0 | 6.4 | 15 | 0 | 800 | 10.4% | 22.1% | 100 |
| M2219 | 4 | 16 | 47.8 | 8 | 0 | 9.2 | 15 | 0 | 800 | 10.1% | 22.3% | 150 |
| M2220 | 4 | 16 | 47.2 | 8 | 0 | 9.8 | 15 | 0 | 800 | 10.0% | 22.3% | 150 |
| M2221 | 4 | 16 | 46.8 | 8 | 0 | 10.2 | 15 | 0 | 800 | 10.0% | 22.3% | 100 |
| M2222 | 3 | 12 | 51.4 | 8 | 0 | 10.6 | 15 | 0 | 800 | 12.0% | 25.0% | 50 |
| M2223 | 4 | 16 | 46.2 | 8 | 0 | 10.8 | 15 | 0 | 800 | 10.0% | 22.4% | 100 |
| M2224 | 3 | 12 | 50.8 | 8 | 0 | 11.2 | 15 | 0 | 800 | 12.0% | 25.0% | 100 |
| M2225 | 4 | 16 | 45.6 | 8 | 0 | 11.4 | 15 | 0 | 800 | 9.9% | 22.4% | 100 |
| M2226 | 3 | 12 | 50.2 | 8 | 0 | 11.8 | 15 | 0 | 800 | 11.9% | 25.0% | 100 |
| M2227 | 4 | 16 | 45 | 8 | 0 | 12 | 15 | 0 | 800 | 9.9% | 22.5% | 100 |
| M2228 | 3 | 12 | 49.6 | 8 | 0 | 12.4 | 15 | 0 | 800 | 11.9% | 25.0% | 100 |
| M2229 | 4 | 16 | 44.4 | 8 | 0 | 12.6 | 15 | 0 | 800 | 9.8% | 22.5% | 150 |
| M2230 | 3 | 12 | 49 | 8 | 0 | 13 | 15 | 0 | 800 | 11.9% | 25.0% | 100 |
| M2231 | 4 | 16 | 43.8 | 8 | 0 | 13.2 | 15 | 0 | 800 | 9.8% | 22.5% | 150 |
| M2232 | 3 | 12 | 48.4 | 8 | 0 | 13.6 | 15 | 0 | 800 | 11.9% | 25.1% | 100 |
| M2233 | 4 | 16 | 43.2 | 8 | 0 | 13.8 | 15 | 0 | 800 | 9.7% | 22.6% | 150 |
| M2234 | 3 | 12 | 61.8 | 8.2 | 0 | 0 | 15 | 0 | 850 | 12.9% | 24.9% | −50 |
| M2235 | 4 | 16 | 56.6 | 8.2 | 0 | 0.2 | 15 | 0 | 850 | 11.2% | 21.9% | 50 |
| M2236 | 3 | 12 | 61.2 | 8.2 | 0 | 0.6 | 15 | 0 | 850 | 12.9% | 24.9% | 0 |
| M2237 | 4 | 16 | 56 | 8.2 | 0 | 0.8 | 15 | 0 | 850 | 11.1% | 21.9% | 50 |
| M2238 | 3 | 12 | 60.6 | 8.2 | 0 | 1.2 | 15 | 0 | 850 | 12.8% | 24.9% | 0 |
| M2239 | 4 | 16 | 55.4 | 8.2 | 0 | 1.4 | 15 | 0 | 850 | 11.0% | 21.9% | 100 |
| M2240 | 3 | 12 | 60 | 8.2 | 0 | 1.8 | 15 | 0 | 850 | 12.7% | 25.0% | 0 |
| M2241 | 4 | 16 | 54.8 | 8.2 | 0 | 2 | 15 | 0 | 850 | 11.0% | 21.9% | 100 |
| M2242 | 3 | 12 | 59.4 | 8.2 | 0 | 2.4 | 15 | 0 | 850 | 12.7% | 25.0% | 0 |
| M2243 | 4 | 16 | 54.2 | 8.2 | 0 | 2.6 | 15 | 0 | 850 | 10.9% | 22.0% | 100 |
| M2244 | 3 | 12 | 58.8 | 8.2 | 0 | 3 | 15 | 0 | 850 | 12.6% | 25.0% | 0 |
| M2245 | 4 | 16 | 53.6 | 8.2 | 0 | 3.2 | 15 | 0 | 850 | 10.8% | 22.0% | 100 |
| M2246 | 3 | 12 | 58.2 | 8.2 | 0 | 3.6 | 15 | 0 | 850 | 12.6% | 25.1% | 0 |
| M2247 | 4 | 16 | 53 | 8.2 | 0 | 3.8 | 15 | 0 | 850 | 10.7% | 22.0% | 100 |
| M2248 | 3 | 12 | 57.6 | 8.2 | 0 | 4.2 | 15 | 0 | 850 | 12.5% | 25.1% | 0 |
| M2249 | 4 | 16 | 52.4 | 8.2 | 0 | 4.4 | 15 | 0 | 850 | 10.6% | 22.0% | 100 |
| M2250 | 3 | 12 | 57 | 8.2 | 0 | 4.8 | 15 | 0 | 850 | 12.4% | 25.2% | 0 |
| M2251 | 4 | 16 | 51.8 | 8.2 | 0 | 5 | 15 | 0 | 850 | 10.6% | 22.1% | 100 |
| M2252 | 3 | 12 | 56.4 | 8.2 | 0 | 5.4 | 15 | 0 | 850 | 12.4% | 25.2% | 0 |
| M2253 | 4 | 16 | 51.2 | 8.2 | 0 | 5.6 | 15 | 0 | 850 | 10.5% | 22.1% | 100 |
| M2254 | 4 | 16 | 50.8 | 8.2 | 0 | 6 | 15 | 0 | 800 | 10.4% | 22.1% | 100 |
| M2255 | 4 | 16 | 47.8 | 8.2 | 0 | 9 | 15 | 0 | 800 | 10.1% | 22.3% | 150 |
| M2256 | 4 | 16 | 47.2 | 8.2 | 0 | 9.6 | 15 | 0 | 800 | 10.1% | 22.3% | 150 |
| M2257 | 3 | 12 | 51.6 | 8.2 | 0 | 10.2 | 15 | 0 | 800 | 12.0% | 25.0% | 50 |
| M2258 | 4 | 16 | 46.4 | 8.2 | 0 | 10.4 | 15 | 0 | 800 | 10.0% | 22.4% | 100 |
| M2259 | 3 | 12 | 51 | 8.2 | 0 | 10.8 | 15 | 0 | 800 | 12.0% | 25.0% | 50 |
| M2260 | 4 | 16 | 45.8 | 8.2 | 0 | 11 | 15 | 0 | 800 | 9.9% | 22.4% | 100 |
| M2261 | 3 | 12 | 50.4 | 8.2 | 0 | 11.4 | 15 | 0 | 800 | 12.0% | 25.0% | 100 |
| M2262 | 4 | 16 | 45.2 | 8.2 | 0 | 11.6 | 15 | 0 | 800 | 9.9% | 22.4% | 100 |
| M2263 | 3 | 12 | 49.8 | 8.2 | 0 | 12 | 15 | 0 | 800 | 11.9% | 25.0% | 100 |
| M2264 | 4 | 16 | 44.6 | 8.2 | 0 | 12.2 | 15 | 0 | 800 | 9.8% | 22.5% | 150 |
| M2265 | 3 | 12 | 49.2 | 8.2 | 0 | 12.6 | 15 | 0 | 800 | 11.9% | 25.0% | 100 |
| M2266 | 4 | 16 | 44 | 8.2 | 0 | 12.8 | 15 | 0 | 800 | 9.8% | 22.5% | 150 |
| M2267 | 3 | 12 | 48.6 | 8.2 | 0 | 13.2 | 15 | 0 | 800 | 11.9% | 25.0% | 100 |
| M2268 | 4 | 16 | 43.4 | 8.2 | 0 | 13.4 | 15 | 0 | 800 | 9.8% | 22.5% | 150 |
| M2269 | 3 | 12 | 48 | 8.2 | 0 | 13.8 | 15 | 0 | 800 | 11.8% | 25.1% | 100 |
| M2270 | 4 | 16 | 42.8 | 8.2 | 0 | 14 | 15 | 0 | 800 | 9.9% | 22.6% | 150 |
| M2271 | 3 | 12 | 61.4 | 8.4 | 0 | 0.2 | 15 | 0 | 850 | 12.9% | 24.9% | 0 |
| M2272 | 4 | 16 | 56.2 | 8.4 | 0 | 0.4 | 15 | 0 | 850 | 11.2% | 21.9% | 50 |
| M2273 | 3 | 12 | 60.8 | 8.4 | 0 | 0.8 | 15 | 0 | 850 | 12.8% | 24.9% | 0 |
| M2274 | 4 | 16 | 55.6 | 8.4 | 0 | 1 | 15 | 0 | 850 | 11.1% | 21.9% | 50 |
| M2275 | 3 | 12 | 60.2 | 8.4 | 0 | 1.4 | 15 | 0 | 850 | 12.8% | 24.9% | 0 |
| M2276 | 4 | 16 | 55 | 8.4 | 0 | 1.6 | 15 | 0 | 850 | 11.0% | 21.9% | 100 |
| M2277 | 3 | 12 | 59.6 | 8.4 | 0 | 2 | 15 | 0 | 850 | 12.7% | 25.0% | 0 |
| M2278 | 4 | 16 | 54.4 | 8.4 | 0 | 2.2 | 15 | 0 | 850 | 10.9% | 21.9% | 100 |
| M2279 | 3 | 12 | 59 | 8.4 | 0 | 2.6 | 15 | 0 | 850 | 12.7% | 25.0% | 0 |
| M2280 | 4 | 16 | 53.8 | 8.4 | 0 | 2.8 | 15 | 0 | 850 | 10.8% | 22.0% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2281 | 3 | 12 | 58.4 | 8.4 | 0 | 3.2 | 15 | 0 | 850 | 12.6% | 25.1% | 0 |
| M2282 | 4 | 16 | 53.2 | 8.4 | 0 | 3.4 | 15 | 0 | 850 | 10.8% | 22.0% | 100 |
| M2283 | 3 | 12 | 57.8 | 8.4 | 0 | 3.8 | 15 | 0 | 850 | 12.5% | 25.1% | 0 |
| M2284 | 4 | 16 | 52.6 | 8.4 | 0 | 4 | 15 | 0 | 850 | 10.7% | 22.0% | 100 |
| M2285 | 3 | 12 | 57.2 | 8.4 | 0 | 4.4 | 15 | 0 | 850 | 12.5% | 25.1% | 0 |
| M2286 | 4 | 16 | 52 | 8.4 | 0 | 4.6 | 15 | 0 | 850 | 10.6% | 22.0% | 100 |
| M2287 | 3 | 12 | 56.6 | 8.4 | 0 | 5 | 15 | 0 | 850 | 12.4% | 25.2% | 0 |
| M2288 | 4 | 16 | 51.4 | 8.4 | 0 | 5.2 | 15 | 0 | 850 | 10.5% | 22.1% | 100 |
| M2289 | 3 | 12 | 56 | 8.4 | 0 | 5.6 | 15 | 0 | 850 | 12.4% | 25.2% | 0 |
| M2290 | 4 | 16 | 50.6 | 8.4 | 0 | 6 | 15 | 0 | 800 | 10.4% | 22.1% | 100 |
| M2291 | 4 | 16 | 47.4 | 8.4 | 0 | 9.2 | 15 | 0 | 800 | 10.1% | 22.3% | 150 |
| M2292 | 4 | 16 | 46.8 | 8.4 | 0 | 9.8 | 15 | 0 | 800 | 10.0% | 22.3% | 150 |
| M2293 | 4 | 16 | 46.4 | 8.4 | 0 | 10.2 | 15 | 0 | 800 | 10.0% | 22.3% | 150 |
| M2294 | 3 | 12 | 51 | 8.4 | 0 | 10.6 | 15 | 0 | 800 | 12.0% | 25.0% | 50 |
| M2295 | 4 | 16 | 45.8 | 8.4 | 0 | 10.8 | 15 | 0 | 800 | 9.9% | 22.4% | 100 |
| M2296 | 3 | 12 | 50.4 | 8.4 | 0 | 11.2 | 15 | 0 | 800 | 12.0% | 25.0% | 100 |
| M2297 | 4 | 16 | 45.2 | 8.4 | 0 | 11.4 | 15 | 0 | 800 | 9.9% | 22.4% | 100 |
| M2298 | 3 | 12 | 49.8 | 8.4 | 0 | 11.8 | 15 | 0 | 800 | 11.9% | 25.0% | 100 |
| M2299 | 4 | 16 | 44.6 | 8.4 | 0 | 12 | 15 | 0 | 800 | 9.8% | 22.4% | 100 |
| M2300 | 3 | 12 | 49.2 | 8.4 | 0 | 12.4 | 15 | 0 | 800 | 11.9% | 25.0% | 100 |
| M2301 | 4 | 16 | 44 | 8.4 | 0 | 12.6 | 15 | 0 | 800 | 9.8% | 22.5% | 150 |
| M2302 | 3 | 12 | 48.6 | 8.4 | 0 | 13 | 15 | 0 | 800 | 11.9% | 25.0% | 100 |
| M2303 | 4 | 16 | 43.4 | 8.4 | 0 | 13.2 | 15 | 0 | 800 | 9.8% | 22.5% | 150 |
| M2304 | 3 | 12 | 48 | 8.4 | 0 | 13.6 | 15 | 0 | 800 | 11.9% | 25.0% | 100 |
| M2305 | 4 | 16 | 42.8 | 8.4 | 0 | 13.8 | 15 | 0 | 800 | 9.7% | 22.6% | 150 |
| M2306 | 2 | 10 | 69.5 | 8.5 | 0 | 0 | 10 | 0 | 850 | 10.5% | 16.9% | −50 |
| M2307 | 2.6 | 10 | 68.9 | 8.5 | 0 | 0 | 10 | 0 | 900 | 9.1% | 17.1% | −50 |
| M2308 | 2 | 10.2 | 69.3 | 8.5 | 0 | 0 | 10 | 0 | 850 | 10.7% | 16.9% | −50 |
| M2309 | 2.6 | 10.2 | 68.7 | 8.5 | 0 | 0 | 10 | 0 | 900 | 9.2% | 17.0% | −50 |
| M2310 | 2 | 10.4 | 69.1 | 8.5 | 0 | 0 | 10 | 0 | 850 | 10.9% | 16.9% | −50 |
| M2311 | 2.6 | 10.4 | 68.5 | 8.5 | 0 | 0 | 10 | 0 | 900 | 9.3% | 16.9% | −50 |
| M2312 | 2 | 10.6 | 68.9 | 8.5 | 0 | 0 | 10 | 0 | 850 | 11.1% | 16.9% | −50 |
| M2313 | 2.6 | 10.6 | 68.3 | 8.5 | 0 | 0 | 10 | 0 | 900 | 9.4% | 16.7% | −50 |
| M2314 | 2 | 10.8 | 68.7 | 8.5 | 0 | 0 | 10 | 0 | 850 | 11.3% | 16.9% | −50 |
| M2315 | 2.6 | 10.8 | 68.1 | 8.5 | 0 | 0 | 10 | 0 | 900 | 9.5% | 16.6% | −50 |
| M2316 | 2 | 11 | 68.5 | 8.5 | 0 | 0 | 10 | 0 | 850 | 11.5% | 16.8% | −50 |
| M2317 | 2.6 | 11 | 67.9 | 8.5 | 0 | 0 | 10 | 0 | 900 | 9.7% | 16.5% | −50 |
| M2318 | 2 | 11.2 | 68.3 | 8.5 | 0 | 0 | 10 | 0 | 850 | 11.7% | 16.7% | −50 |
| M2319 | 2.6 | 11.2 | 67.7 | 8.5 | 0 | 0 | 10 | 0 | 900 | 9.8% | 16.4% | −50 |
| M2320 | 2 | 11.4 | 68.1 | 8.5 | 0 | 0 | 10 | 0 | 850 | 12.0% | 16.6% | −50 |
| M2321 | 2.6 | 11.4 | 67.5 | 8.5 | 0 | 0 | 10 | 0 | 850 | 9.9% | 16.2% | −50 |
| M2322 | 2 | 11.6 | 67.9 | 8.5 | 0 | 0 | 10 | 0 | 850 | 12.2% | 16.4% | −50 |
| M2323 | 2.6 | 11.6 | 67.3 | 8.5 | 0 | 0 | 10 | 0 | 850 | 10.0% | 16.1% | −50 |
| M2324 | 2.2 | 11.8 | 67.5 | 8.5 | 0 | 0 | 10 | 0 | 850 | 11.6% | 16.1% | −50 |
| M2325 | 2.8 | 11.8 | 66.9 | 8.5 | 0 | 0 | 10 | 0 | 900 | 9.4% | 15.9% | −50 |
| M2326 | 2.4 | 12 | 67.1 | 8.5 | 0 | 0 | 10 | 0 | 850 | 11.0% | 15.9% | −50 |
| M2327 | 3 | 12 | 66.5 | 8.5 | 0 | 0 | 10 | 0 | 900 | 8.8% | 15.8% | −50 |
| M2328 | 3 | 12 | 61.2 | 8.6 | 0 | 0.2 | 15 | 0 | 850 | 12.9% | 24.9% | 0 |
| M2329 | 4 | 16 | 56 | 8.6 | 0 | 0.4 | 15 | 0 | 850 | 11.2% | 21.9% | 50 |
| M2330 | 3 | 12 | 60.6 | 8.6 | 0 | 0.8 | 15 | 0 | 850 | 12.8% | 24.9% | 0 |
| M2331 | 4 | 16 | 55.4 | 8.6 | 0 | 1 | 15 | 0 | 850 | 11.1% | 21.9% | 50 |
| M2332 | 3 | 12 | 60 | 8.6 | 0 | 1.4 | 15 | 0 | 850 | 12.8% | 24.9% | 0 |
| M2333 | 4 | 16 | 54.8 | 8.6 | 0 | 1.6 | 15 | 0 | 850 | 11.0% | 21.9% | 100 |
| M2334 | 3 | 12 | 59.4 | 8.6 | 0 | 2 | 15 | 0 | 850 | 12.7% | 25.0% | 0 |
| M2335 | 4 | 16 | 54.2 | 8.6 | 0 | 2.2 | 15 | 0 | 850 | 10.9% | 21.9% | 100 |
| M2336 | 3 | 12 | 58.8 | 8.6 | 0 | 2.6 | 15 | 0 | 850 | 12.7% | 25.0% | 0 |
| M2337 | 4 | 16 | 53.6 | 8.6 | 0 | 2.8 | 15 | 0 | 850 | 10.8% | 22.0% | 100 |
| M2338 | 3 | 12 | 58.2 | 8.6 | 0 | 3.2 | 15 | 0 | 850 | 12.6% | 25.0% | 0 |
| M2339 | 4 | 16 | 53 | 8.6 | 0 | 3.4 | 15 | 0 | 850 | 10.8% | 22.0% | 100 |
| M2340 | 3 | 12 | 57.6 | 8.6 | 0 | 3.8 | 15 | 0 | 850 | 12.5% | 25.1% | 0 |
| M2341 | 4 | 16 | 52.4 | 8.6 | 0 | 4 | 15 | 0 | 850 | 10.7% | 22.0% | 100 |
| M2342 | 3 | 12 | 57 | 8.6 | 0 | 4.4 | 15 | 0 | 850 | 12.5% | 25.1% | 0 |
| M2343 | 4 | 16 | 51.8 | 8.6 | 0 | 4.6 | 15 | 0 | 850 | 10.6% | 22.0% | 100 |
| M2344 | 3 | 12 | 56.4 | 8.6 | 0 | 5 | 15 | 0 | 850 | 12.4% | 25.1% | 0 |
| M2345 | 4 | 16 | 51.2 | 8.6 | 0 | 5.2 | 15 | 0 | 800 | 10.5% | 22.1% | 100 |
| M2346 | 3 | 12 | 55.8 | 8.6 | 0 | 5.6 | 15 | 0 | 850 | 12.4% | 25.2% | 50 |
| M2347 | 4 | 16 | 50.4 | 8.6 | 0 | 6 | 15 | 0 | 800 | 10.4% | 22.1% | 100 |
| M2348 | 4 | 16 | 47 | 8.6 | 0 | 9.4 | 15 | 0 | 800 | 10.1% | 22.3% | 150 |
| M2349 | 4 | 16 | 46.4 | 8.6 | 0 | 10 | 15 | 0 | 800 | 10.0% | 22.3% | 150 |
| M2350 | 4 | 16 | 46 | 8.6 | 0 | 10.4 | 15 | 0 | 800 | 10.0% | 22.3% | 150 |
| M2351 | 3 | 12 | 50.6 | 8.6 | 0 | 10.8 | 15 | 0 | 800 | 12.0% | 25.0% | 50 |
| M2352 | 4 | 16 | 45.4 | 8.6 | 0 | 11 | 15 | 0 | 800 | 9.9% | 22.4% | 100 |
| M2353 | 3 | 12 | 50 | 8.6 | 0 | 11.4 | 15 | 0 | 800 | 12.0% | 25.0% | 100 |
| M2354 | 4 | 16 | 44.8 | 8.6 | 0 | 11.6 | 15 | 0 | 800 | 9.9% | 22.4% | 100 |
| M2355 | 3 | 12 | 49.4 | 8.6 | 0 | 12 | 15 | 0 | 800 | 11.9% | 25.0% | 100 |
| M2356 | 4 | 16 | 44.2 | 8.6 | 0 | 12.2 | 15 | 0 | 800 | 9.8% | 22.4% | 150 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2357 | 3 | 12 | 48.8 | 8.6 | 0 | 12.6 | 15 | 0 | 800 | 11.9% | 25.0% | 100 |
| M2358 | 4 | 16 | 43.6 | 8.6 | 0 | 12.8 | 15 | 0 | 800 | 9.8% | 22.5% | 150 |
| M2359 | 3 | 12 | 48.2 | 8.6 | 0 | 13.2 | 15 | 0 | 800 | 11.9% | 25.0% | 100 |
| M2360 | 4 | 16 | 43 | 8.6 | 0 | 13.4 | 15 | 0 | 800 | 9.7% | 22.5% | 150 |
| M2361 | 3 | 12 | 47.6 | 8.6 | 0 | 13.8 | 15 | 0 | 800 | 11.8% | 25.0% | 100 |
| M2362 | 4 | 16 | 42.4 | 8.6 | 0 | 14 | 15 | 0 | 750 | 9.7% | 22.6% | 150 |
| M2363 | 3 | 12 | 61 | 8.8 | 0 | 0.2 | 15 | 0 | 850 | 12.9% | 24.9% | 0 |
| M2364 | 4 | 16 | 55.8 | 8.8 | 0 | 0.4 | 15 | 0 | 850 | 11.2% | 21.9% | 50 |
| M2365 | 3 | 12 | 60.4 | 8.8 | 0 | 0.8 | 15 | 0 | 850 | 12.9% | 24.9% | 0 |
| M2366 | 4 | 16 | 55.2 | 8.8 | 0 | 1 | 15 | 0 | 850 | 11.1% | 21.9% | 100 |
| M2367 | 3 | 12 | 59.8 | 8.8 | 0 | 1.4 | 15 | 0 | 850 | 12.8% | 24.9% | 0 |
| M2368 | 4 | 16 | 54.6 | 8.8 | 0 | 1.6 | 15 | 0 | 850 | 11.0% | 21.9% | 100 |
| M2369 | 3 | 12 | 59.2 | 8.8 | 0 | 2 | 15 | 0 | 850 | 12.7% | 25.0% | 0 |
| M2370 | 4 | 16 | 54 | 8.8 | 0 | 2.2 | 15 | 0 | 850 | 10.9% | 21.9% | 100 |
| M2371 | 3 | 12 | 58.6 | 8.8 | 0 | 2.6 | 15 | 0 | 850 | 12.7% | 25.0% | 0 |
| M2372 | 4 | 16 | 53.4 | 8.8 | 0 | 2.8 | 15 | 0 | 850 | 10.9% | 22.0% | 100 |
| M2373 | 3 | 12 | 58 | 8.8 | 0 | 3.2 | 15 | 0 | 850 | 12.6% | 25.0% | 0 |
| M2374 | 4 | 16 | 52.8 | 8.8 | 0 | 3.4 | 15 | 0 | 850 | 10.8% | 22.0% | 100 |
| M2375 | 3 | 12 | 57.4 | 8.8 | 0 | 3.8 | 15 | 0 | 850 | 12.5% | 25.1% | 0 |
| M2376 | 4 | 16 | 52.2 | 8.8 | 0 | 4 | 15 | 0 | 850 | 10.7% | 22.0% | 100 |
| M2377 | 3 | 12 | 56.8 | 8.8 | 0 | 4.4 | 15 | 0 | 850 | 12.5% | 25.1% | 0 |
| M2378 | 4 | 16 | 51.6 | 8.8 | 0 | 4.6 | 15 | 0 | 800 | 10.6% | 22.0% | 100 |
| M2379 | 3 | 12 | 56.2 | 8.8 | 0 | 5 | 15 | 0 | 850 | 12.4% | 25.1% | 0 |
| M2380 | 4 | 16 | 51 | 8.8 | 0 | 5.2 | 15 | 0 | 800 | 10.5% | 22.1% | 100 |
| M2381 | 4 | 16 | 50.6 | 8.8 | 0 | 5.6 | 15 | 0 | 800 | 10.5% | 22.1% | 100 |
| M2382 | 4 | 16 | 47.2 | 8.8 | 0 | 9 | 15 | 0 | 800 | 10.1% | 22.2% | 150 |
| M2383 | 4 | 16 | 46.6 | 8.8 | 0 | 9.6 | 15 | 0 | 800 | 10.0% | 22.3% | 150 |
| M2384 | 4 | 16 | 46 | 8.8 | 0 | 10.2 | 15 | 0 | 800 | 10.0% | 22.3% | 150 |
| M2385 | 3 | 12 | 50.6 | 8.8 | 0 | 10.6 | 15 | 0 | 800 | 12.0% | 25.0% | 50 |
| M2386 | 4 | 16 | 45.4 | 8.8 | 0 | 10.8 | 15 | 0 | 800 | 9.9% | 22.3% | 150 |
| M2387 | 3 | 12 | 50 | 8.8 | 0 | 11.2 | 15 | 0 | 800 | 12.0% | 25.0% | 100 |
| M2388 | 4 | 16 | 44.8 | 8.8 | 0 | 11.4 | 15 | 0 | 800 | 9.9% | 22.4% | 100 |
| M2389 | 3 | 12 | 49.4 | 8.8 | 0 | 11.8 | 15 | 0 | 800 | 11.9% | 25.0% | 100 |
| M2390 | 4 | 16 | 44.2 | 8.8 | 0 | 12 | 15 | 0 | 800 | 9.8% | 22.4% | 150 |
| M2391 | 3 | 12 | 48.8 | 8.8 | 0 | 12.4 | 15 | 0 | 800 | 11.9% | 25.0% | 100 |
| M2392 | 4 | 16 | 43.6 | 8.8 | 0 | 12.6 | 15 | 0 | 800 | 9.8% | 22.5% | 150 |
| M2393 | 3 | 12 | 48.2 | 8.8 | 0 | 13 | 15 | 0 | 800 | 11.9% | 25.0% | 100 |
| M2394 | 4 | 16 | 43 | 8.8 | 0 | 13.2 | 15 | 0 | 800 | 9.7% | 22.5% | 150 |
| M2395 | 3 | 12 | 47.6 | 8.8 | 0 | 13.6 | 15 | 0 | 800 | 11.8% | 25.0% | 100 |
| M2396 | 4 | 16 | 42.4 | 8.8 | 0 | 13.8 | 15 | 0 | 750 | 9.7% | 22.5% | 150 |
| M2397 | 3.75 | 7 | 60.25 | 9 | 0 | 0 | 20 | 0 | 850 | 8.0% | 32.9% | 150 |
| M2398 | 4 | 8 | 59 | 9 | 0 | 0 | 20 | 0 | 850 | 9.0% | 34.1% | 200 |
| M2399 | 2 | 10 | 69 | 9 | 0 | 0 | 10 | 0 | 850 | 10.5% | 16.9% | −50 |
| M2400 | 2.5 | 10 | 68.5 | 9 | 0 | 0 | 10 | 0 | 850 | 9.5% | 17.1% | −50 |
| M2401 | 3 | 10 | 68 | 9 | 0 | 0 | 10 | 0 | 900 | 7.8% | 17.1% | −50 |
| M2402 | 3 | 10 | 67.5 | 9 | 0 | 0 | 10.5 | 0 | 900 | 8.2% | 18.1% | −50 |
| M2403 | 2.5 | 10 | 67 | 9 | 0 | 0 | 11.5 | 0 | 850 | 10.5% | 20.0% | −50 |
| M2404 | 3 | 10 | 66 | 9 | 0 | 0 | 12 | 0 | 850 | 9.2% | 20.8% | −50 |
| M2405 | 2.2 | 10.2 | 68.6 | 9 | 0 | 0 | 10 | 0 | 850 | 10.6% | 17.1% | −50 |
| M2406 | 2.6 | 10.2 | 68.2 | 9 | 0 | 0 | 10 | 0 | 850 | 9.2% | 17.0% | −50 |
| M2407 | 2 | 10.2 | 68.3 | 9 | 0 | 0 | 10.5 | 0 | 850 | 10.8% | 17.3% | −50 |
| M2408 | 2.5 | 10.2 | 67.3 | 9 | 0 | 0 | 11 | 0 | 850 | 10.4% | 18.9% | −50 |
| M2409 | 3 | 10.2 | 66.3 | 9 | 0 | 0 | 11.5 | 0 | 850 | 9.0% | 19.8% | −50 |
| M2410 | 2 | 10.4 | 68.6 | 9 | 0 | 0 | 10 | 0 | 850 | 10.9% | 16.9% | −50 |
| M2411 | 2.5 | 10.4 | 68.1 | 9 | 0 | 0 | 10 | 0 | 850 | 9.7% | 16.9% | −50 |
| M2412 | 3 | 10.4 | 67.6 | 9 | 0 | 0 | 10 | 0 | 900 | 8.0% | 16.9% | −50 |
| M2413 | 3 | 10.4 | 67.1 | 9 | 0 | 0 | 10.5 | 0 | 900 | 8.4% | 17.8% | −50 |
| M2414 | 2.5 | 10.4 | 66.6 | 9 | 0 | 0 | 11.5 | 0 | 850 | 10.9% | 19.8% | −50 |
| M2415 | 3 | 10.4 | 65.6 | 9 | 0 | 0 | 12 | 0 | 850 | 9.4% | 20.5% | −50 |
| M2416 | 2.4 | 10.6 | 68 | 9 | 0 | 0 | 10 | 0 | 850 | 10.2% | 16.8% | −50 |
| M2417 | 2.8 | 10.6 | 67.6 | 9 | 0 | 0 | 10 | 0 | 850 | 8.8% | 16.7% | −50 |
| M2418 | 3 | 10.6 | 66.9 | 9 | 0 | 0 | 10.5 | 0 | 900 | 8.5% | 17.7% | −50 |
| M2419 | 2.5 | 10.6 | 66.4 | 9 | 0 | 0 | 11.5 | 0 | 850 | 11.0% | 19.6% | −50 |
| M2420 | 3 | 10.6 | 65.4 | 9 | 0 | 0 | 12 | 0 | 850 | 9.6% | 20.4% | −50 |
| M2421 | 2.2 | 10.8 | 68 | 9 | 0 | 0 | 10 | 0 | 850 | 11.1% | 16.8% | −50 |
| M2422 | 2.6 | 10.8 | 67.6 | 9 | 0 | 0 | 10 | 0 | 850 | 9.6% | 16.6% | −50 |
| M2423 | 2.5 | 10.8 | 67.2 | 9 | 0 | 0 | 10.5 | 0 | 850 | 10.3% | 17.6% | −50 |
| M2424 | 3 | 10.8 | 66.2 | 9 | 0 | 0 | 11 | 0 | 850 | 8.9% | 18.5% | −50 |
| M2425 | 3 | 10.8 | 65.7 | 9 | 0 | 0 | 11.5 | 0 | 850 | 9.3% | 19.4% | −50 |
| M2426 | 3.5 | 10.8 | 64.7 | 9 | 0 | 0 | 12 | 0 | 900 | 8.0% | 20.4% | 50 |
| M2427 | 4 | 10.8 | 63.2 | 9 | 0 | 0 | 13 | 0 | 850 | 7.2% | 22.3% | 100 |
| M2428 | 4 | 10.8 | 62.2 | 9 | 0 | 0 | 14 | 0 | 850 | 7.8% | 24.0% | 100 |
| M2429 | 4 | 10.8 | 61.2 | 9 | 0 | 0 | 15 | 0 | 850 | 8.4% | 25.7% | 150 |
| M2430 | 2 | 11 | 68 | 9 | 0 | 0 | 10 | 0 | 850 | 11.5% | 16.8% | −50 |
| M2431 | 2.5 | 11 | 67.5 | 9 | 0 | 0 | 10 | 0 | 850 | 10.0% | 16.5% | −50 |
| M2432 | 3 | 11 | 67 | 9 | 0 | 0 | 10 | 0 | 900 | 8.3% | 16.5% | −50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2433 | 2.5 | 11 | 66.5 | 9 | 0 | 0 | 11 | 0 | 850 | 10.9% | 18.4% | −50 |
| M2434 | 2.5 | 11 | 66 | 9 | 0 | 0 | 11.5 | 0 | 850 | 11.3% | 19.4% | −50 |
| M2435 | 3 | 11 | 65 | 9 | 0 | 0 | 12 | 0 | 850 | 9.8% | 20.1% | −50 |
| M2436 | 3.5 | 11 | 63.5 | 9 | 0 | 0 | 13 | 0 | 850 | 8.8% | 22.0% | 0 |
| M2437 | 3.5 | 11 | 62.5 | 9 | 0 | 0 | 14 | 0 | 850 | 9.5% | 23.7% | 0 |
| M2438 | 3.5 | 11 | 61.5 | 9 | 0 | 0 | 15 | 0 | 850 | 10.3% | 25.4% | 50 |
| M2439 | 3 | 11.2 | 67.8 | 9 | 0 | 0 | 9 | 0 | 900 | 7.8% | 14.5% | −50 |
| M2440 | 2.4 | 11.2 | 67.4 | 9 | 0 | 0 | 10 | 0 | 850 | 10.5% | 16.4% | −50 |
| M2441 | 2.8 | 11.2 | 67 | 9 | 0 | 0 | 10 | 0 | 850 | 9.1% | 16.3% | −50 |
| M2442 | 3 | 11.2 | 66.3 | 9 | 0 | 0 | 10.5 | 0 | 850 | 8.8% | 17.3% | −50 |
| M2443 | 3.5 | 11.2 | 65.3 | 9 | 0 | 0 | 11 | 0 | 850 | 7.6% | 18.3% | 0 |
| M2444 | 2.5 | 11.2 | 65.3 | 9 | 0 | 0 | 12 | 0 | 850 | 11.8% | 20.2% | −50 |
| M2445 | 3 | 11.2 | 63.8 | 9 | 0 | 0 | 13 | 0 | 850 | 10.7% | 21.8% | −50 |
| M2446 | 3 | 11.2 | 62.8 | 9 | 0 | 0 | 14 | 0 | 850 | 11.6% | 23.6% | −50 |
| M2447 | 3 | 11.2 | 61.8 | 9 | 0 | 0 | 15 | 0 | 850 | 12.2% | 25.4% | 0 |
| M2448 | 3 | 11.4 | 67.6 | 9 | 0 | 0 | 9 | 0 | 900 | 7.9% | 14.4% | −50 |
| M2449 | 2.4 | 11.4 | 67.2 | 9 | 0 | 0 | 10 | 0 | 850 | 10.6% | 16.3% | −50 |
| M2450 | 2.8 | 11.4 | 66.8 | 9 | 0 | 0 | 10 | 0 | 850 | 9.2% | 16.2% | −50 |
| M2451 | 2.5 | 11.4 | 66.6 | 9 | 0 | 0 | 10.5 | 0 | 850 | 10.7% | 17.2% | −50 |
| M2452 | 3 | 11.4 | 65.6 | 9 | 0 | 0 | 11 | 0 | 850 | 9.2% | 18.0% | −50 |
| M2453 | 3 | 11.4 | 65.1 | 9 | 0 | 0 | 11.5 | 0 | 850 | 9.6% | 19.0% | −50 |
| M2454 | 3.5 | 11.4 | 64.1 | 9 | 0 | 0 | 12 | 0 | 900 | 8.3% | 19.9% | 50 |
| M2455 | 4 | 11.4 | 62.6 | 9 | 0 | 0 | 13 | 0 | 850 | 7.4% | 21.9% | 100 |
| M2456 | 4 | 11.4 | 61.6 | 9 | 0 | 0 | 14 | 0 | 850 | 8.1% | 23.6% | 100 |
| M2457 | 3 | 11.6 | 67.4 | 9 | 0 | 0 | 9 | 0 | 900 | 8.0% | 14.2% | −50 |
| M2458 | 2.4 | 11.6 | 67 | 9 | 0 | 0 | 10 | 0 | 850 | 10.8% | 16.1% | −50 |
| M2459 | 2.8 | 11.6 | 66.6 | 9 | 0 | 0 | 10 | 0 | 850 | 9.3% | 16.1% | −50 |
| M2460 | 2.5 | 11.6 | 66.4 | 9 | 0 | 0 | 10.5 | 0 | 850 | 10.8% | 17.1% | −50 |
| M2461 | 3 | 11.6 | 65.4 | 9 | 0 | 0 | 11 | 0 | 850 | 9.3% | 17.9% | −50 |
| M2462 | 3 | 11.6 | 64.9 | 9 | 0 | 0 | 11.5 | 0 | 850 | 9.7% | 18.8% | −50 |
| M2463 | 3.5 | 11.6 | 63.9 | 9 | 0 | 0 | 12 | 0 | 900 | 8.4% | 19.8% | 50 |
| M2464 | 4 | 11.6 | 62.4 | 9 | 0 | 0 | 13 | 0 | 850 | 7.5% | 21.8% | 100 |
| M2465 | 4 | 11.6 | 61.4 | 9 | 0 | 0 | 14 | 0 | 850 | 8.2% | 23.4% | 100 |
| M2466 | 3 | 11.8 | 67.2 | 9 | 0 | 0 | 9 | 0 | 900 | 8.1% | 14.1% | −50 |
| M2467 | 2.5 | 11.8 | 66.7 | 9 | 0 | 0 | 10 | 0 | 850 | 10.5% | 16.0% | −50 |
| M2468 | 3 | 11.8 | 66.2 | 9 | 0 | 0 | 10 | 0 | 900 | 8.7% | 15.9% | −50 |
| M2469 | 3 | 11.8 | 65.7 | 9 | 0 | 0 | 10.5 | 0 | 850 | 9.1% | 16.9% | −50 |
| M2470 | 3.5 | 11.8 | 64.7 | 9 | 0 | 0 | 11 | 0 | 900 | 7.8% | 17.9% | 0 |
| M2471 | 2.5 | 11.8 | 64.7 | 9 | 0 | 0 | 12 | 0 | 850 | 12.2% | 20.0% | −50 |
| M2472 | 4 | 11.8 | 63.2 | 9 | 0 | 0 | 12 | 0 | 850 | 7.0% | 19.9% | 50 |
| M2473 | 4 | 11.8 | 62.2 | 9 | 0 | 0 | 13 | 0 | 850 | 7.6% | 21.6% | 100 |
| M2474 | 4 | 11.8 | 61.2 | 9 | 0 | 0 | 14 | 0 | 850 | 8.3% | 23.3% | 100 |
| M2475 | 3 | 12 | 67 | 9 | 0 | 0 | 9 | 0 | 900 | 8.2% | 14.0% | −50 |
| M2476 | 2.5 | 12 | 66.5 | 9 | 0 | 0 | 10 | 0 | 850 | 10.6% | 15.8% | −50 |
| M2477 | 3 | 12 | 66 | 9 | 0 | 0 | 10 | 0 | 900 | 8.8% | 15.8% | −50 |
| M2478 | 3 | 12 | 65.5 | 9 | 0 | 0 | 10.5 | 0 | 850 | 9.2% | 16.7% | −50 |
| M2479 | 3.5 | 12 | 64.5 | 9 | 0 | 0 | 11 | 0 | 900 | 7.9% | 17.8% | 0 |
| M2480 | 2.5 | 12 | 64.5 | 9 | 0 | 0 | 12 | 0 | 850 | 12.3% | 19.9% | −50 |
| M2481 | 4 | 12 | 63 | 9 | 0 | 0 | 12 | 0 | 850 | 7.1% | 19.8% | 50 |
| M2482 | 4 | 12 | 62 | 9 | 0 | 0 | 13 | 0 | 850 | 7.7% | 21.5% | 100 |
| M2483 | 3 | 12 | 61 | 9 | 0 | 0 | 15 | 0 | 850 | 12.9% | 24.8% | −50 |
| M2484 | 2.5 | 12.2 | 65.8 | 9 | 0 | 0 | 10.5 | 0 | 850 | 11.1% | 16.7% | −50 |
| M2485 | 3 | 12.2 | 64.8 | 9 | 0 | 0 | 11 | 0 | 850 | 9.7% | 17.5% | 0 |
| M2486 | 2.5 | 12.2 | 64.3 | 9 | 0 | 0 | 12 | 0 | 850 | 12.4% | 19.8% | −50 |
| M2487 | 3 | 12.4 | 65.6 | 9 | 0 | 0 | 10 | 0 | 900 | 9.0% | 15.5% | −50 |
| M2488 | 2.5 | 12.4 | 65.1 | 9 | 0 | 0 | 11 | 0 | 850 | 11.7% | 17.5% | −50 |
| M2489 | 3 | 12.4 | 64.1 | 9 | 0 | 0 | 11.5 | 0 | 850 | 10.2% | 18.3% | 0 |
| M2490 | 2.5 | 12.6 | 65.9 | 9 | 0 | 0 | 10 | 0 | 850 | 10.9% | 15.5% | −50 |
| M2491 | 3 | 12.6 | 64.9 | 9 | 0 | 0 | 10.5 | 0 | 850 | 9.5% | 16.3% | −50 |
| M2492 | 2.5 | 12.6 | 64.4 | 9 | 0 | 0 | 11.5 | 0 | 850 | 12.2% | 18.5% | −50 |
| M2493 | 3 | 12.6 | 63.4 | 9 | 0 | 0 | 12 | 0 | 850 | 10.7% | 19.1% | 0 |
| M2494 | 2.5 | 12.8 | 65.2 | 9 | 0 | 0 | 10.5 | 0 | 850 | 11.5% | 16.3% | −50 |
| M2495 | 3 | 12.8 | 64.2 | 9 | 0 | 0 | 11 | 0 | 850 | 10.0% | 17.1% | −50 |
| M2496 | 2.5 | 12.8 | 63.7 | 9 | 0 | 0 | 12 | 0 | 850 | 12.8% | 19.4% | −50 |
| M2497 | 3 | 13 | 65 | 9 | 0 | 0 | 10 | 0 | 850 | 9.3% | 15.1% | −50 |
| M2498 | 2.5 | 13 | 64.5 | 9 | 0 | 0 | 11 | 0 | 850 | 12.0% | 17.1% | −50 |
| M2499 | 3 | 13 | 63.5 | 9 | 0 | 0 | 11.5 | 0 | 850 | 10.5% | 17.9% | −50 |
| M2500 | 2.5 | 13.2 | 65.3 | 9 | 0 | 0 | 10 | 0 | 850 | 11.3% | 15.1% | −50 |
| M2501 | 3 | 13.2 | 64.3 | 9 | 0 | 0 | 10.5 | 0 | 850 | 9.8% | 15.9% | −50 |
| M2502 | 2.5 | 13.2 | 63.8 | 9 | 0 | 0 | 11.5 | 0 | 850 | 12.6% | 18.5% | −50 |
| M2503 | 3 | 13.2 | 62.8 | 9 | 0 | 0 | 12 | 0 | 850 | 11.0% | 18.6% | 0 |
| M2504 | 2.5 | 13.4 | 64.6 | 9 | 0 | 0 | 10.5 | 0 | 850 | 11.8% | 15.9% | −50 |
| M2505 | 3 | 13.4 | 63.6 | 9 | 0 | 0 | 11 | 0 | 850 | 10.3% | 16.7% | −50 |
| M2506 | 2.5 | 13.4 | 63.1 | 9 | 0 | 0 | 12 | 0 | 850 | 13.1% | 19.0% | −50 |
| M2507 | 3 | 13.6 | 64.4 | 9 | 0 | 0 | 10 | 0 | 850 | 9.7% | 14.7% | −50 |
| M2508 | 2.5 | 13.6 | 63.9 | 9 | 0 | 0 | 11 | 0 | 850 | 12.4% | 17.1% | −50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2509 | 3 | 13.6 | 62.9 | 9 | 0 | 0 | 11.5 | 0 | 850 | 10.8% | 17.5% | −50 |
| M2510 | 2.5 | 13.8 | 64.7 | 9 | 0 | 0 | 10 | 0 | 850 | 11.6% | 14.7% | −50 |
| M2511 | 3 | 13.8 | 63.7 | 9 | 0 | 0 | 10.5 | 0 | 850 | 10.2% | 15.5% | −50 |
| M2512 | 2.5 | 13.8 | 63.2 | 9 | 0 | 0 | 11.5 | 0 | 850 | 13.0% | 18.0% | −50 |
| M2513 | 2.5 | 14 | 64.5 | 9 | 0 | 0 | 10 | 0 | 850 | 11.8% | 14.5% | −50 |
| M2514 | 3 | 14 | 63.5 | 9 | 0 | 0 | 10.5 | 0 | 850 | 10.3% | 15.4% | −50 |
| M2515 | 2.5 | 14 | 63 | 9 | 0 | 0 | 11.5 | 0 | 850 | 13.1% | 17.9% | −50 |
| M2516 | 4 | 16 | 56 | 9 | 0 | 0 | 15 | 0 | 850 | 11.3% | 21.8% | 50 |
| M2517 | 3 | 12 | 60.6 | 9 | 0 | 0.4 | 15 | 0 | 850 | 12.9% | 24.9% | 0 |
| M2518 | 4 | 16 | 55.4 | 9 | 0 | 0.6 | 15 | 0 | 850 | 11.2% | 21.9% | 50 |
| M2519 | 3 | 12 | 60 | 9 | 0 | 1 | 15 | 0 | 850 | 12.8% | 24.9% | 0 |
| M2520 | 4 | 16 | 54.8 | 9 | 0 | 1.2 | 15 | 0 | 850 | 11.1% | 21.9% | 100 |
| M2521 | 3 | 12 | 59.4 | 9 | 0 | 1.6 | 15 | 0 | 850 | 12.8% | 24.9% | 0 |
| M2522 | 4 | 16 | 54.2 | 9 | 0 | 1.8 | 15 | 0 | 850 | 11.0% | 21.9% | 100 |
| M2523 | 3 | 12 | 58.8 | 9 | 0 | 2.2 | 15 | 0 | 850 | 12.7% | 25.0% | 0 |
| M2524 | 4 | 16 | 53.6 | 9 | 0 | 2.4 | 15 | 0 | 850 | 10.9% | 21.9% | 100 |
| M2525 | 3 | 12 | 58.2 | 9 | 0 | 2.8 | 15 | 0 | 850 | 12.6% | 25.0% | 0 |
| M2526 | 4 | 16 | 53 | 9 | 0 | 3 | 15 | 0 | 850 | 10.8% | 22.0% | 100 |
| M2527 | 3 | 12 | 57.6 | 9 | 0 | 3.4 | 15 | 0 | 850 | 12.6% | 25.0% | 0 |
| M2528 | 4 | 16 | 52.4 | 9 | 0 | 3.6 | 15 | 0 | 850 | 10.7% | 22.0% | 100 |
| M2529 | 3 | 12 | 57 | 9 | 0 | 4 | 15 | 0 | 850 | 12.5% | 25.1% | 0 |
| M2530 | 4 | 16 | 51.8 | 9 | 0 | 4.2 | 15 | 0 | 800 | 10.7% | 22.0% | 100 |
| M2531 | 3 | 12 | 56.4 | 9 | 0 | 4.6 | 15 | 0 | 800 | 12.5% | 25.1% | 0 |
| M2532 | 4 | 16 | 51.2 | 9 | 0 | 4.8 | 15 | 0 | 800 | 10.6% | 22.0% | 100 |
| M2533 | 3 | 12 | 55.8 | 9 | 0 | 5.2 | 15 | 0 | 800 | 12.4% | 25.1% | 0 |
| M2534 | 4 | 16 | 50.4 | 9 | 0 | 5.6 | 15 | 0 | 800 | 10.5% | 22.1% | 100 |
| M2535 | 4 | 16 | 46.6 | 9 | 0 | 9.4 | 15 | 0 | 800 | 10.1% | 22.3% | 150 |
| M2536 | 4 | 16 | 46 | 9 | 0 | 10 | 15 | 0 | 800 | 10.0% | 22.3% | 150 |
| M2537 | 4 | 16 | 45.6 | 9 | 0 | 10.4 | 15 | 0 | 800 | 10.0% | 22.3% | 150 |
| M2538 | 3 | 12 | 50.2 | 9 | 0 | 10.8 | 15 | 0 | 800 | 12.0% | 25.0% | 100 |
| M2539 | 4 | 16 | 45 | 9 | 0 | 11 | 15 | 0 | 800 | 9.9% | 22.3% | 150 |
| M2540 | 3 | 12 | 49.6 | 9 | 0 | 11.4 | 15 | 0 | 800 | 11.9% | 25.0% | 100 |
| M2541 | 4 | 16 | 44.4 | 9 | 0 | 11.6 | 15 | 0 | 800 | 9.9% | 22.4% | 100 |
| M2542 | 3 | 12 | 49 | 9 | 0 | 12 | 15 | 0 | 800 | 11.9% | 25.0% | 100 |
| M2543 | 4 | 16 | 43.8 | 9 | 0 | 12.2 | 15 | 0 | 800 | 9.8% | 22.4% | 150 |
| M2544 | 3 | 12 | 48.4 | 9 | 0 | 12.6 | 15 | 0 | 800 | 11.9% | 25.0% | 100 |
| M2545 | 4 | 16 | 43.2 | 9 | 0 | 12.8 | 15 | 0 | 800 | 9.8% | 22.5% | 150 |
| M2546 | 3 | 12 | 47.8 | 9 | 0 | 13.2 | 15 | 0 | 800 | 11.8% | 25.0% | 100 |
| M2547 | 4 | 16 | 42.6 | 9 | 0 | 13.4 | 15 | 0 | 750 | 9.7% | 22.5% | 150 |
| M2548 | 3 | 12 | 47.2 | 9 | 0 | 13.8 | 15 | 0 | 800 | 11.8% | 25.0% | 100 |
| M2549 | 4 | 16 | 42 | 9 | 0 | 14 | 15 | 0 | 750 | 9.7% | 22.5% | 150 |
| M2550 | 3 | 12 | 60.6 | 9.2 | 0 | 0.2 | 15 | 0 | 850 | 12.9% | 24.8% | 0 |
| M2551 | 4 | 16 | 55.4 | 9.2 | 0 | 0.4 | 15 | 0 | 850 | 11.2% | 21.9% | 50 |
| M2552 | 3 | 12 | 60 | 9.2 | 0 | 0.8 | 15 | 0 | 850 | 12.9% | 24.9% | 0 |
| M2553 | 4 | 16 | 54.8 | 9.2 | 0 | 1 | 15 | 0 | 850 | 11.1% | 21.9% | 100 |
| M2554 | 3 | 12 | 59.4 | 9.2 | 0 | 1.4 | 15 | 0 | 850 | 12.8% | 24.9% | 0 |
| M2555 | 4 | 16 | 54.2 | 9.2 | 0 | 1.6 | 15 | 0 | 850 | 11.0% | 21.9% | 100 |
| M2556 | 3 | 12 | 58.8 | 9.2 | 0 | 2 | 15 | 0 | 850 | 12.7% | 24.9% | 0 |
| M2557 | 4 | 16 | 53.6 | 9.2 | 0 | 2.2 | 15 | 0 | 850 | 11.0% | 21.9% | 100 |
| M2558 | 3 | 12 | 58.2 | 9.2 | 0 | 2.6 | 15 | 0 | 850 | 12.7% | 25.0% | 0 |
| M2559 | 4 | 16 | 53 | 9.2 | 0 | 2.8 | 15 | 0 | 850 | 10.9% | 21.9% | 100 |
| M2560 | 3 | 12 | 57.6 | 9.2 | 0 | 3.2 | 15 | 0 | 850 | 12.6% | 25.0% | 0 |
| M2561 | 4 | 16 | 52.4 | 9.2 | 0 | 3.4 | 15 | 0 | 850 | 10.8% | 22.0% | 100 |
| M2562 | 3 | 12 | 57 | 9.2 | 0 | 3.8 | 15 | 0 | 800 | 12.5% | 25.1% | 0 |
| M2563 | 4 | 16 | 51.8 | 9.2 | 0 | 4 | 15 | 0 | 800 | 10.7% | 22.0% | 100 |
| M2564 | 3 | 12 | 56.4 | 9.2 | 0 | 4.4 | 15 | 0 | 800 | 12.5% | 25.1% | 0 |
| M2565 | 4 | 16 | 51.2 | 9.2 | 0 | 4.6 | 15 | 0 | 800 | 10.6% | 22.0% | 100 |
| M2566 | 3 | 12 | 55.8 | 9.2 | 0 | 5 | 15 | 0 | 800 | 12.4% | 25.1% | 0 |
| M2567 | 4 | 16 | 50.4 | 9.2 | 0 | 5.4 | 15 | 0 | 800 | 10.5% | 22.1% | 100 |
| M2568 | 4 | 16 | 46.4 | 9.2 | 0 | 9.4 | 15 | 0 | 800 | 10.0% | 22.2% | 150 |
| M2569 | 4 | 16 | 45.8 | 9.2 | 0 | 10 | 15 | 0 | 800 | 10.0% | 22.3% | 150 |
| M2570 | 4 | 16 | 45.4 | 9.2 | 0 | 10.4 | 15 | 0 | 800 | 9.9% | 22.3% | 150 |
| M2571 | 3 | 12 | 50 | 9.2 | 0 | 10.8 | 15 | 0 | 800 | 12.0% | 25.0% | 100 |
| M2572 | 4 | 16 | 44.8 | 9.2 | 0 | 11 | 15 | 0 | 800 | 9.9% | 22.3% | 150 |
| M2573 | 3 | 12 | 49.4 | 9.2 | 0 | 11.4 | 15 | 0 | 800 | 11.9% | 25.0% | 100 |
| M2574 | 4 | 16 | 44.2 | 9.2 | 0 | 11.6 | 15 | 0 | 800 | 9.8% | 22.4% | 100 |
| M2575 | 3 | 12 | 48.8 | 9.2 | 0 | 12 | 15 | 0 | 800 | 11.9% | 25.0% | 100 |
| M2576 | 4 | 16 | 43.6 | 9.2 | 0 | 12.2 | 15 | 0 | 800 | 9.8% | 22.4% | 150 |
| M2577 | 3 | 12 | 48.2 | 9.2 | 0 | 12.6 | 15 | 0 | 800 | 11.9% | 25.0% | 100 |
| M2578 | 4 | 16 | 43 | 9.2 | 0 | 12.8 | 15 | 0 | 800 | 9.7% | 22.5% | 150 |
| M2579 | 3 | 12 | 47.6 | 9.2 | 0 | 13.2 | 15 | 0 | 800 | 11.8% | 25.0% | 100 |
| M2580 | 4 | 16 | 42.4 | 9.2 | 0 | 13.4 | 15 | 0 | 750 | 9.7% | 22.5% | 150 |
| M2581 | 3 | 12 | 47 | 9.2 | 0 | 13.8 | 15 | 0 | 800 | 11.8% | 25.0% | 100 |
| M2582 | 4 | 16 | 41.8 | 9.2 | 0 | 14 | 15 | 0 | 750 | 9.7% | 22.5% | 150 |
| M2583 | 3 | 12 | 60.4 | 9.4 | 0 | 0.2 | 15 | 0 | 850 | 12.9% | 24.8% | 0 |
| M2584 | 4 | 16 | 55.2 | 9.4 | 0 | 0.4 | 15 | 0 | 850 | 11.2% | 21.9% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2585 | 3 | 12 | 59.8 | 9.4 | 0 | 0.8 | 15 | 0 | 850 | 12.9% | 24.9% | 0 |
| M2586 | 4 | 16 | 54.6 | 9.4 | 0 | 1 | 15 | 0 | 850 | 11.1% | 21.9% | 100 |
| M2587 | 3 | 12 | 59.2 | 9.4 | 0 | 1.4 | 15 | 0 | 850 | 12.8% | 24.9% | 0 |
| M2588 | 4 | 16 | 54 | 9.4 | 0 | 1.6 | 15 | 0 | 850 | 11.0% | 21.9% | 100 |
| M2589 | 3 | 12 | 58.6 | 9.4 | 0 | 2 | 15 | 0 | 850 | 12.7% | 24.9% | 0 |
| M2590 | 4 | 16 | 53.4 | 9.4 | 0 | 2.2 | 15 | 0 | 850 | 11.0% | 21.9% | 100 |
| M2591 | 3 | 12 | 58 | 9.4 | 0 | 2.6 | 15 | 0 | 850 | 12.7% | 25.0% | 0 |
| M2592 | 4 | 16 | 52.8 | 9.4 | 0 | 2.8 | 15 | 0 | 850 | 10.9% | 21.9% | 100 |
| M2593 | 3 | 12 | 57.4 | 9.4 | 0 | 3.2 | 15 | 0 | 800 | 12.6% | 25.0% | 0 |
| M2594 | 4 | 16 | 52.2 | 9.4 | 0 | 3.4 | 15 | 0 | 800 | 10.8% | 22.0% | 100 |
| M2595 | 3 | 12 | 56.8 | 9.4 | 0 | 3.8 | 15 | 0 | 800 | 12.5% | 25.0% | 0 |
| M2596 | 4 | 16 | 51.6 | 9.4 | 0 | 4 | 15 | 0 | 800 | 10.7% | 22.0% | 100 |
| M2597 | 3 | 12 | 56.2 | 9.4 | 0 | 4.4 | 15 | 0 | 800 | 12.5% | 25.1% | 0 |
| M2598 | 4 | 16 | 51 | 9.4 | 0 | 4.6 | 15 | 0 | 800 | 10.6% | 22.0% | 100 |
| M2599 | 3 | 12 | 55.6 | 9.4 | 0 | 5 | 15 | 0 | 800 | 12.4% | 25.1% | 0 |
| M2600 | 4 | 16 | 50.2 | 9.4 | 0 | 5.4 | 15 | 0 | 800 | 10.5% | 22.1% | 100 |
| M2601 | 4 | 16 | 46.2 | 9.4 | 0 | 9.4 | 15 | 0 | 800 | 10.0% | 22.2% | 150 |
| M2602 | 4 | 16 | 45.6 | 9.4 | 0 | 10 | 15 | 0 | 800 | 10.0% | 22.3% | 150 |
| M2603 | 3 | 12 | 50 | 9.4 | 0 | 10.6 | 15 | 0 | 800 | 12.0% | 24.9% | 50 |
| M2604 | 4 | 16 | 44.8 | 9.4 | 0 | 10.8 | 15 | 0 | 800 | 9.9% | 22.3% | 150 |
| M2605 | 3 | 12 | 49.4 | 9.4 | 0 | 11.2 | 15 | 0 | 800 | 11.9% | 25.0% | 100 |
| M2606 | 4 | 16 | 44.2 | 9.4 | 0 | 11.4 | 15 | 0 | 800 | 9.9% | 22.4% | 150 |
| M2607 | 3 | 12 | 48.8 | 9.4 | 0 | 11.8 | 15 | 0 | 800 | 11.9% | 25.0% | 100 |
| M2608 | 4 | 16 | 43.6 | 9.4 | 0 | 12 | 15 | 0 | 800 | 9.8% | 22.4% | 150 |
| M2609 | 3 | 12 | 48.2 | 9.4 | 0 | 12.4 | 15 | 0 | 800 | 11.9% | 25.0% | 100 |
| M2610 | 4 | 16 | 43 | 9.4 | 0 | 12.6 | 15 | 0 | 800 | 9.8% | 22.4% | 150 |
| M2611 | 3 | 12 | 47.6 | 9.4 | 0 | 13 | 15 | 0 | 800 | 11.8% | 25.0% | 100 |
| M2612 | 4 | 16 | 42.4 | 9.4 | 0 | 13.2 | 15 | 0 | 750 | 9.7% | 22.5% | 150 |
| M2613 | 3 | 12 | 47 | 9.4 | 0 | 13.6 | 15 | 0 | 800 | 11.8% | 25.0% | 100 |
| M2614 | 4 | 16 | 41.8 | 9.4 | 0 | 13.8 | 15 | 0 | 750 | 9.7% | 22.5% | 150 |
| M2615 | 2 | 10 | 68.5 | 9.5 | 0 | 0 | 10 | 0 | 850 | 10.5% | 16.9% | −50 |
| M2616 | 2.6 | 10 | 67.9 | 9.5 | 0 | 0 | 10 | 0 | 850 | 9.1% | 17.1% | −50 |
| M2617 | 2 | 10.2 | 68.3 | 9.5 | 0 | 0 | 10 | 0 | 850 | 10.7% | 16.9% | −50 |
| M2618 | 2.6 | 10.2 | 67.7 | 9.5 | 0 | 0 | 10 | 0 | 850 | 9.3% | 17.0% | −50 |
| M2619 | 2 | 10.4 | 68.1 | 9.5 | 0 | 0 | 10 | 0 | 850 | 10.9% | 16.9% | −50 |
| M2620 | 2.6 | 10.4 | 67.5 | 9.5 | 0 | 0 | 10 | 0 | 850 | 9.4% | 16.9% | −50 |
| M2621 | 2 | 10.6 | 67.9 | 9.5 | 0 | 0 | 10 | 0 | 850 | 11.1% | 16.9% | −50 |
| M2622 | 2.6 | 10.6 | 67.3 | 9.5 | 0 | 0 | 10 | 0 | 850 | 9.5% | 16.7% | −50 |
| M2623 | 2 | 10.8 | 67.7 | 9.5 | 0 | 0 | 10 | 0 | 850 | 11.3% | 16.8% | −50 |
| M2624 | 2.6 | 10.8 | 67.1 | 9.5 | 0 | 0 | 10 | 0 | 850 | 9.6% | 16.6% | −50 |
| M2625 | 2 | 11 | 67.5 | 9.5 | 0 | 0 | 10 | 0 | 850 | 11.5% | 16.8% | −50 |
| M2626 | 2.6 | 11 | 66.9 | 9.5 | 0 | 0 | 10 | 0 | 850 | 9.7% | 16.5% | −50 |
| M2627 | 2 | 11.2 | 67.3 | 9.5 | 0 | 0 | 10 | 0 | 850 | 11.7% | 16.7% | −50 |
| M2628 | 2.6 | 11.2 | 66.7 | 9.5 | 0 | 0 | 10 | 0 | 850 | 9.8% | 16.3% | −50 |
| M2629 | 2 | 11.4 | 67.1 | 9.5 | 0 | 0 | 10 | 0 | 850 | 12.0% | 16.5% | −50 |
| M2630 | 2.6 | 11.4 | 66.5 | 9.5 | 0 | 0 | 10 | 0 | 850 | 9.9% | 16.2% | −50 |
| M2631 | 2.2 | 11.6 | 66.7 | 9.5 | 0 | 0 | 10 | 0 | 850 | 11.6% | 16.3% | −50 |
| M2632 | 2.8 | 11.6 | 66.1 | 9.5 | 0 | 0 | 10 | 0 | 850 | 9.3% | 16.1% | −50 |
| M2633 | 2.4 | 11.8 | 66.3 | 9.5 | 0 | 0 | 10 | 0 | 850 | 10.9% | 16.0% | −50 |
| M2634 | 3 | 11.8 | 65.7 | 9.5 | 0 | 0 | 10 | 0 | 850 | 8.7% | 15.9% | −50 |
| M2635 | 2.6 | 12 | 65.9 | 9.5 | 0 | 0 | 10 | 0 | 850 | 10.2% | 15.8% | −50 |
| M2636 | 3 | 12 | 60.4 | 9.6 | 0 | 0 | 15 | 0 | 850 | 12.9% | 24.8% | 50 |
| M2637 | 3 | 12 | 60.2 | 9.6 | 0 | 0.2 | 15 | 0 | 850 | 12.9% | 24.8% | 50 |
| M2638 | 4 | 16 | 55 | 9.6 | 0 | 0.4 | 15 | 0 | 850 | 11.3% | 21.9% | 50 |
| M2639 | 3 | 12 | 59.6 | 9.6 | 0 | 0.8 | 15 | 0 | 850 | 12.9% | 24.9% | 0 |
| M2640 | 4 | 16 | 54.4 | 9.6 | 0 | 1 | 15 | 0 | 850 | 11.2% | 21.9% | 100 |
| M2641 | 3 | 12 | 59 | 9.6 | 0 | 1.4 | 15 | 0 | 850 | 12.8% | 24.9% | 0 |
| M2642 | 4 | 16 | 53.8 | 9.6 | 0 | 1.6 | 15 | 0 | 850 | 11.1% | 21.9% | 100 |
| M2643 | 3 | 12 | 58.4 | 9.6 | 0 | 2 | 15 | 0 | 850 | 12.7% | 24.9% | 0 |
| M2644 | 4 | 16 | 53.2 | 9.6 | 0 | 2.2 | 15 | 0 | 850 | 11.0% | 21.9% | 100 |
| M2645 | 3 | 12 | 57.8 | 9.6 | 0 | 2.6 | 15 | 0 | 800 | 12.7% | 25.0% | 0 |
| M2646 | 4 | 16 | 52.6 | 9.6 | 0 | 2.8 | 15 | 0 | 800 | 10.9% | 21.9% | 100 |
| M2647 | 3 | 12 | 57.2 | 9.6 | 0 | 3.2 | 15 | 0 | 800 | 12.6% | 25.0% | 0 |
| M2648 | 4 | 16 | 52 | 9.6 | 0 | 3.4 | 15 | 0 | 800 | 10.8% | 22.0% | 100 |
| M2649 | 3 | 12 | 56.6 | 9.6 | 0 | 3.8 | 15 | 0 | 800 | 12.5% | 25.0% | 0 |
| M2650 | 4 | 16 | 51.4 | 9.6 | 0 | 4 | 15 | 0 | 800 | 10.7% | 22.0% | 100 |
| M2651 | 3 | 12 | 56 | 9.6 | 0 | 4.4 | 15 | 0 | 800 | 12.5% | 25.1% | 0 |
| M2652 | 4 | 16 | 50.8 | 9.6 | 0 | 4.6 | 15 | 0 | 800 | 10.6% | 22.0% | 100 |
| M2653 | 4 | 16 | 50.4 | 9.6 | 0 | 5 | 15 | 0 | 800 | 10.6% | 22.0% | 100 |
| M2654 | 4 | 16 | 46 | 9.6 | 0 | 9.4 | 15 | 0 | 800 | 10.0% | 22.2% | 150 |
| M2655 | 4 | 16 | 45.4 | 9.6 | 0 | 10 | 15 | 0 | 800 | 10.0% | 22.3% | 150 |
| M2656 | 3 | 12 | 49.8 | 9.6 | 0 | 10.6 | 15 | 0 | 800 | 12.0% | 24.9% | 100 |
| M2657 | 4 | 16 | 44.6 | 9.6 | 0 | 10.8 | 15 | 0 | 800 | 9.9% | 22.3% | 150 |
| M2658 | 3 | 12 | 49.2 | 9.6 | 0 | 11.2 | 15 | 0 | 800 | 11.9% | 24.9% | 100 |
| M2659 | 4 | 16 | 44 | 9.6 | 0 | 11.4 | 15 | 0 | 800 | 9.8% | 22.3% | 150 |
| M2660 | 3 | 12 | 48.6 | 9.6 | 0 | 11.8 | 15 | 0 | 800 | 11.9% | 25.0% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2661 | 4 | 16 | 43.4 | 9.6 | 0 | 12 | 15 | 0 | 800 | 9.8% | 22.4% | 150 |
| M2662 | 3 | 12 | 48 | 9.6 | 0 | 12.4 | 15 | 0 | 800 | 11.9% | 25.0% | 100 |
| M2663 | 4 | 16 | 42.8 | 9.6 | 0 | 12.6 | 15 | 0 | 800 | 9.7% | 22.4% | 150 |
| M2664 | 3 | 12 | 47.4 | 9.6 | 0 | 13 | 15 | 0 | 800 | 11.8% | 25.0% | 100 |
| M2665 | 4 | 16 | 42.2 | 9.6 | 0 | 13.2 | 15 | 0 | 750 | 9.7% | 22.5% | 150 |
| M2666 | 3 | 12 | 46.8 | 9.6 | 0 | 13.6 | 15 | 0 | 800 | 11.8% | 25.0% | 100 |
| M2667 | 4 | 16 | 41.6 | 9.6 | 0 | 13.8 | 15 | 0 | 750 | 9.7% | 22.5% | 150 |
| M2668 | 3 | 12 | 60.2 | 9.8 | 0 | 0 | 15 | 0 | 850 | 12.9% | 24.8% | 50 |
| M2669 | 3 | 12 | 60 | 9.8 | 0 | 0.2 | 15 | 0 | 850 | 12.9% | 24.8% | 50 |
| M2670 | 4 | 16 | 54.8 | 9.8 | 0 | 0.4 | 15 | 0 | 850 | 11.3% | 21.8% | 50 |
| M2671 | 3 | 12 | 59.4 | 9.8 | 0 | 0.8 | 15 | 0 | 850 | 12.9% | 24.9% | 0 |
| M2672 | 4 | 16 | 54.2 | 9.8 | 0 | 1 | 15 | 0 | 850 | 11.2% | 21.9% | 100 |
| M2673 | 3 | 12 | 58.8 | 9.8 | 0 | 1.4 | 15 | 0 | 850 | 12.8% | 24.9% | 0 |
| M2674 | 4 | 16 | 53.6 | 9.8 | 0 | 1.6 | 15 | 0 | 850 | 11.1% | 21.9% | 100 |
| M2675 | 3 | 12 | 58.2 | 9.8 | 0 | 2 | 15 | 0 | 850 | 12.7% | 24.9% | 0 |
| M2676 | 4 | 16 | 53 | 9.8 | 0 | 2.2 | 15 | 0 | 800 | 11.0% | 21.9% | 100 |
| M2677 | 3 | 12 | 57.6 | 9.8 | 0 | 2.6 | 15 | 0 | 800 | 12.7% | 25.0% | 0 |
| M2678 | 4 | 16 | 52.4 | 9.8 | 0 | 2.8 | 15 | 0 | 800 | 10.9% | 21.9% | 100 |
| M2679 | 3 | 12 | 57 | 9.8 | 0 | 3.2 | 15 | 0 | 800 | 12.6% | 25.0% | 0 |
| M2680 | 4 | 16 | 51.8 | 9.8 | 0 | 3.4 | 15 | 0 | 800 | 10.8% | 22.0% | 100 |
| M2681 | 3 | 12 | 56.4 | 9.8 | 0 | 3.8 | 15 | 0 | 800 | 12.5% | 25.0% | 0 |
| M2682 | 4 | 16 | 51.2 | 9.8 | 0 | 4 | 15 | 0 | 800 | 10.7% | 22.0% | 100 |
| M2683 | 3 | 12 | 55.8 | 9.8 | 0 | 4.4 | 15 | 0 | 800 | 12.5% | 25.1% | 0 |
| M2684 | 4 | 16 | 50.6 | 9.8 | 0 | 4.6 | 15 | 0 | 800 | 10.6% | 22.0% | 100 |
| M2685 | 4 | 16 | 50 | 9.8 | 0 | 5.2 | 15 | 0 | 800 | 10.5% | 22.0% | 100 |
| M2686 | 4 | 16 | 45.6 | 9.8 | 0 | 9.6 | 15 | 0 | 800 | 10.0% | 22.2% | 150 |
| M2687 | 4 | 16 | 45 | 9.8 | 0 | 10.2 | 15 | 0 | 800 | 9.9% | 22.3% | 150 |
| M2688 | 4 | 16 | 44.6 | 9.8 | 0 | 10.6 | 15 | 0 | 800 | 9.9% | 22.3% | 150 |
| M2689 | 3 | 12 | 49.2 | 9.8 | 0 | 11 | 15 | 0 | 800 | 11.9% | 24.9% | 100 |
| M2690 | 4 | 16 | 44 | 9.8 | 0 | 11.2 | 15 | 0 | 800 | 9.9% | 22.3% | 150 |
| M2691 | 3 | 12 | 48.6 | 9.8 | 0 | 11.6 | 15 | 0 | 800 | 11.9% | 24.9% | 100 |
| M2692 | 4 | 16 | 43.4 | 9.8 | 0 | 11.8 | 15 | 0 | 800 | 9.8% | 22.4% | 150 |
| M2693 | 3 | 12 | 48 | 9.8 | 0 | 12.2 | 15 | 0 | 800 | 11.9% | 25.0% | 100 |
| M2694 | 4 | 16 | 42.8 | 9.8 | 0 | 12.4 | 15 | 0 | 800 | 9.8% | 22.4% | 150 |
| M2695 | 3 | 12 | 47.4 | 9.8 | 0 | 12.8 | 15 | 0 | 800 | 11.8% | 25.0% | 100 |
| M2696 | 4 | 16 | 42.2 | 9.8 | 0 | 13 | 15 | 0 | 750 | 9.7% | 22.4% | 150 |
| M2697 | 3 | 12 | 46.8 | 9.8 | 0 | 13.4 | 15 | 0 | 800 | 11.8% | 25.0% | 100 |
| M2698 | 4 | 16 | 41.6 | 9.8 | 0 | 13.6 | 15 | 0 | 750 | 9.7% | 22.5% | 150 |
| M2699 | 3 | 12 | 46.2 | 9.8 | 0 | 14 | 15 | 0 | 800 | 11.8% | 25.0% | 100 |
| M2700 | 4 | 7 | 59 | 10 | 0 | 0 | 20 | 0 | 800 | 7.8% | 34.1% | 200 |
| M2701 | 3.75 | 9 | 57.25 | 10 | 0 | 0 | 20 | 0 | 850 | 10.3% | 32.8% | 150 |
| M2702 | 2.2 | 10 | 67.8 | 10 | 0 | 0 | 10 | 0 | 850 | 10.4% | 17.3% | −50 |
| M2703 | 2.6 | 10 | 67.4 | 10 | 0 | 0 | 10 | 0 | 850 | 9.2% | 17.1% | −50 |
| M2704 | 2 | 10 | 67.5 | 10 | 0 | 0 | 10.5 | 0 | 850 | 10.5% | 17.3% | −50 |
| M2705 | 2.5 | 10 | 66.5 | 10 | 0 | 0 | 11 | 0 | 850 | 10.3% | 19.1% | −50 |
| M2706 | 3 | 10 | 65.5 | 10 | 0 | 0 | 11.5 | 0 | 850 | 8.9% | 19.9% | −50 |
| M2707 | 4 | 10 | 56 | 10 | 0 | 0 | 20 | 0 | 800 | 11.3% | 34.0% | 150 |
| M2708 | 2.4 | 10.2 | 67.4 | 10 | 0 | 0 | 10 | 0 | 850 | 10.0% | 17.0% | −50 |
| M2709 | 2.8 | 10.2 | 67 | 10 | 0 | 0 | 10 | 0 | 850 | 8.6% | 17.0% | −50 |
| M2710 | 2.5 | 10.2 | 66.8 | 10 | 0 | 0 | 10.5 | 0 | 850 | 10.0% | 18.0% | −50 |
| M2711 | 3 | 10.2 | 65.8 | 10 | 0 | 0 | 11 | 0 | 850 | 8.6% | 18.8% | −50 |
| M2712 | 2.5 | 10.2 | 65.3 | 10 | 0 | 0 | 12 | 0 | 850 | 10.8% | 20.8% | −50 |
| M2713 | 2.2 | 10.4 | 67.4 | 10 | 0 | 0 | 10 | 0 | 850 | 10.8% | 17.0% | −50 |
| M2714 | 2.6 | 10.4 | 67 | 10 | 0 | 0 | 10 | 0 | 850 | 9.4% | 16.8% | −50 |
| M2715 | 2.5 | 10.4 | 66.6 | 10 | 0 | 0 | 10.5 | 0 | 850 | 10.1% | 17.8% | −50 |
| M2716 | 3 | 10.4 | 65.6 | 10 | 0 | 0 | 11 | 0 | 850 | 8.7% | 18.7% | −50 |
| M2717 | 2.5 | 10.4 | 65.1 | 10 | 0 | 0 | 12 | 0 | 850 | 11.0% | 20.7% | −50 |
| M2718 | 2.2 | 10.6 | 67.2 | 10 | 0 | 0 | 10 | 0 | 850 | 11.0% | 16.9% | −50 |
| M2719 | 2.6 | 10.6 | 66.8 | 10 | 0 | 0 | 10 | 0 | 850 | 9.5% | 16.7% | −50 |
| M2720 | 2.5 | 10.6 | 66.4 | 10 | 0 | 0 | 10.5 | 0 | 850 | 10.2% | 17.7% | −50 |
| M2721 | 3 | 10.6 | 65.4 | 10 | 0 | 0 | 11 | 0 | 850 | 8.8% | 18.6% | −50 |
| M2722 | 2.5 | 10.6 | 64.9 | 10 | 0 | 0 | 12 | 0 | 850 | 11.2% | 20.6% | −50 |
| M2723 | 3 | 10.8 | 67.2 | 10 | 0 | 0 | 9 | 0 | 850 | 7.6% | 14.7% | −50 |
| M2724 | 2.4 | 10.8 | 66.8 | 10 | 0 | 0 | 10 | 0 | 850 | 10.3% | 16.7% | −50 |
| M2725 | 2.5 | 10.8 | 64.7 | 10 | 2 | 0 | 10 | 0 | 850 | 10.3% | 17.4% | −50 |
| M2726 | 2.6 | 10.8 | 66.6 | 10 | 0 | 0 | 10 | 0 | 850 | 9.6% | 16.6% | −50 |
| M2727 | 3 | 10.8 | 65.2 | 10 | 1 | 0 | 10 | 0 | 850 | 8.4% | 17.0% | 0 |
| M2728 | 3 | 10.8 | 62.2 | 10 | 4 | 0 | 10 | 0 | 850 | 8.5% | 17.1% | 0 |
| M2729 | 2.5 | 10.8 | 65.7 | 10 | 0 | 0 | 11 | 0 | 850 | 10.8% | 18.5% | −50 |
| M2730 | 2.5 | 10.8 | 62.7 | 10 | 3 | 0 | 11 | 0 | 850 | 11.1% | 18.3% | −50 |
| M2731 | 3 | 10.8 | 64.2 | 10 | 1 | 0 | 11 | 0 | 850 | 9.1% | 18.8% | 0 |
| M2732 | 3 | 10.8 | 61.2 | 10 | 4 | 0 | 11 | 0 | 800 | 9.3% | 18.4% | 50 |
| M2733 | 3.5 | 10.8 | 62.7 | 10 | 2 | 0 | 11 | 0 | 850 | 7.3% | 19.4% | 50 |
| M2734 | 3 | 10.8 | 64.7 | 10 | 0 | 0 | 11.5 | 0 | 850 | 9.3% | 19.3% | −50 |
| M2735 | 2.5 | 10.8 | 62.7 | 10 | 2 | 0 | 12 | 0 | 850 | 11.5% | 21.3% | −50 |
| M2736 | 3 | 10.8 | 63.2 | 10 | 1 | 0 | 12 | 0 | 850 | 9.9% | 20.7% | −50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2737 | 3.5 | 10.8 | 63.7 | 10 | 0 | 0 | 12 | 0 | 850 | 8.0% | 20.3% | 50 |
| M2738 | 2.5 | 10.8 | 63.7 | 10 | 0 | 0 | 13 | 0 | 850 | 11.6% | 21.7% | −50 |
| M2739 | 3 | 10.8 | 62.2 | 10 | 1 | 0 | 13 | 0 | 850 | 10.7% | 22.5% | 0 |
| M2740 | 3.5 | 10.8 | 61.7 | 10 | 1 | 0 | 13 | 0 | 850 | 8.9% | 22.5% | 50 |
| M2741 | 3.5 | 10.8 | 61.7 | 10 | 0 | 0 | 14 | 0 | 850 | 9.5% | 23.8% | 50 |
| M2742 | 3 | 11 | 68 | 10 | 0 | 0 | 8 | 0 | 850 | 7.1% | 12.7% | −50 |
| M2743 | 2.2 | 11 | 66.8 | 10 | 0 | 0 | 10 | 0 | 850 | 11.2% | 16.6% | −50 |
| M2744 | 2.6 | 11 | 66.4 | 10 | 0 | 0 | 10 | 0 | 850 | 9.7% | 16.5% | −50 |
| M2745 | 2.5 | 11 | 66 | 10 | 0 | 0 | 10.5 | 0 | 850 | 10.5% | 17.4% | −50 |
| M2746 | 3 | 11 | 65 | 10 | 0 | 0 | 11 | 0 | 850 | 9.1% | 18.3% | −50 |
| M2747 | 3 | 11 | 64.5 | 10 | 0 | 0 | 11.5 | 0 | 850 | 9.4% | 19.2% | −50 |
| M2748 | 3.5 | 11 | 63.5 | 10 | 0 | 0 | 12 | 0 | 850 | 8.1% | 20.2% | 50 |
| M2749 | 3 | 11 | 62 | 10 | 0 | 0 | 14 | 0 | 850 | 11.5% | 23.8% | 0 |
| M2750 | 3 | 11.2 | 67.8 | 10 | 0 | 0 | 8 | 0 | 850 | 7.2% | 12.6% | −50 |
| M2751 | 2.2 | 11.2 | 66.6 | 10 | 0 | 0 | 10 | 0 | 850 | 11.3% | 16.5% | −50 |
| M2752 | 2.6 | 11.2 | 66.2 | 10 | 0 | 0 | 10 | 0 | 850 | 9.8% | 16.3% | −50 |
| M2753 | 3.5 | 11.2 | 65.3 | 10 | 0 | 0 | 10 | 0 | 850 | 7.0% | 16.5% | 0 |
| M2754 | 2.5 | 11.2 | 65.3 | 10 | 0 | 0 | 11 | 0 | 850 | 11.0% | 18.3% | −50 |
| M2755 | 2.5 | 11.2 | 64.8 | 10 | 0 | 0 | 11.5 | 0 | 850 | 11.4% | 19.2% | −50 |
| M2756 | 3 | 11.2 | 63.8 | 10 | 0 | 0 | 12 | 0 | 850 | 9.9% | 20.0% | −50 |
| M2757 | 3.5 | 11.2 | 62.3 | 10 | 0 | 0 | 13 | 0 | 850 | 8.9% | 21.8% | 50 |
| M2758 | 3.5 | 11.2 | 61.3 | 10 | 0 | 0 | 14 | 0 | 850 | 9.7% | 23.5% | 50 |
| M2759 | 2.2 | 11.4 | 66.4 | 10 | 0 | 0 | 10 | 0 | 850 | 11.5% | 16.4% | −50 |
| M2760 | 2.6 | 11.4 | 66 | 10 | 0 | 0 | 10 | 0 | 850 | 9.9% | 16.2% | −50 |
| M2761 | 3.5 | 11.4 | 65.1 | 10 | 0 | 0 | 10 | 0 | 850 | 7.1% | 16.3% | 0 |
| M2762 | 2.5 | 11.4 | 65.1 | 10 | 0 | 0 | 11 | 0 | 850 | 11.1% | 18.1% | −50 |
| M2763 | 2.5 | 11.4 | 64.6 | 10 | 0 | 0 | 11.5 | 0 | 850 | 11.6% | 19.1% | −50 |
| M2764 | 3 | 11.4 | 63.6 | 10 | 0 | 0 | 12 | 0 | 850 | 10.0% | 19.8% | −50 |
| M2765 | 3.5 | 11.4 | 62.1 | 10 | 0 | 0 | 13 | 0 | 850 | 9.0% | 21.6% | 50 |
| M2766 | 3 | 11.6 | 67.4 | 10 | 0 | 0 | 8 | 0 | 850 | 7.4% | 12.3% | −50 |
| M2767 | 2.4 | 11.6 | 66 | 10 | 0 | 0 | 10 | 0 | 850 | 10.8% | 16.1% | −50 |
| M2768 | 2.8 | 11.6 | 65.6 | 10 | 0 | 0 | 10 | 0 | 850 | 9.3% | 16.0% | −50 |
| M2769 | 2.5 | 11.6 | 65.4 | 10 | 0 | 0 | 10.5 | 0 | 850 | 10.8% | 17.1% | −50 |
| M2770 | 3 | 11.6 | 64.4 | 10 | 0 | 0 | 11 | 0 | 850 | 9.4% | 17.9% | 0 |
| M2771 | 3 | 11.6 | 63.9 | 10 | 0 | 0 | 11.5 | 0 | 850 | 9.8% | 18.8% | 0 |
| M2772 | 3.5 | 11.6 | 62.9 | 10 | 0 | 0 | 12 | 0 | 850 | 8.4% | 19.8% | 50 |
| M2773 | 4 | 11.6 | 61.4 | 10 | 0 | 0 | 13 | 0 | 850 | 7.6% | 21.7% | 100 |
| M2774 | 3 | 11.8 | 66.2 | 10 | 0 | 0 | 9 | 0 | 850 | 8.1% | 14.1% | −50 |
| M2775 | 2.5 | 11.8 | 65.7 | 10 | 0 | 0 | 10 | 0 | 850 | 10.5% | 16.0% | −50 |
| M2776 | 3 | 11.8 | 65.2 | 10 | 0 | 0 | 10 | 0 | 850 | 8.8% | 15.9% | −50 |
| M2777 | 3 | 11.8 | 64.7 | 10 | 0 | 0 | 10.5 | 0 | 850 | 9.1% | 16.8% | −50 |
| M2778 | 3.5 | 11.8 | 63.7 | 10 | 0 | 0 | 11 | 0 | 850 | 7.9% | 17.9% | 0 |
| M2779 | 2.5 | 11.8 | 63.7 | 10 | 0 | 0 | 12 | 0 | 850 | 12.2% | 20.0% | −50 |
| M2780 | 3 | 11.8 | 62.2 | 10 | 0 | 0 | 13 | 0 | 850 | 11.1% | 21.4% | 0 |
| M2781 | 3 | 11.8 | 61.2 | 10 | 0 | 0 | 14 | 0 | 850 | 12.0% | 23.2% | 0 |
| M2782 | 2.2 | 12 | 65.8 | 10 | 0 | 0 | 10 | 0 | 850 | 11.8% | 16.0% | −50 |
| M2783 | 2.6 | 12 | 65.4 | 10 | 0 | 0 | 10 | 0 | 850 | 10.3% | 15.8% | −50 |
| M2784 | 3 | 12 | 64 | 10 | 1 | 0 | 10 | 0 | 850 | 9.0% | 16.2% | −50 |
| M2785 | 3 | 12 | 61 | 10 | 4 | 0 | 10 | 0 | 800 | 9.2% | 15.6% | 0 |
| M2786 | 3.5 | 12 | 63.5 | 10 | 1 | 0 | 10 | 0 | 850 | 7.5% | 16.3% | 0 |
| M2787 | 3.5 | 12 | 60.5 | 10 | 4 | 0 | 10 | 0 | 800 | 7.6% | 17.4% | 50 |
| M2788 | 3 | 12 | 64.5 | 10 | 0 | 0 | 10.5 | 0 | 850 | 9.2% | 16.7% | −50 |
| M2789 | 3 | 12 | 63 | 10 | 1 | 0 | 11 | 0 | 850 | 9.8% | 18.0% | 0 |
| M2790 | 3 | 12 | 60 | 10 | 4 | 0 | 11 | 0 | 800 | 9.9% | 16.8% | 0 |
| M2791 | 3.5 | 12 | 62.5 | 10 | 1 | 0 | 11 | 0 | 850 | 8.1% | 18.1% | 50 |
| M2792 | 3.5 | 12 | 59.5 | 10 | 4 | 0 | 11 | 0 | 800 | 8.2% | 18.9% | 50 |
| M2793 | 3 | 12 | 63.5 | 10 | 0 | 0 | 11.5 | 0 | 850 | 10.0% | 18.5% | 0 |
| M2794 | 3 | 12 | 62 | 10 | 1 | 0 | 12 | 0 | 850 | 10.6% | 19.8% | 0 |
| M2795 | 3 | 12 | 59 | 10 | 4 | 0 | 12 | 0 | 800 | 10.7% | 17.8% | 50 |
| M2796 | 3.5 | 12 | 61.5 | 10 | 1 | 0 | 12 | 0 | 850 | 8.8% | 19.9% | 50 |
| M2797 | 3.5 | 12 | 58.5 | 10 | 4 | 0 | 12 | 0 | 800 | 9.0% | 20.2% | 50 |
| M2798 | 4 | 12 | 59 | 10 | 3 | 0 | 12 | 0 | 850 | 7.2% | 20.9% | 100 |
| M2799 | 3 | 12 | 62 | 10 | 0 | 0 | 13 | 0 | 850 | 11.2% | 21.3% | 0 |
| M2800 | 3 | 12 | 59 | 10 | 3 | 0 | 13 | 0 | 800 | 11.6% | 21.0% | 50 |
| M2801 | 3.5 | 12 | 61.5 | 10 | 0 | 0 | 13 | 0 | 850 | 9.4% | 21.2% | 50 |
| M2802 | 3.5 | 12 | 58.5 | 10 | 3 | 0 | 13 | 0 | 800 | 9.6% | 22.5% | 100 |
| M2803 | 4 | 12 | 61 | 10 | 0 | 0 | 13 | 0 | 850 | 7.8% | 21.4% | 100 |
| M2804 | 4 | 12 | 58 | 10 | 3 | 0 | 13 | 0 | 800 | 7.9% | 22.7% | 100 |
| M2805 | 3 | 12 | 61 | 10 | 0 | 0 | 14 | 0 | 850 | 12.1% | 23.2% | 0 |
| M2806 | 3 | 12 | 58 | 10 | 3 | 0 | 14 | 0 | 800 | 12.4% | 22.4% | 50 |
| M2807 | 3.5 | 12 | 60.5 | 10 | 0 | 0 | 14 | 0 | 850 | 10.1% | 23.0% | 50 |
| M2808 | 3.5 | 12 | 57.5 | 10 | 3 | 0 | 14 | 0 | 800 | 10.5% | 24.2% | 100 |
| M2809 | 4 | 12 | 60 | 10 | 0 | 0 | 14 | 0 | 850 | 8.4% | 23.1% | 100 |
| M2810 | 4 | 12 | 57 | 10 | 3 | 0 | 14 | 0 | 800 | 8.6% | 24.4% | 150 |
| M2811 | 3 | 12 | 60 | 10 | 0 | 0 | 15 | 0 | 850 | 12.9% | 24.8% | 50 |
| M2812 | 3.5 | 12 | 58.5 | 10 | 1 | 0 | 15 | 0 | 800 | 11.2% | 25.1% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M2813 | 3.5 | 12 | 55.5 | 10 | 4 | 0 | 15 | 0 | 800 | 11.4% | 22.9% | 100 |
| M2814 | 4 | 12 | 58 | 10 | 1 | 0 | 15 | 0 | 850 | 9.3% | 25.2% | 150 |
| M2815 | 4 | 12 | 55 | 10 | 4 | 0 | 15 | 0 | 800 | 9.6% | 25.6% | 150 |
| M2816 | 3 | 12.2 | 64.8 | 10 | 0 | 0 | 10 | 0 | 850 | 9.0% | 15.7% | −50 |
| M2817 | 2.5 | 12.2 | 64.3 | 10 | 0 | 0 | 11 | 0 | 850 | 11.6% | 17.6% | −50 |
| M2818 | 3 | 12.2 | 63.3 | 10 | 0 | 0 | 11.5 | 0 | 850 | 10.1% | 18.4% | 0 |
| M2819 | 2.5 | 12.4 | 65.1 | 10 | 0 | 0 | 10 | 0 | 850 | 10.9% | 15.6% | −50 |
| M2820 | 3 | 12.4 | 64.1 | 10 | 0 | 0 | 10.5 | 0 | 850 | 9.4% | 16.4% | −50 |
| M2821 | 2.5 | 12.4 | 63.6 | 10 | 0 | 0 | 11.5 | 0 | 850 | 12.2% | 18.6% | −50 |
| M2822 | 3 | 12.4 | 62.6 | 10 | 0 | 0 | 12 | 0 | 850 | 10.6% | 19.2% | 0 |
| M2823 | 2.5 | 12.6 | 64.4 | 10 | 0 | 0 | 10.5 | 0 | 850 | 11.4% | 16.4% | −50 |
| M2824 | 3 | 12.6 | 63.4 | 10 | 0 | 0 | 11 | 0 | 850 | 9.9% | 17.2% | −50 |
| M2825 | 2.5 | 12.6 | 62.9 | 10 | 0 | 0 | 12 | 0 | 850 | 12.6% | 19.5% | −50 |
| M2826 | 3 | 12.8 | 64.2 | 10 | 0 | 0 | 10 | 0 | 850 | 9.3% | 15.3% | −50 |
| M2827 | 2.5 | 12.8 | 63.7 | 10 | 0 | 0 | 11 | 0 | 850 | 12.0% | 17.2% | −50 |
| M2828 | 3 | 12.8 | 62.7 | 10 | 0 | 0 | 11.5 | 0 | 850 | 10.4% | 18.0% | 0 |
| M2829 | 2.5 | 13 | 64.5 | 10 | 0 | 0 | 10 | 0 | 850 | 11.2% | 15.2% | −50 |
| M2830 | 3 | 13 | 62 | 10 | 2 | 0 | 10 | 0 | 850 | 9.7% | 15.8% | −50 |
| M2831 | 3 | 13 | 59 | 10 | 5 | 0 | 10 | 0 | 800 | 9.7% | 12.5% | 0 |
| M2832 | 3.5 | 13 | 61.5 | 10 | 2 | 0 | 10 | 0 | 850 | 8.1% | 16.0% | 0 |
| M2833 | 3.5 | 13 | 58.5 | 10 | 5 | 0 | 10 | 0 | 800 | 8.1% | 14.9% | 50 |
| M2834 | 2.5 | 13 | 63.5 | 10 | 0 | 0 | 11 | 0 | 850 | 12.1% | 17.1% | −50 |
| M2835 | 3 | 13 | 61 | 10 | 2 | 0 | 11 | 0 | 800 | 10.5% | 17.7% | 0 |
| M2836 | 3 | 13 | 58 | 10 | 5 | 0 | 11 | 0 | 800 | 10.4% | 13.4% | 0 |
| M2837 | 3.5 | 13 | 60.5 | 10 | 2 | 0 | 11 | 0 | 850 | 8.8% | 17.8% | 50 |
| M2838 | 3.5 | 13 | 57.5 | 10 | 5 | 0 | 11 | 0 | 800 | 8.8% | 16.1% | 50 |
| M2839 | 4 | 13 | 57 | 10 | 5 | 0 | 11 | 0 | 800 | 7.4% | 18.3% | 100 |
| M2840 | 2.5 | 13 | 62.5 | 10 | 0 | 0 | 12 | 0 | 850 | 12.9% | 19.2% | −50 |
| M2841 | 3 | 13 | 60 | 10 | 2 | 0 | 12 | 0 | 800 | 11.1% | 19.5% | 0 |
| M2842 | 3 | 13 | 57 | 10 | 5 | 0 | 12 | 0 | 800 | 11.1% | 14.1% | 50 |
| M2843 | 3.5 | 13 | 59.5 | 10 | 2 | 0 | 12 | 0 | 850 | 9.5% | 19.5% | 50 |
| M2844 | 3.5 | 13 | 56.5 | 10 | 5 | 0 | 12 | 0 | 800 | 9.5% | 17.1% | 100 |
| M2845 | 4 | 13 | 59 | 10 | 2 | 0 | 12 | 0 | 850 | 7.6% | 19.8% | 100 |
| M2846 | 4 | 13 | 56 | 10 | 5 | 0 | 12 | 0 | 800 | 8.1% | 19.5% | 100 |
| M2847 | 3 | 13 | 59 | 10 | 2 | 0 | 13 | 0 | 800 | 12.0% | 21.9% | 0 |
| M2848 | 3 | 13 | 56 | 10 | 5 | 0 | 13 | 0 | 800 | 11.9% | 15.7% | 50 |
| M2849 | 3.5 | 13 | 58.5 | 10 | 2 | 0 | 13 | 0 | 800 | 10.3% | 21.3% | 50 |
| M2850 | 3.5 | 13 | 55.5 | 10 | 5 | 0 | 13 | 0 | 800 | 10.3% | 17.9% | 100 |
| M2851 | 4 | 13 | 58 | 10 | 2 | 0 | 13 | 0 | 850 | 8.2% | 21.5% | 100 |
| M2852 | 4 | 13 | 55 | 10 | 5 | 0 | 13 | 0 | 800 | 8.7% | 20.6% | 150 |
| M2853 | 3.5 | 13 | 59.5 | 10 | 0 | 0 | 14 | 0 | 850 | 10.7% | 22.3% | 50 |
| M2854 | 3.5 | 13 | 56.5 | 10 | 3 | 0 | 14 | 0 | 800 | 11.1% | 22.9% | 100 |
| M2855 | 4 | 13 | 59 | 10 | 0 | 0 | 14 | 0 | 850 | 8.9% | 22.4% | 100 |
| M2856 | 4 | 13 | 56 | 10 | 3 | 0 | 14 | 0 | 800 | 9.2% | 23.6% | 150 |
| M2857 | 3.5 | 13 | 58.5 | 10 | 0 | 0 | 15 | 0 | 850 | 11.5% | 24.0% | 50 |
| M2858 | 3.5 | 13 | 55.5 | 10 | 3 | 0 | 15 | 0 | 800 | 12.0% | 24.6% | 100 |
| M2859 | 4 | 13 | 58 | 10 | 0 | 0 | 15 | 0 | 850 | 9.6% | 24.0% | 100 |
| M2860 | 4 | 13 | 55 | 10 | 3 | 0 | 15 | 0 | 800 | 10.0% | 25.3% | 150 |
| M2861 | 2.5 | 13.2 | 64.3 | 10 | 0 | 0 | 10 | 0 | 850 | 11.3% | 15.1% | −50 |
| M2862 | 3 | 13.2 | 63.3 | 10 | 0 | 0 | 10.5 | 0 | 850 | 9.9% | 15.9% | −50 |
| M2863 | 2.5 | 13.2 | 62.8 | 10 | 0 | 0 | 11.5 | 0 | 850 | 12.5% | 18.4% | −50 |
| M2864 | 3 | 13.2 | 61.8 | 10 | 0 | 0 | 12 | 0 | 850 | 11.1% | 18.6% | 0 |
| M2865 | 2.5 | 13.4 | 63.6 | 10 | 0 | 0 | 10.5 | 0 | 850 | 11.9% | 15.9% | −50 |
| M2866 | 3 | 13.4 | 62.6 | 10 | 0 | 0 | 11 | 0 | 850 | 10.4% | 16.7% | −50 |
| M2867 | 2.5 | 13.4 | 62.1 | 10 | 0 | 0 | 12 | 0 | 850 | 13.1% | 18.9% | −50 |
| M2868 | 3 | 13.6 | 63.4 | 10 | 0 | 0 | 10 | 0 | 850 | 9.7% | 14.7% | −50 |
| M2869 | 2.5 | 13.6 | 62.9 | 10 | 0 | 0 | 11 | 0 | 850 | 12.4% | 17.2% | −50 |
| M2870 | 3 | 13.6 | 61.9 | 10 | 0 | 0 | 11.5 | 0 | 850 | 10.9% | 17.5% | −50 |
| M2871 | 3 | 13.8 | 63.2 | 10 | 0 | 0 | 10 | 0 | 850 | 9.8% | 14.6% | −50 |
| M2872 | 2.5 | 13.8 | 62.7 | 10 | 0 | 0 | 11 | 0 | 850 | 12.4% | 17.3% | −50 |
| M2873 | 3 | 13.8 | 61.7 | 10 | 0 | 0 | 11.5 | 0 | 850 | 11.0% | 17.3% | −50 |
| M2874 | 3 | 14 | 63 | 10 | 0 | 0 | 10 | 0 | 850 | 9.9% | 14.5% | −50 |
| M2875 | 3 | 14 | 60 | 10 | 3 | 0 | 10 | 0 | 800 | 10.1% | 15.1% | −50 |
| M2876 | 3.5 | 14 | 62.5 | 10 | 0 | 0 | 10 | 0 | 850 | 8.3% | 14.6% | 0 |
| M2877 | 3.5 | 14 | 59.5 | 10 | 3 | 0 | 10 | 0 | 850 | 8.4% | 15.6% | 0 |
| M2878 | 4 | 14 | 58 | 10 | 4 | 0 | 10 | 0 | 850 | 7.1% | 16.1% | 50 |
| M2879 | 3 | 14 | 62.5 | 10 | 0 | 0 | 10.5 | 0 | 850 | 10.3% | 15.4% | −50 |
| M2880 | 3 | 14 | 61 | 10 | 1 | 0 | 11 | 0 | 850 | 10.9% | 16.6% | −50 |
| M2881 | 3 | 14 | 58 | 10 | 4 | 0 | 11 | 0 | 800 | 10.9% | 14.1% | 0 |
| M2882 | 3.5 | 14 | 60.5 | 10 | 1 | 0 | 11 | 0 | 850 | 9.1% | 16.7% | 0 |
| M2883 | 3.5 | 14 | 57.5 | 10 | 4 | 0 | 11 | 0 | 800 | 9.3% | 16.5% | 50 |
| M2884 | 4 | 14 | 60 | 10 | 1 | 0 | 11 | 0 | 850 | 7.2% | 16.9% | 50 |
| M2885 | 4 | 14 | 57 | 10 | 4 | 0 | 11 | 0 | 800 | 7.7% | 18.0% | 100 |
| M2886 | 3 | 14 | 61.5 | 10 | 0 | 0 | 11.5 | 0 | 850 | 11.1% | 17.2% | −50 |
| M2887 | 3 | 14 | 59 | 10 | 2 | 0 | 12 | 0 | 800 | 11.7% | 18.8% | 0 |
| M2888 | 3 | 14 | 56 | 10 | 5 | 0 | 12 | 0 | 800 | 11.6% | 12.4% | 0 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M2889 | 3.5 | 14 | 58.5 | 10 | 2 | 0 | 12 | 0 | 850 | 10.0% | 18.8% | 50 |
| M2890 | 3.5 | 14 | 55.5 | 10 | 5 | 0 | 12 | 0 | 800 | 10.0% | 15.6% | 50 |
| M2891 | 4 | 14 | 58 | 10 | 2 | 0 | 12 | 0 | 850 | 8.0% | 19.0% | 50 |
| M2892 | 4 | 14 | 55 | 10 | 5 | 0 | 12 | 0 | 800 | 8.5% | 18.2% | 100 |
| M2893 | 3 | 14 | 58 | 10 | 2 | 0 | 13 | 0 | 800 | 12.6% | 21.6% | 0 |
| M2894 | 3.5 | 14 | 59.5 | 10 | 0 | 0 | 13 | 0 | 850 | 10.5% | 19.8% | 0 |
| M2895 | 3.5 | 14 | 56.5 | 10 | 3 | 0 | 13 | 0 | 800 | 10.8% | 20.6% | 50 |
| M2896 | 4 | 14 | 59 | 10 | 0 | 0 | 13 | 0 | 850 | 8.7% | 20.0% | 50 |
| M2897 | 4 | 14 | 56 | 10 | 3 | 0 | 13 | 0 | 800 | 8.9% | 21.1% | 100 |
| M2898 | 3 | 14 | 59 | 10 | 0 | 0 | 14 | 0 | 850 | 13.2% | 22.2% | 0 |
| M2899 | 3.5 | 14 | 56.5 | 10 | 2 | 0 | 14 | 0 | 800 | 11.5% | 22.3% | 50 |
| M2900 | 3.5 | 14 | 53.5 | 10 | 5 | 0 | 14 | 0 | 800 | 11.5% | 16.9% | 100 |
| M2901 | 4 | 14 | 56 | 10 | 2 | 0 | 14 | 0 | 800 | 9.5% | 22.4% | 100 |
| M2902 | 4 | 14 | 53 | 10 | 5 | 0 | 14 | 0 | 800 | 9.9% | 20.1% | 150 |
| M2903 | 3.5 | 14 | 55.5 | 10 | 2 | 0 | 15 | 0 | 800 | 12.4% | 25.2% | 50 |
| M2904 | 3.5 | 14 | 52.5 | 10 | 5 | 0 | 15 | 0 | 800 | 12.2% | 19.4% | 100 |
| M2905 | 4 | 14 | 55 | 10 | 2 | 0 | 15 | 0 | 800 | 10.3% | 24.1% | 100 |
| M2906 | 4 | 14 | 52 | 10 | 5 | 0 | 15 | 0 | 800 | 10.6% | 20.7% | 150 |
| M2907 | 3 | 15 | 60 | 10 | 2 | 0 | 10 | 0 | 850 | 10.8% | 14.4% | −50 |
| M2908 | 3 | 15 | 57 | 10 | 5 | 0 | 10 | 0 | 800 | 10.6% | 9.6% | 0 |
| M2909 | 3.5 | 15 | 59.5 | 10 | 2 | 0 | 10 | 0 | 850 | 9.1% | 14.5% | 0 |
| M2910 | 3.5 | 15 | 56.5 | 10 | 5 | 0 | 10 | 0 | 800 | 9.1% | 12.3% | 0 |
| M2911 | 4 | 15 | 59 | 10 | 2 | 0 | 10 | 0 | 850 | 7.2% | 14.8% | 50 |
| M2912 | 4 | 15 | 56 | 10 | 5 | 0 | 10 | 0 | 800 | 7.7% | 14.5% | 50 |
| M2913 | 3 | 15 | 59 | 10 | 2 | 0 | 11 | 0 | 800 | 11.4% | 16.2% | −50 |
| M2914 | 3 | 15 | 56 | 10 | 5 | 0 | 11 | 0 | 800 | 11.4% | 10.3% | 0 |
| M2915 | 3.5 | 15 | 58.5 | 10 | 2 | 0 | 11 | 0 | 850 | 9.8% | 16.3% | 0 |
| M2916 | 3.5 | 15 | 55.5 | 10 | 5 | 0 | 11 | 0 | 800 | 9.8% | 13.3% | 50 |
| M2917 | 4 | 15 | 58 | 10 | 2 | 0 | 11 | 0 | 850 | 7.9% | 16.6% | 50 |
| M2918 | 4 | 15 | 55 | 10 | 5 | 0 | 11 | 0 | 800 | 8.3% | 15.8% | 100 |
| M2919 | 3 | 15 | 58 | 10 | 2 | 0 | 12 | 0 | 800 | 12.3% | 19.1% | 0 |
| M2920 | 3 | 15 | 55 | 10 | 5 | 0 | 12 | 0 | 800 | 12.1% | 12.6% | 0 |
| M2921 | 3.5 | 15 | 57.5 | 10 | 2 | 0 | 12 | 0 | 800 | 10.3% | 18.1% | 0 |
| M2922 | 3.5 | 15 | 54.5 | 10 | 5 | 0 | 12 | 0 | 800 | 10.5% | 14.1% | 50 |
| M2923 | 4 | 15 | 57 | 10 | 2 | 0 | 12 | 0 | 850 | 8.9% | 18.3% | 50 |
| M2924 | 4 | 15 | 54 | 10 | 5 | 0 | 12 | 0 | 800 | 9.0% | 16.9% | 100 |
| M2925 | 3.5 | 15 | 57.5 | 10 | 1 | 0 | 13 | 0 | 850 | 11.2% | 19.5% | 50 |
| M2926 | 3.5 | 15 | 54.5 | 10 | 4 | 0 | 13 | 0 | 800 | 11.3% | 17.0% | 50 |
| M2927 | 4 | 15 | 57 | 10 | 1 | 0 | 13 | 0 | 850 | 9.4% | 19.6% | 50 |
| M2928 | 4 | 15 | 54 | 10 | 4 | 0 | 13 | 0 | 800 | 9.6% | 19.6% | 100 |
| M2929 | 3.5 | 15 | 56.5 | 10 | 1 | 0 | 14 | 0 | 800 | 11.9% | 21.3% | 50 |
| M2930 | 3.5 | 15 | 53.5 | 10 | 4 | 0 | 14 | 0 | 800 | 12.1% | 19.0% | 50 |
| M2931 | 4 | 15 | 56 | 10 | 1 | 0 | 14 | 0 | 850 | 10.2% | 21.3% | 100 |
| M2932 | 4 | 15 | 53 | 10 | 4 | 0 | 14 | 0 | 800 | 10.4% | 20.5% | 100 |
| M2933 | 3.5 | 15 | 55.5 | 10 | 1 | 0 | 15 | 0 | 800 | 12.8% | 24.2% | 50 |
| M2934 | 4 | 15 | 54 | 10 | 2 | 0 | 15 | 0 | 800 | 10.9% | 23.3% | 100 |
| M2935 | 4 | 15 | 51 | 10 | 5 | 0 | 15 | 0 | 800 | 11.1% | 19.1% | 150 |
| M2936 | 3 | 16 | 59 | 10 | 2 | 0 | 10 | 0 | 800 | 11.1% | 13.6% | −50 |
| M2937 | 3 | 16 | 56 | 10 | 5 | 0 | 10 | 0 | 800 | 11.1% | 8.0% | −50 |
| M2938 | 3.5 | 16 | 58.5 | 10 | 2 | 0 | 10 | 0 | 850 | 9.6% | 13.8% | 0 |
| M2939 | 3.5 | 16 | 55.5 | 10 | 5 | 0 | 10 | 0 | 800 | 9.5% | 11.0% | 0 |
| M2940 | 4 | 16 | 58 | 10 | 2 | 0 | 10 | 0 | 850 | 7.7% | 14.1% | 0 |
| M2941 | 4 | 16 | 55 | 10 | 5 | 0 | 10 | 0 | 800 | 8.1% | 13.3% | 50 |
| M2942 | 3 | 16 | 58 | 10 | 2 | 0 | 11 | 0 | 800 | 12.0% | 15.9% | −50 |
| M2943 | 3 | 16 | 55 | 10 | 5 | 0 | 11 | 0 | 800 | 11.8% | 9.3% | 0 |
| M2944 | 3.5 | 16 | 57.5 | 10 | 2 | 0 | 11 | 0 | 850 | 10.4% | 15.6% | 0 |
| M2945 | 3.5 | 16 | 54.5 | 10 | 5 | 0 | 11 | 0 | 800 | 10.2% | 11.9% | 50 |
| M2946 | 4 | 16 | 57 | 10 | 2 | 0 | 11 | 0 | 850 | 8.3% | 15.8% | 50 |
| M2947 | 4 | 16 | 54 | 10 | 5 | 0 | 11 | 0 | 800 | 8.7% | 14.5% | 100 |
| M2948 | 3 | 16 | 54 | 10 | 5 | 0 | 12 | 0 | 800 | 12.5% | 12.2% | 0 |
| M2949 | 3.5 | 16 | 56.5 | 10 | 2 | 0 | 12 | 0 | 800 | 10.9% | 17.3% | 0 |
| M2950 | 3.5 | 16 | 53.5 | 10 | 5 | 0 | 12 | 0 | 800 | 11.0% | 12.6% | 50 |
| M2951 | 4 | 16 | 56 | 10 | 2 | 0 | 12 | 0 | 850 | 9.4% | 17.5% | 50 |
| M2952 | 4 | 16 | 53 | 10 | 5 | 0 | 12 | 0 | 800 | 9.4% | 15.5% | 100 |
| M2953 | 3.5 | 16 | 55.5 | 10 | 2 | 0 | 13 | 0 | 800 | 11.7% | 19.1% | 50 |
| M2954 | 3.5 | 16 | 52.5 | 10 | 5 | 0 | 13 | 0 | 800 | 11.7% | 13.1% | 50 |
| M2955 | 4 | 16 | 55 | 10 | 2 | 0 | 13 | 0 | 850 | 9.8% | 19.2% | 50 |
| M2956 | 4 | 16 | 52 | 10 | 5 | 0 | 13 | 0 | 800 | 10.1% | 16.3% | 100 |
| M2957 | 3.5 | 16 | 52.5 | 10 | 4 | 0 | 14 | 0 | 800 | 12.6% | 19.3% | 50 |
| M2958 | 4 | 16 | 55 | 10 | 1 | 0 | 14 | 0 | 850 | 10.7% | 20.5% | 50 |
| M2959 | 4 | 16 | 52 | 10 | 4 | 0 | 14 | 0 | 800 | 10.9% | 19.1% | 100 |
| M2960 | 4 | 16 | 55 | 10 | 0 | 0 | 15 | 0 | 850 | 11.3% | 21.8% | 50 |
| M2961 | 4 | 16 | 53 | 10 | 2 | 0 | 15 | 0 | 800 | 11.5% | 22.5% | 100 |
| M2962 | 4 | 16 | 50 | 10 | 5 | 0 | 15 | 0 | 800 | 11.6% | 17.4% | 150 |
| M2963 | 3 | 12 | 59.6 | 10 | 0 | 0.4 | 15 | 0 | 850 | 12.8% | 24.8% | 50 |
| M2964 | 4 | 16 | 54.4 | 10 | 0 | 0.6 | 15 | 0 | 850 | 11.2% | 21.9% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M2965 | 3 | 12 | 59 | 10 | 0 | 1 | 15 | 0 | 850 | 12.8% | 24.9% | 50 |
| M2966 | 4 | 16 | 53.8 | 10 | 0 | 1.2 | 15 | 0 | 850 | 11.1% | 21.9% | 100 |
| M2967 | 3 | 12 | 58.4 | 10 | 0 | 1.6 | 15 | 0 | 800 | 12.8% | 24.9% | 0 |
| M2968 | 4 | 16 | 53.2 | 10 | 0 | 1.8 | 15 | 0 | 800 | 11.0% | 21.9% | 100 |
| M2969 | 3 | 12 | 57.8 | 10 | 0 | 2.2 | 15 | 0 | 800 | 12.7% | 24.9% | 0 |
| M2970 | 4 | 16 | 52.6 | 10 | 0 | 2.4 | 15 | 0 | 800 | 10.9% | 21.9% | 100 |
| M2971 | 3 | 12 | 57.2 | 10 | 0 | 2.8 | 15 | 0 | 800 | 12.7% | 25.0% | 0 |
| M2972 | 4 | 16 | 52 | 10 | 0 | 3 | 15 | 0 | 800 | 10.8% | 21.9% | 100 |
| M2973 | 3 | 12 | 56.6 | 10 | 0 | 3.4 | 15 | 0 | 800 | 12.6% | 25.0% | 0 |
| M2974 | 4 | 16 | 51.4 | 10 | 0 | 3.6 | 15 | 0 | 800 | 10.8% | 22.0% | 100 |
| M2975 | 3 | 12 | 56 | 10 | 0 | 4 | 15 | 0 | 800 | 12.5% | 25.0% | 0 |
| M2976 | 4 | 16 | 50.8 | 10 | 0 | 4.2 | 15 | 0 | 800 | 10.7% | 22.0% | 100 |
| M2977 | 3 | 12 | 55.4 | 10 | 0 | 4.6 | 15 | 0 | 800 | 12.5% | 25.1% | 0 |
| M2978 | 4 | 16 | 50 | 10 | 0 | 5 | 15 | 0 | 800 | 10.6% | 22.0% | 100 |
| M2979 | 4 | 16 | 45.4 | 10 | 0 | 9.6 | 15 | 0 | 800 | 10.0% | 22.2% | 150 |
| M2980 | 4 | 16 | 44.8 | 10 | 0 | 10.2 | 15 | 0 | 800 | 9.9% | 22.3% | 150 |
| M2981 | 4 | 16 | 44.4 | 10 | 0 | 10.6 | 15 | 0 | 800 | 9.9% | 22.3% | 150 |
| M2982 | 3 | 12 | 49 | 10 | 0 | 11 | 15 | 0 | 800 | 11.9% | 24.9% | 100 |
| M2983 | 4 | 16 | 43.8 | 10 | 0 | 11.2 | 15 | 0 | 800 | 9.8% | 22.3% | 150 |
| M2984 | 3 | 12 | 48.4 | 10 | 0 | 11.6 | 15 | 0 | 800 | 11.9% | 24.9% | 100 |
| M2985 | 4 | 16 | 43.2 | 10 | 0 | 11.8 | 15 | 0 | 800 | 9.8% | 22.3% | 150 |
| M2986 | 3 | 12 | 47.8 | 10 | 0 | 12.2 | 15 | 0 | 800 | 11.9% | 24.9% | 100 |
| M2987 | 4 | 16 | 42.6 | 10 | 0 | 12.4 | 15 | 0 | 750 | 9.7% | 22.4% | 150 |
| M2988 | 3 | 12 | 47.2 | 10 | 0 | 12.8 | 15 | 0 | 800 | 11.8% | 25.0% | 100 |
| M2989 | 4 | 16 | 42 | 10 | 0 | 13 | 15 | 0 | 750 | 9.7% | 22.4% | 150 |
| M2990 | 3 | 12 | 46.6 | 10 | 0 | 13.4 | 15 | 0 | 800 | 11.8% | 25.0% | 100 |
| M2991 | 4 | 16 | 41.4 | 10 | 0 | 13.6 | 15 | 0 | 750 | 9.7% | 22.5% | 150 |
| M2992 | 3 | 12 | 46 | 10 | 0 | 14 | 15 | 0 | 800 | 11.8% | 25.0% | 100 |
| M2993 | 4 | 16 | 54.8 | 10.2 | 0 | 0 | 15 | 0 | 850 | 11.1% | 21.8% | 50 |
| M2994 | 3 | 12 | 59.4 | 10.2 | 0 | 0.4 | 15 | 0 | 850 | 12.9% | 24.8% | 50 |
| M2995 | 4 | 16 | 54.2 | 10.2 | 0 | 0.6 | 15 | 0 | 850 | 11.2% | 21.9% | 100 |
| M2996 | 3 | 12 | 58.8 | 10.2 | 0 | 1 | 15 | 0 | 850 | 12.8% | 24.9% | 50 |
| M2997 | 4 | 16 | 53.6 | 10.2 | 0 | 1.2 | 15 | 0 | 800 | 11.1% | 21.9% | 100 |
| M2998 | 3 | 12 | 58.2 | 10.2 | 0 | 1.6 | 15 | 0 | 800 | 12.8% | 24.9% | 0 |
| M2999 | 4 | 16 | 53 | 10.2 | 0 | 1.8 | 15 | 0 | 800 | 11.0% | 21.9% | 100 |
| M3000 | 3 | 12 | 57.6 | 10.2 | 0 | 2.2 | 15 | 0 | 800 | 12.7% | 24.9% | 0 |
| M3001 | 4 | 16 | 52.4 | 10.2 | 0 | 2.4 | 15 | 0 | 800 | 10.9% | 21.9% | 100 |
| M3002 | 3 | 12 | 57 | 10.2 | 0 | 2.8 | 15 | 0 | 800 | 12.7% | 25.0% | 0 |
| M3003 | 4 | 16 | 51.8 | 10.2 | 0 | 3 | 15 | 0 | 800 | 10.8% | 21.9% | 100 |
| M3004 | 3 | 12 | 56.4 | 10.2 | 0 | 3.4 | 15 | 0 | 800 | 12.6% | 25.0% | 0 |
| M3005 | 4 | 16 | 51.2 | 10.2 | 0 | 3.6 | 15 | 0 | 800 | 10.8% | 22.0% | 100 |
| M3006 | 3 | 12 | 55.8 | 10.2 | 0 | 4 | 15 | 0 | 800 | 12.5% | 25.0% | 0 |
| M3007 | 4 | 16 | 50.6 | 10.2 | 0 | 4.2 | 15 | 0 | 800 | 10.7% | 22.0% | 100 |
| M3008 | 4 | 16 | 50.2 | 10.2 | 0 | 4.6 | 15 | 0 | 800 | 10.6% | 22.0% | 100 |
| M3009 | 4 | 16 | 49.6 | 10.2 | 0 | 5.2 | 15 | 0 | 800 | 10.5% | 22.0% | 100 |
| M3010 | 4 | 16 | 44.8 | 10.2 | 0 | 10 | 15 | 0 | 800 | 10.0% | 22.2% | 150 |
| M3011 | 4 | 16 | 44.2 | 10.2 | 0 | 10.6 | 15 | 0 | 800 | 9.9% | 22.3% | 150 |
| M3012 | 3 | 12 | 48.8 | 10.2 | 0 | 11 | 15 | 0 | 800 | 11.9% | 24.9% | 100 |
| M3013 | 4 | 16 | 43.6 | 10.2 | 0 | 11.2 | 15 | 0 | 800 | 9.8% | 22.3% | 200 |
| M3014 | 3 | 12 | 48.2 | 10.2 | 0 | 11.6 | 15 | 0 | 800 | 11.9% | 24.9% | 100 |
| M3015 | 4 | 16 | 43 | 10.2 | 0 | 11.8 | 15 | 0 | 800 | 9.8% | 22.3% | 200 |
| M3016 | 3 | 12 | 47.6 | 10.2 | 0 | 12.2 | 15 | 0 | 800 | 11.9% | 24.9% | 100 |
| M3017 | 4 | 16 | 42.4 | 10.2 | 0 | 12.4 | 15 | 0 | 750 | 9.7% | 22.4% | 150 |
| M3018 | 3 | 12 | 47 | 10.2 | 0 | 12.8 | 15 | 0 | 800 | 11.8% | 24.9% | 100 |
| M3019 | 4 | 16 | 41.8 | 10.2 | 0 | 13 | 15 | 0 | 750 | 9.7% | 22.4% | 150 |
| M3020 | 3 | 12 | 46.4 | 10.2 | 0 | 13.4 | 15 | 0 | 800 | 11.8% | 25.0% | 100 |
| M3021 | 4 | 16 | 41.2 | 10.2 | 0 | 13.6 | 15 | 0 | 750 | 9.6% | 22.5% | 150 |
| M3022 | 3 | 12 | 45.8 | 10.2 | 0 | 14 | 15 | 0 | 750 | 11.8% | 25.0% | 100 |
| M3023 | 4 | 16 | 54.6 | 10.4 | 0 | 0 | 15 | 0 | 850 | 11.1% | 21.8% | 50 |
| M3024 | 3 | 12 | 59.2 | 10.4 | 0 | 0.4 | 15 | 0 | 850 | 12.9% | 24.8% | 50 |
| M3025 | 4 | 16 | 54 | 10.4 | 0 | 0.6 | 15 | 0 | 800 | 11.2% | 21.8% | 100 |
| M3026 | 3 | 12 | 58.6 | 10.4 | 0 | 1 | 15 | 0 | 800 | 12.8% | 24.8% | 50 |
| M3027 | 4 | 16 | 53.4 | 10.4 | 0 | 1.2 | 15 | 0 | 800 | 11.1% | 21.9% | 100 |
| M3028 | 3 | 12 | 58 | 10.4 | 0 | 1.6 | 15 | 0 | 800 | 12.8% | 24.9% | 50 |
| M3029 | 4 | 16 | 52.8 | 10.4 | 0 | 1.8 | 15 | 0 | 800 | 11.0% | 21.9% | 100 |
| M3030 | 3 | 12 | 57.4 | 10.4 | 0 | 2.2 | 15 | 0 | 800 | 12.7% | 24.9% | 0 |
| M3031 | 4 | 16 | 52.2 | 10.4 | 0 | 2.4 | 15 | 0 | 800 | 10.9% | 21.9% | 100 |
| M3032 | 3 | 12 | 56.8 | 10.4 | 0 | 2.8 | 15 | 0 | 800 | 12.7% | 24.9% | 0 |
| M3033 | 4 | 16 | 51.6 | 10.4 | 0 | 3 | 15 | 0 | 800 | 10.9% | 21.9% | 100 |
| M3034 | 3 | 12 | 56.2 | 10.4 | 0 | 3.4 | 15 | 0 | 800 | 12.6% | 25.0% | 0 |
| M3035 | 4 | 16 | 51 | 10.4 | 0 | 3.6 | 15 | 0 | 800 | 10.8% | 22.0% | 100 |
| M3036 | 3 | 12 | 55.6 | 10.4 | 0 | 4 | 15 | 0 | 800 | 12.5% | 25.0% | 0 |
| M3037 | 4 | 16 | 50.4 | 10.4 | 0 | 4.2 | 15 | 0 | 800 | 10.7% | 22.0% | 100 |
| M3038 | 4 | 16 | 49.8 | 10.4 | 0 | 4.8 | 15 | 0 | 800 | 10.6% | 22.0% | 100 |
| M3039 | 4 | 16 | 44.8 | 10.4 | 0 | 9.8 | 15 | 0 | 800 | 10.0% | 22.2% | 150 |
| M3040 | 4 | 16 | 44.2 | 10.4 | 0 | 10.4 | 15 | 0 | 800 | 9.9% | 22.3% | 150 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3041 | 4 | 16 | 43.8 | 10.4 | 0 | 10.8 | 15 | 0 | 800 | 9.9% | 22.3% | 150 |
| M3042 | 3 | 12 | 48.4 | 10.4 | 0 | 11.2 | 15 | 0 | 800 | 11.9% | 24.9% | 100 |
| M3043 | 4 | 16 | 43.2 | 10.4 | 0 | 11.4 | 15 | 0 | 800 | 9.8% | 22.3% | 200 |
| M3044 | 3 | 12 | 47.8 | 10.4 | 0 | 11.8 | 15 | 0 | 800 | 11.9% | 24.9% | 100 |
| M3045 | 4 | 16 | 42.6 | 10.4 | 0 | 12 | 15 | 0 | 750 | 9.8% | 22.3% | 200 |
| M3046 | 3 | 12 | 47.2 | 10.4 | 0 | 12.4 | 15 | 0 | 800 | 11.8% | 24.9% | 100 |
| M3047 | 4 | 16 | 42 | 10.4 | 0 | 12.6 | 15 | 0 | 750 | 9.7% | 22.4% | 150 |
| M3048 | 3 | 12 | 46.6 | 10.4 | 0 | 13 | 15 | 0 | 800 | 11.8% | 24.9% | 100 |
| M3049 | 4 | 16 | 41.4 | 10.4 | 0 | 13.2 | 15 | 0 | 750 | 9.7% | 22.4% | 150 |
| M3050 | 3 | 12 | 46 | 10.4 | 0 | 13.6 | 15 | 0 | 750 | 11.8% | 25.0% | 100 |
| M3051 | 4 | 16 | 40.8 | 10.4 | 0 | 13.8 | 15 | 0 | 750 | 9.6% | 22.5% | 150 |
| M3052 | 2.2 | 8.6 | 67.4 | 10.6 | 0.8 | 0 | 10.4 | 0 | 850 | 9.0% | 18.5% | −50 |
| M3053 | 4 | 16 | 54.4 | 10.6 | 0 | 0 | 15 | 0 | 850 | 11.1% | 21.8% | 50 |
| M3054 | 3 | 12 | 59 | 10.6 | 0 | 0.4 | 15 | 0 | 800 | 12.9% | 24.8% | 50 |
| M3055 | 4 | 16 | 53.8 | 10.6 | 0 | 0.6 | 15 | 0 | 800 | 11.3% | 21.8% | 100 |
| M3056 | 3 | 12 | 58.4 | 10.6 | 0 | 1 | 15 | 0 | 800 | 12.8% | 24.8% | 50 |
| M3057 | 4 | 16 | 53.2 | 10.6 | 0 | 1.2 | 15 | 0 | 800 | 11.2% | 21.9% | 100 |
| M3058 | 3 | 12 | 57.8 | 10.6 | 0 | 1.6 | 15 | 0 | 800 | 12.8% | 24.9% | 50 |
| M3059 | 4 | 16 | 52.6 | 10.6 | 0 | 1.8 | 15 | 0 | 800 | 11.1% | 21.9% | 100 |
| M3060 | 3 | 12 | 57.2 | 10.6 | 0 | 2.2 | 15 | 0 | 800 | 12.7% | 24.9% | 0 |
| M3061 | 4 | 16 | 52 | 10.6 | 0 | 2.4 | 15 | 0 | 800 | 11.0% | 21.9% | 100 |
| M3062 | 3 | 12 | 56.6 | 10.6 | 0 | 2.8 | 15 | 0 | 800 | 12.7% | 24.9% | 0 |
| M3063 | 4 | 16 | 51.4 | 10.6 | 0 | 3 | 15 | 0 | 800 | 10.9% | 21.9% | 100 |
| M3064 | 3 | 12 | 56 | 10.6 | 0 | 3.4 | 15 | 0 | 800 | 12.6% | 25.0% | 0 |
| M3065 | 4 | 16 | 50.8 | 10.6 | 0 | 3.6 | 15 | 0 | 800 | 10.8% | 21.9% | 100 |
| M3066 | 3 | 12 | 55.4 | 10.6 | 0 | 4 | 15 | 0 | 800 | 12.5% | 25.0% | 0 |
| M3067 | 4 | 16 | 50.2 | 10.6 | 0 | 4.2 | 15 | 0 | 800 | 10.7% | 22.0% | 100 |
| M3068 | 4 | 16 | 49.6 | 10.6 | 0 | 4.8 | 15 | 0 | 800 | 10.6% | 22.0% | 100 |
| M3069 | 4 | 16 | 44.6 | 10.6 | 0 | 9.8 | 15 | 0 | 800 | 10.0% | 22.2% | 150 |
| M3070 | 4 | 16 | 44 | 10.6 | 0 | 10.4 | 15 | 0 | 800 | 9.9% | 22.2% | 150 |
| M3071 | 4 | 16 | 43.6 | 10.6 | 0 | 10.8 | 15 | 0 | 800 | 9.9% | 22.3% | 150 |
| M3072 | 3 | 12 | 48.2 | 10.6 | 0 | 11.2 | 15 | 0 | 800 | 11.9% | 25.0% | 100 |
| M3073 | 4 | 16 | 43 | 10.6 | 0 | 11.4 | 15 | 0 | 800 | 9.8% | 22.3% | 200 |
| M3074 | 3 | 12 | 47.6 | 10.6 | 0 | 11.8 | 15 | 0 | 800 | 11.9% | 24.9% | 100 |
| M3075 | 4 | 16 | 42.4 | 10.6 | 0 | 12 | 15 | 0 | 750 | 9.8% | 22.3% | 200 |
| M3076 | 3 | 12 | 47 | 10.6 | 0 | 12.4 | 15 | 0 | 800 | 11.8% | 24.9% | 100 |
| M3077 | 4 | 16 | 41.8 | 10.6 | 0 | 12.6 | 15 | 0 | 750 | 9.7% | 22.4% | 150 |
| M3078 | 3 | 12 | 46.4 | 10.6 | 0 | 13 | 15 | 0 | 800 | 11.8% | 24.9% | 100 |
| M3079 | 4 | 16 | 41.2 | 10.6 | 0 | 13.2 | 15 | 0 | 750 | 9.7% | 22.4% | 150 |
| M3080 | 3 | 12 | 45.8 | 10.6 | 0 | 13.6 | 15 | 0 | 750 | 11.8% | 24.9% | 100 |
| M3081 | 4 | 16 | 40.6 | 10.6 | 0 | 13.8 | 15 | 0 | 750 | 9.6% | 22.4% | 150 |
| M3082 | 3 | 12 | 59.2 | 10.8 | 0 | 0 | 15 | 0 | 850 | 12.9% | 24.8% | 50 |
| M3083 | 4 | 16 | 54 | 10.8 | 0 | 0.2 | 15 | 0 | 800 | 11.1% | 21.8% | 50 |
| M3084 | 3 | 12 | 58.6 | 10.8 | 0 | 0.6 | 15 | 0 | 800 | 12.8% | 24.8% | 50 |
| M3085 | 4 | 16 | 53.4 | 10.8 | 0 | 0.8 | 15 | 0 | 800 | 11.2% | 21.8% | 100 |
| M3086 | 3 | 12 | 58 | 10.8 | 0 | 1.2 | 15 | 0 | 800 | 12.8% | 24.8% | 50 |
| M3087 | 4 | 16 | 52.8 | 10.8 | 0 | 1.4 | 15 | 0 | 800 | 11.1% | 21.9% | 100 |
| M3088 | 3 | 12 | 57.4 | 10.8 | 0 | 1.8 | 15 | 0 | 800 | 12.8% | 24.9% | 50 |
| M3089 | 4 | 16 | 52.2 | 10.8 | 0 | 2 | 15 | 0 | 800 | 11.0% | 21.9% | 100 |
| M3090 | 3 | 12 | 56.8 | 10.8 | 0 | 2.4 | 15 | 0 | 800 | 12.7% | 24.9% | 0 |
| M3091 | 4 | 16 | 51.6 | 10.8 | 0 | 2.6 | 15 | 0 | 800 | 10.9% | 21.9% | 100 |
| M3092 | 3 | 12 | 56.2 | 10.8 | 0 | 3 | 15 | 0 | 800 | 12.6% | 24.9% | 0 |
| M3093 | 4 | 16 | 51 | 10.8 | 0 | 3.2 | 15 | 0 | 800 | 10.8% | 21.9% | 100 |
| M3094 | 3 | 12 | 55.6 | 10.8 | 0 | 3.6 | 15 | 0 | 800 | 12.6% | 25.0% | 0 |
| M3095 | 4 | 16 | 50.4 | 10.8 | 0 | 3.8 | 15 | 0 | 800 | 10.7% | 21.9% | 100 |
| M3096 | 4 | 16 | 50 | 10.8 | 0 | 4.2 | 15 | 0 | 800 | 10.7% | 22.0% | 100 |
| M3097 | 4 | 16 | 49.4 | 10.8 | 0 | 4.8 | 15 | 0 | 800 | 10.6% | 22.0% | 100 |
| M3098 | 4 | 16 | 44 | 10.8 | 0 | 10.2 | 15 | 0 | 800 | 9.9% | 22.2% | 150 |
| M3099 | 4 | 16 | 43.4 | 10.8 | 0 | 10.8 | 15 | 0 | 800 | 9.9% | 22.3% | 150 |
| M3100 | 3 | 12 | 48 | 10.8 | 0 | 11.2 | 15 | 0 | 800 | 11.9% | 25.0% | 100 |
| M3101 | 4 | 16 | 42.8 | 10.8 | 0 | 11.4 | 15 | 0 | 750 | 9.8% | 22.3% | 200 |
| M3102 | 3 | 12 | 47.4 | 10.8 | 0 | 11.8 | 15 | 0 | 800 | 11.9% | 24.9% | 100 |
| M3103 | 4 | 16 | 42.2 | 10.8 | 0 | 12 | 15 | 0 | 750 | 9.7% | 22.3% | 200 |
| M3104 | 3 | 12 | 46.8 | 10.8 | 0 | 12.4 | 15 | 0 | 800 | 11.8% | 24.9% | 100 |
| M3105 | 4 | 16 | 41.6 | 10.8 | 0 | 12.6 | 15 | 0 | 750 | 9.7% | 22.4% | 150 |
| M3106 | 3 | 12 | 46.2 | 10.8 | 0 | 13 | 15 | 0 | 750 | 11.8% | 24.9% | 100 |
| M3107 | 4 | 16 | 41 | 10.8 | 0 | 13.2 | 15 | 0 | 750 | 9.6% | 22.4% | 150 |
| M3108 | 3 | 12 | 45.6 | 10.8 | 0 | 13.6 | 15 | 0 | 750 | 11.8% | 24.9% | 100 |
| M3109 | 4 | 16 | 40.4 | 10.8 | 0 | 13.8 | 15 | 0 | 750 | 9.6% | 22.4% | 150 |
| M3110 | 3.75 | 7 | 58.25 | 11 | 0 | 0 | 20 | 0 | 800 | 8.0% | 32.8% | 200 |
| M3111 | 4 | 8 | 57 | 11 | 0 | 0 | 20 | 0 | 800 | 9.0% | 34.0% | 200 |
| M3112 | 2 | 10 | 67 | 11 | 0 | 0 | 10 | 0 | 850 | 10.5% | 16.8% | −50 |
| M3113 | 2 | 10 | 66.5 | 11 | 0 | 0 | 10.5 | 0 | 850 | 10.5% | 17.2% | −50 |
| M3114 | 2.5 | 10 | 65.5 | 11 | 0 | 0 | 11 | 0 | 850 | 10.3% | 19.0% | −50 |
| M3115 | 3 | 10 | 64.5 | 11 | 0 | 0 | 11.5 | 0 | 850 | 8.9% | 19.8% | −50 |
| M3116 | 4 | 10 | 55 | 11 | 0 | 0 | 20 | 0 | 800 | 11.3% | 34.0% | 200 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M3117 | 3 | 10.2 | 65.8 | 11 | 0 | 0 | 10 | 0 | 850 | 8.0% | 16.9% | 0 |
| M3118 | 2.5 | 10.2 | 65.3 | 11 | 0 | 0 | 11 | 0 | 850 | 10.5% | 18.9% | −50 |
| M3119 | 3 | 10.2 | 64.3 | 11 | 0 | 0 | 11.5 | 0 | 850 | 9.0% | 19.7% | −50 |
| M3120 | 2 | 10.4 | 66.6 | 11 | 0 | 0 | 10 | 0 | 850 | 10.9% | 16.8% | −50 |
| M3121 | 2.5 | 10.4 | 65.6 | 11 | 0 | 0 | 10.5 | 0 | 850 | 10.2% | 17.8% | −50 |
| M3122 | 3 | 10.4 | 64.6 | 11 | 0 | 0 | 11 | 0 | 850 | 8.8% | 18.7% | 0 |
| M3123 | 2.5 | 10.4 | 64.1 | 11 | 0 | 0 | 12 | 0 | 800 | 11.0% | 20.7% | −50 |
| M3124 | 2.5 | 10.6 | 65.9 | 11 | 0 | 0 | 10 | 0 | 850 | 9.9% | 16.7% | −50 |
| M3125 | 3 | 10.6 | 64.9 | 11 | 0 | 0 | 10.5 | 0 | 850 | 8.5% | 17.6% | 0 |
| M3126 | 2.5 | 10.6 | 64.4 | 11 | 0 | 0 | 11.5 | 0 | 800 | 11.1% | 19.6% | −50 |
| M3127 | 3 | 10.6 | 63.4 | 11 | 0 | 0 | 12 | 0 | 850 | 9.6% | 20.4% | −50 |
| M3128 | 2.5 | 10.8 | 65.7 | 11 | 0 | 0 | 10 | 0 | 850 | 10.0% | 16.6% | −50 |
| M3129 | 3 | 10.8 | 64.7 | 11 | 0 | 0 | 10.5 | 0 | 850 | 8.6% | 17.5% | 0 |
| M3130 | 3.5 | 10.8 | 63.7 | 11 | 0 | 0 | 11 | 0 | 850 | 7.0% | 18.5% | 50 |
| M3131 | 2.5 | 10.8 | 63.7 | 11 | 0 | 0 | 12 | 0 | 800 | 11.5% | 20.4% | −50 |
| M3132 | 3 | 10.8 | 62.2 | 11 | 0 | 0 | 13 | 0 | 800 | 10.5% | 22.1% | −50 |
| M3133 | 3 | 11 | 66 | 11 | 0 | 0 | 9 | 0 | 850 | 7.7% | 14.5% | −50 |
| M3134 | 3 | 11 | 65 | 11 | 0 | 0 | 10 | 0 | 850 | 8.4% | 16.4% | −50 |
| M3135 | 2.5 | 11 | 64.5 | 11 | 0 | 0 | 11 | 0 | 800 | 10.9% | 18.4% | −50 |
| M3136 | 2.5 | 11 | 64 | 11 | 0 | 0 | 11.5 | 0 | 800 | 11.3% | 19.4% | −50 |
| M3137 | 3 | 11 | 63 | 11 | 0 | 0 | 12 | 0 | 850 | 9.9% | 20.1% | 0 |
| M3138 | 3.5 | 11 | 61.5 | 11 | 0 | 0 | 13 | 0 | 850 | 8.9% | 21.9% | 50 |
| M3139 | 2.5 | 11.2 | 65.3 | 11 | 0 | 0 | 10 | 0 | 850 | 10.2% | 16.3% | −50 |
| M3140 | 3 | 11.2 | 64.3 | 11 | 0 | 0 | 10.5 | 0 | 850 | 8.8% | 17.2% | 0 |
| M3141 | 3.5 | 11.2 | 63.3 | 11 | 0 | 0 | 11 | 0 | 850 | 7.2% | 18.2% | 50 |
| M3142 | 2.5 | 11.2 | 63.3 | 11 | 0 | 0 | 12 | 0 | 800 | 11.8% | 20.2% | −50 |
| M3143 | 3 | 11.2 | 61.8 | 11 | 0 | 0 | 13 | 0 | 800 | 10.8% | 21.8% | 0 |
| M3144 | 2.5 | 11.4 | 65.1 | 11 | 0 | 0 | 10 | 0 | 850 | 10.3% | 16.2% | −50 |
| M3145 | 3 | 11.4 | 64.1 | 11 | 0 | 0 | 10.5 | 0 | 850 | 8.9% | 17.1% | 0 |
| M3146 | 3.5 | 11.4 | 63.1 | 11 | 0 | 0 | 11 | 0 | 850 | 7.3% | 18.1% | 0 |
| M3147 | 2.5 | 11.4 | 63.1 | 11 | 0 | 0 | 12 | 0 | 800 | 11.9% | 20.2% | −50 |
| M3148 | 3 | 11.4 | 61.6 | 11 | 0 | 0 | 13 | 0 | 800 | 10.9% | 21.7% | 0 |
| M3149 | 2.5 | 11.6 | 64.9 | 11 | 0 | 0 | 10 | 0 | 850 | 10.4% | 16.1% | −50 |
| M3150 | 3 | 11.6 | 63.9 | 11 | 0 | 0 | 10.5 | 0 | 850 | 9.1% | 16.9% | 0 |
| M3151 | 3.5 | 11.6 | 62.9 | 11 | 0 | 0 | 11 | 0 | 850 | 7.4% | 18.0% | 0 |
| M3152 | 2.5 | 11.6 | 62.9 | 11 | 0 | 0 | 12 | 0 | 800 | 12.0% | 20.1% | −50 |
| M3153 | 3 | 11.6 | 61.4 | 11 | 0 | 0 | 13 | 0 | 800 | 11.0% | 21.5% | 0 |
| M3154 | 2.5 | 11.8 | 64.7 | 11 | 0 | 0 | 10 | 0 | 850 | 10.6% | 16.0% | −50 |
| M3155 | 3 | 11.8 | 63.7 | 11 | 0 | 0 | 10.5 | 0 | 850 | 9.2% | 16.8% | −50 |
| M3156 | 3.5 | 11.8 | 62.7 | 11 | 0 | 0 | 11 | 0 | 850 | 7.9% | 17.8% | 0 |
| M3157 | 2.5 | 11.8 | 62.7 | 11 | 0 | 0 | 12 | 0 | 800 | 12.1% | 20.0% | −50 |
| M3158 | 3 | 11.8 | 61.2 | 11 | 0 | 0 | 13 | 0 | 800 | 11.1% | 21.4% | 0 |
| M3159 | 2.5 | 12 | 64.5 | 11 | 0 | 0 | 10 | 0 | 850 | 10.7% | 15.8% | −50 |
| M3160 | 3 | 12 | 62 | 11 | 2 | 0 | 10 | 0 | 800 | 8.9% | 16.5% | 0 |
| M3161 | 3 | 12 | 59 | 11 | 5 | 0 | 10 | 0 | 800 | 9.2% | 13.7% | 0 |
| M3162 | 3.5 | 12 | 60.5 | 11 | 3 | 0 | 10 | 0 | 800 | 7.4% | 17.0% | 50 |
| M3163 | 2.5 | 12 | 64 | 11 | 0 | 0 | 10.5 | 0 | 850 | 11.1% | 16.8% | −50 |
| M3164 | 3 | 12 | 63 | 11 | 0 | 0 | 11 | 0 | 850 | 9.6% | 17.6% | 0 |
| M3165 | 3 | 12 | 60 | 11 | 3 | 0 | 11 | 0 | 800 | 9.9% | 18.6% | 0 |
| M3166 | 3.5 | 12 | 62.5 | 11 | 0 | 0 | 11 | 0 | 850 | 8.0% | 17.7% | 0 |
| M3167 | 3.5 | 12 | 59.5 | 11 | 3 | 0 | 11 | 0 | 800 | 8.1% | 18.8% | 50 |
| M3168 | 2.5 | 12 | 63 | 11 | 0 | 0 | 11.5 | 0 | 800 | 11.8% | 18.7% | −50 |
| M3169 | 3 | 12 | 62 | 11 | 0 | 0 | 12 | 0 | 850 | 10.4% | 19.4% | 0 |
| M3170 | 3 | 12 | 59 | 11 | 3 | 0 | 12 | 0 | 800 | 10.7% | 19.8% | 0 |
| M3171 | 3.5 | 12 | 61.5 | 11 | 0 | 0 | 12 | 0 | 850 | 8.7% | 19.5% | 50 |
| M3172 | 3.5 | 12 | 58.5 | 11 | 3 | 0 | 12 | 0 | 800 | 8.9% | 20.6% | 50 |
| M3173 | 4 | 12 | 59 | 11 | 2 | 0 | 12 | 0 | 850 | 7.1% | 20.4% | 100 |
| M3174 | 4 | 12 | 56 | 11 | 5 | 0 | 12 | 0 | 800 | 7.6% | 20.6% | 150 |
| M3175 | 3 | 12 | 59 | 11 | 2 | 0 | 13 | 0 | 800 | 11.4% | 22.1% | 0 |
| M3176 | 3 | 12 | 56 | 11 | 5 | 0 | 13 | 0 | 800 | 11.4% | 16.1% | 50 |
| M3177 | 3.5 | 12 | 58.5 | 11 | 2 | 0 | 13 | 0 | 800 | 9.5% | 22.0% | 50 |
| M3178 | 3.5 | 12 | 55.5 | 11 | 5 | 0 | 13 | 0 | 800 | 9.8% | 19.3% | 100 |
| M3179 | 4 | 12 | 58 | 11 | 2 | 0 | 13 | 0 | 800 | 7.8% | 22.2% | 100 |
| M3180 | 4 | 12 | 55 | 11 | 5 | 0 | 13 | 0 | 800 | 8.3% | 21.8% | 150 |
| M3181 | 3 | 12 | 58 | 11 | 2 | 0 | 14 | 0 | 800 | 12.4% | 24.1% | 50 |
| M3182 | 3 | 12 | 55 | 11 | 5 | 0 | 14 | 0 | 800 | 12.2% | 17.0% | 50 |
| M3183 | 3.5 | 12 | 57.5 | 11 | 2 | 0 | 14 | 0 | 800 | 10.3% | 23.8% | 100 |
| M3184 | 3.5 | 12 | 54.5 | 11 | 5 | 0 | 14 | 0 | 800 | 10.6% | 20.0% | 100 |
| M3185 | 4 | 12 | 57 | 11 | 2 | 0 | 14 | 0 | 800 | 8.5% | 23.9% | 150 |
| M3186 | 4 | 12 | 54 | 11 | 5 | 0 | 14 | 0 | 800 | 9.0% | 22.8% | 150 |
| M3187 | 3.5 | 12 | 58.5 | 11 | 0 | 0 | 15 | 0 | 800 | 10.8% | 24.7% | 50 |
| M3188 | 3.5 | 12 | 55.5 | 11 | 3 | 0 | 15 | 0 | 800 | 11.4% | 25.0% | 100 |
| M3189 | 4 | 12 | 58 | 11 | 0 | 0 | 15 | 0 | 850 | 9.1% | 24.7% | 100 |
| M3190 | 4 | 12 | 55 | 11 | 3 | 0 | 15 | 0 | 800 | 9.4% | 26.0% | 150 |
| M3191 | 2.5 | 12.2 | 64.3 | 11 | 0 | 0 | 10 | 0 | 850 | 10.8% | 15.7% | −50 |
| M3192 | 3 | 12.2 | 63.3 | 11 | 0 | 0 | 10.5 | 0 | 850 | 9.4% | 16.6% | −50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3193 | 2.5 | 12.2 | 62.8 | 11 | 0 | 0 | 11.5 | 0 | 800 | 11.9% | 18.7% | −50 |
| M3194 | 3 | 12.2 | 61.8 | 11 | 0 | 0 | 12 | 0 | 850 | 10.5% | 19.3% | 0 |
| M3195 | 2.5 | 12.4 | 63.6 | 11 | 0 | 0 | 10.5 | 0 | 800 | 11.3% | 16.5% | −50 |
| M3196 | 3 | 12.4 | 62.6 | 11 | 0 | 0 | 11 | 0 | 850 | 9.9% | 17.3% | 0 |
| M3197 | 2.5 | 12.4 | 62.1 | 11 | 0 | 0 | 12 | 0 | 850 | 12.5% | 19.6% | −50 |
| M3198 | 3 | 12.6 | 63.4 | 11 | 0 | 0 | 10 | 0 | 850 | 9.2% | 15.4% | −50 |
| M3199 | 2.5 | 12.6 | 62.9 | 11 | 0 | 0 | 11 | 0 | 800 | 11.7% | 17.4% | −50 |
| M3200 | 3 | 12.6 | 61.9 | 11 | 0 | 0 | 11.5 | 0 | 850 | 10.4% | 18.1% | 0 |
| M3201 | 2.5 | 12.8 | 63.7 | 11 | 0 | 0 | 10 | 0 | 850 | 11.1% | 15.3% | −50 |
| M3202 | 3 | 12.8 | 62.7 | 11 | 0 | 0 | 10.5 | 0 | 850 | 9.7% | 16.2% | −50 |
| M3203 | 2.5 | 12.8 | 62.2 | 11 | 0 | 0 | 11.5 | 0 | 800 | 12.3% | 18.7% | −50 |
| M3204 | 3 | 12.8 | 61.2 | 11 | 0 | 0 | 12 | 0 | 800 | 10.9% | 18.9% | 0 |
| M3205 | 3 | 13 | 62 | 11 | 1 | 0 | 10 | 0 | 850 | 9.6% | 15.4% | −50 |
| M3206 | 3 | 13 | 59 | 11 | 4 | 0 | 10 | 0 | 800 | 9.7% | 14.3% | 0 |
| M3207 | 3.5 | 13 | 61.5 | 11 | 1 | 0 | 10 | 0 | 850 | 7.6% | 15.6% | 0 |
| M3208 | 3.5 | 13 | 58.5 | 11 | 4 | 0 | 10 | 0 | 800 | 8.1% | 16.3% | 50 |
| M3209 | 3 | 13 | 62.5 | 11 | 0 | 0 | 10.5 | 0 | 850 | 9.8% | 16.0% | −50 |
| M3210 | 3 | 13 | 61 | 11 | 1 | 0 | 11 | 0 | 800 | 10.4% | 17.3% | 0 |
| M3211 | 3 | 13 | 58 | 11 | 4 | 0 | 11 | 0 | 800 | 10.5% | 15.4% | 0 |
| M3212 | 3.5 | 13 | 60.5 | 11 | 1 | 0 | 11 | 0 | 850 | 8.3% | 17.4% | 0 |
| M3213 | 3.5 | 13 | 57.5 | 11 | 4 | 0 | 11 | 0 | 800 | 8.8% | 17.6% | 50 |
| M3214 | 4 | 13 | 57 | 11 | 4 | 0 | 11 | 0 | 800 | 7.3% | 18.7% | 100 |
| M3215 | 3 | 13 | 61.5 | 11 | 0 | 0 | 11.5 | 0 | 850 | 10.6% | 17.8% | 0 |
| M3216 | 3 | 13 | 60 | 11 | 1 | 0 | 12 | 0 | 800 | 10.9% | 19.1% | 0 |
| M3217 | 3 | 13 | 57 | 11 | 4 | 0 | 12 | 0 | 800 | 11.2% | 16.2% | 0 |
| M3218 | 3.5 | 13 | 59.5 | 11 | 1 | 0 | 12 | 0 | 850 | 9.0% | 19.1% | 50 |
| M3219 | 3.5 | 13 | 56.5 | 11 | 4 | 0 | 12 | 0 | 800 | 9.6% | 18.8% | 50 |
| M3220 | 4 | 13 | 59 | 11 | 1 | 0 | 12 | 0 | 850 | 7.4% | 19.3% | 50 |
| M3221 | 4 | 13 | 56 | 11 | 4 | 0 | 12 | 0 | 800 | 7.9% | 20.5% | 100 |
| M3222 | 3 | 13 | 59 | 11 | 1 | 0 | 13 | 0 | 800 | 11.9% | 21.2% | 0 |
| M3223 | 3 | 13 | 56 | 11 | 4 | 0 | 13 | 0 | 800 | 12.0% | 18.4% | 50 |
| M3224 | 3.5 | 13 | 58.5 | 11 | 1 | 0 | 13 | 0 | 800 | 9.8% | 20.9% | 50 |
| M3225 | 3.5 | 13 | 55.5 | 11 | 4 | 0 | 13 | 0 | 800 | 10.3% | 19.8% | 100 |
| M3226 | 4 | 13 | 58 | 11 | 1 | 0 | 13 | 0 | 850 | 8.1% | 21.1% | 100 |
| M3227 | 4 | 13 | 55 | 11 | 4 | 0 | 13 | 0 | 800 | 8.6% | 22.0% | 150 |
| M3228 | 3 | 13 | 58 | 11 | 1 | 0 | 14 | 0 | 800 | 12.8% | 23.1% | 0 |
| M3229 | 3.5 | 13 | 56.5 | 11 | 2 | 0 | 14 | 0 | 800 | 10.9% | 23.0% | 50 |
| M3230 | 3.5 | 13 | 53.5 | 11 | 5 | 0 | 14 | 0 | 800 | 11.0% | 18.4% | 100 |
| M3231 | 4 | 13 | 56 | 11 | 2 | 0 | 14 | 0 | 800 | 9.0% | 23.1% | 100 |
| M3232 | 4 | 13 | 53 | 11 | 5 | 0 | 14 | 0 | 800 | 9.5% | 21.4% | 150 |
| M3233 | 3.5 | 13 | 55.5 | 11 | 2 | 0 | 15 | 0 | 800 | 11.8% | 25.1% | 100 |
| M3234 | 3.5 | 13 | 52.5 | 11 | 5 | 0 | 15 | 0 | 800 | 11.8% | 19.5% | 100 |
| M3235 | 4 | 13 | 55 | 11 | 2 | 0 | 15 | 0 | 800 | 9.8% | 24.8% | 150 |
| M3236 | 4 | 13 | 52 | 11 | 5 | 0 | 15 | 0 | 800 | 10.2% | 22.1% | 150 |
| M3237 | 2.5 | 13.2 | 62.8 | 11 | 0 | 0 | 10.5 | 0 | 800 | 11.6% | 16.0% | −50 |
| M3238 | 3 | 13.2 | 61.8 | 11 | 0 | 0 | 11 | 0 | 850 | 10.3% | 16.8% | −50 |
| M3239 | 2.5 | 13.2 | 61.3 | 11 | 0 | 0 | 12 | 0 | 850 | 13.0% | 19.1% | −50 |
| M3240 | 3 | 13.4 | 62.6 | 11 | 0 | 0 | 10 | 0 | 850 | 9.6% | 14.8% | −50 |
| M3241 | 2.5 | 13.4 | 62.1 | 11 | 0 | 0 | 11 | 0 | 800 | 12.2% | 17.4% | −50 |
| M3242 | 3 | 13.4 | 61.1 | 11 | 0 | 0 | 11.5 | 0 | 850 | 10.8% | 17.6% | −50 |
| M3243 | 2.5 | 13.6 | 62.9 | 11 | 0 | 0 | 10 | 0 | 800 | 11.6% | 14.8% | −50 |
| M3244 | 3 | 13.6 | 61.9 | 11 | 0 | 0 | 10.5 | 0 | 850 | 10.1% | 15.6% | −50 |
| M3245 | 2.5 | 13.6 | 61.4 | 11 | 0 | 0 | 11.5 | 0 | 850 | 12.8% | 18.1% | −50 |
| M3246 | 2.5 | 13.8 | 62.7 | 11 | 0 | 0 | 10 | 0 | 800 | 11.5% | 14.7% | −50 |
| M3247 | 3 | 13.8 | 61.7 | 11 | 0 | 0 | 10.5 | 0 | 850 | 10.2% | 15.5% | −50 |
| M3248 | 2.5 | 13.8 | 61.2 | 11 | 0 | 0 | 11.5 | 0 | 850 | 12.9% | 18.0% | −50 |
| M3249 | 2.5 | 14 | 62.5 | 11 | 0 | 0 | 10 | 0 | 800 | 11.6% | 14.5% | −50 |
| M3250 | 3 | 14 | 60 | 11 | 2 | 0 | 10 | 0 | 800 | 10.0% | 15.1% | −50 |
| M3251 | 3 | 14 | 57 | 11 | 5 | 0 | 10 | 0 | 800 | 10.2% | 10.9% | 0 |
| M3252 | 3.5 | 14 | 59.5 | 11 | 2 | 0 | 10 | 0 | 850 | 8.3% | 15.2% | 0 |
| M3253 | 3.5 | 14 | 56.5 | 11 | 5 | 0 | 10 | 0 | 800 | 8.6% | 13.5% | 50 |
| M3254 | 2.5 | 14 | 62 | 11 | 0 | 0 | 10.5 | 0 | 800 | 12.1% | 15.9% | −50 |
| M3255 | 3 | 14 | 61 | 11 | 0 | 0 | 11 | 0 | 850 | 10.7% | 16.3% | −50 |
| M3256 | 3 | 14 | 58 | 11 | 3 | 0 | 11 | 0 | 800 | 11.0% | 16.2% | 0 |
| M3257 | 3.5 | 14 | 60.5 | 11 | 0 | 0 | 11 | 0 | 850 | 9.0% | 16.3% | 0 |
| M3258 | 3.5 | 14 | 57.5 | 11 | 3 | 0 | 11 | 0 | 800 | 9.2% | 17.3% | 50 |
| M3259 | 4 | 14 | 60 | 11 | 0 | 0 | 11 | 0 | 850 | 7.1% | 16.5% | 50 |
| M3260 | 4 | 14 | 57 | 11 | 3 | 0 | 11 | 0 | 800 | 7.6% | 17.6% | 50 |
| M3261 | 2.5 | 14 | 61 | 11 | 0 | 0 | 11.5 | 0 | 850 | 13.1% | 17.9% | −50 |
| M3262 | 3 | 14 | 59 | 11 | 1 | 0 | 12 | 0 | 800 | 11.5% | 18.4% | 0 |
| M3263 | 3 | 14 | 56 | 11 | 4 | 0 | 12 | 0 | 800 | 11.7% | 15.1% | 0 |
| M3264 | 3.5 | 14 | 58.5 | 11 | 1 | 0 | 12 | 0 | 800 | 9.6% | 18.4% | 0 |
| M3265 | 3.5 | 14 | 55.5 | 11 | 4 | 0 | 12 | 0 | 800 | 10.1% | 17.4% | 50 |
| M3266 | 4 | 14 | 58 | 11 | 1 | 0 | 12 | 0 | 850 | 7.9% | 18.6% | 50 |
| M3267 | 4 | 14 | 55 | 11 | 4 | 0 | 12 | 0 | 800 | 8.4% | 19.6% | 100 |
| M3268 | 3 | 14 | 58 | 11 | 1 | 0 | 13 | 0 | 800 | 12.5% | 21.2% | 0 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M3269 | 3 | 14 | 54 | 11 | 5 | 0 | 13 | 0 | 800 | 12.3% | 14.5% | 50 |
| M3270 | 3.5 | 14 | 56.5 | 11 | 2 | 0 | 13 | 0 | 800 | 10.6% | 20.5% | 50 |
| M3271 | 3.5 | 14 | 53.5 | 11 | 5 | 0 | 13 | 0 | 800 | 10.8% | 16.2% | 100 |
| M3272 | 4 | 14 | 56 | 11 | 2 | 0 | 13 | 0 | 800 | 8.8% | 20.7% | 100 |
| M3273 | 4 | 14 | 53 | 11 | 5 | 0 | 13 | 0 | 800 | 9.2% | 19.1% | 150 |
| M3274 | 3.5 | 14 | 55.5 | 11 | 2 | 0 | 14 | 0 | 800 | 11.5% | 22.3% | 50 |
| M3275 | 3.5 | 14 | 52.5 | 11 | 5 | 0 | 14 | 0 | 800 | 11.5% | 16.7% | 100 |
| M3276 | 4 | 14 | 55 | 11 | 2 | 0 | 14 | 0 | 800 | 9.6% | 22.4% | 100 |
| M3277 | 4 | 14 | 52 | 11 | 5 | 0 | 14 | 0 | 750 | 9.9% | 19.9% | 150 |
| M3278 | 3.5 | 14 | 54.5 | 11 | 2 | 0 | 15 | 0 | 800 | 12.4% | 25.2% | 50 |
| M3279 | 3.5 | 14 | 51.5 | 11 | 5 | 0 | 15 | 0 | 800 | 12.2% | 19.2% | 100 |
| M3280 | 4 | 14 | 54 | 11 | 2 | 0 | 15 | 0 | 800 | 10.4% | 24.0% | 100 |
| M3281 | 4 | 14 | 51 | 11 | 5 | 0 | 15 | 0 | 750 | 10.7% | 20.6% | 150 |
| M3282 | 3 | 15 | 59 | 11 | 2 | 0 | 10 | 0 | 800 | 10.6% | 14.4% | −50 |
| M3283 | 3 | 15 | 56 | 11 | 5 | 0 | 10 | 0 | 800 | 10.6% | 9.5% | 0 |
| M3284 | 3.5 | 15 | 58.5 | 11 | 2 | 0 | 10 | 0 | 850 | 8.8% | 14.5% | 0 |
| M3285 | 3.5 | 15 | 55.5 | 11 | 5 | 0 | 10 | 0 | 800 | 9.1% | 12.2% | 50 |
| M3286 | 4 | 15 | 57 | 11 | 3 | 0 | 10 | 0 | 850 | 7.4% | 15.0% | 50 |
| M3287 | 3 | 15 | 60 | 11 | 0 | 0 | 11 | 0 | 850 | 11.1% | 15.6% | −50 |
| M3288 | 3 | 15 | 57 | 11 | 3 | 0 | 11 | 0 | 800 | 11.6% | 14.8% | 0 |
| M3289 | 3.5 | 15 | 59.5 | 11 | 0 | 0 | 11 | 0 | 850 | 9.5% | 15.6% | 0 |
| M3290 | 3.5 | 15 | 56.5 | 11 | 3 | 0 | 11 | 0 | 800 | 9.7% | 16.6% | 0 |
| M3291 | 4 | 15 | 59 | 11 | 0 | 0 | 11 | 0 | 850 | 7.6% | 15.9% | 0 |
| M3292 | 4 | 15 | 56 | 11 | 3 | 0 | 11 | 0 | 800 | 8.1% | 16.8% | 50 |
| M3293 | 3 | 15 | 59 | 11 | 0 | 0 | 12 | 0 | 800 | 12.0% | 17.6% | −50 |
| M3294 | 3 | 15 | 56 | 11 | 3 | 0 | 12 | 0 | 800 | 12.4% | 18.0% | 0 |
| M3295 | 3.5 | 15 | 58.5 | 11 | 0 | 0 | 12 | 0 | 850 | 10.3% | 17.4% | 0 |
| M3296 | 3.5 | 15 | 55.5 | 11 | 3 | 0 | 12 | 0 | 800 | 10.5% | 18.1% | 50 |
| M3297 | 4 | 15 | 58 | 11 | 0 | 0 | 12 | 0 | 850 | 8.6% | 17.6% | 50 |
| M3298 | 4 | 15 | 55 | 11 | 3 | 0 | 12 | 0 | 800 | 8.8% | 18.6% | 100 |
| M3299 | 3 | 15 | 58 | 11 | 0 | 0 | 13 | 0 | 800 | 12.9% | 20.2% | 0 |
| M3300 | 3.5 | 15 | 55.5 | 11 | 2 | 0 | 13 | 0 | 800 | 11.2% | 19.8% | 50 |
| M3301 | 3.5 | 15 | 52.5 | 11 | 5 | 0 | 13 | 0 | 800 | 11.3% | 14.6% | 50 |
| M3302 | 4 | 15 | 55 | 11 | 2 | 0 | 13 | 0 | 800 | 9.3% | 19.9% | 100 |
| M3303 | 4 | 15 | 52 | 11 | 5 | 0 | 13 | 0 | 750 | 9.7% | 17.6% | 100 |
| M3304 | 3.5 | 15 | 54.5 | 11 | 2 | 0 | 14 | 0 | 800 | 12.1% | 22.3% | 50 |
| M3305 | 3.5 | 15 | 51.5 | 11 | 5 | 0 | 14 | 0 | 800 | 12.0% | 16.6% | 100 |
| M3306 | 4 | 15 | 54 | 11 | 2 | 0 | 14 | 0 | 800 | 10.1% | 21.6% | 100 |
| M3307 | 4 | 15 | 51 | 11 | 5 | 0 | 14 | 0 | 750 | 10.4% | 18.4% | 150 |
| M3308 | 4 | 15 | 55 | 11 | 0 | 0 | 15 | 0 | 800 | 10.5% | 22.5% | 100 |
| M3309 | 4 | 15 | 52 | 11 | 3 | 0 | 15 | 0 | 800 | 11.2% | 23.3% | 100 |
| M3310 | 3 | 16 | 60 | 11 | 0 | 0 | 10 | 0 | 850 | 11.1% | 13.1% | −50 |
| M3311 | 3 | 16 | 57 | 11 | 3 | 0 | 10 | 0 | 800 | 11.3% | 12.5% | −50 |
| M3312 | 3.5 | 16 | 59.5 | 11 | 0 | 0 | 10 | 0 | 850 | 9.3% | 13.2% | −50 |
| M3313 | 3.5 | 16 | 56.5 | 11 | 3 | 0 | 10 | 0 | 800 | 9.5% | 14.0% | 0 |
| M3314 | 4 | 16 | 59 | 11 | 0 | 0 | 10 | 0 | 850 | 7.4% | 13.5% | 0 |
| M3315 | 4 | 16 | 56 | 11 | 3 | 0 | 10 | 0 | 850 | 7.9% | 14.3% | 50 |
| M3316 | 3 | 16 | 59 | 11 | 0 | 0 | 11 | 0 | 800 | 11.7% | 14.9% | −50 |
| M3317 | 3 | 16 | 56 | 11 | 3 | 0 | 11 | 0 | 800 | 12.1% | 14.7% | −50 |
| M3318 | 3.5 | 16 | 58.5 | 11 | 0 | 0 | 11 | 0 | 850 | 10.0% | 15.0% | 0 |
| M3319 | 3.5 | 16 | 55.5 | 11 | 3 | 0 | 11 | 0 | 800 | 10.2% | 15.7% | 0 |
| M3320 | 4 | 16 | 58 | 11 | 0 | 0 | 11 | 0 | 850 | 8.0% | 15.2% | 0 |
| M3321 | 4 | 16 | 55 | 11 | 3 | 0 | 11 | 0 | 800 | 8.5% | 16.1% | 50 |
| M3322 | 3 | 16 | 58 | 11 | 0 | 0 | 12 | 0 | 800 | 12.6% | 17.8% | −50 |
| M3323 | 3.5 | 16 | 57.5 | 11 | 0 | 0 | 12 | 0 | 850 | 10.5% | 16.7% | 0 |
| M3324 | 3.5 | 16 | 54.5 | 11 | 3 | 0 | 12 | 0 | 800 | 11.1% | 16.8% | 50 |
| M3325 | 4 | 16 | 57 | 11 | 0 | 0 | 12 | 0 | 850 | 9.1% | 16.9% | 50 |
| M3326 | 4 | 16 | 54 | 11 | 3 | 0 | 12 | 0 | 800 | 9.3% | 17.8% | 50 |
| M3327 | 3.5 | 16 | 56.5 | 11 | 0 | 0 | 13 | 0 | 800 | 11.4% | 18.4% | 0 |
| M3328 | 3.5 | 16 | 53.5 | 11 | 3 | 0 | 13 | 0 | 800 | 12.0% | 18.4% | 50 |
| M3329 | 4 | 16 | 56 | 11 | 0 | 0 | 13 | 0 | 850 | 9.5% | 18.5% | 50 |
| M3330 | 4 | 16 | 53 | 11 | 3 | 0 | 13 | 0 | 800 | 10.1% | 19.5% | 100 |
| M3331 | 3.5 | 16 | 55.5 | 11 | 0 | 0 | 14 | 0 | 800 | 12.3% | 20.9% | 0 |
| M3332 | 3.5 | 16 | 51.5 | 11 | 4 | 0 | 14 | 0 | 800 | 12.6% | 19.2% | 50 |
| M3333 | 4 | 16 | 54 | 11 | 1 | 0 | 14 | 0 | 800 | 10.5% | 20.5% | 50 |
| M3334 | 4 | 16 | 51 | 11 | 4 | 0 | 14 | 0 | 750 | 10.9% | 18.9% | 100 |
| M3335 | 4 | 16 | 54 | 11 | 0 | 0 | 15 | 0 | 800 | 11.1% | 21.8% | 50 |
| M3336 | 4 | 16 | 51 | 11 | 3 | 0 | 15 | 0 | 800 | 11.8% | 22.1% | 100 |
| M3337 | 3 | 12 | 58.8 | 11 | 0 | 0.2 | 15 | 0 | 800 | 12.9% | 24.8% | 50 |
| M3338 | 4 | 16 | 53.6 | 11 | 0 | 0.4 | 15 | 0 | 800 | 11.1% | 21.8% | 100 |
| M3339 | 3 | 12 | 58.2 | 11 | 0 | 0.8 | 15 | 0 | 800 | 12.8% | 24.8% | 50 |
| M3340 | 4 | 16 | 53 | 11 | 0 | 1 | 15 | 0 | 800 | 11.2% | 21.8% | 100 |
| M3341 | 3 | 12 | 57.6 | 11 | 0 | 1.4 | 15 | 0 | 800 | 12.8% | 24.8% | 50 |
| M3342 | 4 | 16 | 52.4 | 11 | 0 | 1.6 | 15 | 0 | 800 | 11.1% | 21.9% | 100 |
| M3343 | 3 | 12 | 57 | 11 | 0 | 2 | 15 | 0 | 800 | 12.8% | 24.9% | 50 |
| M3344 | 4 | 16 | 51.8 | 11 | 0 | 2.2 | 15 | 0 | 800 | 11.0% | 21.9% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M3345 | 3 | 12 | 56.4 | 11 | 0 | 2.6 | 15 | 0 | 800 | 12.7% | 24.9% | 0 |
| M3346 | 4 | 16 | 51.2 | 11 | 0 | 2.8 | 15 | 0 | 800 | 10.9% | 21.9% | 100 |
| M3347 | 3 | 12 | 55.8 | 11 | 0 | 3.2 | 15 | 0 | 800 | 12.6% | 24.9% | 0 |
| M3348 | 4 | 16 | 50.6 | 11 | 0 | 3.4 | 15 | 0 | 800 | 10.8% | 21.9% | 100 |
| M3349 | 3 | 12 | 55.2 | 11 | 0 | 3.8 | 15 | 0 | 800 | 12.6% | 25.0% | 0 |
| M3350 | 4 | 16 | 50 | 11 | 0 | 4 | 15 | 0 | 800 | 10.7% | 21.9% | 100 |
| M3351 | 4 | 16 | 49.4 | 11 | 0 | 4.6 | 15 | 0 | 800 | 10.6% | 22.0% | 100 |
| M3352 | 4 | 16 | 44 | 11 | 0 | 10 | 15 | 0 | 800 | 9.9% | 22.2% | 150 |
| M3353 | 4 | 16 | 43.4 | 11 | 0 | 10.6 | 15 | 0 | 800 | 9.9% | 22.2% | 150 |
| M3354 | 4 | 16 | 43 | 11 | 0 | 11 | 15 | 0 | 750 | 9.8% | 22.3% | 200 |
| M3355 | 3 | 12 | 47.6 | 11 | 0 | 11.4 | 15 | 0 | 800 | 11.9% | 25.0% | 100 |
| M3356 | 4 | 16 | 42.4 | 11 | 0 | 11.6 | 15 | 0 | 750 | 9.8% | 22.3% | 200 |
| M3357 | 3 | 12 | 47 | 11 | 0 | 12 | 15 | 0 | 800 | 11.9% | 24.9% | 100 |
| M3358 | 4 | 16 | 41.8 | 11 | 0 | 12.2 | 15 | 0 | 750 | 9.7% | 22.3% | 200 |
| M3359 | 3 | 12 | 46.4 | 11 | 0 | 12.6 | 15 | 0 | 750 | 11.8% | 24.9% | 100 |
| M3360 | 4 | 16 | 41.2 | 11 | 0 | 12.8 | 15 | 0 | 750 | 9.7% | 22.4% | 150 |
| M3361 | 3 | 12 | 45.8 | 11 | 0 | 13.2 | 15 | 0 | 750 | 11.8% | 24.9% | 100 |
| M3362 | 4 | 16 | 40.6 | 11 | 0 | 13.4 | 15 | 0 | 750 | 9.6% | 22.4% | 150 |
| M3363 | 3 | 12 | 45.2 | 11 | 0 | 13.8 | 15 | 0 | 750 | 11.8% | 24.9% | 100 |
| M3364 | 4 | 16 | 40 | 11 | 0 | 14 | 15 | 0 | 750 | 9.6% | 22.4% | 150 |
| M3365 | 3 | 12 | 58.6 | 11.2 | 0 | 0.2 | 15 | 0 | 800 | 12.9% | 24.8% | 50 |
| M3366 | 4 | 16 | 53.4 | 11.2 | 0 | 0.4 | 15 | 0 | 800 | 11.1% | 21.8% | 100 |
| M3367 | 3 | 12 | 58 | 11.2 | 0 | 0.8 | 15 | 0 | 800 | 12.8% | 24.8% | 50 |
| M3368 | 4 | 16 | 52.8 | 11.2 | 0 | 1 | 15 | 0 | 800 | 11.0% | 21.8% | 100 |
| M3369 | 3 | 12 | 57.4 | 11.2 | 0 | 1.4 | 15 | 0 | 800 | 12.8% | 24.8% | 50 |
| M3370 | 4 | 16 | 52.2 | 11.2 | 0 | 1.6 | 15 | 0 | 800 | 11.1% | 21.9% | 100 |
| M3371 | 3 | 12 | 56.8 | 11.2 | 0 | 2 | 15 | 0 | 800 | 12.7% | 24.9% | 50 |
| M3372 | 4 | 16 | 51.6 | 11.2 | 0 | 2.2 | 15 | 0 | 800 | 11.0% | 21.9% | 100 |
| M3373 | 3 | 12 | 56.2 | 11.2 | 0 | 2.6 | 15 | 0 | 800 | 12.7% | 24.9% | 50 |
| M3374 | 4 | 16 | 51 | 11.2 | 0 | 2.8 | 15 | 0 | 800 | 10.9% | 21.9% | 100 |
| M3375 | 3 | 12 | 55.6 | 11.2 | 0 | 3.2 | 15 | 0 | 800 | 12.6% | 24.9% | 0 |
| M3376 | 4 | 16 | 50.4 | 11.2 | 0 | 3.4 | 15 | 0 | 800 | 10.8% | 21.9% | 100 |
| M3377 | 3 | 12 | 55 | 11.2 | 0 | 3.8 | 15 | 0 | 800 | 12.6% | 25.0% | 0 |
| M3378 | 4 | 16 | 49.6 | 11.2 | 0 | 4.2 | 15 | 0 | 800 | 10.7% | 22.0% | 100 |
| M3379 | 4 | 16 | 44 | 11.2 | 0 | 9.8 | 15 | 0 | 800 | 10.0% | 22.2% | 150 |
| M3380 | 4 | 16 | 43.4 | 11.2 | 0 | 10.4 | 15 | 0 | 800 | 9.9% | 22.2% | 150 |
| M3381 | 3 | 12 | 47.8 | 11.2 | 0 | 11 | 15 | 0 | 800 | 11.9% | 25.0% | 100 |
| M3382 | 4 | 16 | 42.6 | 11.2 | 0 | 11.2 | 15 | 0 | 750 | 9.8% | 22.3% | 200 |
| M3383 | 3 | 12 | 47.2 | 11.2 | 0 | 11.6 | 15 | 0 | 800 | 11.9% | 25.0% | 100 |
| M3384 | 4 | 16 | 42 | 11.2 | 0 | 11.8 | 15 | 0 | 750 | 9.8% | 22.3% | 200 |
| M3385 | 3 | 12 | 46.6 | 11.2 | 0 | 12.2 | 15 | 0 | 750 | 11.8% | 24.9% | 100 |
| M3386 | 4 | 16 | 41.4 | 11.2 | 0 | 12.4 | 15 | 0 | 750 | 9.7% | 22.3% | 200 |
| M3387 | 3 | 12 | 46 | 11.2 | 0 | 12.8 | 15 | 0 | 750 | 11.8% | 24.9% | 100 |
| M3388 | 4 | 16 | 40.8 | 11.2 | 0 | 13 | 15 | 0 | 750 | 9.6% | 22.4% | 150 |
| M3389 | 3 | 12 | 45.4 | 11.2 | 0 | 13.4 | 15 | 0 | 750 | 11.8% | 24.9% | 100 |
| M3390 | 4 | 16 | 40.2 | 11.2 | 0 | 13.6 | 15 | 0 | 750 | 9.6% | 22.4% | 150 |
| M3391 | 3 | 12 | 44.8 | 11.2 | 0 | 14 | 15 | 0 | 750 | 11.7% | 24.9% | 100 |
| M3392 | 4 | 16 | 53.6 | 11.4 | 0 | 0 | 15 | 0 | 800 | 11.1% | 21.8% | 50 |
| M3393 | 3 | 12 | 58.2 | 11.4 | 0 | 0.4 | 15 | 0 | 800 | 12.9% | 24.8% | 50 |
| M3394 | 4 | 16 | 53 | 11.4 | 0 | 0.6 | 15 | 0 | 800 | 11.0% | 21.8% | 100 |
| M3395 | 3 | 12 | 57.6 | 11.4 | 0 | 1 | 15 | 0 | 800 | 12.8% | 24.8% | 50 |
| M3396 | 4 | 16 | 52.4 | 11.4 | 0 | 1.2 | 15 | 0 | 800 | 10.9% | 21.8% | 100 |
| M3397 | 3 | 12 | 57 | 11.4 | 0 | 1.6 | 15 | 0 | 800 | 12.7% | 24.8% | 50 |
| M3398 | 4 | 16 | 51.8 | 11.4 | 0 | 1.8 | 15 | 0 | 800 | 11.1% | 21.9% | 100 |
| M3399 | 3 | 12 | 56.4 | 11.4 | 0 | 2.2 | 15 | 0 | 800 | 12.7% | 24.9% | 50 |
| M3400 | 4 | 16 | 51.2 | 11.4 | 0 | 2.4 | 15 | 0 | 800 | 11.0% | 21.9% | 100 |
| M3401 | 3 | 12 | 55.8 | 11.4 | 0 | 2.8 | 15 | 0 | 800 | 12.7% | 24.9% | 50 |
| M3402 | 4 | 16 | 50.6 | 11.4 | 0 | 3 | 15 | 0 | 800 | 10.9% | 21.9% | 100 |
| M3403 | 3 | 12 | 55.2 | 11.4 | 0 | 3.4 | 15 | 0 | 800 | 12.6% | 24.9% | 0 |
| M3404 | 4 | 16 | 50 | 11.4 | 0 | 3.6 | 15 | 0 | 800 | 10.8% | 21.9% | 100 |
| M3405 | 4 | 16 | 49.6 | 11.4 | 0 | 4 | 15 | 0 | 800 | 10.7% | 21.9% | 100 |
| M3406 | 4 | 16 | 49 | 11.4 | 0 | 4.6 | 15 | 0 | 800 | 10.6% | 22.0% | 100 |
| M3407 | 4 | 16 | 43.4 | 11.4 | 0 | 10.2 | 15 | 0 | 750 | 9.9% | 22.2% | 150 |
| M3408 | 4 | 16 | 42.8 | 11.4 | 0 | 10.8 | 15 | 0 | 750 | 9.8% | 22.2% | 200 |
| M3409 | 3 | 12 | 47.4 | 11.4 | 0 | 11.2 | 15 | 0 | 800 | 11.9% | 25.0% | 100 |
| M3410 | 4 | 16 | 42.2 | 11.4 | 0 | 11.4 | 15 | 0 | 750 | 9.8% | 22.3% | 200 |
| M3411 | 3 | 12 | 46.8 | 11.4 | 0 | 11.8 | 15 | 0 | 750 | 11.9% | 25.0% | 100 |
| M3412 | 4 | 16 | 41.6 | 11.4 | 0 | 12 | 15 | 0 | 750 | 9.7% | 22.3% | 200 |
| M3413 | 3 | 12 | 46.2 | 11.4 | 0 | 12.4 | 15 | 0 | 750 | 11.8% | 24.9% | 100 |
| M3414 | 4 | 16 | 41 | 11.4 | 0 | 12.6 | 15 | 0 | 750 | 9.7% | 22.3% | 200 |
| M3415 | 3 | 12 | 45.6 | 11.4 | 0 | 13 | 15 | 0 | 750 | 11.8% | 24.9% | 100 |
| M3416 | 4 | 16 | 40.4 | 11.4 | 0 | 13.2 | 15 | 0 | 750 | 9.6% | 22.4% | 150 |
| M3417 | 3 | 12 | 45 | 11.4 | 0 | 13.6 | 15 | 0 | 750 | 11.7% | 24.9% | 100 |
| M3418 | 4 | 16 | 39.8 | 11.4 | 0 | 13.8 | 15 | 0 | 750 | 9.6% | 22.4% | 150 |
| M3419 | 3 | 12 | 58.4 | 11.6 | 0 | 0 | 15 | 0 | 800 | 12.9% | 24.7% | 50 |
| M3420 | 4 | 16 | 53.2 | 11.6 | 0 | 0.2 | 15 | 0 | 800 | 11.1% | 21.8% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3421 | 3 | 12 | 57.8 | 11.6 | 0 | 0.6 | 15 | 0 | 800 | 12.9% | 24.8% | 50 |
| M3422 | 4 | 16 | 52.6 | 11.6 | 0 | 0.8 | 15 | 0 | 800 | 11.0% | 21.8% | 100 |
| M3423 | 3 | 12 | 57.2 | 11.6 | 0 | 1.2 | 15 | 0 | 800 | 12.8% | 24.8% | 50 |
| M3424 | 4 | 16 | 52 | 11.6 | 0 | 1.4 | 15 | 0 | 800 | 11.1% | 21.9% | 100 |
| M3425 | 3 | 12 | 56.6 | 11.6 | 0 | 1.8 | 15 | 0 | 800 | 12.7% | 24.8% | 50 |
| M3426 | 4 | 16 | 51.4 | 11.6 | 0 | 2 | 15 | 0 | 800 | 11.0% | 21.9% | 100 |
| M3427 | 3 | 12 | 56 | 11.6 | 0 | 2.4 | 15 | 0 | 800 | 12.7% | 24.9% | 50 |
| M3428 | 4 | 16 | 50.8 | 11.6 | 0 | 2.6 | 15 | 0 | 800 | 10.9% | 21.9% | 100 |
| M3429 | 3 | 12 | 55.4 | 11.6 | 0 | 3 | 15 | 0 | 800 | 12.6% | 24.9% | 50 |
| M3430 | 4 | 16 | 50.2 | 11.6 | 0 | 3.2 | 15 | 0 | 800 | 10.8% | 21.9% | 100 |
| M3431 | 3 | 12 | 54.8 | 11.6 | 0 | 3.6 | 15 | 0 | 800 | 12.6% | 24.9% | 0 |
| M3432 | 4 | 16 | 49.4 | 11.6 | 0 | 4 | 15 | 0 | 800 | 10.7% | 21.9% | 100 |
| M3433 | 4 | 16 | 48.8 | 11.6 | 0 | 4.6 | 15 | 0 | 800 | 10.6% | 22.0% | 100 |
| M3434 | 4 | 16 | 43 | 11.6 | 0 | 10.4 | 15 | 0 | 750 | 9.9% | 22.2% | 150 |
| M3435 | 3 | 12 | 47.4 | 11.6 | 0 | 11 | 15 | 0 | 750 | 11.9% | 25.1% | 100 |
| M3436 | 4 | 16 | 42.2 | 11.6 | 0 | 11.2 | 15 | 0 | 750 | 9.8% | 22.2% | 200 |
| M3437 | 3 | 12 | 46.8 | 11.6 | 0 | 11.6 | 15 | 0 | 750 | 11.9% | 25.0% | 100 |
| M3438 | 4 | 16 | 41.6 | 11.6 | 0 | 11.8 | 15 | 0 | 750 | 9.7% | 22.3% | 200 |
| M3439 | 3 | 12 | 46.2 | 11.6 | 0 | 12.2 | 15 | 0 | 750 | 11.8% | 25.0% | 100 |
| M3440 | 4 | 16 | 41 | 11.6 | 0 | 12.4 | 15 | 0 | 750 | 9.7% | 22.3% | 200 |
| M3441 | 3 | 12 | 45.6 | 11.6 | 0 | 12.8 | 15 | 0 | 750 | 11.8% | 24.9% | 100 |
| M3442 | 4 | 16 | 40.4 | 11.6 | 0 | 13 | 15 | 0 | 750 | 9.6% | 22.3% | 150 |
| M3443 | 3 | 12 | 45 | 11.6 | 0 | 13.4 | 15 | 0 | 750 | 11.8% | 24.9% | 100 |
| M3444 | 4 | 16 | 39.8 | 11.6 | 0 | 13.6 | 15 | 0 | 750 | 9.6% | 22.4% | 150 |
| M3445 | 3 | 12 | 44.4 | 11.6 | 0 | 14 | 15 | 0 | 750 | 11.7% | 24.9% | 100 |
| M3446 | 4 | 16 | 53.2 | 11.8 | 0 | 0 | 15 | 0 | 800 | 11.2% | 21.8% | 100 |
| M3447 | 3 | 12 | 57.8 | 11.8 | 0 | 0.4 | 15 | 0 | 800 | 12.9% | 24.8% | 50 |
| M3448 | 4 | 16 | 52.6 | 11.8 | 0 | 0.6 | 15 | 0 | 800 | 11.1% | 21.8% | 100 |
| M3449 | 3 | 12 | 57.2 | 11.8 | 0 | 1 | 15 | 0 | 800 | 12.8% | 24.8% | 50 |
| M3450 | 4 | 16 | 52 | 11.8 | 0 | 1.2 | 15 | 0 | 800 | 10.9% | 21.8% | 100 |
| M3451 | 3 | 12 | 56.6 | 11.8 | 0 | 1.6 | 15 | 0 | 800 | 12.8% | 24.8% | 50 |
| M3452 | 4 | 16 | 51.4 | 11.8 | 0 | 1.8 | 15 | 0 | 800 | 11.1% | 21.9% | 100 |
| M3453 | 3 | 12 | 56 | 11.8 | 0 | 2.2 | 15 | 0 | 800 | 12.7% | 24.9% | 50 |
| M3454 | 4 | 16 | 50.8 | 11.8 | 0 | 2.4 | 15 | 0 | 800 | 11.0% | 21.9% | 100 |
| M3455 | 3 | 12 | 55.4 | 11.8 | 0 | 2.8 | 15 | 0 | 800 | 12.7% | 24.9% | 50 |
| M3456 | 4 | 16 | 50.2 | 11.8 | 0 | 3 | 15 | 0 | 800 | 10.9% | 21.9% | 100 |
| M3457 | 4 | 16 | 49.6 | 11.8 | 0 | 3.6 | 15 | 0 | 800 | 10.8% | 21.9% | 100 |
| M3458 | 4 | 16 | 49 | 11.8 | 0 | 4.2 | 15 | 0 | 800 | 10.7% | 21.9% | 100 |
| M3459 | 4 | 16 | 43 | 11.8 | 0 | 10.2 | 15 | 0 | 750 | 9.9% | 22.2% | 150 |
| M3460 | 4 | 16 | 42.4 | 11.8 | 0 | 10.8 | 15 | 0 | 750 | 9.8% | 22.2% | 200 |
| M3461 | 4 | 16 | 42 | 11.8 | 0 | 11.2 | 15 | 0 | 750 | 9.8% | 22.2% | 200 |
| M3462 | 3 | 12 | 46.6 | 11.8 | 0 | 11.6 | 15 | 0 | 750 | 11.9% | 25.1% | 100 |
| M3463 | 4 | 16 | 41.4 | 11.8 | 0 | 11.8 | 15 | 0 | 750 | 9.7% | 22.3% | 200 |
| M3464 | 3 | 12 | 46 | 11.8 | 0 | 12.2 | 15 | 0 | 750 | 11.8% | 25.0% | 100 |
| M3465 | 4 | 16 | 40.8 | 11.8 | 0 | 12.4 | 15 | 0 | 750 | 9.7% | 22.3% | 200 |
| M3466 | 3 | 12 | 45.4 | 11.8 | 0 | 12.8 | 15 | 0 | 750 | 11.8% | 24.9% | 100 |
| M3467 | 4 | 16 | 40.2 | 11.8 | 0 | 13 | 15 | 0 | 750 | 9.6% | 22.3% | 150 |
| M3468 | 3 | 12 | 44.8 | 11.8 | 0 | 13.4 | 15 | 0 | 750 | 11.7% | 24.9% | 100 |
| M3469 | 4 | 16 | 39.6 | 11.8 | 0 | 13.6 | 15 | 0 | 750 | 9.6% | 22.4% | 150 |
| M3470 | 3 | 12 | 44.2 | 11.8 | 0 | 14 | 15 | 0 | 750 | 11.7% | 24.9% | 100 |
| M3471 | 4 | 7 | 57 | 12 | 0 | 0 | 20 | 0 | 800 | 7.8% | 34.0% | 200 |
| M3472 | 3.75 | 9 | 55.25 | 12 | 0 | 0 | 20 | 0 | 800 | 10.3% | 32.7% | 150 |
| M3473 | 2.5 | 10 | 65.5 | 12 | 0 | 0 | 10 | 0 | 800 | 9.6% | 17.1% | −50 |
| M3474 | 2.5 | 10 | 65 | 12 | 0 | 0 | 10.5 | 0 | 800 | 10.0% | 18.1% | −50 |
| M3475 | 2.5 | 10 | 64.5 | 12 | 0 | 0 | 11 | 0 | 800 | 10.4% | 19.0% | −50 |
| M3476 | 3 | 10 | 63.5 | 12 | 0 | 0 | 11.5 | 0 | 800 | 8.6% | 19.8% | 0 |
| M3477 | 4 | 10 | 54 | 12 | 0 | 0 | 20 | 0 | 800 | 11.3% | 33.9% | 200 |
| M3478 | 3 | 10.2 | 64.8 | 12 | 0 | 0 | 10 | 0 | 850 | 7.7% | 16.9% | 0 |
| M3479 | 3 | 10.2 | 64.3 | 12 | 0 | 0 | 10.5 | 0 | 850 | 8.0% | 17.8% | 0 |
| M3480 | 3 | 10.2 | 63.8 | 12 | 0 | 0 | 11 | 0 | 850 | 8.4% | 18.8% | 0 |
| M3481 | 2.5 | 10.2 | 63.3 | 12 | 0 | 0 | 12 | 0 | 800 | 10.8% | 20.8% | −50 |
| M3482 | 2.5 | 10.4 | 65.1 | 12 | 0 | 0 | 10 | 0 | 800 | 9.8% | 16.8% | −50 |
| M3483 | 2.5 | 10.4 | 64.6 | 12 | 0 | 0 | 10.5 | 0 | 800 | 10.2% | 17.8% | −50 |
| M3484 | 2.5 | 10.4 | 64.1 | 12 | 0 | 0 | 11 | 0 | 800 | 10.4% | 18.8% | −50 |
| M3485 | 3 | 10.4 | 63.1 | 12 | 0 | 0 | 11.5 | 0 | 800 | 8.9% | 19.6% | 0 |
| M3486 | 2 | 10.6 | 65.4 | 12 | 0 | 0 | 10 | 0 | 800 | 11.1% | 16.8% | −50 |
| M3487 | 2.5 | 10.6 | 64.4 | 12 | 0 | 0 | 10.5 | 0 | 800 | 10.3% | 17.7% | −50 |
| M3488 | 2.5 | 10.6 | 63.9 | 12 | 0 | 0 | 11 | 0 | 800 | 10.5% | 18.6% | −50 |
| M3489 | 3 | 10.6 | 62.9 | 12 | 0 | 0 | 11.5 | 0 | 800 | 9.0% | 19.4% | 0 |
| M3490 | 3 | 10.8 | 65.2 | 12 | 0 | 0 | 9 | 0 | 850 | 7.3% | 14.6% | −50 |
| M3491 | 3 | 10.8 | 64.2 | 12 | 0 | 0 | 10 | 0 | 850 | 8.0% | 16.5% | 0 |
| M3492 | 2.5 | 10.8 | 63.7 | 12 | 0 | 0 | 11 | 0 | 800 | 10.6% | 18.5% | −50 |
| M3493 | 2.5 | 10.8 | 63.2 | 12 | 0 | 0 | 11.5 | 0 | 800 | 11.1% | 19.5% | −50 |
| M3494 | 3 | 10.8 | 62.2 | 12 | 0 | 0 | 12 | 0 | 800 | 9.5% | 20.2% | 0 |
| M3495 | 3 | 11 | 65 | 12 | 0 | 0 | 9 | 0 | 850 | 7.4% | 14.5% | −50 |
| M3496 | 2.5 | 11 | 64 | 12 | 0 | 0 | 10.5 | 0 | 800 | 10.5% | 17.4% | −50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3497 | 3 | 11 | 63 | 12 | 0 | 0 | 11 | 0 | 800 | 8.8% | 18.2% | 0 |
| M3498 | 3 | 11 | 62.5 | 12 | 0 | 0 | 11.5 | 0 | 800 | 9.2% | 19.2% | 0 |
| M3499 | 3.5 | 11 | 61.5 | 12 | 0 | 0 | 12 | 0 | 850 | 7.8% | 20.1% | 50 |
| M3500 | 2.5 | 11.2 | 64.3 | 12 | 0 | 0 | 10 | 0 | 800 | 10.3% | 16.3% | −50 |
| M3501 | 3 | 11.2 | 63.3 | 12 | 0 | 0 | 10.5 | 0 | 850 | 8.5% | 17.2% | 0 |
| M3502 | 3.5 | 11.2 | 62.3 | 12 | 0 | 0 | 11 | 0 | 850 | 7.3% | 18.2% | 50 |
| M3503 | 2.5 | 11.2 | 62.3 | 12 | 0 | 0 | 12 | 0 | 800 | 11.8% | 20.3% | −50 |
| M3504 | 3 | 11.4 | 64.6 | 12 | 0 | 0 | 9 | 0 | 850 | 7.6% | 14.3% | −50 |
| M3505 | 2.5 | 11.4 | 63.6 | 12 | 0 | 0 | 10.5 | 0 | 800 | 10.5% | 17.2% | −50 |
| M3506 | 3 | 11.4 | 62.6 | 12 | 0 | 0 | 11 | 0 | 800 | 9.0% | 18.0% | 0 |
| M3507 | 3 | 11.4 | 62.1 | 12 | 0 | 0 | 11.5 | 0 | 800 | 9.4% | 18.9% | 0 |
| M3508 | 3 | 11.6 | 65.4 | 12 | 0 | 0 | 8 | 0 | 850 | 7.1% | 12.2% | −50 |
| M3509 | 3 | 11.6 | 63.4 | 12 | 0 | 0 | 10 | 0 | 850 | 8.4% | 16.0% | −50 |
| M3510 | 2.5 | 11.6 | 62.9 | 12 | 0 | 0 | 11 | 0 | 800 | 11.1% | 18.0% | −50 |
| M3511 | 2.5 | 11.6 | 62.4 | 12 | 0 | 0 | 11.5 | 0 | 800 | 11.6% | 19.0% | −50 |
| M3512 | 3 | 11.6 | 61.4 | 12 | 0 | 0 | 12 | 0 | 800 | 10.0% | 19.7% | 0 |
| M3513 | 2.5 | 11.8 | 63.7 | 12 | 0 | 0 | 10 | 0 | 800 | 10.4% | 16.0% | −50 |
| M3514 | 3 | 11.8 | 62.7 | 12 | 0 | 0 | 10.5 | 0 | 850 | 8.9% | 16.8% | 0 |
| M3515 | 3.5 | 11.8 | 61.7 | 12 | 0 | 0 | 11 | 0 | 850 | 7.6% | 17.8% | 0 |
| M3516 | 2.5 | 11.8 | 61.7 | 12 | 0 | 0 | 12 | 0 | 800 | 12.2% | 20.0% | −50 |
| M3517 | 3 | 12 | 64 | 12 | 0 | 0 | 9 | 0 | 850 | 7.9% | 13.9% | −50 |
| M3518 | 3 | 12 | 62 | 12 | 1 | 0 | 10 | 0 | 800 | 8.8% | 16.1% | −50 |
| M3519 | 3 | 12 | 59 | 12 | 4 | 0 | 10 | 0 | 800 | 9.2% | 15.4% | 0 |
| M3520 | 3.5 | 12 | 61.5 | 12 | 1 | 0 | 10 | 0 | 850 | 7.2% | 16.2% | 0 |
| M3521 | 3.5 | 12 | 58.5 | 12 | 4 | 0 | 10 | 0 | 800 | 7.6% | 17.3% | 50 |
| M3522 | 3 | 12 | 62.5 | 12 | 0 | 0 | 10.5 | 0 | 850 | 9.0% | 16.7% | −50 |
| M3523 | 3 | 12 | 61 | 12 | 1 | 0 | 11 | 0 | 800 | 9.5% | 18.0% | 0 |
| M3524 | 3 | 12 | 58 | 12 | 4 | 0 | 11 | 0 | 800 | 10.0% | 16.6% | 0 |
| M3525 | 3.5 | 12 | 60.5 | 12 | 1 | 0 | 11 | 0 | 850 | 7.8% | 18.0% | 50 |
| M3526 | 3.5 | 12 | 57.5 | 12 | 4 | 0 | 11 | 0 | 800 | 8.3% | 18.7% | 50 |
| M3527 | 2.5 | 12 | 62 | 12 | 0 | 0 | 11.5 | 0 | 800 | 11.8% | 18.9% | −50 |
| M3528 | 3 | 12 | 61 | 12 | 0 | 0 | 12 | 0 | 800 | 10.2% | 19.4% | 0 |
| M3529 | 3 | 12 | 58 | 12 | 3 | 0 | 12 | 0 | 800 | 10.7% | 19.7% | 0 |
| M3530 | 3.5 | 12 | 60.5 | 12 | 0 | 0 | 12 | 0 | 850 | 8.4% | 19.4% | 50 |
| M3531 | 3.5 | 12 | 57.5 | 12 | 3 | 0 | 12 | 0 | 800 | 8.9% | 20.6% | 50 |
| M3532 | 4 | 12 | 59 | 12 | 1 | 0 | 12 | 0 | 850 | 7.0% | 20.0% | 100 |
| M3533 | 4 | 12 | 56 | 12 | 4 | 0 | 12 | 0 | 800 | 7.5% | 21.2% | 150 |
| M3534 | 3 | 12 | 59 | 12 | 1 | 0 | 13 | 0 | 800 | 11.3% | 21.6% | 0 |
| M3535 | 3 | 12 | 56 | 12 | 4 | 0 | 13 | 0 | 800 | 11.5% | 18.4% | 50 |
| M3536 | 3.5 | 12 | 58.5 | 12 | 1 | 0 | 13 | 0 | 800 | 9.3% | 21.6% | 50 |
| M3537 | 3.5 | 12 | 55.5 | 12 | 4 | 0 | 13 | 0 | 750 | 9.9% | 21.0% | 100 |
| M3538 | 4 | 12 | 58 | 12 | 1 | 0 | 13 | 0 | 800 | 7.6% | 21.7% | 100 |
| M3539 | 4 | 12 | 55 | 12 | 4 | 0 | 13 | 0 | 750 | 8.2% | 22.9% | 150 |
| M3540 | 3 | 12 | 58 | 12 | 1 | 0 | 14 | 0 | 800 | 12.2% | 23.8% | 50 |
| M3541 | 3 | 12 | 55 | 12 | 4 | 0 | 14 | 0 | 800 | 12.3% | 19.4% | 50 |
| M3542 | 3.5 | 12 | 57.5 | 12 | 1 | 0 | 14 | 0 | 800 | 10.1% | 23.3% | 50 |
| M3543 | 3.5 | 12 | 54.5 | 12 | 4 | 0 | 14 | 0 | 750 | 10.6% | 21.9% | 100 |
| M3544 | 4 | 12 | 57 | 12 | 1 | 0 | 14 | 0 | 800 | 8.3% | 23.4% | 100 |
| M3545 | 4 | 12 | 54 | 12 | 4 | 0 | 14 | 0 | 750 | 8.9% | 24.3% | 150 |
| M3546 | 3 | 12 | 58 | 12 | 0 | 0 | 15 | 0 | 800 | 13.0% | 24.7% | 50 |
| M3547 | 3.5 | 12 | 55.5 | 12 | 2 | 0 | 15 | 0 | 750 | 11.2% | 25.5% | 100 |
| M3548 | 3.5 | 12 | 52.5 | 12 | 5 | 0 | 15 | 0 | 750 | 11.3% | 20.4% | 150 |
| M3549 | 4 | 12 | 55 | 12 | 2 | 0 | 15 | 0 | 800 | 9.3% | 25.5% | 150 |
| M3550 | 4 | 12 | 52 | 12 | 5 | 0 | 15 | 0 | 750 | 9.7% | 23.5% | 200 |
| M3551 | 2.5 | 12.2 | 62.8 | 12 | 0 | 0 | 10.5 | 0 | 800 | 11.0% | 16.7% | −50 |
| M3552 | 3 | 12.2 | 61.8 | 12 | 0 | 0 | 11 | 0 | 800 | 9.5% | 17.5% | 0 |
| M3553 | 2.5 | 12.2 | 61.3 | 12 | 0 | 0 | 12 | 0 | 800 | 12.4% | 19.7% | −50 |
| M3554 | 3 | 12.4 | 62.6 | 12 | 0 | 0 | 10 | 0 | 850 | 8.8% | 15.5% | −50 |
| M3555 | 2.5 | 12.4 | 62.1 | 12 | 0 | 0 | 11 | 0 | 800 | 11.6% | 17.5% | −50 |
| M3556 | 3 | 12.4 | 61.1 | 12 | 0 | 0 | 11.5 | 0 | 800 | 10.0% | 18.2% | 0 |
| M3557 | 3 | 12.5 | 62.5 | 12 | 0 | 0 | 10 | 0 | 850 | 8.9% | 15.4% | −50 |
| M3558 | 3.5 | 12.5 | 61 | 12 | 0 | 0 | 11 | 0 | 850 | 7.9% | 17.3% | 0 |
| M3559 | 4 | 12.5 | 59.5 | 12 | 0 | 0 | 12 | 0 | 850 | 7.1% | 19.2% | 50 |
| M3560 | 4 | 12.5 | 58.5 | 12 | 0 | 0 | 13 | 0 | 850 | 7.7% | 21.0% | 100 |
| M3561 | 4 | 12.5 | 57.5 | 12 | 0 | 0 | 14 | 0 | 800 | 8.4% | 22.6% | 100 |
| M3562 | 2.5 | 12.6 | 62.9 | 12 | 0 | 0 | 10 | 0 | 800 | 10.8% | 15.4% | −50 |
| M3563 | 3 | 12.6 | 61.9 | 12 | 0 | 0 | 10.5 | 0 | 800 | 9.3% | 16.3% | −50 |
| M3564 | 2.5 | 12.6 | 61.4 | 12 | 0 | 0 | 11.5 | 0 | 800 | 12.2% | 18.8% | −50 |
| M3565 | 3 | 12.6 | 60.4 | 12 | 0 | 0 | 12 | 0 | 800 | 10.6% | 19.0% | 0 |
| M3566 | 2.5 | 12.8 | 62.2 | 12 | 0 | 0 | 10.5 | 0 | 800 | 11.4% | 16.3% | −50 |
| M3567 | 3 | 12.8 | 61.2 | 12 | 0 | 0 | 11 | 0 | 800 | 9.8% | 17.1% | −50 |
| M3568 | 2.5 | 12.8 | 60.7 | 12 | 0 | 0 | 12 | 0 | 800 | 12.8% | 19.3% | −50 |
| M3569 | 3 | 13 | 62 | 12 | 0 | 0 | 10 | 0 | 850 | 9.1% | 15.1% | −50 |
| M3570 | 3 | 13 | 59 | 12 | 3 | 0 | 10 | 0 | 800 | 9.6% | 16.0% | 0 |
| M3571 | 3.5 | 13 | 61.5 | 12 | 0 | 0 | 10 | 0 | 850 | 7.5% | 15.2% | 0 |
| M3572 | 3.5 | 13 | 58.5 | 12 | 3 | 0 | 10 | 0 | 800 | 8.0% | 16.2% | 50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3573 | 2.5 | 13 | 62 | 12 | 0 | 0 | 10.5 | 0 | 800 | 11.5% | 16.1% | −50 |
| M3574 | 3 | 13 | 61 | 12 | 0 | 0 | 11 | 0 | 800 | 9.9% | 16.9% | −50 |
| M3575 | 3 | 13 | 58 | 12 | 3 | 0 | 11 | 0 | 800 | 10.5% | 17.3% | 0 |
| M3576 | 3.5 | 13 | 60.5 | 12 | 0 | 0 | 11 | 0 | 850 | 8.2% | 17.0% | 0 |
| M3577 | 3.5 | 13 | 57.5 | 12 | 3 | 0 | 11 | 0 | 800 | 8.7% | 18.0% | 50 |
| M3578 | 4 | 13 | 58 | 12 | 2 | 0 | 11 | 0 | 850 | 7.0% | 17.9% | 50 |
| M3579 | 4 | 13 | 55 | 12 | 5 | 0 | 11 | 0 | 800 | 7.5% | 17.9% | 150 |
| M3580 | 2.5 | 13 | 60.5 | 12 | 0 | 0 | 12 | 0 | 800 | 12.9% | 19.2% | −50 |
| M3581 | 3 | 13 | 58 | 12 | 2 | 0 | 12 | 0 | 800 | 11.2% | 19.5% | 0 |
| M3582 | 3 | 13 | 55 | 12 | 5 | 0 | 12 | 0 | 800 | 11.2% | 13.8% | 50 |
| M3583 | 3.5 | 13 | 57.5 | 12 | 2 | 0 | 12 | 0 | 800 | 9.3% | 19.5% | 50 |
| M3584 | 3.5 | 13 | 54.5 | 12 | 5 | 0 | 12 | 0 | 750 | 9.6% | 16.8% | 100 |
| M3585 | 4 | 13 | 57 | 12 | 2 | 0 | 12 | 0 | 800 | 7.6% | 19.7% | 100 |
| M3586 | 4 | 13 | 54 | 12 | 5 | 0 | 12 | 0 | 750 | 8.1% | 19.2% | 150 |
| M3587 | 3 | 13 | 57 | 12 | 2 | 0 | 13 | 0 | 800 | 12.1% | 22.2% | 0 |
| M3588 | 3 | 13 | 54 | 12 | 5 | 0 | 13 | 0 | 800 | 11.9% | 15.8% | 50 |
| M3589 | 3.5 | 13 | 56.5 | 12 | 2 | 0 | 13 | 0 | 800 | 10.1% | 21.3% | 50 |
| M3590 | 3.5 | 13 | 53.5 | 12 | 5 | 0 | 13 | 0 | 750 | 10.3% | 17.6% | 100 |
| M3591 | 4 | 13 | 56 | 12 | 2 | 0 | 13 | 0 | 800 | 8.3% | 21.4% | 100 |
| M3592 | 4 | 13 | 53 | 12 | 5 | 0 | 13 | 0 | 750 | 8.8% | 20.3% | 150 |
| M3593 | 3.5 | 13 | 57.5 | 12 | 0 | 0 | 14 | 0 | 800 | 10.5% | 22.2% | 50 |
| M3594 | 3.5 | 13 | 54.5 | 12 | 3 | 0 | 14 | 0 | 750 | 11.1% | 22.7% | 100 |
| M3595 | 4 | 13 | 57 | 12 | 0 | 0 | 14 | 0 | 800 | 8.7% | 22.3% | 100 |
| M3596 | 4 | 13 | 54 | 12 | 3 | 0 | 14 | 0 | 800 | 9.2% | 23.5% | 150 |
| M3597 | 3.5 | 13 | 56.5 | 12 | 0 | 0 | 15 | 0 | 800 | 11.4% | 23.9% | 50 |
| M3598 | 3.5 | 13 | 53.5 | 12 | 3 | 0 | 15 | 0 | 750 | 12.0% | 24.7% | 100 |
| M3599 | 4 | 13 | 56 | 12 | 0 | 0 | 15 | 0 | 800 | 9.4% | 23.9% | 100 |
| M3600 | 4 | 13 | 53 | 12 | 3 | 0 | 15 | 0 | 750 | 10.1% | 25.2% | 150 |
| M3601 | 2.5 | 13.2 | 62.3 | 12 | 0 | 0 | 10 | 0 | 800 | 11.2% | 15.1% | −50 |
| M3602 | 3 | 13.2 | 61.3 | 12 | 0 | 0 | 10.5 | 0 | 800 | 9.6% | 15.9% | −50 |
| M3603 | 2.5 | 13.2 | 60.8 | 12 | 0 | 0 | 11.5 | 0 | 800 | 12.6% | 18.4% | −50 |
| M3604 | 3 | 13.2 | 59.8 | 12 | 0 | 0 | 12 | 0 | 800 | 10.9% | 18.6% | 0 |
| M3605 | 2.5 | 13.4 | 61.6 | 12 | 0 | 0 | 10.5 | 0 | 800 | 11.8% | 15.9% | −50 |
| M3606 | 3 | 13.4 | 60.6 | 12 | 0 | 0 | 11 | 0 | 800 | 10.2% | 16.7% | −50 |
| M3607 | 2.5 | 13.4 | 60.1 | 12 | 0 | 0 | 12 | 0 | 800 | 13.2% | 18.9% | −50 |
| M3608 | 3.5 | 13.5 | 61 | 12 | 0 | 0 | 10 | 0 | 850 | 7.8% | 14.9% | 0 |
| M3609 | 3 | 13.5 | 59.5 | 12 | 0 | 0 | 12 | 0 | 800 | 11.1% | 18.4% | 0 |
| M3610 | 3 | 13.5 | 58.5 | 12 | 0 | 0 | 13 | 0 | 800 | 12.0% | 20.7% | 0 |
| M3611 | 3 | 13.5 | 57.5 | 12 | 0 | 0 | 14 | 0 | 800 | 13.0% | 22.5% | 0 |
| M3612 | 3.5 | 13.5 | 56 | 12 | 0 | 0 | 15 | 0 | 800 | 11.7% | 23.6% | 50 |
| M3613 | 3 | 13.6 | 61.4 | 12 | 0 | 0 | 10 | 0 | 850 | 9.5% | 14.7% | −50 |
| M3614 | 2.5 | 13.6 | 60.9 | 12 | 0 | 0 | 11 | 0 | 800 | 12.4% | 17.4% | −50 |
| M3615 | 3 | 13.6 | 59.9 | 12 | 0 | 0 | 11.5 | 0 | 800 | 10.7% | 17.4% | −50 |
| M3616 | 3 | 13.8 | 61.2 | 12 | 0 | 0 | 10 | 0 | 850 | 9.6% | 14.6% | −50 |
| M3617 | 2.5 | 13.8 | 60.7 | 12 | 0 | 0 | 11 | 0 | 800 | 12.5% | 17.3% | −50 |
| M3618 | 3 | 13.8 | 59.7 | 12 | 0 | 0 | 11.5 | 0 | 800 | 10.8% | 17.3% | −50 |
| M3619 | 3 | 14 | 61 | 12 | 0 | 0 | 10 | 0 | 800 | 9.7% | 14.4% | −50 |
| M3620 | 3 | 14 | 58 | 12 | 3 | 0 | 10 | 0 | 800 | 10.2% | 14.9% | −50 |
| M3621 | 3.5 | 14 | 60.5 | 12 | 0 | 0 | 10 | 0 | 850 | 8.0% | 14.5% | 0 |
| M3622 | 3.5 | 14 | 57.5 | 12 | 3 | 0 | 10 | 0 | 800 | 8.5% | 15.5% | 0 |
| M3623 | 4 | 14 | 57 | 12 | 3 | 0 | 10 | 0 | 800 | 7.0% | 15.7% | 50 |
| M3624 | 2.5 | 14 | 61 | 12 | 0 | 0 | 10.5 | 0 | 800 | 12.1% | 16.1% | −50 |
| M3625 | 3 | 14 | 60 | 12 | 0 | 0 | 11 | 0 | 800 | 10.5% | 16.3% | −50 |
| M3626 | 3 | 14 | 57 | 12 | 3 | 0 | 11 | 0 | 800 | 11.0% | 16.1% | 0 |
| M3627 | 3.5 | 14 | 59.5 | 12 | 0 | 0 | 11 | 0 | 850 | 8.7% | 16.3% | 0 |
| M3628 | 3.5 | 14 | 56.5 | 12 | 3 | 0 | 11 | 0 | 800 | 9.2% | 17.3% | 50 |
| M3629 | 4 | 14 | 59 | 12 | 0 | 0 | 11 | 0 | 850 | 7.2% | 16.5% | 50 |
| M3630 | 4 | 14 | 56 | 12 | 3 | 0 | 11 | 0 | 800 | 7.6% | 17.5% | 100 |
| M3631 | 2.5 | 14 | 60 | 12 | 0 | 0 | 11.5 | 0 | 800 | 13.1% | 17.8% | −50 |
| M3632 | 3 | 14 | 58 | 12 | 1 | 0 | 12 | 0 | 800 | 11.6% | 18.4% | 0 |
| M3633 | 3 | 14 | 55 | 12 | 4 | 0 | 12 | 0 | 800 | 11.8% | 15.2% | 0 |
| M3634 | 3.5 | 14 | 57.5 | 12 | 1 | 0 | 12 | 0 | 800 | 9.6% | 18.4% | 50 |
| M3635 | 3.5 | 14 | 54.5 | 12 | 4 | 0 | 12 | 0 | 750 | 10.1% | 17.3% | 50 |
| M3636 | 4 | 14 | 57 | 12 | 1 | 0 | 12 | 0 | 850 | 8.0% | 18.6% | 50 |
| M3637 | 4 | 14 | 54 | 12 | 4 | 0 | 12 | 0 | 800 | 8.5% | 19.5% | 100 |
| M3638 | 3 | 14 | 57 | 12 | 1 | 0 | 13 | 0 | 800 | 12.5% | 21.2% | 0 |
| M3639 | 3 | 14 | 53 | 12 | 5 | 0 | 13 | 0 | 750 | 12.4% | 14.3% | 50 |
| M3640 | 3.5 | 14 | 55.5 | 12 | 2 | 0 | 13 | 0 | 800 | 10.6% | 20.5% | 50 |
| M3641 | 3.5 | 14 | 52.5 | 12 | 5 | 0 | 13 | 0 | 750 | 10.8% | 16.1% | 100 |
| M3642 | 4 | 14 | 55 | 12 | 2 | 0 | 13 | 0 | 800 | 8.8% | 20.7% | 100 |
| M3643 | 4 | 14 | 52 | 12 | 5 | 0 | 13 | 0 | 750 | 9.3% | 18.9% | 150 |
| M3644 | 3.5 | 14 | 54.5 | 12 | 2 | 0 | 14 | 0 | 800 | 11.5% | 22.3% | 50 |
| M3645 | 3.5 | 14 | 51.5 | 12 | 5 | 0 | 14 | 0 | 750 | 11.5% | 16.5% | 100 |
| M3646 | 4 | 14 | 54 | 12 | 2 | 0 | 14 | 0 | 800 | 9.6% | 22.3% | 100 |
| M3647 | 4 | 14 | 51 | 12 | 5 | 0 | 14 | 0 | 750 | 10.0% | 19.7% | 150 |
| M3648 | 3.5 | 14 | 53.5 | 12 | 2 | 0 | 15 | 0 | 750 | 12.5% | 25.2% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M3649 | 3.5 | 14 | 50.5 | 12 | 5 | 0 | 15 | 0 | 750 | 12.2% | 19.0% | 100 |
| M3650 | 4 | 14 | 53 | 12 | 2 | 0 | 15 | 0 | 800 | 10.4% | 24.0% | 100 |
| M3651 | 4 | 14 | 50 | 12 | 5 | 0 | 15 | 0 | 750 | 10.7% | 20.4% | 150 |
| M3652 | 3 | 14.5 | 59.5 | 12 | 0 | 0 | 11 | 0 | 800 | 10.8% | 15.9% | −50 |
| M3653 | 3 | 14.5 | 58.5 | 12 | 0 | 0 | 12 | 0 | 800 | 11.7% | 17.7% | −50 |
| M3654 | 3 | 14.5 | 57.5 | 12 | 0 | 0 | 13 | 0 | 800 | 12.6% | 20.5% | 0 |
| M3655 | 3.5 | 14.5 | 56 | 12 | 0 | 0 | 14 | 0 | 800 | 11.4% | 21.2% | 50 |
| M3656 | 4 | 14.5 | 54.5 | 12 | 0 | 0 | 15 | 0 | 800 | 10.3% | 22.9% | 100 |
| M3657 | 3 | 15 | 58 | 12 | 2 | 0 | 10 | 0 | 800 | 10.6% | 14.3% | −50 |
| M3658 | 3 | 15 | 55 | 12 | 5 | 0 | 10 | 0 | 750 | 10.7% | 9.3% | 0 |
| M3659 | 3.5 | 15 | 57.5 | 12 | 2 | 0 | 10 | 0 | 800 | 8.8% | 14.5% | 0 |
| M3660 | 3.5 | 15 | 54.5 | 12 | 5 | 0 | 10 | 0 | 750 | 9.1% | 12.0% | 100 |
| M3661 | 4 | 15 | 57 | 12 | 2 | 0 | 10 | 0 | 850 | 7.3% | 14.7% | 50 |
| M3662 | 4 | 15 | 54 | 12 | 5 | 0 | 10 | 0 | 800 | 7.8% | 14.2% | 100 |
| M3663 | 3 | 15 | 57 | 12 | 2 | 0 | 11 | 0 | 800 | 11.5% | 16.2% | −50 |
| M3664 | 3 | 15 | 54 | 12 | 5 | 0 | 11 | 0 | 750 | 11.4% | 9.9% | 0 |
| M3665 | 3.5 | 15 | 56.5 | 12 | 2 | 0 | 11 | 0 | 800 | 9.6% | 16.3% | 0 |
| M3666 | 3.5 | 15 | 53.5 | 12 | 5 | 0 | 11 | 0 | 750 | 9.8% | 13.0% | 50 |
| M3667 | 4 | 15 | 56 | 12 | 2 | 0 | 11 | 0 | 800 | 8.0% | 16.5% | 50 |
| M3668 | 4 | 15 | 53 | 12 | 5 | 0 | 11 | 0 | 750 | 8.4% | 15.5% | 150 |
| M3669 | 3 | 15 | 56 | 12 | 2 | 0 | 12 | 0 | 800 | 12.4% | 19.4% | 0 |
| M3670 | 3 | 15 | 53 | 12 | 5 | 0 | 12 | 0 | 750 | 12.1% | 12.8% | 0 |
| M3671 | 3.5 | 15 | 55.5 | 12 | 2 | 0 | 12 | 0 | 800 | 10.4% | 18.0% | 50 |
| M3672 | 3.5 | 15 | 52.5 | 12 | 5 | 0 | 12 | 0 | 750 | 10.6% | 13.8% | 50 |
| M3673 | 4 | 15 | 55 | 12 | 2 | 0 | 12 | 0 | 800 | 8.6% | 18.2% | 50 |
| M3674 | 4 | 15 | 52 | 12 | 5 | 0 | 12 | 0 | 750 | 9.0% | 16.6% | 150 |
| M3675 | 3.5 | 15 | 55.5 | 12 | 1 | 0 | 13 | 0 | 800 | 11.0% | 19.4% | 50 |
| M3676 | 3.5 | 15 | 52.5 | 12 | 4 | 0 | 13 | 0 | 750 | 11.4% | 16.7% | 50 |
| M3677 | 4 | 15 | 55 | 12 | 1 | 0 | 13 | 0 | 800 | 9.2% | 19.6% | 50 |
| M3678 | 4 | 15 | 52 | 12 | 4 | 0 | 13 | 0 | 750 | 9.7% | 19.3% | 150 |
| M3679 | 3.5 | 15 | 54.5 | 12 | 1 | 0 | 14 | 0 | 800 | 11.9% | 21.6% | 50 |
| M3680 | 3.5 | 15 | 51.5 | 12 | 4 | 0 | 14 | 0 | 750 | 12.1% | 19.2% | 100 |
| M3681 | 4 | 15 | 54 | 12 | 1 | 0 | 14 | 0 | 800 | 10.0% | 21.2% | 100 |
| M3682 | 4 | 15 | 51 | 12 | 4 | 0 | 14 | 0 | 750 | 10.5% | 20.2% | 100 |
| M3683 | 3.5 | 15 | 53.5 | 12 | 1 | 0 | 15 | 0 | 800 | 12.9% | 24.2% | 50 |
| M3684 | 4 | 15 | 52 | 12 | 2 | 0 | 15 | 0 | 800 | 11.0% | 23.3% | 100 |
| M3685 | 4 | 15 | 49 | 12 | 5 | 0 | 15 | 0 | 750 | 11.2% | 18.8% | 150 |
| M3686 | 4 | 15.5 | 58.5 | 12 | 0 | 0 | 10 | 0 | 850 | 7.3% | 13.7% | 0 |
| M3687 | 4 | 15.5 | 57.5 | 12 | 0 | 0 | 11 | 0 | 850 | 7.9% | 15.5% | 0 |
| M3688 | 4 | 15.5 | 56.5 | 12 | 0 | 0 | 12 | 0 | 850 | 8.5% | 17.2% | 50 |
| M3689 | 3.5 | 15.5 | 55 | 12 | 0 | 0 | 14 | 0 | 800 | 12.0% | 21.0% | 50 |
| M3690 | 4 | 15.5 | 53.5 | 12 | 0 | 0 | 15 | 0 | 800 | 10.9% | 22.2% | 100 |
| M3691 | 3 | 16 | 57 | 12 | 2 | 0 | 10 | 0 | 800 | 11.2% | 13.6% | −50 |
| M3692 | 3 | 16 | 54 | 12 | 5 | 0 | 10 | 0 | 750 | 11.2% | 7.7% | 0 |
| M3693 | 3.5 | 16 | 56.5 | 12 | 2 | 0 | 10 | 0 | 800 | 9.3% | 13.7% | 0 |
| M3694 | 3.5 | 16 | 53.5 | 12 | 5 | 0 | 10 | 0 | 750 | 9.6% | 10.7% | 50 |
| M3695 | 4 | 16 | 56 | 12 | 2 | 0 | 10 | 0 | 850 | 7.8% | 14.0% | 50 |
| M3696 | 4 | 16 | 53 | 12 | 5 | 0 | 10 | 0 | 800 | 8.2% | 13.0% | 100 |
| M3697 | 3 | 16 | 56 | 12 | 2 | 0 | 11 | 0 | 800 | 12.1% | 16.3% | −50 |
| M3698 | 3 | 16 | 53 | 12 | 5 | 0 | 11 | 0 | 750 | 11.9% | 9.5% | 0 |
| M3699 | 3.5 | 16 | 55.5 | 12 | 2 | 0 | 11 | 0 | 800 | 10.1% | 15.5% | 0 |
| M3700 | 3.5 | 16 | 52.5 | 12 | 5 | 0 | 11 | 0 | 750 | 10.3% | 11.6% | 100 |
| M3701 | 4 | 16 | 55 | 12 | 2 | 0 | 11 | 0 | 800 | 8.4% | 15.7% | 50 |
| M3702 | 4 | 16 | 52 | 12 | 5 | 0 | 11 | 0 | 750 | 8.8% | 14.2% | 150 |
| M3703 | 3 | 16 | 52 | 12 | 5 | 0 | 12 | 0 | 750 | 12.6% | 11.8% | 0 |
| M3704 | 3.5 | 16 | 54.5 | 12 | 2 | 0 | 12 | 0 | 800 | 11.0% | 17.3% | 0 |
| M3705 | 3.5 | 16 | 51.5 | 12 | 5 | 0 | 12 | 0 | 750 | 11.0% | 12.3% | 100 |
| M3706 | 4 | 16 | 54 | 12 | 2 | 0 | 12 | 0 | 800 | 9.1% | 17.5% | 50 |
| M3707 | 4 | 16 | 51 | 12 | 5 | 0 | 12 | 0 | 750 | 9.5% | 15.2% | 150 |
| M3708 | 3.5 | 16 | 53.5 | 12 | 2 | 0 | 13 | 0 | 800 | 11.8% | 19.4% | 50 |
| M3709 | 3.5 | 16 | 50.5 | 12 | 5 | 0 | 13 | 0 | 750 | 11.7% | 13.4% | 50 |
| M3710 | 4 | 16 | 53 | 12 | 2 | 0 | 13 | 0 | 800 | 9.9% | 19.2% | 50 |
| M3711 | 4 | 16 | 50 | 12 | 5 | 0 | 13 | 0 | 750 | 10.2% | 16.0% | 150 |
| M3712 | 3.5 | 16 | 52.5 | 12 | 2 | 0 | 14 | 0 | 750 | 12.8% | 22.7% | 50 |
| M3713 | 4 | 16 | 54 | 12 | 0 | 0 | 14 | 0 | 800 | 10.3% | 20.2% | 50 |
| M3714 | 4 | 16 | 51 | 12 | 3 | 0 | 14 | 0 | 750 | 10.9% | 20.9% | 150 |
| M3715 | 4 | 16 | 53 | 12 | 0 | 0 | 15 | 0 | 800 | 11.2% | 21.8% | 100 |
| M3716 | 4 | 16 | 51 | 12 | 2 | 0 | 15 | 0 | 800 | 11.6% | 22.5% | 100 |
| M3717 | 4 | 16 | 48 | 12 | 5 | 0 | 15 | 0 | 750 | 11.6% | 17.2% | 200 |
| M3718 | 3 | 12 | 57.6 | 12 | 0 | 0.4 | 15 | 0 | 800 | 12.9% | 24.7% | 50 |
| M3719 | 4 | 16 | 52.4 | 12 | 0 | 0.6 | 15 | 0 | 800 | 11.1% | 21.8% | 100 |
| M3720 | 3 | 12 | 57 | 12 | 0 | 1 | 15 | 0 | 800 | 12.8% | 24.8% | 50 |
| M3721 | 4 | 16 | 51.8 | 12 | 0 | 1.2 | 15 | 0 | 800 | 11.0% | 21.8% | 100 |
| M3722 | 3 | 12 | 56.4 | 12 | 0 | 1.6 | 15 | 0 | 800 | 12.8% | 24.8% | 50 |
| M3723 | 4 | 16 | 51.2 | 12 | 0 | 1.8 | 15 | 0 | 800 | 11.1% | 21.9% | 100 |
| M3724 | 3 | 12 | 55.8 | 12 | 0 | 2.2 | 15 | 0 | 800 | 12.7% | 24.8% | 50 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3725 | 4 | 16 | 50.6 | 12 | 0 | 2.4 | 15 | 0 | 800 | 11.0% | 21.9% | 100 |
| M3726 | 3 | 12 | 55.2 | 12 | 0 | 2.8 | 15 | 0 | 800 | 12.7% | 24.9% | 50 |
| M3727 | 4 | 16 | 50 | 12 | 0 | 3 | 15 | 0 | 800 | 10.9% | 21.9% | 100 |
| M3728 | 4 | 16 | 49.4 | 12 | 0 | 3.6 | 15 | 0 | 800 | 10.8% | 21.9% | 100 |
| M3729 | 4 | 16 | 48.8 | 12 | 0 | 4.2 | 15 | 0 | 800 | 10.7% | 21.9% | 100 |
| M3730 | 4 | 16 | 42.8 | 12 | 0 | 10.2 | 15 | 0 | 750 | 9.9% | 22.2% | 150 |
| M3731 | 4 | 16 | 42.2 | 12 | 0 | 10.8 | 15 | 0 | 750 | 9.8% | 22.2% | 200 |
| M3732 | 4 | 16 | 41.8 | 12 | 0 | 11.2 | 15 | 0 | 750 | 9.8% | 22.2% | 200 |
| M3733 | 3 | 12 | 46.4 | 12 | 0 | 11.6 | 15 | 0 | 750 | 11.9% | 25.1% | 100 |
| M3734 | 4 | 16 | 41.2 | 12 | 0 | 11.8 | 15 | 0 | 750 | 9.7% | 22.3% | 200 |
| M3735 | 3 | 12 | 45.8 | 12 | 0 | 12.2 | 15 | 0 | 750 | 11.8% | 25.0% | 100 |
| M3736 | 4 | 16 | 40.6 | 12 | 0 | 12.4 | 15 | 0 | 750 | 9.7% | 22.3% | 200 |
| M3737 | 3 | 12 | 45.2 | 12 | 0 | 12.8 | 15 | 0 | 750 | 11.8% | 25.0% | 100 |
| M3738 | 4 | 16 | 40 | 12 | 0 | 13 | 15 | 0 | 750 | 9.6% | 22.3% | 200 |
| M3739 | 3 | 12 | 44.6 | 12 | 0 | 13.4 | 15 | 0 | 750 | 11.7% | 24.9% | 100 |
| M3740 | 4 | 16 | 39.4 | 12 | 0 | 13.6 | 15 | 0 | 750 | 9.6% | 22.4% | 150 |
| M3741 | 3 | 12 | 44 | 12 | 0 | 14 | 15 | 0 | 750 | 11.7% | 24.9% | 100 |
| M3742 | 4 | 16 | 52.8 | 12.2 | 0 | 0 | 15 | 0 | 800 | 11.2% | 21.8% | 100 |
| M3743 | 3.6 | 16.6 | 53.6 | 12.2 | 0 | 0 | 14 | 0 | 800 | 12.3% | 20.6% | 50 |
| M3744 | 3 | 12 | 57.4 | 12.2 | 0 | 0.4 | 15 | 0 | 800 | 12.9% | 24.7% | 50 |
| M3745 | 4 | 16 | 52.2 | 12.2 | 0 | 0.6 | 15 | 0 | 800 | 11.1% | 21.8% | 100 |
| M3746 | 3 | 12 | 56.8 | 12.2 | 0 | 1 | 15 | 0 | 800 | 12.8% | 24.8% | 50 |
| M3747 | 4 | 16 | 51.6 | 12.2 | 0 | 1.2 | 15 | 0 | 800 | 11.0% | 21.8% | 100 |
| M3748 | 3 | 12 | 56.2 | 12.2 | 0 | 1.6 | 15 | 0 | 800 | 12.8% | 24.8% | 50 |
| M3749 | 4 | 16 | 51 | 12.2 | 0 | 1.8 | 15 | 0 | 800 | 10.9% | 21.9% | 100 |
| M3750 | 3 | 12 | 55.6 | 12.2 | 0 | 2.2 | 15 | 0 | 800 | 12.7% | 24.8% | 50 |
| M3751 | 4 | 16 | 50.4 | 12.2 | 0 | 2.4 | 15 | 0 | 800 | 11.0% | 21.9% | 100 |
| M3752 | 3 | 12 | 55 | 12.2 | 0 | 2.8 | 15 | 0 | 800 | 12.6% | 24.9% | 50 |
| M3753 | 4 | 16 | 49.6 | 12.2 | 0 | 3.2 | 15 | 0 | 800 | 10.9% | 21.9% | 100 |
| M3754 | 4 | 16 | 49 | 12.2 | 0 | 3.8 | 15 | 0 | 800 | 10.8% | 21.9% | 100 |
| M3755 | 4 | 16 | 42.8 | 12.2 | 0 | 10 | 15 | 0 | 750 | 9.9% | 22.2% | 150 |
| M3756 | 4 | 16 | 42.2 | 12.2 | 0 | 10.6 | 15 | 0 | 750 | 9.8% | 22.2% | 200 |
| M3757 | 3 | 12 | 46.6 | 12.2 | 0 | 11.2 | 15 | 0 | 750 | 11.9% | 25.2% | 100 |
| M3758 | 4 | 16 | 41.4 | 12.2 | 0 | 11.4 | 15 | 0 | 750 | 9.8% | 22.2% | 200 |
| M3759 | 3 | 12 | 46 | 12.2 | 0 | 11.8 | 15 | 0 | 750 | 11.8% | 25.1% | 100 |
| M3760 | 4 | 16 | 40.8 | 12.2 | 0 | 12 | 15 | 0 | 750 | 9.7% | 22.3% | 200 |
| M3761 | 3 | 12 | 45.4 | 12.2 | 0 | 12.4 | 15 | 0 | 750 | 11.8% | 25.0% | 100 |
| M3762 | 4 | 16 | 40.2 | 12.2 | 0 | 12.6 | 15 | 0 | 750 | 9.6% | 22.3% | 200 |
| M3763 | 3 | 12 | 44.8 | 12.2 | 0 | 13 | 15 | 0 | 750 | 11.8% | 25.0% | 100 |
| M3764 | 4 | 16 | 39.6 | 12.2 | 0 | 13.2 | 15 | 0 | 750 | 9.6% | 22.3% | 200 |
| M3765 | 3 | 12 | 44.2 | 12.2 | 0 | 13.6 | 15 | 0 | 750 | 11.7% | 24.9% | 100 |
| M3766 | 4 | 16 | 39 | 12.2 | 0 | 13.8 | 15 | 0 | 750 | 9.5% | 22.4% | 150 |
| M3767 | 3 | 12 | 57.6 | 12.4 | 0 | 0 | 15 | 0 | 800 | 13.0% | 24.7% | 50 |
| M3768 | 4 | 16 | 52.4 | 12.4 | 0 | 0.2 | 15 | 0 | 800 | 11.2% | 21.8% | 100 |
| M3769 | 3 | 12 | 57 | 12.4 | 0 | 0.6 | 15 | 0 | 800 | 12.9% | 24.7% | 50 |
| M3770 | 4 | 16 | 51.8 | 12.4 | 0 | 0.8 | 15 | 0 | 800 | 11.0% | 21.8% | 100 |
| M3771 | 3 | 12 | 56.4 | 12.4 | 0 | 1.2 | 15 | 0 | 800 | 12.8% | 24.8% | 50 |
| M3772 | 4 | 16 | 51.2 | 12.4 | 0 | 1.4 | 15 | 0 | 800 | 10.9% | 21.8% | 100 |
| M3773 | 3 | 12 | 55.8 | 12.4 | 0 | 1.8 | 15 | 0 | 800 | 12.7% | 24.8% | 50 |
| M3774 | 4 | 16 | 50.6 | 12.4 | 0 | 2 | 15 | 0 | 800 | 10.8% | 21.9% | 100 |
| M3775 | 3 | 12 | 55.2 | 12.4 | 0 | 2.4 | 15 | 0 | 800 | 12.7% | 24.8% | 50 |
| M3776 | 4 | 16 | 50 | 12.4 | 0 | 2.6 | 15 | 0 | 800 | 11.0% | 21.9% | 100 |
| M3777 | 4 | 16 | 49.6 | 12.4 | 0 | 3 | 15 | 0 | 800 | 10.9% | 21.9% | 100 |
| M3778 | 4 | 16 | 49 | 12.4 | 0 | 3.6 | 15 | 0 | 800 | 10.8% | 21.9% | 100 |
| M3779 | 4 | 16 | 48.4 | 12.4 | 0 | 4.2 | 15 | 0 | 800 | 10.7% | 21.9% | 100 |
| M3780 | 4 | 16 | 42 | 12.4 | 0 | 10.6 | 15 | 0 | 750 | 9.8% | 22.2% | 200 |
| M3781 | 3 | 12 | 46.4 | 12.4 | 0 | 11.2 | 15 | 0 | 750 | 11.9% | 25.2% | 100 |
| M3782 | 4 | 16 | 41.2 | 12.4 | 0 | 11.4 | 15 | 0 | 750 | 9.7% | 22.2% | 200 |
| M3783 | 3 | 12 | 45.8 | 12.4 | 0 | 11.8 | 15 | 0 | 750 | 11.8% | 25.1% | 100 |
| M3784 | 4 | 16 | 40.6 | 12.4 | 0 | 12 | 15 | 0 | 750 | 9.7% | 22.3% | 200 |
| M3785 | 3 | 12 | 45.2 | 12.4 | 0 | 12.4 | 15 | 0 | 750 | 11.8% | 25.1% | 100 |
| M3786 | 4 | 16 | 40 | 12.4 | 0 | 12.6 | 15 | 0 | 750 | 9.6% | 22.3% | 200 |
| M3787 | 3 | 12 | 44.6 | 12.4 | 0 | 13 | 15 | 0 | 750 | 11.8% | 25.0% | 100 |
| M3788 | 4 | 16 | 39.4 | 12.4 | 0 | 13.2 | 15 | 0 | 750 | 9.6% | 22.3% | 200 |
| M3789 | 3 | 12 | 44 | 12.4 | 0 | 13.6 | 15 | 0 | 750 | 11.7% | 24.9% | 100 |
| M3790 | 4 | 16 | 38.8 | 12.4 | 0 | 13.8 | 15 | 0 | 750 | 9.5% | 22.4% | 150 |
| M3791 | 3 | 12 | 62.5 | 12.5 | 0 | 0 | 10 | 0 | 800 | 8.6% | 15.7% | −50 |
| M3792 | 3.5 | 12 | 61 | 12.5 | 0 | 0 | 11 | 0 | 850 | 7.7% | 17.6% | 0 |
| M3793 | 3 | 12 | 59.5 | 12.5 | 0 | 0 | 13 | 0 | 800 | 11.1% | 21.2% | 0 |
| M3794 | 3 | 12 | 58.5 | 12.5 | 0 | 0 | 14 | 0 | 800 | 12.0% | 23.4% | 0 |
| M3795 | 3 | 12 | 57.5 | 12.5 | 0 | 0 | 15 | 0 | 800 | 13.0% | 24.7% | 50 |
| M3796 | 3 | 12.5 | 62 | 12.5 | 0 | 0 | 10 | 0 | 800 | 8.9% | 15.4% | −50 |
| M3797 | 3.5 | 12.5 | 60.5 | 12.5 | 0 | 0 | 11 | 0 | 850 | 7.9% | 17.3% | 0 |
| M3798 | 4 | 12.5 | 59 | 12.5 | 0 | 0 | 12 | 0 | 850 | 7.1% | 19.2% | 50 |
| M3799 | 4 | 12.5 | 58 | 12.5 | 0 | 0 | 13 | 0 | 850 | 7.7% | 20.9% | 100 |
| M3800 | 4 | 12.5 | 57 | 12.5 | 0 | 0 | 14 | 0 | 800 | 8.4% | 22.6% | 100 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M3801 | 3 | 13 | 61.5 | 12.5 | 0 | 0 | 10 | 0 | 800 | 9.2% | 15.1% | −50 |
| M3802 | 3.5 | 13 | 60 | 12.5 | 0 | 0 | 11 | 0 | 850 | 8.2% | 17.0% | 0 |
| M3803 | 4 | 13 | 58.5 | 12.5 | 0 | 0 | 12 | 0 | 850 | 7.3% | 18.9% | 50 |
| M3804 | 4 | 13 | 57.5 | 12.5 | 0 | 0 | 13 | 0 | 850 | 8.0% | 20.6% | 100 |
| M3805 | 4 | 13 | 56.5 | 12.5 | 0 | 0 | 14 | 0 | 800 | 8.7% | 22.3% | 100 |
| M3806 | 3 | 13.5 | 61 | 12.5 | 0 | 0 | 10 | 0 | 800 | 9.4% | 14.8% | −50 |
| M3807 | 3.5 | 13.5 | 59.5 | 12.5 | 0 | 0 | 11 | 0 | 850 | 8.5% | 16.6% | 0 |
| M3808 | 4 | 13.5 | 58 | 12.5 | 0 | 0 | 12 | 0 | 850 | 7.6% | 18.5% | 50 |
| M3809 | 4 | 13.5 | 57 | 12.5 | 0 | 0 | 13 | 0 | 800 | 8.2% | 20.2% | 100 |
| M3810 | 4 | 13.5 | 56 | 12.5 | 0 | 0 | 14 | 0 | 800 | 8.9% | 21.9% | 100 |
| M3811 | 3 | 14 | 60.5 | 12.5 | 0 | 0 | 10 | 0 | 800 | 9.7% | 14.4% | −50 |
| M3812 | 3.5 | 14 | 59 | 12.5 | 0 | 0 | 11 | 0 | 850 | 8.7% | 16.3% | 0 |
| M3813 | 3.5 | 14 | 58 | 12.5 | 0 | 0 | 12 | 0 | 800 | 9.5% | 18.0% | 0 |
| M3814 | 3.5 | 14 | 57 | 12.5 | 0 | 0 | 13 | 0 | 800 | 10.3% | 19.8% | 50 |
| M3815 | 4 | 14 | 55.5 | 12.5 | 0 | 0 | 14 | 0 | 800 | 9.2% | 21.6% | 100 |
| M3816 | 3 | 14.5 | 60 | 12.5 | 0 | 0 | 10 | 0 | 800 | 10.0% | 14.1% | −50 |
| M3817 | 3.5 | 14.5 | 58.5 | 12.5 | 0 | 0 | 11 | 0 | 800 | 9.0% | 16.0% | 0 |
| M3818 | 3.5 | 14.5 | 57.5 | 12.5 | 0 | 0 | 12 | 0 | 800 | 9.7% | 17.7% | 0 |
| M3819 | 3.5 | 14.5 | 56.5 | 12.5 | 0 | 0 | 13 | 0 | 800 | 10.6% | 19.4% | 50 |
| M3820 | 4 | 14.5 | 55 | 12.5 | 0 | 0 | 14 | 0 | 800 | 9.5% | 21.2% | 100 |
| M3821 | 3 | 15 | 59.5 | 12.5 | 0 | 0 | 10 | 0 | 800 | 10.3% | 13.8% | −50 |
| M3822 | 3 | 15 | 58.5 | 12.5 | 0 | 0 | 11 | 0 | 800 | 11.1% | 15.6% | −50 |
| M3823 | 3 | 15 | 57.5 | 12.5 | 0 | 0 | 12 | 0 | 800 | 12.0% | 17.9% | −50 |
| M3824 | 3 | 15 | 56.5 | 12.5 | 0 | 0 | 13 | 0 | 800 | 13.0% | 20.2% | 0 |
| M3825 | 3.5 | 15 | 55 | 12.5 | 0 | 0 | 14 | 0 | 800 | 11.8% | 20.9% | 50 |
| M3826 | 4 | 15 | 53.5 | 12.5 | 0 | 0 | 15 | 0 | 800 | 10.6% | 22.5% | 100 |
| M3827 | 4 | 15.5 | 58 | 12.5 | 0 | 0 | 10 | 0 | 850 | 7.3% | 13.7% | 0 |
| M3828 | 4 | 15.5 | 57 | 12.5 | 0 | 0 | 11 | 0 | 850 | 7.9% | 15.5% | 0 |
| M3829 | 4 | 15.5 | 56 | 12.5 | 0 | 0 | 12 | 0 | 850 | 8.6% | 17.2% | 50 |
| M3830 | 3.5 | 15.5 | 54.5 | 12.5 | 0 | 0 | 14 | 0 | 800 | 12.1% | 21.1% | 50 |
| M3831 | 4 | 15.5 | 53 | 12.5 | 0 | 0 | 15 | 0 | 800 | 10.9% | 22.1% | 100 |
| M3832 | 4 | 16 | 57.5 | 12.5 | 0 | 0 | 10 | 0 | 850 | 7.5% | 13.4% | 0 |
| M3833 | 4 | 16 | 56.5 | 12.5 | 0 | 0 | 11 | 0 | 850 | 8.1% | 15.1% | 0 |
| M3834 | 4 | 16 | 55.5 | 12.5 | 0 | 0 | 12 | 0 | 850 | 8.8% | 16.8% | 50 |
| M3835 | 3.5 | 16 | 54 | 12.5 | 0 | 0 | 14 | 0 | 800 | 12.4% | 21.2% | 0 |
| M3836 | 3.6 | 11 | 58.7 | 12.6 | 0 | 0 | 14.1 | 0 | 800 | 9.1% | 23.8% | 100 |
| M3837 | 3 | 12 | 57.2 | 12.6 | 0 | 0.2 | 15 | 0 | 800 | 13.0% | 24.7% | 50 |
| M3838 | 4 | 16 | 52 | 12.6 | 0 | 0.4 | 15 | 0 | 800 | 11.1% | 21.8% | 100 |
| M3839 | 3 | 12 | 56.6 | 12.6 | 0 | 0.8 | 15 | 0 | 800 | 12.9% | 24.7% | 50 |
| M3840 | 4 | 16 | 51.4 | 12.6 | 0 | 1 | 15 | 0 | 800 | 11.0% | 21.8% | 100 |
| M3841 | 3 | 12 | 56 | 12.6 | 0 | 1.4 | 15 | 0 | 800 | 12.8% | 24.8% | 50 |
| M3842 | 4 | 16 | 50.8 | 12.6 | 0 | 1.6 | 15 | 0 | 800 | 10.9% | 21.8% | 100 |
| M3843 | 3 | 12 | 55.4 | 12.6 | 0 | 2 | 15 | 0 | 800 | 12.7% | 24.8% | 50 |
| M3844 | 4 | 16 | 50.2 | 12.6 | 0 | 2.2 | 15 | 0 | 800 | 10.8% | 21.9% | 100 |
| M3845 | 3 | 12 | 54.8 | 12.6 | 0 | 2.6 | 15 | 0 | 800 | 12.7% | 24.8% | 50 |
| M3846 | 4 | 16 | 49.4 | 12.6 | 0 | 3 | 15 | 0 | 800 | 10.9% | 21.9% | 100 |
| M3847 | 4 | 16 | 48.8 | 12.6 | 0 | 3.6 | 15 | 0 | 800 | 10.8% | 21.9% | 100 |
| M3848 | 4 | 16 | 42.2 | 12.6 | 0 | 10.2 | 15 | 0 | 750 | 9.9% | 22.1% | 200 |
| M3849 | 4 | 16 | 41.6 | 12.6 | 0 | 10.8 | 15 | 0 | 750 | 9.8% | 22.2% | 200 |
| M3850 | 4 | 16 | 41.2 | 12.6 | 0 | 11.2 | 15 | 0 | 750 | 9.8% | 22.2% | 200 |
| M3851 | 3 | 12 | 45.8 | 12.6 | 0 | 11.6 | 15 | 0 | 750 | 11.8% | 25.2% | 100 |
| M3852 | 4 | 16 | 40.6 | 12.6 | 0 | 11.8 | 15 | 0 | 750 | 9.7% | 22.2% | 200 |
| M3853 | 3 | 12 | 45.2 | 12.6 | 0 | 12.2 | 15 | 0 | 750 | 11.8% | 25.1% | 100 |
| M3854 | 4 | 16 | 40 | 12.6 | 0 | 12.4 | 15 | 0 | 750 | 9.6% | 22.3% | 200 |
| M3855 | 3 | 12 | 44.6 | 12.6 | 0 | 12.8 | 15 | 0 | 750 | 11.8% | 25.0% | 100 |
| M3856 | 4 | 16 | 39.4 | 12.6 | 0 | 13 | 15 | 0 | 750 | 9.6% | 22.3% | 200 |
| M3857 | 3 | 12 | 44 | 12.6 | 0 | 13.4 | 15 | 0 | 750 | 11.7% | 25.0% | 100 |
| M3858 | 4 | 16 | 38.8 | 12.6 | 0 | 13.6 | 15 | 0 | 750 | 9.5% | 22.3% | 150 |
| M3859 | 3 | 12 | 43.4 | 12.6 | 0 | 14 | 15 | 0 | 750 | 11.7% | 24.9% | 100 |
| M3860 | 3 | 12 | 57.2 | 12.8 | 0 | 0 | 15 | 0 | 800 | 13.0% | 24.7% | 50 |
| M3861 | 4 | 16 | 52 | 12.8 | 0 | 0.2 | 15 | 0 | 800 | 11.2% | 21.8% | 100 |
| M3862 | 3 | 12 | 56.6 | 12.8 | 0 | 0.6 | 15 | 0 | 800 | 12.9% | 24.7% | 50 |
| M3863 | 4 | 16 | 51.4 | 12.8 | 0 | 0.8 | 15 | 0 | 800 | 11.1% | 21.8% | 100 |
| M3864 | 3 | 12 | 56 | 12.8 | 0 | 1.2 | 15 | 0 | 800 | 12.8% | 24.8% | 50 |
| M3865 | 4 | 16 | 50.8 | 12.8 | 0 | 1.4 | 15 | 0 | 800 | 10.9% | 21.8% | 100 |
| M3866 | 3 | 12 | 55.4 | 12.8 | 0 | 1.8 | 15 | 0 | 800 | 12.8% | 24.8% | 50 |
| M3867 | 4 | 16 | 50.2 | 12.8 | 0 | 2 | 15 | 0 | 800 | 10.8% | 21.8% | 100 |
| M3868 | 3 | 12 | 54.8 | 12.8 | 0 | 2.4 | 15 | 0 | 800 | 12.7% | 24.8% | 50 |
| M3869 | 4 | 16 | 49.6 | 12.8 | 0 | 2.6 | 15 | 0 | 800 | 11.0% | 21.9% | 100 |
| M3870 | 4 | 16 | 49 | 12.8 | 0 | 3.2 | 15 | 0 | 800 | 10.9% | 21.9% | 100 |
| M3871 | 4 | 16 | 48.4 | 12.8 | 0 | 3.8 | 15 | 0 | 800 | 10.8% | 21.9% | 100 |
| M3872 | 4 | 16 | 41.8 | 12.8 | 0 | 10.4 | 15 | 0 | 750 | 9.8% | 22.1% | 200 |
| M3873 | 4 | 16 | 41.2 | 12.8 | 0 | 11 | 15 | 0 | 750 | 9.8% | 22.2% | 200 |
| M3874 | 4 | 16 | 40.8 | 12.8 | 0 | 11.4 | 15 | 0 | 750 | 9.7% | 22.2% | 200 |
| M3875 | 3 | 12 | 45.4 | 12.8 | 0 | 11.8 | 15 | 0 | 750 | 11.8% | 25.2% | 100 |
| M3876 | 4 | 16 | 40.2 | 12.8 | 0 | 12 | 15 | 0 | 750 | 9.7% | 22.2% | 200 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3877 | 3 | 12 | 44.8 | 12.8 | 0 | 12.4 | 15 | 0 | 750 | 11.8% | 25.1% | 100 |
| M3878 | 4 | 16 | 39.6 | 12.8 | 0 | 12.6 | 15 | 0 | 750 | 9.6% | 22.3% | 200 |
| M3879 | 3 | 12 | 44.2 | 12.8 | 0 | 13 | 15 | 0 | 750 | 11.7% | 25.0% | 100 |
| M3880 | 4 | 16 | 39 | 12.8 | 0 | 13.2 | 15 | 0 | 750 | 9.6% | 22.3% | 200 |
| M3881 | 3 | 12 | 43.6 | 12.8 | 0 | 13.6 | 15 | 0 | 750 | 11.7% | 25.0% | 100 |
| M3882 | 4 | 16 | 38.4 | 12.8 | 0 | 13.8 | 15 | 0 | 750 | 9.5% | 22.3% | 150 |
| M3883 | 3.75 | 7 | 56.25 | 13 | 0 | 0 | 20 | 0 | 800 | 8.0% | 32.8% | 200 |
| M3884 | 4 | 8 | 55 | 13 | 0 | 0 | 20 | 0 | 800 | 9.0% | 33.9% | 200 |
| M3885 | 4 | 11 | 52 | 13 | 0 | 0 | 20 | 0 | 800 | 12.6% | 33.3% | 200 |
| M3886 | 3 | 12 | 60 | 13 | 2 | 0 | 10 | 0 | 800 | 9.0% | 16.4% | 0 |
| M3887 | 3 | 12 | 57 | 13 | 5 | 0 | 10 | 0 | 750 | 9.3% | 13.4% | 0 |
| M3888 | 3.5 | 12 | 59.5 | 13 | 2 | 0 | 10 | 0 | 800 | 7.4% | 16.5% | 50 |
| M3889 | 3.5 | 12 | 56.5 | 13 | 5 | 0 | 10 | 0 | 750 | 7.8% | 15.6% | 50 |
| M3890 | 3 | 12 | 59 | 13 | 2 | 0 | 11 | 0 | 800 | 9.8% | 18.3% | 0 |
| M3891 | 3 | 12 | 56 | 13 | 5 | 0 | 11 | 0 | 750 | 10.0% | 14.5% | 50 |
| M3892 | 3.5 | 12 | 58.5 | 13 | 2 | 0 | 11 | 0 | 800 | 8.0% | 18.4% | 50 |
| M3893 | 3.5 | 12 | 55.5 | 13 | 5 | 0 | 11 | 0 | 750 | 8.5% | 16.9% | 100 |
| M3894 | 3 | 12 | 59 | 13 | 1 | 0 | 12 | 0 | 800 | 10.4% | 19.8% | 0 |
| M3895 | 3 | 12 | 56 | 13 | 4 | 0 | 12 | 0 | 750 | 10.8% | 17.4% | 50 |
| M3896 | 3.5 | 12 | 58.5 | 13 | 1 | 0 | 12 | 0 | 800 | 8.6% | 19.8% | 50 |
| M3897 | 3.5 | 12 | 55.5 | 13 | 4 | 0 | 12 | 0 | 750 | 9.1% | 19.8% | 100 |
| M3898 | 4 | 12 | 57 | 13 | 2 | 0 | 12 | 0 | 800 | 7.2% | 20.3% | 100 |
| M3899 | 4 | 12 | 54 | 13 | 5 | 0 | 12 | 0 | 750 | 7.7% | 20.3% | 150 |
| M3900 | 3 | 12 | 57 | 13 | 2 | 0 | 13 | 0 | 750 | 11.5% | 22.0% | 50 |
| M3901 | 3 | 12 | 54 | 13 | 5 | 0 | 13 | 0 | 750 | 11.5% | 15.8% | 50 |
| M3902 | 3.5 | 12 | 56.5 | 13 | 2 | 0 | 13 | 0 | 750 | 9.5% | 22.0% | 50 |
| M3903 | 3.5 | 12 | 53.5 | 13 | 5 | 0 | 13 | 0 | 750 | 9.9% | 18.9% | 100 |
| M3904 | 4 | 12 | 56 | 13 | 2 | 0 | 13 | 0 | 800 | 7.9% | 22.1% | 100 |
| M3905 | 4 | 12 | 53 | 13 | 5 | 0 | 13 | 0 | 750 | 8.4% | 21.4% | 150 |
| M3906 | 3 | 12 | 56 | 13 | 2 | 0 | 14 | 0 | 750 | 12.4% | 24.1% | 50 |
| M3907 | 3 | 12 | 53 | 13 | 5 | 0 | 14 | 0 | 750 | 12.2% | 16.6% | 50 |
| M3908 | 3.5 | 12 | 55.5 | 13 | 2 | 0 | 14 | 0 | 750 | 10.4% | 23.7% | 100 |
| M3909 | 3.5 | 12 | 52.5 | 13 | 5 | 0 | 14 | 0 | 750 | 10.6% | 19.7% | 100 |
| M3910 | 4 | 12 | 55 | 13 | 2 | 0 | 14 | 0 | 800 | 8.6% | 23.8% | 150 |
| M3911 | 4 | 12 | 52 | 13 | 5 | 0 | 14 | 0 | 750 | 9.0% | 22.4% | 150 |
| M3912 | 3.5 | 12 | 56.5 | 13 | 0 | 0 | 15 | 0 | 800 | 10.8% | 24.6% | 100 |
| M3913 | 3.5 | 12 | 53.5 | 13 | 3 | 0 | 15 | 0 | 750 | 11.5% | 24.8% | 100 |
| M3914 | 4 | 12 | 56 | 13 | 0 | 0 | 15 | 0 | 800 | 8.9% | 24.6% | 100 |
| M3915 | 4 | 12 | 53 | 13 | 3 | 0 | 15 | 0 | 750 | 9.5% | 25.9% | 150 |
| M3916 | 3 | 12.5 | 61.5 | 13 | 0 | 0 | 10 | 0 | 800 | 8.9% | 15.4% | −50 |
| M3917 | 3.5 | 12.5 | 60 | 13 | 0 | 0 | 11 | 0 | 800 | 8.0% | 17.3% | 0 |
| M3918 | 4 | 12.5 | 58.5 | 13 | 0 | 0 | 12 | 0 | 850 | 7.1% | 19.2% | 50 |
| M3919 | 4 | 12.5 | 57.5 | 13 | 0 | 0 | 13 | 0 | 800 | 7.8% | 20.9% | 100 |
| M3920 | 4 | 12.5 | 56.5 | 13 | 0 | 0 | 14 | 0 | 800 | 8.4% | 22.6% | 100 |
| M3921 | 3 | 13 | 61 | 13 | 0 | 0 | 10 | 0 | 800 | 9.2% | 15.1% | −50 |
| M3922 | 3 | 13 | 58 | 13 | 3 | 0 | 10 | 0 | 750 | 9.7% | 15.9% | 0 |
| M3923 | 3.5 | 13 | 60.5 | 13 | 0 | 0 | 10 | 0 | 850 | 7.6% | 15.1% | 0 |
| M3924 | 3.5 | 13 | 57.5 | 13 | 3 | 0 | 10 | 0 | 800 | 8.0% | 16.2% | 50 |
| M3925 | 3 | 13 | 60 | 13 | 0 | 0 | 11 | 0 | 800 | 10.0% | 16.9% | −50 |
| M3926 | 3 | 13 | 57 | 13 | 3 | 0 | 11 | 0 | 750 | 10.5% | 17.2% | 0 |
| M3927 | 3.5 | 13 | 59.5 | 13 | 0 | 0 | 11 | 0 | 800 | 8.2% | 16.9% | 0 |
| M3928 | 3.5 | 13 | 56.5 | 13 | 3 | 0 | 11 | 0 | 800 | 8.7% | 18.0% | 50 |
| M3929 | 4 | 13 | 57 | 13 | 2 | 0 | 11 | 0 | 800 | 7.1% | 17.8% | 50 |
| M3930 | 4 | 13 | 54 | 13 | 5 | 0 | 11 | 0 | 750 | 7.5% | 17.8% | 150 |
| M3931 | 3 | 13 | 57 | 13 | 2 | 0 | 12 | 0 | 750 | 11.2% | 19.5% | 0 |
| M3932 | 3 | 13 | 54 | 13 | 5 | 0 | 12 | 0 | 750 | 11.2% | 13.6% | 50 |
| M3933 | 3.5 | 13 | 56.5 | 13 | 2 | 0 | 12 | 0 | 800 | 9.3% | 19.5% | 50 |
| M3934 | 3.5 | 13 | 53.5 | 13 | 5 | 0 | 12 | 0 | 750 | 9.6% | 16.6% | 100 |
| M3935 | 4 | 13 | 56 | 13 | 2 | 0 | 12 | 0 | 800 | 7.7% | 19.6% | 100 |
| M3936 | 4 | 13 | 53 | 13 | 5 | 0 | 12 | 0 | 750 | 8.2% | 19.0% | 200 |
| M3937 | 3 | 13 | 56 | 13 | 2 | 0 | 13 | 0 | 750 | 12.1% | 22.2% | 0 |
| M3938 | 3 | 13 | 53 | 13 | 5 | 0 | 13 | 0 | 750 | 11.9% | 15.6% | 50 |
| M3939 | 3.5 | 13 | 55.5 | 13 | 2 | 0 | 13 | 0 | 750 | 10.1% | 21.2% | 50 |
| M3940 | 3.5 | 13 | 52.5 | 13 | 5 | 0 | 13 | 0 | 750 | 10.4% | 17.4% | 100 |
| M3941 | 4 | 13 | 55 | 13 | 2 | 0 | 13 | 0 | 800 | 8.4% | 21.3% | 100 |
| M3942 | 4 | 13 | 52 | 13 | 5 | 0 | 13 | 0 | 750 | 8.8% | 20.1% | 150 |
| M3943 | 3.5 | 13 | 56.5 | 13 | 0 | 0 | 14 | 0 | 800 | 10.6% | 22.2% | 50 |
| M3944 | 3.5 | 13 | 53.5 | 13 | 3 | 0 | 14 | 0 | 750 | 11.2% | 22.5% | 100 |
| M3945 | 4 | 13 | 56 | 13 | 0 | 0 | 14 | 0 | 800 | 8.7% | 22.2% | 100 |
| M3946 | 4 | 13 | 53 | 13 | 3 | 0 | 14 | 0 | 750 | 9.3% | 23.4% | 150 |
| M3947 | 3.5 | 13 | 55.5 | 13 | 0 | 0 | 15 | 0 | 800 | 11.4% | 23.9% | 50 |
| M3948 | 3.5 | 13 | 52.5 | 13 | 3 | 0 | 15 | 0 | 750 | 12.1% | 24.8% | 100 |
| M3949 | 4 | 13 | 55 | 13 | 0 | 0 | 15 | 0 | 800 | 9.5% | 23.9% | 100 |
| M3950 | 4 | 13 | 52 | 13 | 3 | 0 | 15 | 0 | 750 | 10.1% | 25.1% | 150 |
| M3951 | 3 | 13.5 | 60.5 | 13 | 0 | 0 | 10 | 0 | 800 | 9.5% | 14.7% | −50 |
| M3952 | 3.5 | 13.5 | 59 | 13 | 0 | 0 | 11 | 0 | 800 | 8.5% | 16.6% | 0 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M3953 | 3.5 | 13.5 | 58 | 13 | 0 | 0 | 12 | 0 | 800 | 9.2% | 18.4% | 0 |
| M3954 | 3.5 | 13.5 | 57 | 13 | 0 | 0 | 13 | 0 | 800 | 10.0% | 20.1% | 50 |
| M3955 | 3.5 | 13.5 | 56 | 13 | 0 | 0 | 14 | 0 | 800 | 10.9% | 21.9% | 50 |
| M3956 | 4 | 13.5 | 54.5 | 13 | 0 | 0 | 15 | 0 | 800 | 9.8% | 23.6% | 100 |
| M3957 | 3 | 14 | 58 | 13 | 2 | 0 | 10 | 0 | 800 | 10.1% | 15.0% | −50 |
| M3958 | 3 | 14 | 55 | 13 | 5 | 0 | 10 | 0 | 750 | 10.2% | 10.7% | 0 |
| M3959 | 3.5 | 14 | 57.5 | 13 | 2 | 0 | 10 | 0 | 800 | 8.4% | 15.1% | 0 |
| M3960 | 3.5 | 14 | 54.5 | 13 | 5 | 0 | 10 | 0 | 750 | 8.7% | 13.2% | 100 |
| M3961 | 4 | 14 | 54 | 13 | 5 | 0 | 10 | 0 | 750 | 7.4% | 15.2% | 150 |
| M3962 | 3 | 14 | 57 | 13 | 2 | 0 | 11 | 0 | 750 | 10.9% | 16.9% | 0 |
| M3963 | 3 | 14 | 54 | 13 | 5 | 0 | 11 | 0 | 750 | 11.0% | 11.4% | 0 |
| M3964 | 3.5 | 14 | 56.5 | 13 | 2 | 0 | 11 | 0 | 800 | 9.1% | 16.9% | 0 |
| M3965 | 3.5 | 14 | 53.5 | 13 | 5 | 0 | 11 | 0 | 750 | 9.4% | 14.3% | 50 |
| M3966 | 4 | 14 | 56 | 13 | 2 | 0 | 11 | 0 | 800 | 7.5% | 17.1% | 50 |
| M3967 | 4 | 14 | 53 | 13 | 5 | 0 | 11 | 0 | 750 | 8.0% | 16.5% | 150 |
| M3968 | 3 | 14 | 56 | 13 | 2 | 0 | 12 | 0 | 750 | 11.8% | 19.2% | 0 |
| M3969 | 3 | 14 | 53 | 13 | 5 | 0 | 12 | 0 | 750 | 11.7% | 12.7% | 0 |
| M3970 | 3.5 | 14 | 55.5 | 13 | 2 | 0 | 12 | 0 | 800 | 9.9% | 18.7% | 50 |
| M3971 | 3.5 | 14 | 52.5 | 13 | 5 | 0 | 12 | 0 | 750 | 10.1% | 15.2% | 50 |
| M3972 | 4 | 14 | 55 | 13 | 2 | 0 | 12 | 0 | 800 | 8.2% | 18.9% | 100 |
| M3973 | 4 | 14 | 52 | 13 | 5 | 0 | 12 | 0 | 750 | 8.6% | 17.7% | 150 |
| M3974 | 3 | 14 | 55 | 13 | 2 | 0 | 13 | 0 | 750 | 12.7% | 21.5% | 0 |
| M3975 | 3.5 | 14 | 56.5 | 13 | 0 | 0 | 13 | 0 | 800 | 10.3% | 19.8% | 50 |
| M3976 | 3.5 | 14 | 53.5 | 13 | 3 | 0 | 13 | 0 | 750 | 10.9% | 20.2% | 50 |
| M3977 | 4 | 14 | 56 | 13 | 0 | 0 | 13 | 0 | 800 | 8.5% | 19.9% | 50 |
| M3978 | 4 | 14 | 53 | 13 | 3 | 0 | 13 | 0 | 750 | 9.1% | 21.0% | 100 |
| M3979 | 3.5 | 14 | 55.5 | 13 | 0 | 0 | 14 | 0 | 800 | 11.2% | 21.5% | 50 |
| M3980 | 3.5 | 14 | 52.5 | 13 | 3 | 0 | 14 | 0 | 750 | 11.8% | 21.6% | 100 |
| M3981 | 4 | 14 | 55 | 13 | 0 | 0 | 14 | 0 | 800 | 9.2% | 21.5% | 100 |
| M3982 | 4 | 14 | 52 | 13 | 3 | 0 | 14 | 0 | 750 | 9.8% | 22.7% | 100 |
| M3983 | 3.5 | 14 | 54.5 | 13 | 0 | 0 | 15 | 0 | 800 | 12.1% | 24.0% | 50 |
| M3984 | 3.5 | 14 | 51.5 | 13 | 3 | 0 | 15 | 0 | 750 | 12.6% | 23.9% | 100 |
| M3985 | 4 | 14 | 54 | 13 | 0 | 0 | 15 | 0 | 800 | 10.0% | 23.2% | 100 |
| M3986 | 4 | 14 | 51 | 13 | 3 | 0 | 15 | 0 | 750 | 10.7% | 24.4% | 150 |
| M3987 | 3 | 14.5 | 59.5 | 13 | 0 | 0 | 10 | 0 | 800 | 10.0% | 14.1% | −50 |
| M3988 | 3.5 | 14.5 | 58 | 13 | 0 | 0 | 11 | 0 | 800 | 9.0% | 15.9% | 0 |
| M3989 | 3.5 | 14.5 | 57 | 13 | 0 | 0 | 12 | 0 | 800 | 9.8% | 17.7% | 0 |
| M3990 | 3.5 | 14.5 | 56 | 13 | 0 | 0 | 13 | 0 | 800 | 10.6% | 19.4% | 50 |
| M3991 | 4 | 14.5 | 54.5 | 13 | 0 | 0 | 14 | 0 | 800 | 9.5% | 21.2% | 100 |
| M3992 | 3 | 15 | 59 | 13 | 0 | 0 | 10 | 0 | 800 | 10.3% | 13.8% | −50 |
| M3993 | 3 | 15 | 56 | 13 | 3 | 0 | 10 | 0 | 750 | 10.8% | 13.6% | −50 |
| M3994 | 3.5 | 15 | 58.5 | 13 | 0 | 0 | 10 | 0 | 850 | 8.5% | 13.8% | 0 |
| M3995 | 3.5 | 15 | 55.5 | 13 | 3 | 0 | 10 | 0 | 800 | 9.0% | 14.7% | 50 |
| M3996 | 4 | 15 | 58 | 13 | 0 | 0 | 10 | 0 | 850 | 7.1% | 14.0% | 0 |
| M3997 | 4 | 15 | 55 | 13 | 3 | 0 | 10 | 0 | 800 | 7.5% | 14.9% | 100 |
| M3998 | 3 | 15 | 58 | 13 | 0 | 0 | 11 | 0 | 800 | 11.2% | 15.6% | −50 |
| M3999 | 3 | 15 | 55 | 13 | 3 | 0 | 11 | 0 | 750 | 11.6% | 14.6% | 0 |
| M4000 | 3.5 | 15 | 57.5 | 13 | 0 | 0 | 11 | 0 | 800 | 9.3% | 15.6% | 0 |
| M4001 | 3.5 | 15 | 54.5 | 13 | 3 | 0 | 11 | 0 | 750 | 9.8% | 16.5% | 50 |
| M4002 | 4 | 15 | 57 | 13 | 0 | 0 | 11 | 0 | 850 | 7.7% | 15.8% | 50 |
| M4003 | 4 | 15 | 54 | 13 | 3 | 0 | 11 | 0 | 800 | 8.2% | 16.7% | 100 |
| M4004 | 3 | 15 | 57 | 13 | 0 | 0 | 12 | 0 | 800 | 12.1% | 18.0% | −50 |
| M4005 | 3 | 15 | 54 | 13 | 3 | 0 | 12 | 0 | 750 | 12.4% | 18.0% | 0 |
| M4006 | 3.5 | 15 | 56.5 | 13 | 0 | 0 | 12 | 0 | 800 | 10.1% | 17.4% | 0 |
| M4007 | 3.5 | 15 | 53.5 | 13 | 3 | 0 | 12 | 0 | 750 | 10.6% | 17.9% | 50 |
| M4008 | 4 | 15 | 56 | 13 | 0 | 0 | 12 | 0 | 800 | 8.3% | 17.5% | 50 |
| M4009 | 4 | 15 | 53 | 13 | 3 | 0 | 12 | 0 | 800 | 8.9% | 18.5% | 150 |
| M4010 | 3 | 15 | 56 | 13 | 0 | 0 | 13 | 0 | 800 | 13.0% | 20.2% | 0 |
| M4011 | 3.5 | 15 | 53.5 | 13 | 2 | 0 | 13 | 0 | 750 | 11.3% | 19.8% | 50 |
| M4012 | 3.5 | 15 | 50.5 | 13 | 5 | 0 | 13 | 0 | 750 | 11.3% | 14.3% | 100 |
| M4013 | 4 | 15 | 53 | 13 | 2 | 0 | 13 | 0 | 800 | 9.4% | 19.9% | 100 |
| M4014 | 4 | 15 | 50 | 13 | 5 | 0 | 13 | 0 | 750 | 9.8% | 17.3% | 200 |
| M4015 | 3.5 | 15 | 52.5 | 13 | 2 | 0 | 14 | 0 | 750 | 12.2% | 22.7% | 50 |
| M4016 | 3.5 | 15 | 49.5 | 13 | 5 | 0 | 14 | 0 | 750 | 12.0% | 16.8% | 100 |
| M4017 | 4 | 15 | 52 | 13 | 2 | 0 | 14 | 0 | 750 | 10.2% | 21.6% | 100 |
| M4018 | 4 | 15 | 49 | 13 | 5 | 0 | 14 | 0 | 750 | 10.5% | 18.0% | 200 |
| M4019 | 4 | 15 | 53 | 13 | 0 | 0 | 15 | 0 | 800 | 10.6% | 22.5% | 100 |
| M4020 | 4 | 15 | 50 | 13 | 3 | 0 | 15 | 0 | 750 | 11.3% | 23.0% | 150 |
| M4021 | 3 | 15.5 | 58.5 | 13 | 0 | 0 | 10 | 0 | 800 | 10.6% | 13.4% | −50 |
| M4022 | 3 | 15.5 | 57.5 | 13 | 0 | 0 | 11 | 0 | 800 | 11.5% | 15.2% | −50 |
| M4023 | 3 | 15.5 | 56.5 | 13 | 0 | 0 | 12 | 0 | 800 | 12.4% | 18.2% | −50 |
| M4024 | 3.5 | 15.5 | 55 | 13 | 0 | 0 | 13 | 0 | 800 | 11.2% | 18.7% | 0 |
| M4025 | 4 | 15.5 | 53.5 | 13 | 0 | 0 | 14 | 0 | 800 | 10.1% | 20.5% | 50 |
| M4026 | 3 | 16 | 58 | 13 | 0 | 0 | 10 | 0 | 800 | 10.9% | 13.1% | −50 |
| M4027 | 3 | 16 | 55 | 13 | 3 | 0 | 10 | 0 | 750 | 11.4% | 12.3% | −50 |
| M4028 | 3.5 | 16 | 57.5 | 13 | 0 | 0 | 10 | 0 | 800 | 9.1% | 13.2% | −50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M4029 | 3.5 | 16 | 54.5 | 13 | 3 | 0 | 10 | 0 | 800 | 9.6% | 14.0% | 50 |
| M4030 | 4 | 16 | 57 | 13 | 0 | 0 | 10 | 0 | 850 | 7.5% | 13.4% | 0 |
| M4031 | 4 | 16 | 54 | 13 | 3 | 0 | 10 | 0 | 800 | 8.0% | 14.2% | 100 |
| M4032 | 3 | 16 | 57 | 13 | 0 | 0 | 11 | 0 | 800 | 11.8% | 15.0% | −50 |
| M4033 | 3 | 16 | 54 | 13 | 3 | 0 | 11 | 0 | 750 | 12.2% | 14.9% | −50 |
| M4034 | 3.5 | 16 | 56.5 | 13 | 0 | 0 | 11 | 0 | 800 | 9.8% | 14.9% | 0 |
| M4035 | 3.5 | 16 | 53.5 | 13 | 3 | 0 | 11 | 0 | 750 | 10.3% | 15.5% | 50 |
| M4036 | 4 | 16 | 56 | 13 | 0 | 0 | 11 | 0 | 850 | 8.2% | 15.1% | 0 |
| M4037 | 4 | 16 | 53 | 13 | 3 | 0 | 11 | 0 | 800 | 8.7% | 16.0% | 100 |
| M4038 | 3 | 16 | 56 | 13 | 0 | 0 | 12 | 0 | 800 | 12.7% | 18.3% | −50 |
| M4039 | 3.5 | 16 | 55.5 | 13 | 0 | 0 | 12 | 0 | 800 | 10.6% | 16.7% | 0 |
| M4040 | 3.5 | 16 | 52.5 | 13 | 3 | 0 | 12 | 0 | 750 | 11.2% | 16.6% | 50 |
| M4041 | 4 | 16 | 55 | 13 | 0 | 0 | 12 | 0 | 800 | 8.8% | 16.8% | 50 |
| M4042 | 4 | 16 | 52 | 13 | 3 | 0 | 12 | 0 | 800 | 9.4% | 17.7% | 150 |
| M4043 | 3.5 | 16 | 54.5 | 13 | 0 | 0 | 13 | 0 | 800 | 11.5% | 18.4% | 0 |
| M4044 | 3.5 | 16 | 51.5 | 13 | 3 | 0 | 13 | 0 | 750 | 12.0% | 18.7% | 50 |
| M4045 | 4 | 16 | 54 | 13 | 0 | 0 | 13 | 0 | 800 | 9.6% | 18.5% | 50 |
| M4046 | 4 | 16 | 51 | 13 | 3 | 0 | 13 | 0 | 750 | 10.2% | 19.4% | 150 |
| M4047 | 3.5 | 16 | 53.5 | 13 | 0 | 0 | 14 | 0 | 800 | 12.4% | 21.3% | 0 |
| M4048 | 3.5 | 16 | 48.5 | 13 | 5 | 0 | 14 | 0 | 750 | 12.4% | 16.3% | 150 |
| M4049 | 4 | 16 | 51 | 13 | 2 | 0 | 14 | 0 | 750 | 10.8% | 20.8% | 150 |
| M4050 | 4 | 16 | 48 | 13 | 5 | 0 | 14 | 0 | 750 | 10.9% | 16.5% | 200 |
| M4051 | 4 | 16 | 51 | 13 | 1 | 0 | 15 | 0 | 750 | 11.4% | 22.1% | 100 |
| M4052 | 4 | 16 | 48 | 13 | 4 | 0 | 15 | 0 | 750 | 11.8% | 19.9% | 200 |
| M4053 | 4 | 16 | 51.8 | 13 | 0 | 0.2 | 15 | 0 | 800 | 11.2% | 21.8% | 100 |
| M4054 | 3 | 12 | 56.4 | 13 | 0 | 0.6 | 15 | 0 | 800 | 12.9% | 24.7% | 50 |
| M4055 | 4 | 16 | 51.2 | 13 | 0 | 0.8 | 15 | 0 | 800 | 11.1% | 21.8% | 100 |
| M4056 | 3 | 12 | 55.8 | 13 | 0 | 1.2 | 15 | 0 | 800 | 12.8% | 24.7% | 50 |
| M4057 | 4 | 16 | 50.6 | 13 | 0 | 1.4 | 15 | 0 | 800 | 11.0% | 21.8% | 100 |
| M4058 | 3 | 12 | 55.2 | 13 | 0 | 1.8 | 15 | 0 | 800 | 12.8% | 24.8% | 50 |
| M4059 | 4 | 16 | 50 | 13 | 0 | 2 | 15 | 0 | 800 | 10.8% | 21.8% | 100 |
| M4060 | 3 | 12 | 54.6 | 13 | 0 | 2.4 | 15 | 0 | 800 | 12.7% | 24.8% | 50 |
| M4061 | 4 | 16 | 49.4 | 13 | 0 | 2.6 | 15 | 0 | 800 | 11.0% | 21.9% | 100 |
| M4062 | 4 | 16 | 48.8 | 13 | 0 | 3.2 | 15 | 0 | 800 | 10.9% | 21.9% | 100 |
| M4063 | 4 | 16 | 48.2 | 13 | 0 | 3.8 | 15 | 0 | 800 | 10.8% | 21.9% | 100 |
| M4064 | 4 | 16 | 41.4 | 13 | 0 | 10.6 | 15 | 0 | 750 | 9.8% | 22.2% | 200 |
| M4065 | 4 | 16 | 40.8 | 13 | 0 | 11.2 | 15 | 0 | 750 | 9.8% | 22.2% | 200 |
| M4066 | 3 | 12 | 45.4 | 13 | 0 | 11.6 | 15 | 0 | 750 | 11.8% | 25.2% | 100 |
| M4067 | 4 | 16 | 40.2 | 13 | 0 | 11.8 | 15 | 0 | 750 | 9.7% | 22.2% | 200 |
| M4068 | 3 | 12 | 44.8 | 13 | 0 | 12.2 | 15 | 0 | 750 | 11.8% | 25.1% | 100 |
| M4069 | 4 | 16 | 39.6 | 13 | 0 | 12.4 | 15 | 0 | 750 | 9.6% | 22.2% | 200 |
| M4070 | 3 | 12 | 44.2 | 13 | 0 | 12.8 | 15 | 0 | 750 | 11.7% | 25.1% | 100 |
| M4071 | 4 | 16 | 39 | 13 | 0 | 13 | 15 | 0 | 750 | 9.6% | 22.3% | 200 |
| M4072 | 3 | 12 | 43.6 | 13 | 0 | 13.4 | 15 | 0 | 750 | 11.7% | 25.0% | 100 |
| M4073 | 4 | 16 | 38.4 | 13 | 0 | 13.6 | 15 | 0 | 750 | 9.5% | 22.3% | 200 |
| M4074 | 3 | 12 | 43 | 13 | 0 | 14 | 15 | 0 | 750 | 11.7% | 25.0% | 100 |
| M4075 | 4 | 16 | 51.8 | 13.2 | 0 | 0 | 15 | 0 | 800 | 11.2% | 21.8% | 100 |
| M4076 | 3 | 12 | 56.4 | 13.2 | 0 | 0.4 | 15 | 0 | 800 | 12.9% | 24.7% | 50 |
| M4077 | 4 | 16 | 51.2 | 13.2 | 0 | 0.6 | 15 | 0 | 800 | 11.1% | 21.8% | 100 |
| M4078 | 3 | 12 | 55.8 | 13.2 | 0 | 1 | 15 | 0 | 800 | 12.9% | 24.7% | 50 |
| M4079 | 4 | 16 | 50.6 | 13.2 | 0 | 1.2 | 15 | 0 | 800 | 11.0% | 21.8% | 100 |
| M4080 | 3 | 12 | 55.2 | 13.2 | 0 | 1.6 | 15 | 0 | 800 | 12.8% | 24.8% | 50 |
| M4081 | 4 | 16 | 50 | 13.2 | 0 | 1.8 | 15 | 0 | 800 | 10.9% | 21.8% | 100 |
| M4082 | 3 | 12 | 54.6 | 13.2 | 0 | 2.2 | 15 | 0 | 800 | 12.7% | 24.8% | 50 |
| M4083 | 4 | 16 | 49.4 | 13.2 | 0 | 2.4 | 15 | 0 | 800 | 10.8% | 21.8% | 100 |
| M4084 | 4 | 16 | 48.8 | 13.2 | 0 | 3 | 15 | 0 | 800 | 10.9% | 21.9% | 100 |
| M4085 | 4 | 16 | 48.2 | 13.2 | 0 | 3.6 | 15 | 0 | 750 | 10.8% | 21.9% | 100 |
| M4086 | 4 | 16 | 41.2 | 13.2 | 0 | 10.6 | 15 | 0 | 750 | 9.8% | 22.1% | 200 |
| M4087 | 4 | 16 | 40.6 | 13.2 | 0 | 11.2 | 15 | 0 | 750 | 9.7% | 22.2% | 200 |
| M4088 | 3 | 12 | 45.2 | 13.2 | 0 | 11.6 | 15 | 0 | 750 | 11.8% | 25.2% | 100 |
| M4089 | 4 | 16 | 40 | 13.2 | 0 | 11.8 | 15 | 0 | 750 | 9.7% | 22.2% | 200 |
| M4090 | 3 | 12 | 44.6 | 13.2 | 0 | 12.2 | 15 | 0 | 750 | 11.8% | 25.2% | 100 |
| M4091 | 4 | 16 | 39.4 | 13.2 | 0 | 12.4 | 15 | 0 | 750 | 9.6% | 22.2% | 200 |
| M4092 | 3 | 12 | 44 | 13.2 | 0 | 12.8 | 15 | 0 | 750 | 11.7% | 25.1% | 100 |
| M4093 | 4 | 16 | 38.8 | 13.2 | 0 | 13 | 15 | 0 | 750 | 9.6% | 22.3% | 200 |
| M4094 | 3 | 12 | 43.4 | 13.2 | 0 | 13.4 | 15 | 0 | 750 | 11.7% | 25.1% | 100 |
| M4095 | 4 | 16 | 38.2 | 13.2 | 0 | 13.6 | 15 | 0 | 750 | 9.5% | 22.3% | 200 |
| M4096 | 3 | 12 | 42.8 | 13.2 | 0 | 14 | 15 | 0 | 750 | 11.7% | 25.0% | 100 |
| M4097 | 4 | 16 | 51.6 | 13.4 | 0 | 0 | 15 | 0 | 800 | 11.2% | 21.8% | 100 |
| M4098 | 4 | 16 | 51.4 | 13.4 | 0 | 0.2 | 15 | 0 | 800 | 11.2% | 21.8% | 100 |
| M4099 | 3 | 12 | 56 | 13.4 | 0 | 0.6 | 15 | 0 | 800 | 12.9% | 24.7% | 50 |
| M4100 | 4 | 16 | 50.8 | 13.4 | 0 | 0.8 | 15 | 0 | 800 | 11.1% | 21.8% | 100 |
| M4101 | 3 | 12 | 55.4 | 13.4 | 0 | 1.2 | 15 | 0 | 800 | 12.8% | 24.7% | 50 |
| M4102 | 4 | 16 | 50.2 | 13.4 | 0 | 1.4 | 15 | 0 | 800 | 11.0% | 21.8% | 100 |
| M4103 | 3 | 12 | 54.8 | 13.4 | 0 | 1.8 | 15 | 0 | 800 | 12.8% | 24.8% | 50 |
| M4104 | 4 | 16 | 49.6 | 13.4 | 0 | 2 | 15 | 0 | 800 | 10.9% | 21.8% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M4105 | 3 | 12 | 54.2 | 13.4 | 0 | 2.4 | 15 | 0 | 800 | 12.7% | 24.8% | 50 |
| M4106 | 4 | 16 | 48.8 | 13.4 | 0 | 2.8 | 15 | 0 | 750 | 10.7% | 21.9% | 100 |
| M4107 | 4 | 16 | 48.2 | 13.4 | 0 | 3.4 | 15 | 0 | 750 | 10.8% | 21.9% | 100 |
| M4108 | 4 | 16 | 41 | 13.4 | 0 | 10.6 | 15 | 0 | 750 | 9.8% | 22.1% | 200 |
| M4109 | 4 | 16 | 40.4 | 13.4 | 0 | 11.2 | 15 | 0 | 750 | 9.7% | 22.2% | 200 |
| M4110 | 3 | 12 | 45 | 13.4 | 0 | 11.6 | 15 | 0 | 750 | 11.8% | 25.2% | 100 |
| M4111 | 4 | 16 | 39.8 | 13.4 | 0 | 11.8 | 15 | 0 | 750 | 9.7% | 22.2% | 200 |
| M4112 | 3 | 12 | 44.4 | 13.4 | 0 | 12.2 | 15 | 0 | 750 | 11.8% | 25.2% | 100 |
| M4113 | 4 | 16 | 39.2 | 13.4 | 0 | 12.4 | 15 | 0 | 750 | 9.6% | 22.2% | 200 |
| M4114 | 3 | 12 | 43.8 | 13.4 | 0 | 12.8 | 15 | 0 | 750 | 11.7% | 25.1% | 100 |
| M4115 | 4 | 16 | 38.6 | 13.4 | 0 | 13 | 15 | 0 | 750 | 9.6% | 22.3% | 200 |
| M4116 | 3 | 12 | 43.2 | 13.4 | 0 | 13.4 | 15 | 0 | 750 | 11.7% | 25.1% | 100 |
| M4117 | 4 | 16 | 38 | 13.4 | 0 | 13.6 | 15 | 0 | 750 | 9.5% | 22.3% | 200 |
| M4118 | 3 | 12 | 42.6 | 13.4 | 0 | 14 | 15 | 0 | 750 | 11.7% | 25.0% | 100 |
| M4119 | 3.5 | 12 | 61 | 13.5 | 0 | 0 | 10 | 0 | 850 | 7.1% | 15.8% | 0 |
| M4120 | 3 | 12 | 59.5 | 13.5 | 0 | 0 | 12 | 0 | 800 | 10.3% | 19.4% | 0 |
| M4121 | 3.5 | 12 | 58 | 13.5 | 0 | 0 | 13 | 0 | 800 | 9.2% | 21.1% | 50 |
| M4122 | 3.5 | 12 | 57 | 13.5 | 0 | 0 | 14 | 0 | 800 | 10.0% | 22.9% | 50 |
| M4123 | 3.5 | 12 | 56 | 13.5 | 0 | 0 | 15 | 0 | 750 | 10.8% | 24.6% | 100 |
| M4124 | 3.5 | 12.5 | 60.5 | 13.5 | 0 | 0 | 10 | 0 | 850 | 7.3% | 15.5% | 0 |
| M4125 | 3 | 12.5 | 59 | 13.5 | 0 | 0 | 12 | 0 | 800 | 10.6% | 19.1% | 0 |
| M4126 | 3 | 12.5 | 58 | 13.5 | 0 | 0 | 13 | 0 | 800 | 11.4% | 20.9% | 0 |
| M4127 | 3 | 12.5 | 57 | 13.5 | 0 | 0 | 14 | 0 | 800 | 12.4% | 23.1% | 0 |
| M4128 | 3.5 | 12.5 | 55.5 | 13.5 | 0 | 0 | 15 | 0 | 750 | 11.2% | 24.3% | 50 |
| M4129 | 3.5 | 13 | 60 | 13.5 | 0 | 0 | 10 | 0 | 850 | 7.6% | 15.1% | 0 |
| M4130 | 3 | 13 | 58.5 | 13.5 | 0 | 0 | 12 | 0 | 800 | 10.9% | 18.7% | 0 |
| M4131 | 3 | 13 | 57.5 | 13.5 | 0 | 0 | 13 | 0 | 800 | 11.8% | 20.8% | 0 |
| M4132 | 3 | 13 | 56.5 | 13.5 | 0 | 0 | 14 | 0 | 800 | 12.7% | 22.7% | 0 |
| M4133 | 3.5 | 13 | 55 | 13.5 | 0 | 0 | 15 | 0 | 750 | 11.5% | 23.9% | 50 |
| M4134 | 3.5 | 13.5 | 59.5 | 13.5 | 0 | 0 | 10 | 0 | 800 | 7.8% | 14.8% | 0 |
| M4135 | 4 | 13.5 | 58 | 13.5 | 0 | 0 | 11 | 0 | 850 | 7.0% | 16.8% | 50 |
| M4136 | 4 | 13.5 | 57 | 13.5 | 0 | 0 | 12 | 0 | 800 | 7.6% | 18.5% | 50 |
| M4137 | 4 | 13.5 | 56 | 13.5 | 0 | 0 | 13 | 0 | 800 | 8.3% | 20.2% | 100 |
| M4138 | 4 | 13.5 | 55 | 13.5 | 0 | 0 | 14 | 0 | 800 | 9.0% | 21.9% | 100 |
| M4139 | 3 | 14 | 59.5 | 13.5 | 0 | 0 | 10 | 0 | 800 | 9.8% | 14.4% | −50 |
| M4140 | 3.5 | 14 | 58 | 13.5 | 0 | 0 | 11 | 0 | 800 | 8.8% | 16.3% | 0 |
| M4141 | 3.5 | 14 | 57 | 13.5 | 0 | 0 | 12 | 0 | 800 | 9.5% | 18.0% | 0 |
| M4142 | 3.5 | 14 | 56 | 13.5 | 0 | 0 | 13 | 0 | 800 | 10.3% | 19.8% | 50 |
| M4143 | 4 | 14 | 54.5 | 13.5 | 0 | 0 | 14 | 0 | 800 | 9.3% | 21.5% | 100 |
| M4144 | 3 | 14.5 | 59 | 13.5 | 0 | 0 | 10 | 0 | 800 | 10.0% | 14.1% | −50 |
| M4145 | 3.5 | 14.5 | 57.5 | 13.5 | 0 | 0 | 11 | 0 | 800 | 9.0% | 15.9% | 0 |
| M4146 | 3.5 | 14.5 | 56.5 | 13.5 | 0 | 0 | 12 | 0 | 800 | 9.8% | 17.7% | 0 |
| M4147 | 3.5 | 14.5 | 55.5 | 13.5 | 0 | 0 | 13 | 0 | 800 | 10.6% | 19.4% | 50 |
| M4148 | 4 | 14.5 | 54 | 13.5 | 0 | 0 | 14 | 0 | 800 | 9.5% | 21.2% | 100 |
| M4149 | 3 | 15 | 58.5 | 13.5 | 0 | 0 | 10 | 0 | 800 | 10.3% | 13.8% | −50 |
| M4150 | 3 | 15 | 57.5 | 13.5 | 0 | 0 | 11 | 0 | 800 | 11.2% | 15.6% | −50 |
| M4151 | 3 | 15 | 56.5 | 13.5 | 0 | 0 | 12 | 0 | 800 | 12.1% | 18.1% | −50 |
| M4152 | 3 | 15 | 55.5 | 13.5 | 0 | 0 | 13 | 0 | 800 | 13.0% | 20.2% | 0 |
| M4153 | 3.5 | 15 | 54 | 13.5 | 0 | 0 | 14 | 0 | 750 | 11.8% | 21.1% | 50 |
| M4154 | 4 | 15 | 52.5 | 13.5 | 0 | 0 | 15 | 0 | 800 | 10.6% | 22.5% | 100 |
| M4155 | 4 | 15.5 | 57 | 13.5 | 0 | 0 | 10 | 0 | 850 | 7.3% | 13.7% | 0 |
| M4156 | 4 | 15.5 | 56 | 13.5 | 0 | 0 | 11 | 0 | 850 | 7.9% | 15.4% | 50 |
| M4157 | 4 | 15.5 | 55 | 13.5 | 0 | 0 | 12 | 0 | 800 | 8.6% | 17.1% | 50 |
| M4158 | 3.5 | 15.5 | 53.5 | 13.5 | 0 | 0 | 14 | 0 | 800 | 12.1% | 21.3% | 50 |
| M4159 | 4 | 15.5 | 52 | 13.5 | 0 | 0 | 15 | 0 | 800 | 10.9% | 22.1% | 100 |
| M4160 | 4 | 16 | 56.5 | 13.5 | 0 | 0 | 10 | 0 | 850 | 7.6% | 13.4% | 0 |
| M4161 | 4 | 16 | 55.5 | 13.5 | 0 | 0 | 11 | 0 | 850 | 8.2% | 15.1% | 0 |
| M4162 | 4 | 16 | 54.5 | 13.5 | 0 | 0 | 12 | 0 | 800 | 8.9% | 16.8% | 50 |
| M4163 | 3.5 | 16 | 53 | 13.5 | 0 | 0 | 14 | 0 | 800 | 12.4% | 21.5% | 50 |
| M4164 | 3 | 12 | 56.4 | 13.6 | 0 | 0 | 15 | 0 | 800 | 13.0% | 24.7% | 50 |
| M4165 | 4 | 16 | 51.2 | 13.6 | 0 | 0.2 | 15 | 0 | 800 | 11.2% | 21.8% | 100 |
| M4166 | 3 | 12 | 55.8 | 13.6 | 0 | 0.6 | 15 | 0 | 800 | 12.9% | 24.7% | 50 |
| M4167 | 4 | 16 | 50.6 | 13.6 | 0 | 0.8 | 15 | 0 | 750 | 11.1% | 21.8% | 100 |
| M4168 | 3 | 12 | 55.2 | 13.6 | 0 | 1.2 | 15 | 0 | 800 | 12.9% | 24.7% | 50 |
| M4169 | 4 | 16 | 50 | 13.6 | 0 | 1.4 | 15 | 0 | 750 | 11.0% | 21.8% | 100 |
| M4170 | 3 | 12 | 54.6 | 13.6 | 0 | 1.8 | 15 | 0 | 800 | 12.8% | 24.8% | 50 |
| M4171 | 4 | 16 | 49.4 | 13.6 | 0 | 2 | 15 | 0 | 750 | 10.9% | 21.8% | 100 |
| M4172 | 4 | 16 | 49 | 13.6 | 0 | 2.4 | 15 | 0 | 750 | 10.8% | 21.8% | 100 |
| M4173 | 4 | 16 | 48.4 | 13.6 | 0 | 3 | 15 | 0 | 750 | 10.9% | 21.9% | 100 |
| M4174 | 4 | 16 | 47.8 | 13.6 | 0 | 3.6 | 15 | 0 | 750 | 10.8% | 21.9% | 100 |
| M4175 | 4 | 16 | 40.6 | 13.6 | 0 | 10.8 | 15 | 0 | 750 | 9.8% | 22.1% | 200 |
| M4176 | 3 | 12 | 45 | 13.6 | 0 | 11.4 | 15 | 0 | 750 | 11.8% | 25.2% | 100 |
| M4177 | 4 | 16 | 39.8 | 13.6 | 0 | 11.6 | 15 | 0 | 750 | 9.7% | 22.2% | 200 |
| M4178 | 3 | 12 | 44.4 | 13.6 | 0 | 12 | 15 | 0 | 750 | 11.8% | 25.2% | 100 |
| M4179 | 4 | 16 | 39.2 | 13.6 | 0 | 12.2 | 15 | 0 | 750 | 9.6% | 22.2% | 200 |
| M4180 | 3 | 12 | 43.8 | 13.6 | 0 | 12.6 | 15 | 0 | 750 | 11.7% | 25.2% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M4181 | 4 | 16 | 38.6 | 13.6 | 0 | 12.8 | 15 | 0 | 750 | 9.6% | 22.2% | 200 |
| M4182 | 3 | 12 | 43.2 | 13.6 | 0 | 13.2 | 15 | 0 | 750 | 11.7% | 25.1% | 100 |
| M4183 | 4 | 16 | 38 | 13.6 | 0 | 13.4 | 15 | 0 | 750 | 9.5% | 22.3% | 200 |
| M4184 | 3 | 12 | 42.6 | 13.6 | 0 | 13.8 | 15 | 0 | 750 | 11.7% | 25.1% | 100 |
| M4185 | 4 | 16 | 37.4 | 13.6 | 0 | 14 | 15 | 0 | 750 | 9.5% | 22.3% | 200 |
| M4186 | 4 | 16 | 51.2 | 13.8 | 0 | 0 | 15 | 0 | 750 | 11.3% | 21.8% | 100 |
| M4187 | 3 | 12 | 55.8 | 13.8 | 0 | 0.4 | 15 | 0 | 800 | 13.0% | 24.7% | 50 |
| M4188 | 4 | 16 | 50.6 | 13.8 | 0 | 0.6 | 15 | 0 | 750 | 11.1% | 21.8% | 100 |
| M4189 | 3 | 12 | 55.2 | 13.8 | 0 | 1 | 15 | 0 | 800 | 12.9% | 24.7% | 50 |
| M4190 | 4 | 16 | 50 | 13.8 | 0 | 1.2 | 15 | 0 | 750 | 11.0% | 21.8% | 100 |
| M4191 | 3 | 12 | 54.6 | 13.8 | 0 | 1.6 | 15 | 0 | 800 | 12.8% | 24.7% | 50 |
| M4192 | 4 | 16 | 49.4 | 13.8 | 0 | 1.8 | 15 | 0 | 750 | 10.9% | 21.8% | 100 |
| M4193 | 3 | 12 | 54 | 13.8 | 0 | 2.2 | 15 | 0 | 800 | 12.7% | 24.8% | 50 |
| M4194 | 4 | 16 | 48.6 | 13.8 | 0 | 2.6 | 15 | 0 | 750 | 10.8% | 21.8% | 100 |
| M4195 | 4 | 16 | 48 | 13.8 | 0 | 3.2 | 15 | 0 | 750 | 10.9% | 21.9% | 100 |
| M4196 | 4 | 16 | 40.6 | 13.8 | 0 | 10.6 | 15 | 0 | 750 | 9.8% | 22.1% | 200 |
| M4197 | 4 | 16 | 40 | 13.8 | 0 | 11.2 | 15 | 0 | 750 | 9.7% | 22.1% | 200 |
| M4198 | 4 | 16 | 39.6 | 13.8 | 0 | 11.6 | 15 | 0 | 750 | 9.7% | 22.2% | 200 |
| M4199 | 3 | 12 | 44.2 | 13.8 | 0 | 12 | 15 | 0 | 750 | 11.8% | 25.2% | 100 |
| M4200 | 4 | 16 | 39 | 13.8 | 0 | 12.2 | 15 | 0 | 750 | 9.6% | 22.2% | 200 |
| M4201 | 3 | 12 | 43.6 | 13.8 | 0 | 12.6 | 15 | 0 | 750 | 11.7% | 25.2% | 100 |
| M4202 | 4 | 16 | 38.4 | 13.8 | 0 | 12.8 | 15 | 0 | 750 | 9.6% | 22.2% | 200 |
| M4203 | 3 | 12 | 43 | 13.8 | 0 | 13.2 | 15 | 0 | 750 | 11.7% | 25.2% | 100 |
| M4204 | 4 | 16 | 37.8 | 13.8 | 0 | 13.4 | 15 | 0 | 750 | 9.5% | 22.3% | 200 |
| M4205 | 3 | 12 | 42.4 | 13.8 | 0 | 13.8 | 15 | 0 | 750 | 11.7% | 25.1% | 100 |
| M4206 | 4 | 16 | 37.2 | 13.8 | 0 | 14 | 15 | 0 | 750 | 9.5% | 22.3% | 200 |
| M4207 | 3.75 | 8 | 54.25 | 14 | 0 | 0 | 20 | 0 | 750 | 9.2% | 32.7% | 200 |
| M4208 | 4 | 11 | 51 | 14 | 0 | 0 | 20 | 0 | 800 | 12.6% | 33.3% | 200 |
| M4209 | 2.2 | 12 | 61.8 | 14 | 0 | 0 | 10 | 0 | 800 | 11.8% | 16.3% | −50 |
| M4210 | 2.2 | 12 | 57.8 | 14 | 4 | 0 | 10 | 0 | 750 | 12.0% | 11.6% | −50 |
| M4211 | 2.3 | 12 | 59.7 | 14 | 0 | 0 | 10 | 2 | 800 | 11.2% | 16.3% | −50 |
| M4212 | 2.3 | 12 | 57.7 | 14 | 2 | 0 | 10 | 2 | 750 | 11.4% | 16.6% | −50 |
| M4213 | 2.3 | 12 | 55.7 | 14 | 6 | 0 | 10 | 0 | 750 | 11.4% | 6.8% | 0 |
| M4214 | 2.4 | 12 | 59.6 | 14 | 0 | 0 | 10 | 2 | 800 | 10.9% | 16.6% | −50 |
| M4215 | 2.4 | 12 | 57.6 | 14 | 2 | 0 | 10 | 2 | 750 | 11.1% | 17.2% | −50 |
| M4216 | 2.4 | 12 | 55.6 | 14 | 6 | 0 | 10 | 0 | 750 | 11.1% | 7.5% | 0 |
| M4217 | 2.5 | 12 | 61.5 | 14 | 0 | 0 | 10 | 0 | 800 | 10.6% | 15.8% | −50 |
| M4218 | 2.5 | 12 | 55.5 | 14 | 0 | 0 | 10 | 6 | 750 | 9.7% | 16.6% | −50 |
| M4219 | 2.5 | 12 | 55.5 | 14 | 2 | 0 | 10 | 4 | 750 | 10.4% | 17.0% | −50 |
| M4220 | 2.5 | 12 | 53.5 | 14 | 4 | 0 | 10 | 4 | 750 | 10.5% | 11.7% | 0 |
| M4221 | 2.5 | 12 | 51.5 | 14 | 6 | 0 | 10 | 4 | 750 | 10.6% | 6.4% | 0 |
| M4222 | 2.6 | 12 | 57.4 | 14 | 0 | 0 | 10 | 4 | 750 | 9.9% | 17.0% | −50 |
| M4223 | 2.6 | 12 | 57.4 | 14 | 2 | 0 | 10 | 2 | 750 | 10.7% | 17.7% | −50 |
| M4224 | 2.6 | 12 | 55.4 | 14 | 4 | 0 | 10 | 2 | 750 | 10.6% | 13.9% | 0 |
| M4225 | 2.6 | 12 | 55.4 | 14 | 6 | 0 | 10 | 0 | 750 | 10.5% | 8.9% | 0 |
| M4226 | 2.6 | 12 | 49.4 | 14 | 6 | 0 | 10 | 6 | 700 | 10.0% | 5.9% | 50 |
| M4227 | 2.7 | 12 | 57.3 | 14 | 0 | 0 | 10 | 4 | 750 | 9.6% | 17.3% | −50 |
| M4228 | 2.7 | 12 | 59.3 | 14 | 2 | 0 | 10 | 0 | 750 | 10.1% | 16.4% | −50 |
| M4229 | 2.7 | 12 | 53.3 | 14 | 2 | 0 | 10 | 6 | 750 | 9.5% | 17.5% | 0 |
| M4230 | 2.7 | 12 | 53.3 | 14 | 4 | 0 | 10 | 4 | 750 | 10.1% | 13.6% | 0 |
| M4231 | 2.7 | 12 | 53.3 | 14 | 6 | 0 | 10 | 2 | 750 | 10.2% | 9.9% | 0 |
| M4232 | 2.7 | 12 | 53.3 | 14 | 8 | 0 | 10 | 0 | 750 | 10.1% | 5.3% | 50 |
| M4233 | 2.8 | 12 | 59.2 | 14 | 0 | 0 | 10 | 2 | 800 | 9.6% | 16.7% | −50 |
| M4234 | 2.8 | 12 | 53.2 | 14 | 0 | 0 | 10 | 8 | 750 | 8.7% | 17.6% | 0 |
| M4235 | 2.8 | 12 | 57.2 | 14 | 2 | 0 | 10 | 2 | 750 | 9.9% | 17.6% | 0 |
| M4236 | 2.8 | 12 | 57.2 | 14 | 4 | 0 | 10 | 0 | 750 | 9.9% | 14.3% | 0 |
| M4237 | 2.8 | 12 | 51.2 | 14 | 4 | 0 | 10 | 6 | 700 | 9.5% | 13.3% | 0 |
| M4238 | 2.8 | 12 | 53.2 | 14 | 6 | 0 | 10 | 2 | 750 | 9.9% | 9.9% | 50 |
| M4239 | 2.8 | 12 | 47.2 | 14 | 6 | 0 | 10 | 8 | 700 | 9.4% | 6.8% | 100 |
| M4240 | 2.8 | 12 | 49.2 | 14 | 8 | 0 | 10 | 4 | 700 | 9.9% | 5.4% | 100 |
| M4241 | 2.9 | 12 | 57.1 | 14 | 0 | 0 | 10 | 4 | 800 | 9.2% | 17.8% | 0 |
| M4242 | 2.9 | 12 | 51.1 | 14 | 0 | 0 | 10 | 10 | 750 | 8.3% | 18.1% | 0 |
| M4243 | 2.9 | 12 | 55.1 | 14 | 2 | 0 | 10 | 4 | 750 | 9.5% | 18.6% | 0 |
| M4244 | 2.9 | 12 | 57.1 | 14 | 4 | 0 | 10 | 0 | 750 | 9.6% | 14.7% | 0 |
| M4245 | 2.9 | 12 | 51.1 | 14 | 4 | 0 | 10 | 6 | 700 | 9.3% | 14.2% | 50 |
| M4246 | 2.9 | 12 | 55.1 | 14 | 6 | 0 | 10 | 0 | 750 | 9.6% | 10.9% | 0 |
| M4247 | 2.9 | 12 | 49.1 | 14 | 6 | 0 | 10 | 6 | 700 | 9.5% | 9.6% | 50 |
| M4248 | 2.9 | 12 | 53.1 | 14 | 8 | 0 | 10 | 0 | 750 | 9.6% | 6.9% | 50 |
| M4249 | 3 | 12 | 61 | 14 | 0 | 0 | 10 | 0 | 800 | 8.7% | 15.7% | −50 |
| M4250 | 3 | 12 | 55 | 14 | 0 | 0 | 10 | 6 | 800 | 8.6% | 18.1% | 0 |
| M4251 | 3 | 12 | 60 | 14 | 1 | 0 | 10 | 0 | 800 | 8.9% | 16.0% | 0 |
| M4252 | 3 | 12 | 55 | 14 | 2 | 0 | 10 | 4 | 750 | 9.2% | 18.8% | 0 |
| M4253 | 3 | 12 | 49 | 14 | 2 | 0 | 10 | 10 | 750 | 8.4% | 18.5% | 50 |
| M4254 | 3 | 12 | 55 | 14 | 4 | 0 | 10 | 2 | 750 | 9.4% | 14.6% | 0 |
| M4255 | 3 | 12 | 49 | 14 | 4 | 0 | 10 | 8 | 700 | 8.9% | 14.0% | 50 |
| M4256 | 3 | 12 | 55 | 14 | 6 | 0 | 10 | 0 | 750 | 9.3% | 11.4% | 0 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M4257 | 3 | 12 | 49 | 14 | 6 | 0 | 10 | 6 | 700 | 9.3% | 10.7% | 100 |
| M4258 | 3 | 12 | 53 | 14 | 8 | 0 | 10 | 0 | 750 | 9.3% | 7.6% | 50 |
| M4259 | 3 | 12 | 47 | 14 | 8 | 0 | 10 | 6 | 700 | 9.3% | 6.2% | 150 |
| M4260 | 3.1 | 12 | 56.9 | 14 | 0 | 0 | 10 | 4 | 800 | 8.7% | 17.7% | 0 |
| M4261 | 3.1 | 12 | 50.9 | 14 | 0 | 0 | 10 | 10 | 750 | 7.9% | 18.7% | 50 |
| M4262 | 3.1 | 12 | 54.9 | 14 | 2 | 0 | 10 | 4 | 750 | 9.0% | 18.6% | 0 |
| M4263 | 3.1 | 12 | 48.9 | 14 | 2 | 0 | 10 | 10 | 750 | 8.2% | 19.1% | 50 |
| M4264 | 3.1 | 12 | 52.9 | 14 | 4 | 0 | 10 | 4 | 750 | 9.1% | 15.8% | 50 |
| M4265 | 3.1 | 12 | 46.9 | 14 | 4 | 0 | 10 | 10 | 700 | 8.5% | 13.6% | 100 |
| M4266 | 3.1 | 12 | 50.9 | 14 | 6 | 0 | 10 | 4 | 700 | 9.1% | 11.5% | 50 |
| M4267 | 3.1 | 12 | 44.9 | 14 | 6 | 0 | 10 | 10 | 700 | 8.7% | 8.9% | 150 |
| M4268 | 3.1 | 12 | 48.9 | 14 | 8 | 0 | 10 | 4 | 700 | 9.1% | 6.9% | 100 |
| M4269 | 3.2 | 12 | 60.8 | 14 | 0 | 0 | 10 | 0 | 800 | 8.0% | 15.7% | 0 |
| M4270 | 3.2 | 12 | 54.8 | 14 | 0 | 0 | 10 | 6 | 800 | 8.2% | 18.6% | 0 |
| M4271 | 3.2 | 12 | 58.8 | 14 | 2 | 0 | 10 | 0 | 800 | 8.3% | 16.4% | 0 |
| M4272 | 3.2 | 12 | 52.8 | 14 | 2 | 0 | 10 | 6 | 750 | 8.5% | 19.6% | 50 |
| M4273 | 3.2 | 12 | 56.8 | 14 | 4 | 0 | 10 | 0 | 750 | 8.6% | 15.9% | 0 |
| M4274 | 3.2 | 12 | 50.8 | 14 | 4 | 0 | 10 | 6 | 750 | 8.8% | 16.7% | 50 |
| M4275 | 3.2 | 12 | 54.8 | 14 | 6 | 0 | 10 | 0 | 750 | 8.7% | 12.5% | 50 |
| M4276 | 3.2 | 12 | 48.8 | 14 | 6 | 0 | 10 | 6 | 700 | 8.8% | 12.5% | 100 |
| M4277 | 3.2 | 12 | 52.8 | 14 | 8 | 0 | 10 | 0 | 750 | 8.7% | 8.9% | 100 |
| M4278 | 3.2 | 12 | 46.8 | 14 | 8 | 0 | 10 | 6 | 700 | 8.8% | 8.0% | 150 |
| M4279 | 3.2 | 12 | 50.8 | 14 | 10 | 0 | 10 | 0 | 750 | 8.8% | 5.3% | 150 |
| M4280 | 3.3 | 12 | 56.7 | 14 | 0 | 0 | 10 | 4 | 800 | 8.1% | 17.4% | 0 |
| M4281 | 3.3 | 12 | 50.7 | 14 | 0 | 0 | 10 | 10 | 750 | 7.6% | 19.3% | 50 |
| M4282 | 3.3 | 12 | 54.7 | 14 | 2 | 0 | 10 | 4 | 750 | 8.4% | 18.2% | 50 |
| M4283 | 3.3 | 12 | 48.7 | 14 | 2 | 0 | 10 | 10 | 750 | 7.8% | 20.0% | 150 |
| M4284 | 3.3 | 12 | 52.7 | 14 | 4 | 0 | 10 | 4 | 750 | 8.5% | 16.0% | 50 |
| M4285 | 3.3 | 12 | 46.7 | 14 | 4 | 0 | 10 | 10 | 750 | 8.1% | 15.5% | 150 |
| M4286 | 3.3 | 12 | 50.7 | 14 | 6 | 0 | 10 | 4 | 700 | 8.5% | 11.6% | 100 |
| M4287 | 3.3 | 12 | 44.7 | 14 | 6 | 0 | 10 | 10 | 700 | 8.4% | 11.2% | 200 |
| M4288 | 3.3 | 12 | 48.7 | 14 | 8 | 0 | 10 | 4 | 700 | 8.6% | 7.5% | 150 |
| M4289 | 3.3 | 12 | 42.7 | 14 | 8 | 0 | 10 | 10 | 700 | 8.4% | 6.7% | 200 |
| M4290 | 3.4 | 12 | 58.6 | 14 | 0 | 0 | 10 | 2 | 800 | 7.6% | 16.4% | 0 |
| M4291 | 3.4 | 12 | 52.6 | 14 | 0 | 0 | 10 | 8 | 800 | 7.6% | 19.3% | 50 |
| M4292 | 3.4 | 12 | 56.6 | 14 | 2 | 0 | 10 | 2 | 800 | 7.9% | 17.2% | 50 |
| M4293 | 3.4 | 12 | 50.6 | 14 | 2 | 0 | 10 | 8 | 750 | 7.9% | 20.4% | 100 |
| M4294 | 3.4 | 12 | 54.6 | 14 | 4 | 0 | 10 | 2 | 750 | 8.2% | 16.4% | 50 |
| M4295 | 3.4 | 12 | 48.6 | 14 | 4 | 0 | 10 | 8 | 750 | 8.2% | 17.3% | 150 |
| M4296 | 3.4 | 12 | 52.6 | 14 | 6 | 0 | 10 | 2 | 750 | 8.2% | 12.9% | 100 |
| M4297 | 3.4 | 12 | 46.6 | 14 | 6 | 0 | 10 | 8 | 700 | 8.4% | 13.3% | 200 |
| M4298 | 3.4 | 12 | 50.6 | 14 | 8 | 0 | 10 | 2 | 700 | 8.3% | 9.3% | 150 |
| M4299 | 3.4 | 12 | 50.6 | 14 | 10 | 0 | 10 | 0 | 750 | 8.3% | 6.7% | 150 |
| M4300 | 3.5 | 12 | 58.5 | 14 | 0 | 0 | 10 | 2 | 800 | 7.3% | 16.5% | 0 |
| M4301 | 3.5 | 12 | 50.5 | 14 | 0 | 0 | 10 | 10 | 800 | 7.3% | 19.9% | 100 |
| M4302 | 3.5 | 12 | 56.5 | 14 | 2 | 0 | 10 | 2 | 800 | 7.6% | 17.2% | 50 |
| M4303 | 3.5 | 12 | 50.5 | 14 | 2 | 0 | 10 | 8 | 750 | 7.7% | 20.6% | 150 |
| M4304 | 3.5 | 12 | 56.5 | 14 | 4 | 0 | 10 | 0 | 750 | 7.7% | 17.0% | 50 |
| M4305 | 3.5 | 12 | 50.5 | 14 | 4 | 0 | 10 | 6 | 750 | 8.0% | 16.9% | 150 |
| M4306 | 3.5 | 12 | 55.5 | 14 | 5 | 0 | 10 | 0 | 750 | 7.8% | 15.5% | 50 |
| M4307 | 3.5 | 12 | 50.5 | 14 | 6 | 0 | 10 | 4 | 750 | 8.0% | 12.7% | 150 |
| M4308 | 3.5 | 12 | 44.5 | 14 | 6 | 0 | 10 | 10 | 750 | 8.1% | 13.1% | 200 |
| M4309 | 3.5 | 12 | 48.5 | 14 | 8 | 0 | 10 | 4 | 700 | 8.1% | 9.0% | 200 |
| M4310 | 3.6 | 12 | 56.4 | 14 | 0 | 0 | 10 | 4 | 800 | 7.2% | 17.3% | 50 |
| M4311 | 3.6 | 12 | 50.4 | 14 | 0 | 0 | 10 | 10 | 800 | 7.1% | 20.1% | 150 |
| M4312 | 3.6 | 12 | 54.4 | 14 | 2 | 0 | 10 | 4 | 800 | 7.5% | 18.0% | 50 |
| M4313 | 3.6 | 12 | 48.4 | 14 | 2 | 0 | 10 | 10 | 750 | 7.4% | 21.2% | 150 |
| M4314 | 3.6 | 12 | 52.4 | 14 | 4 | 0 | 10 | 4 | 750 | 7.7% | 16.8% | 150 |
| M4315 | 3.6 | 12 | 46.4 | 14 | 4 | 0 | 10 | 10 | 750 | 7.7% | 17.9% | 200 |
| M4316 | 3.6 | 12 | 50.4 | 14 | 6 | 0 | 10 | 4 | 750 | 7.8% | 13.3% | 150 |
| M4317 | 3.6 | 12 | 44.4 | 14 | 6 | 0 | 10 | 10 | 750 | 7.9% | 14.0% | 200 |
| M4318 | 3.6 | 12 | 48.4 | 14 | 8 | 0 | 10 | 4 | 700 | 7.8% | 9.7% | 200 |
| M4319 | 3.7 | 12 | 52.3 | 14 | 0 | 0 | 10 | 8 | 800 | 7.1% | 19.5% | 150 |
| M4320 | 3.7 | 12 | 52.3 | 14 | 2 | 0 | 10 | 6 | 800 | 7.3% | 19.1% | 150 |
| M4321 | 3.7 | 12 | 56.3 | 14 | 4 | 0 | 10 | 0 | 750 | 7.2% | 17.2% | 50 |
| M4322 | 3.7 | 12 | 50.3 | 14 | 4 | 0 | 10 | 6 | 750 | 7.5% | 17.1% | 150 |
| M4323 | 3.7 | 12 | 54.3 | 14 | 6 | 0 | 10 | 0 | 750 | 7.3% | 14.8% | 150 |
| M4324 | 3.7 | 12 | 48.3 | 14 | 6 | 0 | 10 | 6 | 750 | 7.6% | 13.1% | 200 |
| M4325 | 3.7 | 12 | 50.3 | 14 | 8 | 0 | 10 | 2 | 750 | 7.5% | 11.2% | 200 |
| M4326 | 3.8 | 12 | 52.2 | 14 | 2 | 0 | 10 | 6 | 800 | 7.1% | 19.0% | 150 |
| M4327 | 3.8 | 12 | 54.2 | 14 | 4 | 0 | 10 | 2 | 750 | 7.0% | 17.9% | 150 |
| M4328 | 3.8 | 12 | 48.2 | 14 | 4 | 0 | 10 | 8 | 750 | 7.3% | 17.8% | 200 |
| M4329 | 3.8 | 12 | 52.2 | 14 | 6 | 0 | 10 | 2 | 750 | 7.2% | 14.9% | 150 |
| M4330 | 3.8 | 12 | 46.2 | 14 | 6 | 0 | 10 | 8 | 750 | 7.4% | 13.6% | 200 |
| M4331 | 3.8 | 12 | 48.2 | 14 | 8 | 0 | 10 | 4 | 750 | 7.3% | 11.1% | 200 |
| M4332 | 3.9 | 12 | 50.1 | 14 | 6 | 0 | 10 | 4 | 750 | 7.0% | 14.9% | 200 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M4333 | 3 | 12 | 60 | 14 | 0 | 0 | 11 | 0 | 800 | 9.5% | 17.5% | 0 |
| M4334 | 3 | 12 | 57 | 14 | 3 | 0 | 11 | 0 | 750 | 10.0% | 18.3% | 0 |
| M4335 | 3.5 | 12 | 59.5 | 14 | 0 | 0 | 11 | 0 | 800 | 7.8% | 17.6% | 0 |
| M4336 | 3.5 | 12 | 56.5 | 14 | 3 | 0 | 11 | 0 | 750 | 8.3% | 18.7% | 50 |
| M4337 | 4 | 12 | 54 | 14 | 5 | 0 | 11 | 0 | 750 | 7.1% | 18.8% | 200 |
| M4338 | 3 | 12 | 57 | 14 | 2 | 0 | 12 | 0 | 750 | 10.6% | 20.1% | 0 |
| M4339 | 3 | 12 | 54 | 14 | 5 | 0 | 12 | 0 | 750 | 10.7% | 15.1% | 50 |
| M4340 | 3.5 | 12 | 56.5 | 14 | 2 | 0 | 12 | 0 | 750 | 8.8% | 20.1% | 50 |
| M4341 | 3.5 | 12 | 53.5 | 14 | 5 | 0 | 12 | 0 | 750 | 9.2% | 17.9% | 100 |
| M4342 | 4 | 12 | 55 | 14 | 3 | 0 | 12 | 0 | 750 | 7.4% | 20.6% | 100 |
| M4343 | 3 | 12 | 58 | 14 | 0 | 0 | 13 | 0 | 750 | 11.2% | 21.2% | 0 |
| M4344 | 3 | 12 | 55 | 14 | 3 | 0 | 13 | 0 | 750 | 11.7% | 21.0% | 50 |
| M4345 | 3.5 | 12 | 57.5 | 14 | 0 | 0 | 13 | 0 | 800 | 9.2% | 21.1% | 50 |
| M4346 | 3.5 | 12 | 54.5 | 14 | 3 | 0 | 13 | 0 | 750 | 9.8% | 22.3% | 100 |
| M4347 | 4 | 12 | 57 | 14 | 0 | 0 | 13 | 0 | 800 | 7.6% | 21.2% | 100 |
| M4348 | 4 | 12 | 54 | 14 | 3 | 0 | 13 | 0 | 750 | 8.1% | 22.4% | 150 |
| M4349 | 3 | 12 | 57 | 14 | 0 | 0 | 14 | 0 | 800 | 12.1% | 23.4% | 0 |
| M4350 | 3 | 12 | 54 | 14 | 3 | 0 | 14 | 0 | 750 | 12.5% | 21.8% | 50 |
| M4351 | 3.5 | 12 | 55.5 | 14 | 1 | 0 | 14 | 0 | 750 | 10.2% | 23.3% | 100 |
| M4352 | 3.5 | 12 | 52.5 | 14 | 4 | 0 | 14 | 0 | 750 | 10.7% | 21.6% | 100 |
| M4353 | 4 | 12 | 55 | 14 | 1 | 0 | 14 | 0 | 800 | 8.4% | 23.3% | 100 |
| M4354 | 4 | 12 | 52 | 14 | 4 | 0 | 14 | 0 | 750 | 9.0% | 24.0% | 150 |
| M4355 | 3 | 12 | 56 | 14 | 0 | 0 | 15 | 0 | 800 | 13.0% | 24.6% | 50 |
| M4356 | 3.5 | 12 | 53.5 | 14 | 2 | 0 | 15 | 0 | 750 | 11.3% | 25.5% | 100 |
| M4357 | 3.5 | 12 | 50.5 | 14 | 5 | 0 | 15 | 0 | 750 | 11.3% | 20.0% | 150 |
| M4358 | 4 | 12 | 53 | 14 | 2 | 0 | 15 | 0 | 750 | 9.4% | 25.4% | 150 |
| M4359 | 4 | 12 | 50 | 14 | 5 | 0 | 15 | 0 | 700 | 9.8% | 23.1% | 200 |
| M4360 | 3 | 12.5 | 59.5 | 14 | 0 | 0 | 11 | 0 | 800 | 9.7% | 17.2% | 0 |
| M4361 | 3.5 | 12.5 | 58 | 14 | 0 | 0 | 12 | 0 | 800 | 8.7% | 19.0% | 50 |
| M4362 | 3.5 | 12.5 | 57 | 14 | 0 | 0 | 13 | 0 | 800 | 9.5% | 20.8% | 50 |
| M4363 | 3.5 | 12.5 | 56 | 14 | 0 | 0 | 14 | 0 | 750 | 10.3% | 22.5% | 50 |
| M4364 | 4 | 12.5 | 54.5 | 14 | 0 | 0 | 15 | 0 | 800 | 9.2% | 24.2% | 100 |
| M4365 | 3 | 13 | 58 | 14 | 2 | 0 | 10 | 0 | 750 | 9.6% | 15.7% | 0 |
| M4366 | 3 | 13 | 55 | 14 | 5 | 0 | 10 | 0 | 750 | 9.8% | 11.9% | 0 |
| M4367 | 3.5 | 13 | 57.5 | 14 | 2 | 0 | 10 | 0 | 800 | 7.9% | 15.8% | 0 |
| M4368 | 3.5 | 13 | 54.5 | 14 | 5 | 0 | 10 | 0 | 750 | 8.3% | 14.3% | 50 |
| M4369 | 3 | 13 | 57 | 14 | 2 | 0 | 11 | 0 | 750 | 10.4% | 17.6% | 0 |
| M4370 | 3 | 13 | 54 | 14 | 5 | 0 | 11 | 0 | 750 | 10.5% | 12.8% | 0 |
| M4371 | 3.5 | 13 | 56.5 | 14 | 2 | 0 | 11 | 0 | 800 | 8.6% | 17.6% | 50 |
| M4372 | 3.5 | 13 | 53.5 | 14 | 5 | 0 | 11 | 0 | 750 | 9.0% | 15.4% | 50 |
| M4373 | 4 | 13 | 54 | 14 | 4 | 0 | 11 | 0 | 750 | 7.4% | 18.5% | 150 |
| M4374 | 3 | 13 | 57 | 14 | 1 | 0 | 12 | 0 | 750 | 11.1% | 19.1% | 0 |
| M4375 | 3 | 13 | 54 | 14 | 4 | 0 | 12 | 0 | 750 | 11.3% | 15.8% | 0 |
| M4376 | 3.5 | 13 | 56.5 | 14 | 1 | 0 | 12 | 0 | 800 | 9.2% | 19.1% | 50 |
| M4377 | 3.5 | 13 | 53.5 | 14 | 4 | 0 | 12 | 0 | 750 | 9.7% | 18.3% | 50 |
| M4378 | 4 | 13 | 56 | 14 | 1 | 0 | 12 | 0 | 800 | 7.6% | 19.2% | 100 |
| M4379 | 4 | 13 | 53 | 14 | 4 | 0 | 12 | 0 | 750 | 8.1% | 20.3% | 150 |
| M4380 | 3 | 13 | 56 | 14 | 1 | 0 | 13 | 0 | 750 | 12.0% | 21.7% | 0 |
| M4381 | 3 | 13 | 53 | 14 | 4 | 0 | 13 | 0 | 750 | 12.1% | 17.9% | 50 |
| M4382 | 3.5 | 13 | 55.5 | 14 | 1 | 0 | 13 | 0 | 750 | 10.0% | 20.8% | 50 |
| M4383 | 3.5 | 13 | 52.5 | 14 | 4 | 0 | 13 | 0 | 750 | 10.4% | 19.3% | 100 |
| M4384 | 4 | 13 | 55 | 14 | 1 | 0 | 13 | 0 | 800 | 8.2% | 20.9% | 100 |
| M4385 | 4 | 13 | 52 | 14 | 4 | 0 | 13 | 0 | 750 | 8.8% | 21.6% | 150 |
| M4386 | 3 | 13 | 55 | 14 | 1 | 0 | 14 | 0 | 800 | 12.9% | 23.0% | 0 |
| M4387 | 3.5 | 13 | 53.5 | 14 | 2 | 0 | 14 | 0 | 750 | 11.0% | 23.0% | 100 |
| M4388 | 3.5 | 13 | 50.5 | 14 | 5 | 0 | 14 | 0 | 750 | 11.1% | 17.9% | 100 |
| M4389 | 4 | 13 | 53 | 14 | 2 | 0 | 14 | 0 | 750 | 9.1% | 23.0% | 150 |
| M4390 | 4 | 13 | 50 | 14 | 5 | 0 | 14 | 0 | 700 | 9.5% | 20.8% | 150 |
| M4391 | 3.5 | 13 | 52.5 | 14 | 2 | 0 | 15 | 0 | 750 | 11.9% | 25.6% | 100 |
| M4392 | 3.5 | 13 | 49.5 | 14 | 5 | 0 | 15 | 0 | 750 | 11.8% | 19.9% | 150 |
| M4393 | 4 | 13 | 52 | 14 | 2 | 0 | 15 | 0 | 750 | 9.9% | 24.7% | 150 |
| M4394 | 4 | 13 | 49 | 14 | 5 | 0 | 15 | 0 | 700 | 10.3% | 21.6% | 200 |
| M4395 | 3 | 13.5 | 58.5 | 14 | 0 | 0 | 11 | 0 | 800 | 10.3% | 16.6% | −50 |
| M4396 | 3 | 13.5 | 57.5 | 14 | 0 | 0 | 12 | 0 | 750 | 11.2% | 18.4% | 0 |
| M4397 | 3 | 13.5 | 56.5 | 14 | 0 | 0 | 13 | 0 | 800 | 12.1% | 21.1% | 0 |
| M4398 | 3 | 13.5 | 55.5 | 14 | 0 | 0 | 14 | 0 | 800 | 13.0% | 22.4% | 0 |
| M4399 | 3.5 | 13.5 | 54 | 14 | 0 | 0 | 15 | 0 | 750 | 11.8% | 24.0% | 50 |
| M4400 | 3 | 14 | 58 | 14 | 1 | 0 | 10 | 0 | 800 | 10.0% | 14.7% | −50 |
| M4401 | 3 | 14 | 55 | 14 | 4 | 0 | 10 | 0 | 750 | 10.3% | 12.6% | 0 |
| M4402 | 3.5 | 14 | 57.5 | 14 | 1 | 0 | 10 | 0 | 800 | 8.3% | 14.8% | 0 |
| M4403 | 3.5 | 14 | 54.5 | 14 | 4 | 0 | 10 | 0 | 750 | 8.7% | 14.7% | 100 |
| M4404 | 4 | 14 | 54 | 14 | 4 | 0 | 10 | 0 | 800 | 7.3% | 15.9% | 150 |
| M4405 | 3 | 14 | 57 | 14 | 1 | 0 | 11 | 0 | 750 | 10.8% | 16.6% | −50 |
| M4406 | 3 | 14 | 54 | 14 | 4 | 0 | 11 | 0 | 750 | 11.1% | 13.6% | 0 |
| M4407 | 3.5 | 14 | 56.5 | 14 | 1 | 0 | 11 | 0 | 800 | 9.0% | 16.6% | 0 |
| M4408 | 3.5 | 14 | 53.5 | 14 | 4 | 0 | 11 | 0 | 750 | 9.4% | 15.9% | 50 |

TABLE 4-continued

| Alloy Compositions and Thermodynamic Criteria | | | | | | | | | | | | |
|---|---|---|---|---|---|---|---|---|---|---|---|---|
| No | C | Cr | Fe | Mn | Mo | Ni | V | W | A | B | C | D |
| M4409 | 4 | 14 | 56 | 14 | 1 | 0 | 11 | 0 | 800 | 7.4% | 16.7% | 100 |
| M4410 | 4 | 14 | 53 | 14 | 4 | 0 | 11 | 0 | 750 | 7.9% | 17.7% | 150 |
| M4411 | 3 | 14 | 56 | 14 | 1 | 0 | 12 | 0 | 750 | 11.7% | 18.6% | 0 |
| M4412 | 3 | 14 | 53 | 14 | 4 | 0 | 12 | 0 | 750 | 11.8% | 15.4% | 0 |
| M4413 | 3.5 | 14 | 55.5 | 14 | 1 | 0 | 12 | 0 | 800 | 9.7% | 18.4% | 50 |
| M4414 | 3.5 | 14 | 52.5 | 14 | 4 | 0 | 12 | 0 | 750 | 10.2% | 17.0% | 50 |
| M4415 | 4 | 14 | 55 | 14 | 1 | 0 | 12 | 0 | 800 | 8.1% | 18.5% | 50 |
| M4416 | 4 | 14 | 52 | 14 | 4 | 0 | 12 | 0 | 750 | 8.6% | 19.2% | 150 |
| M4417 | 3 | 14 | 55 | 14 | 1 | 0 | 13 | 0 | 750 | 12.6% | 21.1% | 0 |
| M4418 | 3.5 | 14 | 55.5 | 14 | 0 | 0 | 13 | 0 | 800 | 10.3% | 19.8% | 50 |
| M4419 | 3.5 | 14 | 52.5 | 14 | 3 | 0 | 13 | 0 | 750 | 10.9% | 20.1% | 50 |
| M4420 | 4 | 14 | 55 | 14 | 0 | 0 | 13 | 0 | 800 | 8.6% | 19.8% | 50 |
| M4421 | 4 | 14 | 52 | 14 | 3 | 0 | 13 | 0 | 750 | 9.1% | 20.9% | 150 |
| M4422 | 3.5 | 14 | 54.5 | 14 | 0 | 0 | 14 | 0 | 750 | 11.2% | 21.5% | 50 |
| M4423 | 3.5 | 14 | 51.5 | 14 | 3 | 0 | 14 | 0 | 750 | 11.8% | 21.8% | 100 |
| M4424 | 4 | 14 | 54 | 14 | 0 | 0 | 14 | 0 | 800 | 9.3% | 21.5% | 100 |
| M4425 | 4 | 14 | 51 | 14 | 3 | 0 | 14 | 0 | 750 | 9.9% | 22.6% | 150 |
| M4426 | 3.5 | 14 | 53.5 | 14 | 0 | 0 | 15 | 0 | 750 | 12.1% | 24.2% | 50 |
| M4427 | 3.5 | 14 | 50.5 | 14 | 3 | 0 | 15 | 0 | 750 | 12.6% | 23.7% | 100 |
| M4428 | 4 | 14 | 53 | 14 | 0 | 0 | 15 | 0 | 800 | 10.1% | 23.2% | 100 |
| M4429 | 4 | 14 | 50 | 14 | 3 | 0 | 15 | 0 | 750 | 10.7% | 24.3% | 150 |
| M4430 | 3 | 14.5 | 58.5 | 14 | 0 | 0 | 10 | 0 | 800 | 10.1% | 14.1% | −50 |
| M4431 | 3.5 | 14.5 | 57 | 14 | 0 | 0 | 11 | 0 | 800 | 9.1% | 15.9% | 0 |
| M4432 | 3.5 | 14.5 | 56 | 14 | 0 | 0 | 12 | 0 | 800 | 9.8% | 17.7% | 0 |
| M4433 | 3.5 | 14.5 | 55 | 14 | 0 | 0 | 13 | 0 | 800 | 10.6% | 19.4% | 50 |
| M4434 | 4 | 14.5 | 53.5 | 14 | 0 | 0 | 14 | 0 | 800 | 9.6% | 21.2% | 100 |
| M4435 | 3 | 15 | 58 | 14 | 0 | 0 | 10 | 0 | 800 | 10.4% | 13.8% | −50 |
| M4436 | 3 | 15 | 55 | 14 | 3 | 0 | 10 | 0 | 750 | 10.8% | 13.5% | −50 |
| M4437 | 3.5 | 15 | 57.5 | 14 | 0 | 0 | 10 | 0 | 800 | 8.6% | 13.8% | 0 |
| M4438 | 3.5 | 15 | 54.5 | 14 | 3 | 0 | 10 | 0 | 750 | 9.1% | 14.7% | 50 |
| M4439 | 4 | 15 | 57 | 14 | 0 | 0 | 10 | 0 | 850 | 7.1% | 14.0% | 50 |
| M4440 | 4 | 15 | 54 | 14 | 3 | 0 | 10 | 0 | 800 | 7.6% | 14.9% | 100 |
| M4441 | 3 | 15 | 57 | 14 | 0 | 0 | 11 | 0 | 800 | 11.2% | 15.6% | −50 |
| M4442 | 3 | 15 | 54 | 14 | 3 | 0 | 11 | 0 | 750 | 11.7% | 14.8% | 0 |
| M4443 | 3.5 | 15 | 56.5 | 14 | 0 | 0 | 11 | 0 | 800 | 9.3% | 15.6% | 0 |
| M4444 | 3.5 | 15 | 53.5 | 14 | 3 | 0 | 11 | 0 | 750 | 9.8% | 16.5% | 100 |
| M4445 | 4 | 15 | 56 | 14 | 0 | 0 | 11 | 0 | 800 | 7.7% | 15.7% | 50 |
| M4446 | 4 | 15 | 53 | 14 | 3 | 0 | 11 | 0 | 800 | 8.2% | 16.7% | 100 |
| M4447 | 3 | 15 | 56 | 14 | 0 | 0 | 12 | 0 | 800 | 12.1% | 18.2% | −50 |
| M4448 | 3 | 15 | 53 | 14 | 3 | 0 | 12 | 0 | 750 | 12.5% | 17.9% | 0 |
| M4449 | 3.5 | 15 | 55.5 | 14 | 0 | 0 | 12 | 0 | 800 | 10.1% | 17.3% | 0 |
| M4450 | 3.5 | 15 | 52.5 | 14 | 3 | 0 | 12 | 0 | 750 | 10.7% | 17.8% | 50 |
| M4451 | 4 | 15 | 55 | 14 | 0 | 0 | 12 | 0 | 800 | 8.4% | 17.5% | 50 |
| M4452 | 4 | 15 | 52 | 14 | 3 | 0 | 12 | 0 | 750 | 8.9% | 18.4% | 150 |
| M4453 | 3 | 15 | 55 | 14 | 0 | 0 | 13 | 0 | 800 | 13.0% | 20.2% | 0 |
| M4454 | 3.5 | 15 | 52.5 | 14 | 2 | 0 | 13 | 0 | 750 | 11.3% | 19.7% | 50 |
| M4455 | 3.5 | 15 | 49.5 | 14 | 5 | 0 | 13 | 0 | 700 | 11.3% | 14.1% | 150 |
| M4456 | 4 | 15 | 52 | 14 | 2 | 0 | 13 | 0 | 750 | 9.5% | 19.8% | 150 |
| M4457 | 4 | 15 | 49 | 14 | 5 | 0 | 13 | 0 | 700 | 9.8% | 17.1% | 200 |
| M4458 | 3.5 | 15 | 51.5 | 14 | 2 | 0 | 14 | 0 | 750 | 12.2% | 22.9% | 50 |
| M4459 | 3.5 | 15 | 48.5 | 14 | 5 | 0 | 14 | 0 | 700 | 12.0% | 16.9% | 100 |
| M4460 | 4 | 15 | 51 | 14 | 2 | 0 | 14 | 0 | 750 | 10.3% | 21.5% | 150 |
| M4461 | 4 | 15 | 48 | 14 | 5 | 0 | 14 | 0 | 700 | 10.5% | 17.9% | 200 |
| M4462 | 4 | 15 | 51 | 14 | 1 | 0 | 15 | 0 | 750 | 10.9% | 22.8% | 100 |
| M4463 | 4 | 15 | 48 | 14 | 4 | 0 | 15 | 0 | 700 | 11.3% | 20.6% | 200 |
| M4464 | 3.5 | 15.5 | 57 | 14 | 0 | 0 | 10 | 0 | 800 | 8.9% | 13.5% | 0 |
| M4465 | 3.5 | 15.5 | 56 | 14 | 0 | 0 | 11 | 0 | 800 | 9.6% | 15.2% | 0 |
| M4466 | 3.5 | 15.5 | 55 | 14 | 0 | 0 | 12 | 0 | 800 | 10.4% | 17.0% | 0 |
| M4467 | 4 | 15.5 | 53.5 | 14 | 0 | 0 | 13 | 0 | 800 | 9.4% | 18.8% | 100 |
| M4468 | 3.5 | 15.5 | 52 | 14 | 0 | 0 | 15 | 0 | 800 | 13.1% | 23.4% | 50 |
| M4469 | 3 | 16 | 56 | 14 | 1 | 0 | 10 | 0 | 750 | 11.1% | 13.4% | −50 |
| M4470 | 3 | 16 | 53 | 14 | 4 | 0 | 10 | 0 | 750 | 11.3% | 9.8% | 0 |
| M4471 | 3.5 | 16 | 55.5 | 14 | 1 | 0 | 10 | 0 | 800 | 9.3% | 13.4% | 50 |
| M4472 | 3.5 | 16 | 52.5 | 14 | 4 | 0 | 10 | 0 | 750 | 9.7% | 12.3% | 50 |
| M4473 | 4 | 16 | 55 | 14 | 1 | 0 | 10 | 0 | 800 | 7.7% | 13.6% | 50 |
| M4474 | 4 | 16 | 52 | 14 | 4 | 0 | 10 | 0 | 750 | 8.2% | 14.3% | 100 |
| M4475 | 3 | 16 | 55 | 14 | 1 | 0 | 11 | 0 | 750 | 12.0% | 15.9% | −50 |
| M4476 | 3 | 16 | 52 | 14 | 4 | 0 | 11 | 0 | 750 | 12.0% | 12.4% | 50 |
| M4477 | 3.5 | 16 | 54.5 | 14 | 1 | 0 | 11 | 0 | 800 | 10.0% | 15.2% | 50 |
| M4478 | 3.5 | 16 | 51.5 | 14 | 4 | 0 | 11 | 0 | 750 | 10.4% | 13.3% | 100 |
| M4479 | 4 | 16 | 54 | 14 | 1 | 0 | 11 | 0 | 800 | 8.4% | 15.4% | 100 |
| M4480 | 4 | 16 | 51 | 14 | 4 | 0 | 11 | 0 | 750 | 8.9% | 15.6% | 150 |
| M4481 | 3 | 16 | 54 | 14 | 1 | 0 | 12 | 0 | 750 | 12.9% | 18.6% | −50 |
| M4482 | 3.5 | 16 | 53.5 | 14 | 1 | 0 | 12 | 0 | 750 | 10.9% | 17.0% | 0 |
| M4483 | 3.5 | 16 | 50.5 | 14 | 4 | 0 | 12 | 0 | 750 | 11.2% | 14.2% | 100 |
| M4484 | 4 | 16 | 53 | 14 | 1 | 0 | 12 | 0 | 800 | 9.1% | 17.1% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M4485 | 4 | 16 | 50 | 14 | 4 | 0 | 12 | 0 | 750 | 9.6% | 16.7% | 150 |
| M4486 | 3.5 | 16 | 52.5 | 14 | 1 | 0 | 13 | 0 | 750 | 11.7% | 19.0% | 50 |
| M4487 | 3.5 | 16 | 49.5 | 14 | 4 | 0 | 13 | 0 | 700 | 11.9% | 16.3% | 100 |
| M4488 | 4 | 16 | 52 | 14 | 1 | 0 | 13 | 0 | 800 | 9.8% | 18.8% | 100 |
| M4489 | 4 | 16 | 49 | 14 | 4 | 0 | 13 | 0 | 750 | 10.3% | 17.7% | 150 |
| M4490 | 3.5 | 16 | 51.5 | 14 | 1 | 0 | 14 | 0 | 750 | 12.6% | 22.3% | 50 |
| M4491 | 4 | 16 | 51 | 14 | 1 | 0 | 14 | 0 | 750 | 10.6% | 20.5% | 150 |
| M4492 | 4 | 16 | 48 | 14 | 4 | 0 | 14 | 0 | 700 | 11.0% | 18.5% | 150 |
| M4493 | 4 | 16 | 51 | 14 | 0 | 0 | 15 | 0 | 750 | 11.3% | 21.8% | 100 |
| M4494 | 4 | 16 | 48 | 14 | 3 | 0 | 15 | 0 | 750 | 11.9% | 22.5% | 150 |
| M4495 | 3.9 | 16.1 | 50.4 | 14 | 0 | 0 | 15.6 | 0 | 750 | 12.3% | 24.0% | 100 |
| M4496 | 3 | 12 | 55.6 | 14 | 0 | 0.4 | 15 | 0 | 800 | 13.0% | 24.7% | 50 |
| M4497 | 4 | 16 | 50.4 | 14 | 0 | 0.6 | 15 | 0 | 750 | 11.1% | 21.8% | 100 |
| M4498 | 3 | 12 | 55 | 14 | 0 | 1 | 15 | 0 | 800 | 12.9% | 24.7% | 50 |
| M4499 | 4 | 16 | 49.8 | 14 | 0 | 1.2 | 15 | 0 | 750 | 11.0% | 21.8% | 100 |
| M4500 | 3 | 12 | 54.4 | 14 | 0 | 1.6 | 15 | 0 | 800 | 12.8% | 24.7% | 50 |
| M4501 | 4 | 16 | 49.2 | 14 | 0 | 1.8 | 15 | 0 | 750 | 10.9% | 21.8% | 100 |
| M4502 | 3 | 12 | 53.8 | 14 | 0 | 2.2 | 15 | 0 | 800 | 12.7% | 24.8% | 50 |
| M4503 | 4 | 16 | 48.4 | 14 | 0 | 2.6 | 15 | 0 | 750 | 10.8% | 21.8% | 100 |
| M4504 | 4 | 16 | 47.8 | 14 | 0 | 3.2 | 15 | 0 | 750 | 10.7% | 21.8% | 100 |
| M4505 | 4 | 16 | 40.4 | 14 | 0 | 10.6 | 15 | 0 | 750 | 9.8% | 22.1% | 200 |
| M4506 | 4 | 16 | 39.8 | 14 | 0 | 11.2 | 15 | 0 | 750 | 9.7% | 22.1% | 200 |
| M4507 | 4 | 16 | 39.4 | 14 | 0 | 11.6 | 15 | 0 | 750 | 9.7% | 22.2% | 200 |
| M4508 | 3 | 12 | 44 | 14 | 0 | 12 | 15 | 0 | 750 | 11.8% | 25.2% | 100 |
| M4509 | 4 | 16 | 38.8 | 14 | 0 | 12.2 | 15 | 0 | 750 | 9.6% | 22.2% | 200 |
| M4510 | 3 | 12 | 43.4 | 14 | 0 | 12.6 | 15 | 0 | 750 | 11.7% | 25.2% | 100 |
| M4511 | 4 | 16 | 38.2 | 14 | 0 | 12.8 | 15 | 0 | 750 | 9.6% | 22.2% | 200 |
| M4512 | 3 | 12 | 42.8 | 14 | 0 | 13.2 | 15 | 0 | 750 | 11.7% | 25.2% | 100 |
| M4513 | 4 | 16 | 37.6 | 14 | 0 | 13.4 | 15 | 0 | 750 | 9.5% | 22.3% | 200 |
| M4514 | 3 | 12 | 42.2 | 14 | 0 | 13.8 | 15 | 0 | 750 | 11.7% | 25.1% | 100 |
| M4515 | 4 | 16 | 37 | 14 | 0 | 14 | 15 | 0 | 750 | 9.4% | 22.3% | 200 |
| M4516 | 3 | 12 | 59.5 | 14.5 | 0 | 0 | 11 | 0 | 800 | 9.5% | 17.5% | 0 |
| M4517 | 3.5 | 12 | 58 | 14.5 | 0 | 0 | 12 | 0 | 800 | 8.5% | 19.3% | 50 |
| M4518 | 4 | 12 | 56.5 | 14.5 | 0 | 0 | 13 | 0 | 800 | 7.6% | 21.2% | 100 |
| M4519 | 4 | 12 | 55.5 | 14.5 | 0 | 0 | 14 | 0 | 800 | 8.2% | 22.9% | 100 |
| M4520 | 4 | 12 | 54.5 | 14.5 | 0 | 0 | 15 | 0 | 800 | 9.0% | 24.6% | 150 |
| M4521 | 3 | 12.5 | 59 | 14.5 | 0 | 0 | 11 | 0 | 800 | 9.8% | 17.2% | 0 |
| M4522 | 3.5 | 12.5 | 57.5 | 14.5 | 0 | 0 | 12 | 0 | 800 | 8.7% | 19.0% | 50 |
| M4523 | 3.5 | 12.5 | 56.5 | 14.5 | 0 | 0 | 13 | 0 | 800 | 9.5% | 20.8% | 50 |
| M4524 | 3.5 | 12.5 | 55.5 | 14.5 | 0 | 0 | 14 | 0 | 750 | 10.3% | 22.5% | 50 |
| M4525 | 4 | 12.5 | 54 | 14.5 | 0 | 0 | 15 | 0 | 750 | 9.3% | 24.2% | 100 |
| M4526 | 3 | 13 | 58.5 | 14.5 | 0 | 0 | 11 | 0 | 800 | 10.0% | 16.9% | −50 |
| M4527 | 3.5 | 13 | 57 | 14.5 | 0 | 0 | 12 | 0 | 800 | 9.0% | 18.7% | 50 |
| M4528 | 3.5 | 13 | 56 | 14.5 | 0 | 0 | 13 | 0 | 800 | 9.8% | 20.4% | 50 |
| M4529 | 3.5 | 13 | 55 | 14.5 | 0 | 0 | 14 | 0 | 750 | 10.6% | 22.2% | 50 |
| M4530 | 4 | 13 | 53.5 | 14.5 | 0 | 0 | 15 | 0 | 750 | 9.5% | 23.9% | 100 |
| M4531 | 3 | 13.5 | 58 | 14.5 | 0 | 0 | 11 | 0 | 800 | 10.3% | 16.6% | −50 |
| M4532 | 3 | 13.5 | 57 | 14.5 | 0 | 0 | 12 | 0 | 750 | 11.2% | 18.4% | 0 |
| M4533 | 3 | 13.5 | 56 | 14.5 | 0 | 0 | 13 | 0 | 750 | 12.1% | 21.1% | 0 |
| M4534 | 3 | 13.5 | 55 | 14.5 | 0 | 0 | 14 | 0 | 800 | 13.0% | 22.4% | 0 |
| M4535 | 3.5 | 13.5 | 53.5 | 14.5 | 0 | 0 | 15 | 0 | 750 | 11.8% | 24.2% | 50 |
| M4536 | 3.5 | 14 | 58 | 14.5 | 0 | 0 | 10 | 0 | 800 | 8.1% | 14.5% | 0 |
| M4537 | 4 | 14 | 56.5 | 14.5 | 0 | 0 | 11 | 0 | 800 | 7.3% | 16.4% | 100 |
| M4538 | 4 | 14 | 55.5 | 14.5 | 0 | 0 | 12 | 0 | 800 | 7.9% | 18.1% | 50 |
| M4539 | 4 | 14 | 54.5 | 14.5 | 0 | 0 | 13 | 0 | 800 | 8.6% | 19.8% | 100 |
| M4540 | 3.5 | 14 | 53 | 14.5 | 0 | 0 | 15 | 0 | 750 | 12.1% | 24.3% | 50 |
| M4541 | 3.5 | 14.5 | 57.5 | 14.5 | 0 | 0 | 10 | 0 | 800 | 8.4% | 14.1% | 0 |
| M4542 | 4 | 14.5 | 56 | 14.5 | 0 | 0 | 11 | 0 | 800 | 7.5% | 16.1% | 100 |
| M4543 | 4 | 14.5 | 55 | 14.5 | 0 | 0 | 12 | 0 | 800 | 8.2% | 17.8% | 100 |
| M4544 | 4 | 14.5 | 54 | 14.5 | 0 | 0 | 13 | 0 | 800 | 8.8% | 19.5% | 50 |
| M4545 | 3.5 | 14.5 | 52.5 | 14.5 | 0 | 0 | 15 | 0 | 750 | 12.4% | 24.1% | 50 |
| M4546 | 3.5 | 15 | 57 | 14.5 | 0 | 0 | 10 | 0 | 800 | 8.6% | 13.8% | 0 |
| M4547 | 3.5 | 15 | 56 | 14.5 | 0 | 0 | 11 | 0 | 800 | 9.3% | 15.6% | 0 |
| M4548 | 3.5 | 15 | 55 | 14.5 | 0 | 0 | 12 | 0 | 800 | 10.1% | 17.3% | 0 |
| M4549 | 3.5 | 15 | 54 | 14.5 | 0 | 0 | 13 | 0 | 750 | 11.0% | 19.1% | 0 |
| M4550 | 4 | 15 | 52.5 | 14.5 | 0 | 0 | 14 | 0 | 800 | 9.9% | 20.8% | 100 |
| M4551 | 3 | 15.5 | 57 | 14.5 | 0 | 0 | 10 | 0 | 800 | 10.7% | 13.4% | −50 |
| M4552 | 3 | 15.5 | 56 | 14.5 | 0 | 0 | 11 | 0 | 750 | 11.5% | 15.2% | −50 |
| M4553 | 3 | 15.5 | 55 | 14.5 | 0 | 0 | 12 | 0 | 750 | 12.4% | 18.5% | −50 |
| M4554 | 3.5 | 15.5 | 53.5 | 14.5 | 0 | 0 | 13 | 0 | 750 | 11.3% | 18.7% | 0 |
| M4555 | 4 | 15.5 | 52 | 14.5 | 0 | 0 | 14 | 0 | 800 | 10.2% | 20.5% | 100 |
| M4556 | 3 | 16 | 56.5 | 14.5 | 0 | 0 | 10 | 0 | 800 | 11.0% | 13.1% | −50 |
| M4557 | 3 | 16 | 55.5 | 14.5 | 0 | 0 | 11 | 0 | 750 | 11.8% | 15.3% | −50 |
| M4558 | 3 | 16 | 54.5 | 14.5 | 0 | 0 | 12 | 0 | 800 | 12.7% | 18.2% | −50 |
| M4559 | 3.5 | 16 | 53 | 14.5 | 0 | 0 | 13 | 0 | 750 | 11.6% | 18.4% | 0 |
| M4560 | 4 | 16 | 51.5 | 14.5 | 0 | 0 | 14 | 0 | 750 | 10.4% | 20.1% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M4561 | 4 | 7 | 54 | 15 | 0 | 0 | 20 | 0 | 750 | 7.9% | 33.9% | 200 |
| M4562 | 4 | 10 | 51 | 15 | 0 | 0 | 20 | 0 | 750 | 11.4% | 33.8% | 200 |
| M4563 | 3.5 | 12 | 59.5 | 15 | 0 | 0 | 10 | 0 | 800 | 7.2% | 15.7% | 0 |
| M4564 | 3 | 12 | 58 | 15 | 0 | 0 | 12 | 0 | 750 | 10.3% | 19.4% | 0 |
| M4565 | 3.5 | 12 | 56.5 | 15 | 0 | 0 | 13 | 0 | 750 | 9.2% | 21.1% | 50 |
| M4566 | 3.5 | 12 | 55.5 | 15 | 0 | 0 | 14 | 0 | 750 | 10.0% | 22.8% | 50 |
| M4567 | 3.5 | 12 | 54.5 | 15 | 0 | 0 | 15 | 0 | 750 | 10.9% | 24.6% | 100 |
| M4568 | 3.5 | 12.5 | 59 | 15 | 0 | 0 | 10 | 0 | 800 | 7.4% | 15.4% | 0 |
| M4569 | 3 | 12.5 | 57.5 | 15 | 0 | 0 | 12 | 0 | 750 | 10.6% | 19.0% | 0 |
| M4570 | 3 | 12.5 | 56.5 | 15 | 0 | 0 | 13 | 0 | 750 | 11.5% | 20.9% | 0 |
| M4571 | 3 | 12.5 | 55.5 | 15 | 0 | 0 | 14 | 0 | 750 | 12.4% | 23.0% | 0 |
| M4572 | 3.5 | 12.5 | 54 | 15 | 0 | 0 | 15 | 0 | 750 | 11.2% | 24.2% | 100 |
| M4573 | 3.5 | 13 | 58.5 | 15 | 0 | 0 | 10 | 0 | 800 | 7.7% | 15.1% | 0 |
| M4574 | 3 | 13 | 57 | 15 | 0 | 0 | 12 | 0 | 750 | 10.9% | 18.7% | 0 |
| M4575 | 3 | 13 | 56 | 15 | 0 | 0 | 13 | 0 | 750 | 11.8% | 21.1% | 0 |
| M4576 | 3 | 13 | 55 | 15 | 0 | 0 | 14 | 0 | 800 | 12.7% | 22.7% | 0 |
| M4577 | 3.5 | 13 | 53.5 | 15 | 0 | 0 | 15 | 0 | 750 | 11.5% | 24.1% | 50 |
| M4578 | 3.5 | 13.5 | 58 | 15 | 0 | 0 | 10 | 0 | 800 | 7.9% | 14.8% | 0 |
| M4579 | 4 | 13.5 | 56.5 | 15 | 0 | 0 | 11 | 0 | 800 | 7.1% | 16.7% | 100 |
| M4580 | 4 | 13.5 | 55.5 | 15 | 0 | 0 | 12 | 0 | 800 | 7.7% | 18.4% | 50 |
| M4581 | 4 | 13.5 | 54.5 | 15 | 0 | 0 | 13 | 0 | 800 | 8.4% | 20.1% | 100 |
| M4582 | 4 | 13.5 | 53.5 | 15 | 0 | 0 | 14 | 0 | 800 | 9.1% | 21.8% | 100 |
| M4583 | 3 | 14 | 58 | 15 | 0 | 0 | 10 | 0 | 800 | 9.8% | 14.4% | −50 |
| M4584 | 3.5 | 14 | 56.5 | 15 | 0 | 0 | 11 | 0 | 800 | 8.8% | 16.2% | 0 |
| M4585 | 3.5 | 14 | 55.5 | 15 | 0 | 0 | 12 | 0 | 800 | 9.6% | 18.0% | 0 |
| M4586 | 3.5 | 14 | 54.5 | 15 | 0 | 0 | 13 | 0 | 750 | 10.4% | 19.7% | 50 |
| M4587 | 4 | 14 | 53 | 15 | 0 | 0 | 14 | 0 | 750 | 9.3% | 21.5% | 100 |
| M4588 | 3 | 14.5 | 57.5 | 15 | 0 | 0 | 10 | 0 | 800 | 10.1% | 14.1% | −50 |
| M4589 | 3.5 | 14.5 | 56 | 15 | 0 | 0 | 11 | 0 | 800 | 9.1% | 15.9% | 0 |
| M4590 | 3.5 | 14.5 | 55 | 15 | 0 | 0 | 12 | 0 | 800 | 9.9% | 17.7% | 0 |
| M4591 | 3.5 | 14.5 | 54 | 15 | 0 | 0 | 13 | 0 | 750 | 10.7% | 19.4% | 50 |
| M4592 | 4 | 14.5 | 52.5 | 15 | 0 | 0 | 14 | 0 | 750 | 9.6% | 21.1% | 100 |
| M4593 | 3 | 15 | 57 | 15 | 0 | 0 | 10 | 0 | 800 | 10.4% | 13.7% | −50 |
| M4594 | 3 | 15 | 56 | 15 | 0 | 0 | 11 | 0 | 750 | 11.3% | 15.6% | −50 |
| M4595 | 3 | 15 | 55 | 15 | 0 | 0 | 12 | 0 | 750 | 12.1% | 18.5% | −50 |
| M4596 | 3 | 15 | 54 | 15 | 0 | 0 | 13 | 0 | 750 | 13.1% | 20.1% | 0 |
| M4597 | 3.5 | 15 | 52.5 | 15 | 0 | 0 | 14 | 0 | 750 | 11.9% | 21.5% | 50 |
| M4598 | 4 | 15 | 51 | 15 | 0 | 0 | 15 | 0 | 750 | 10.7% | 22.5% | 100 |
| M4599 | 4 | 15.5 | 55.5 | 15 | 0 | 0 | 10 | 0 | 800 | 7.4% | 13.6% | 50 |
| M4600 | 4 | 15.5 | 54.5 | 15 | 0 | 0 | 11 | 0 | 800 | 8.0% | 15.4% | 100 |
| M4601 | 4 | 15.5 | 53.5 | 15 | 0 | 0 | 12 | 0 | 800 | 8.7% | 17.1% | 100 |
| M4602 | 3.5 | 15.5 | 52 | 15 | 0 | 0 | 14 | 0 | 750 | 12.2% | 21.7% | 50 |
| M4603 | 3 | 16 | 56 | 15 | 0 | 0 | 10 | 0 | 750 | 11.0% | 13.1% | −50 |
| M4604 | 3 | 16 | 55 | 15 | 0 | 0 | 11 | 0 | 750 | 11.9% | 15.4% | −50 |
| M4605 | 3 | 16 | 54 | 15 | 0 | 0 | 12 | 0 | 750 | 12.8% | 18.2% | −50 |
| M4606 | 3.5 | 16 | 52.5 | 15 | 0 | 0 | 13 | 0 | 750 | 11.6% | 18.5% | 0 |
| M4607 | 4 | 16 | 51 | 15 | 0 | 0 | 14 | 0 | 750 | 10.5% | 20.1% | 100 |
| M4608 | 3.5 | 12 | 59 | 15.5 | 0 | 0 | 10 | 0 | 800 | 7.2% | 15.7% | 0 |
| M4609 | 3 | 12 | 57.5 | 15.5 | 0 | 0 | 12 | 0 | 750 | 10.3% | 19.4% | 0 |
| M4610 | 3 | 12 | 56.5 | 15.5 | 0 | 0 | 13 | 0 | 750 | 11.2% | 21.2% | 0 |
| M4611 | 3 | 12 | 55.5 | 15.5 | 0 | 0 | 14 | 0 | 750 | 12.1% | 23.3% | 0 |
| M4612 | 3 | 12 | 54.5 | 15.5 | 0 | 0 | 15 | 0 | 750 | 13.1% | 24.6% | 50 |
| M4613 | 3 | 12.5 | 59 | 15.5 | 0 | 0 | 10 | 0 | 800 | 9.0% | 15.3% | −50 |
| M4614 | 3.5 | 12.5 | 57.5 | 15.5 | 0 | 0 | 11 | 0 | 800 | 8.1% | 17.2% | 0 |
| M4615 | 4 | 12.5 | 56 | 15.5 | 0 | 0 | 12 | 0 | 800 | 7.2% | 19.1% | 100 |
| M4616 | 4 | 12.5 | 55 | 15.5 | 0 | 0 | 13 | 0 | 800 | 7.9% | 20.8% | 100 |
| M4617 | 4 | 12.5 | 54 | 15.5 | 0 | 0 | 14 | 0 | 750 | 8.6% | 22.5% | 100 |
| M4618 | 3 | 13 | 58.5 | 15.5 | 0 | 0 | 10 | 0 | 800 | 9.3% | 15.0% | −50 |
| M4619 | 3.5 | 13 | 57 | 15.5 | 0 | 0 | 11 | 0 | 800 | 8.3% | 16.9% | 0 |
| M4620 | 4 | 13 | 55.5 | 15.5 | 0 | 0 | 12 | 0 | 800 | 7.5% | 18.7% | 50 |
| M4621 | 4 | 13 | 54.5 | 15.5 | 0 | 0 | 13 | 0 | 800 | 8.1% | 20.5% | 100 |
| M4622 | 4 | 13 | 53.5 | 15.5 | 0 | 0 | 14 | 0 | 750 | 8.8% | 22.1% | 100 |
| M4623 | 3 | 13.5 | 58 | 15.5 | 0 | 0 | 10 | 0 | 800 | 9.6% | 14.7% | −50 |
| M4624 | 3.5 | 13.5 | 56.5 | 15.5 | 0 | 0 | 11 | 0 | 800 | 8.6% | 16.5% | 0 |
| M4625 | 3.5 | 13.5 | 55.5 | 15.5 | 0 | 0 | 12 | 0 | 750 | 9.3% | 18.3% | 50 |
| M4626 | 3.5 | 13.5 | 54.5 | 15.5 | 0 | 0 | 13 | 0 | 750 | 10.1% | 20.1% | 50 |
| M4627 | 3.5 | 13.5 | 53.5 | 15.5 | 0 | 0 | 14 | 0 | 750 | 11.0% | 21.8% | 50 |
| M4628 | 4 | 13.5 | 52 | 15.5 | 0 | 0 | 15 | 0 | 750 | 9.9% | 23.5% | 100 |
| M4629 | 3 | 14 | 56.5 | 15.5 | 0 | 0 | 11 | 0 | 750 | 10.7% | 16.2% | −50 |
| M4630 | 3 | 14 | 55.5 | 15.5 | 0 | 0 | 12 | 0 | 750 | 11.5% | 18.2% | 0 |
| M4631 | 3 | 14 | 54.5 | 15.5 | 0 | 0 | 13 | 0 | 750 | 12.5% | 20.7% | 0 |
| M4632 | 3.5 | 14 | 53 | 15.5 | 0 | 0 | 14 | 0 | 750 | 11.3% | 21.5% | 50 |
| M4633 | 4 | 14 | 51.5 | 15.5 | 0 | 0 | 15 | 0 | 750 | 10.2% | 23.1% | 100 |
| M4634 | 4 | 14.5 | 56 | 15.5 | 0 | 0 | 10 | 0 | 800 | 7.0% | 14.2% | 50 |
| M4635 | 4 | 14.5 | 55 | 15.5 | 0 | 0 | 11 | 0 | 800 | 7.6% | 16.0% | 100 |
| M4636 | 4 | 14.5 | 54 | 15.5 | 0 | 0 | 12 | 0 | 800 | 8.2% | 17.7% | 100 |

TABLE 4-continued

Alloy Compositions and Thermodynamic Criteria

| No | C | Cr | Fe | Mn | Mo | Ni | V | W | A | B | C | D |
|---|---|---|---|---|---|---|---|---|---|---|---|---|
| M4637 | 4 | 14.5 | 53 | 15.5 | 0 | 0 | 13 | 0 | 800 | 8.9% | 19.4% | 100 |
| M4638 | 3.5 | 14.5 | 51.5 | 15.5 | 0 | 0 | 15 | 0 | 750 | 12.5% | 24.0% | 50 |
| M4639 | 3.5 | 15 | 56 | 15.5 | 0 | 0 | 10 | 0 | 800 | 8.7% | 13.8% | 50 |
| M4640 | 3.5 | 15 | 55 | 15.5 | 0 | 0 | 11 | 0 | 800 | 9.4% | 15.6% | 0 |
| M4641 | 3.5 | 15 | 54 | 15.5 | 0 | 0 | 12 | 0 | 750 | 10.2% | 17.3% | 0 |
| M4642 | 4 | 15 | 52.5 | 15.5 | 0 | 0 | 13 | 0 | 800 | 9.2% | 19.1% | 100 |
| M4643 | 3.5 | 15 | 51 | 15.5 | 0 | 0 | 15 | 0 | 750 | 12.8% | 23.7% | 50 |
| M4644 | 3.5 | 15.5 | 55.5 | 15.5 | 0 | 0 | 10 | 0 | 800 | 8.9% | 13.5% | 50 |
| M4645 | 3.5 | 15.5 | 54.5 | 15.5 | 0 | 0 | 11 | 0 | 800 | 9.7% | 15.2% | 50 |
| M4646 | 3.5 | 15.5 | 53.5 | 15.5 | 0 | 0 | 12 | 0 | 750 | 10.5% | 17.0% | 0 |
| M4647 | 4 | 15.5 | 52 | 15.5 | 0 | 0 | 13 | 0 | 750 | 9.4% | 18.8% | 100 |
| M4648 | 4 | 15.5 | 50 | 15.5 | 0 | 0 | 15 | 0 | 750 | 11.0% | 22.1% | 150 |
| M4649 | 4 | 16 | 54.5 | 15.5 | 0 | 0 | 10 | 0 | 800 | 7.7% | 13.3% | 50 |
| M4650 | 4 | 16 | 53.5 | 15.5 | 0 | 0 | 11 | 0 | 800 | 8.3% | 15.0% | 100 |
| M4651 | 4 | 16 | 52.5 | 15.5 | 0 | 0 | 12 | 0 | 800 | 9.0% | 16.7% | 100 |
| M4652 | 3.5 | 16 | 51 | 15.5 | 0 | 0 | 14 | 0 | 750 | 12.5% | 21.8% | 50 |
| M4653 | 3.75 | 8 | 52.25 | 16 | 0 | 0 | 20 | 0 | 750 | 9.2% | 32.6% | 200 |
| M4654 | 3 | 12 | 59 | 16 | 0 | 0 | 10 | 0 | 750 | 8.8% | 15.6% | −50 |
| M4655 | 3.5 | 12 | 57.5 | 16 | 0 | 0 | 11 | 0 | 800 | 7.9% | 17.5% | 50 |
| M4656 | 4 | 12 | 56 | 16 | 0 | 0 | 12 | 0 | 800 | 7.0% | 19.3% | 100 |
| M4657 | 4 | 12 | 55 | 16 | 0 | 0 | 13 | 0 | 800 | 7.6% | 21.1% | 100 |
| M4658 | 4 | 12 | 54 | 16 | 0 | 0 | 14 | 0 | 750 | 8.3% | 22.8% | 100 |
| M4659 | 3 | 12.5 | 58.5 | 16 | 0 | 0 | 10 | 0 | 750 | 9.0% | 15.3% | −50 |
| M4660 | 3.5 | 12.5 | 57 | 16 | 0 | 0 | 11 | 0 | 800 | 8.1% | 17.2% | 0 |
| M4661 | 4 | 12.5 | 55.5 | 16 | 0 | 0 | 12 | 0 | 800 | 7.3% | 19.0% | 100 |
| M4662 | 4 | 12.5 | 54.5 | 16 | 0 | 0 | 13 | 0 | 800 | 7.9% | 20.8% | 100 |
| M4663 | 4 | 12.5 | 53.5 | 16 | 0 | 0 | 14 | 0 | 750 | 8.6% | 22.5% | 100 |
| M4664 | 3 | 13 | 58 | 16 | 0 | 0 | 10 | 0 | 750 | 9.3% | 15.0% | −50 |
| M4665 | 3.5 | 13 | 56.5 | 16 | 0 | 0 | 11 | 0 | 800 | 8.4% | 16.8% | 0 |
| M4666 | 4 | 13 | 55 | 16 | 0 | 0 | 12 | 0 | 800 | 7.5% | 18.7% | 50 |
| M4667 | 4 | 13 | 54 | 16 | 0 | 0 | 13 | 0 | 800 | 8.1% | 20.4% | 100 |
| M4668 | 4 | 13 | 53 | 16 | 0 | 0 | 14 | 0 | 750 | 8.8% | 22.1% | 100 |
| M4669 | 3 | 13.5 | 57.5 | 16 | 0 | 0 | 10 | 0 | 750 | 9.6% | 14.7% | −50 |
| M4670 | 3.5 | 13.5 | 56 | 16 | 0 | 0 | 11 | 0 | 800 | 8.6% | 16.5% | 0 |
| M4671 | 3.5 | 13.5 | 55 | 16 | 0 | 0 | 12 | 0 | 750 | 9.4% | 18.3% | 50 |
| M4672 | 3.5 | 13.5 | 54 | 16 | 0 | 0 | 13 | 0 | 750 | 10.1% | 20.1% | 50 |
| M4673 | 4 | 13.5 | 52.5 | 16 | 0 | 0 | 14 | 0 | 750 | 9.1% | 21.8% | 100 |
| M4674 | 3 | 14 | 57 | 16 | 0 | 0 | 10 | 0 | 750 | 9.9% | 14.4% | −50 |
| M4675 | 3.5 | 14 | 55.5 | 16 | 0 | 0 | 11 | 0 | 800 | 8.9% | 16.2% | 0 |
| M4676 | 3.5 | 14 | 54.5 | 16 | 0 | 0 | 12 | 0 | 750 | 9.6% | 18.0% | 0 |
| M4677 | 3.5 | 14 | 53.5 | 16 | 0 | 0 | 13 | 0 | 750 | 10.4% | 19.7% | 50 |
| M4678 | 4 | 14 | 52 | 16 | 0 | 0 | 14 | 0 | 750 | 9.4% | 21.5% | 100 |
| M4679 | 3 | 14.5 | 56.5 | 16 | 0 | 0 | 10 | 0 | 750 | 10.2% | 14.1% | −50 |
| M4680 | 3 | 14.5 | 55.5 | 16 | 0 | 0 | 11 | 0 | 750 | 11.0% | 15.9% | −50 |
| M4681 | 3 | 14.5 | 54.5 | 16 | 0 | 0 | 12 | 0 | 750 | 11.9% | 18.5% | 0 |
| M4682 | 3 | 14.5 | 53.5 | 16 | 0 | 0 | 13 | 0 | 750 | 12.8% | 20.4% | 0 |
| M4683 | 3.5 | 14.5 | 52 | 16 | 0 | 0 | 14 | 0 | 750 | 11.6% | 21.5% | 50 |
| M4684 | 4 | 14.5 | 50.5 | 16 | 0 | 0 | 15 | 0 | 750 | 10.5% | 22.8% | 100 |
| M4685 | 4 | 15 | 55 | 16 | 0 | 0 | 10 | 0 | 800 | 7.3% | 13.9% | 50 |
| M4686 | 4 | 15 | 54 | 16 | 0 | 0 | 11 | 0 | 800 | 7.8% | 15.7% | 100 |
| M4687 | 4 | 15 | 53 | 16 | 0 | 0 | 12 | 0 | 800 | 8.5% | 17.4% | 100 |
| M4688 | 3.5 | 15 | 51.5 | 16 | 0 | 0 | 14 | 0 | 750 | 11.9% | 21.7% | 50 |
| M4689 | 4 | 15 | 50 | 16 | 0 | 0 | 15 | 0 | 750 | 10.8% | 22.4% | 150 |
| M4690 | 4 | 15.5 | 54.5 | 16 | 0 | 0 | 10 | 0 | 800 | 7.5% | 13.6% | 50 |
| M4691 | 4 | 15.5 | 53.5 | 16 | 0 | 0 | 11 | 0 | 800 | 8.1% | 15.3% | 100 |
| M4692 | 4 | 15.5 | 52.5 | 16 | 0 | 0 | 12 | 0 | 800 | 8.7% | 17.1% | 100 |
| M4693 | 3.5 | 15.5 | 51 | 16 | 0 | 0 | 14 | 0 | 750 | 12.2% | 22.0% | 50 |
| M4694 | 3 | 16 | 55 | 16 | 0 | 0 | 10 | 0 | 750 | 11.0% | 13.1% | −50 |
| M4695 | 3 | 16 | 54 | 16 | 0 | 0 | 11 | 0 | 750 | 11.9% | 15.7% | −50 |
| M4696 | 3 | 16 | 53 | 16 | 0 | 0 | 12 | 0 | 750 | 12.8% | 18.2% | −50 |
| M4697 | 3.5 | 16 | 51.5 | 16 | 0 | 0 | 13 | 0 | 750 | 11.6% | 18.8% | 50 |
| M4698 | 4 | 16 | 50 | 16 | 0 | 0 | 14 | 0 | 750 | 10.5% | 20.1% | 100 |
| M4699 | 3.75 | 8 | 51.25 | 17 | 0 | 0 | 20 | 0 | 750 | 9.2% | 32.6% | 200 |
| M4700 | 4 | 16 | 61.6 | 0 | 0 | 3.4 | 15 | 0 | 950 | 10.7% | 22.2% | 0 |
| M4701 | 4 | 11 | 47 | 18 | 0 | 0 | 20 | 0 | 750 | 12.6% | 33.1% | 200 |
| M4702 | 3.9 | 12 | 46.1 | 14 | 4 | 0 | 10 | 10 | 750 | 7.2% | 18.4% | 200 |
| M4703 | 4 | 16 | 61.4 | 0 | 0 | 3.6 | 15 | 0 | 950 | 10.6% | 22.2% | 0 |
| M4704 | 3 | 11 | 70 | 8 | 0 | 0 | 8 | 0 | 900 | 7.0% | 12.8% | −50 |
| M4705 | 4 | 10 | 48 | 18 | 0 | 0 | 20 | 0 | 750 | 11.5% | 33.6% | 200 |
| M4706 | 3.5 | 12 | 48.5 | 14 | 10 | 0 | 10 | 2 | 700 | 8.1% | 6.4% | 200 |

Figure 3:
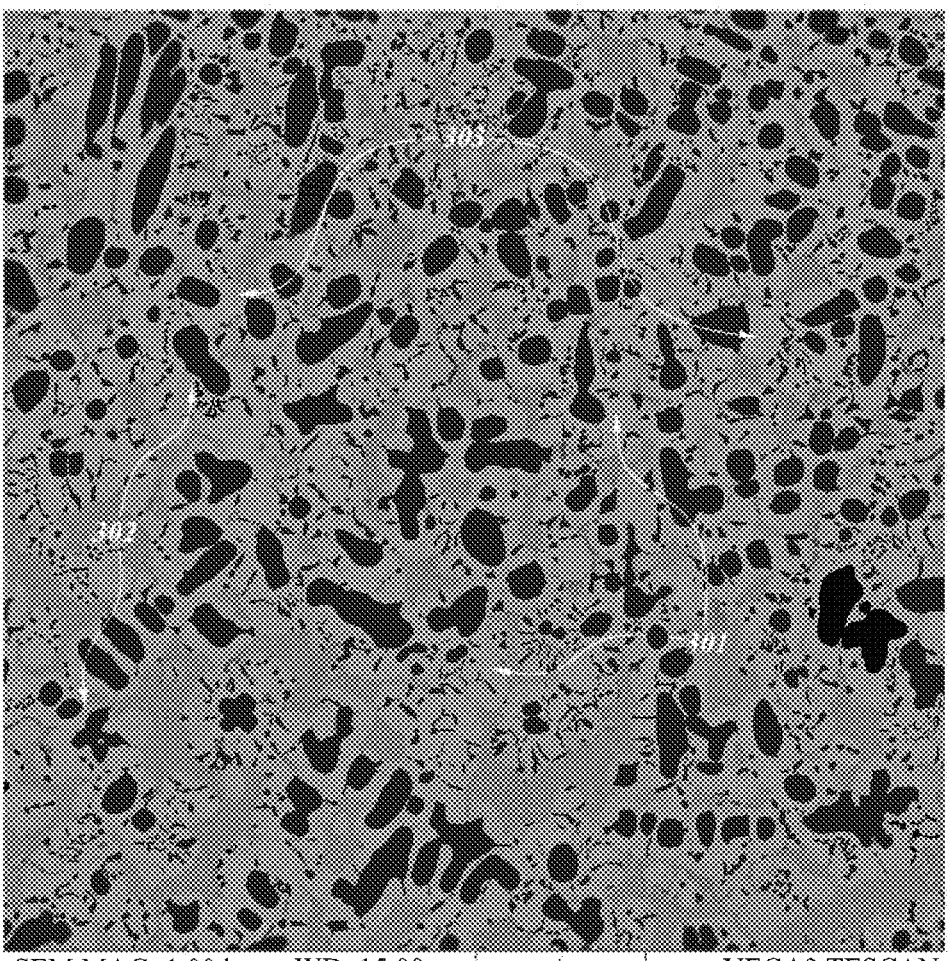
FIG. 3 microstructure of an embodiment of a disclosed alloy having the composition of Fe: 58, C:3, Cr: 12, Mn:12, and V:15.

Microstructural Criteria:

In some embodiments, the alloy can be described by one or more of the microstructural features it possesses. Similar to the concepts described as the thermodynamic material it is desirable to have a FCC (austenite) Fe-based matrix phase with a high fraction of extremely hard particles to increase wear resistance. These microstructural criteria are demonstrated in FIG. 3.

A first microstructural criterion is related to the Fe-based matrix phase being predominantly austenitic [301], the non-magnetic form of iron or steel. Ferrite and martensite are the two most common and likely forms of the matrix phase in this alloy space. Both are highly magnetic and will prevent the hardfacing alloy from meeting the magnetic performance requirements if present in sufficient quantities. In some embodiments, the matrix can be at least 90% volume fraction austenite (or at least about 90 volume % austenite). In some embodiments, the matrix can be at least 95% volume fraction austenite (or at least about 95 volume % austenite). In some embodiments, the matrix can be at least 99% volume fraction austenite (or at least about 99 volume % austenite).

A second microstructural criteria is related to the total measured volume fraction of extremely hard particles [302]. In some embodiments, the alloy can possess at least 5 volume % (or at least about 5 volume %) of extremely hard particles. In some embodiments, the alloy can possess 10 volume % (or at least about 10 volume %) of extremely hard particles. In some embodiments, the alloy can possess 15 volume % (or at least about 15 volume %) of extremely hard particles.

In some embodiments, it can be advantageous for the alloy to have an increased resistance to corrosion. To increase the resistance to corrosion, it is well known that a high weight % of chromium must be in the matrix. An Energy Dispersive Spectrometer, for example, can be used to determine the weight % of chromium in the matrix [303]. In some embodiments, the content of chromium in the matrix can be 7 weight % (or about 7 weight %) or higher. In some embodiments, the content of chromium in the matrix can be 10 weight % (or about 10 weight %) or higher. In some embodiments, the content of chromium in the matrix can be 12 weight % (or about 12 weight %) or higher.

Performance Criteria:

In some embodiments, the alloy can be described by meeting one or more advantageous performance characteristics. The abrasion resistance of hardfacing alloys is commonly characterized by the ASTM G65 dry sand abrasion test, hereby incorporated by reference in its entirety. The manufacturability is commonly characterized by the yield of intended powder size produced during the manufacturing process. To determine if the alloy is non-magnetic, a magnetic permeability test is commonly used to characterize the material. The corrosion resistance of the material is commonly characterized using the ASTM G31 standard, hereby incorporated by reference in its entirety. The crack resistance of the material is commonly characterized using the ASTM E1417 standard, hereby incorporated by reference in its entirety.

In some embodiments, the hardfacing alloy layer can have an ASTM G65 abrasion loss less than 1.5 grams (or less than about 1.5 grams). In some embodiments, the hardfacing alloy layer can have an ASTM G65 abrasion loss of less than 1.25 grams (or less than about 1.25 grams). In some embodiments, the hardfacing alloy layer can have an ASTM G65 abrasion loss of less than 1.1 grams (or less than about 1.1 grams).

In some embodiments, the hardfacing alloy can have a relative magnetic permeability of 1.03μ or less (or about 1.03μ or less). In some embodiments, the hardfacing alloy can have a relative magnetic permeability of 1.02μ or less (or about 1.02μ or less). In some embodiments, the hardfacing alloy can have a relative magnetic permeability of 1.01μ or less (or about 1.01μ or less).

In some embodiments, the alloy can exhibit 2 inches or less (or about 2 inches or less) of lateral cracking per square inch of as-welded hardfacing. In some embodiments, the alloy can exhibit 1.5 inches or less (or about 1.5 inches or less) of lateral cracking per square inch of as-welded hardfacing. In some embodiments, the alloy can exhibit 1 inch or less (or about 1 inch or less) of lateral cracking per square inch of as-welded hardfacing.

In some embodiments, the alloy can have a corrosion resistance of 5 mpy or less (or about 5 mpy or less) in salt water via ASTM G31. In some embodiments, the alloy can have a corrosion resistance of 3 mpy or less (or about 3 mpy or less) in salt water via ASTM G31. In some embodiments, the alloy can have a corrosion resistance of 1 mpy or less (or about 1 mpy or less) in salt water via ASTM G31.

Further, it is often beneficial to manufacture an alloy into a powder as an intermediary step in producing a bulk product or applying a coating to a substrate. Powder is manufactured via atomization or other manufacturing methods. The feasibility of such a process for a particular alloy is often a function of the alloy's solidification behavior and thus its thermodynamic characteristics.

To make a production of powder for processes such as plasma transferred arc (PTA), high velocity oxygen fuel (HVOF), laser welding, and other powder metallurgy processes, it can be advantageous to be able to manufacture the powder at high yields in the size range specified above. The manufacturing process can include forming a melt of the alloy, forcing the melt through a nozzle to form a stream of material, and spraying water or air at the produced stream of the melt to solidify it into a powder form. The powder is then sifted to eliminate any particles that do not meet the specific size requirements.

Embodiments of the disclosed alloys can be produced as powders in high yields to be used in such processes. On the other hand, many alloys, such as other common wear resistant materials, would have low yields due to their properties, such as their thermodynamic properties, when atomized into a powder. Thus, they would not be suitable for powder manufacture.

In some embodiments, the hardfacing alloy can be manufactured into a 53-180 μm (or about 53 to about 180 μm) powder size distribution at a 50% (or about 50%) or greater yield. In some embodiments, the hardfacing alloy can be manufactured into a 53-180 μm (or about 53 to about 180 μm) powder size distribution at a 60% (or about 60%) or greater yield. In some embodiments, the hardfacing alloy can be manufactured into a 53-180 μm (or about 53 to about 180 μm) powder size distribution at a 70% (or about 70%) or greater yield.

EXAMPLES

The following examples are intended to be illustrative and non-limiting.

Example 1

Alloys 3-8 listed in Table 1 were successfully produced via commercial atomization processes into the 53-180 μm size for the purpose of using it as feedstock for plasma transferred arc welding and laser cladding. Alloys 1 and 2 are the nominal chemistries for the manufactured powders listed in Table 1. These powders were used in the plasma transferred arc welding process with the parameters provided in Table 5 to produce a hardfacing layer.

TABLE 5

Plasma transferred arc welding parameters used to produce Alloys 3-8 as a hardfacing layer.

| Voltage | Amperage | Powder Feed | Traverse Rate | Width | Thickness |
|---|---|---|---|---|---|
| 28 V | 180 A | 34 g/min | 46 mm/min | 24 mm | 3 mm |

The manufactured powders were characterized according to the thermodynamic criteria in this disclosure. The results of the thermodynamic properties for each Alloy are shown in Table 6.

TABLE 6

Thermodynamic properties used to characterize Alloys 3-8.

| Alloy | FCC-BCC Transition Temp. | Total Fraction of Hard Phase | Hard Phase Melt Range | Mole % of Cr in Matrix |
|---|---|---|---|---|
| 3 | 800 K | 22% | 100 K | 11.3% |
| 4 | 850 K | 24.5% | 0 K | 12.8% |
| 5 | 750 K | 21.5% | 50 K | 11.8% |
| 6 | 850 K | 24.5% | 0 K | 12.9% |
| 7 | 750 K | 24% | 100 K | 12.3% |
| 8 | 850 K | 23.5% | 0 K | 12.8% |

The hardfacing layers were cross-sectioned, and the microstructures were characterized according to the microstructural criteria in this disclosure. The results of the microstructural properties for each alloy are listed in Table 7.

TABLE 7

Microstructural properties used to characterize Alloys 3-8.

| Alloy | % of Matrix that is Austenite | Total Volume Fraction of Hard Phase | Weight % Cr in the Matrix |
|---|---|---|---|
| 3 | 99% | 22% | 14 |
| 4 | 99% | 25% | 12 |
| 5 | 99% | 22% | 13 |
| 6 | 99% | 25% | 12 |
| 7 | 99% | 24% | 14 |
| 8 | 99% | 24% | 12 |

Additionally, each hardfacing layer was characterized according to the performance criteria in the disclosure. 100% of the manufactured alloys that met the thermodynamic criteria, result in a microstructure that meet the microstructural criteria. Thus, the disclosed thermodynamic criteria are a good indicator of the microstructure. The performance properties for each alloy are listed in Table 8.

TABLE 8

Performance properties used to characterize Alloys 3-8.

| Alloy | G65A Mass Loss | Magnetic Permeability | Cracking per Square Inch | Can be manufactured into a powder? |
|---|---|---|---|---|
| 3 | 0.11 g | <1.02μ | 0 | Yes |
| 4 | 0.13 g | <1.02μ | 0 | Yes |
| 5 | 0.22 g | <1.02μ | 0 | Yes |
| 6 | 0.49 g | <1.02μ | 0 | Yes |
| 7 | 0.16 g | <1.02μ | 0 | Yes |
| 8 | 0.16 g | <1.02μ | 0 | Yes |

100% of the manufactured alloys which meet the microstructural criteria also meet the performance criteria. Thus, the disclosed microstructural criteria are a good indicator of performance. As for the powder manufacturability, this relates back to the thermodynamic criteria of hard phase melt range.

Applications

The alloys described in this patent can be used in a variety of applications and industries. Some non-limiting examples of applications of use include:

Surface Mining applications include the following components and coatings for the following components: Wear resistant sleeves and/or wear resistant hardfacing for slurry pipelines, mud pump components including pump housing or impeller or hardfacing for mud pump components, ore feed chute components including chute blocks or hardfacing of chute blocks, separation screens including but not limited to rotary breaker screens, banana screens, and shaker screens, liners for autogenous grinding mills and semi-autogenous grinding mills, ground engaging tools and hardfacing for ground engaging tools, wear plate for buckets and dumptruck liners, heel blocks and hardfacing for heel blocks on mining shovels, grader blades and hardfacing for grader blades, stacker reclaimers, sizer crushers, general wear packages for mining components and other comminution components.

Downstream oil and gas applications include the following components and coatings for the following components: Downhole casing and downhole casing, drill pipe and coatings for drill pipe including hardbanding, mud management components, mud motors, fracking pump sleeves, fracking impellers, fracking blender pumps, stop collars, drill bits and drill bit components, directional drilling equipment and coatings for directional drilling equipment including stabilizers and centralizers, blow out preventers and coatings for blow out preventers and blow out preventer components including the shear rams, oil country tubular goods and coatings for oil country tubular goods.

Upstream oil and gas applications include the following components and coatings for the following components: Process vessels and coating for process vessels including steam generation equipment, amine vessels, distillation towers, cyclones, catalytic crackers, general refinery piping, corrosion under insulation protection, sulfur recovery units, convection hoods, sour stripper lines, scrubbers, hydrocarbon drums, and other refinery equipment and vessels.

Pulp and paper applications include the following components and coatings for the following components: Rolls used in paper machines including yankee dryers and other dryers, calendar rolls, machine rolls, press rolls, digesters, pulp mixers, pulpers, pumps, boilers, shredders, tissue machines, roll and bale handling machines, doctor blades, evaporators, pulp mills, head boxes, wire parts, press parts, M.G. cylinders, pope reels, winders, vacuum pumps, deflakers, and other pulp and paper equipment, Power generation applications include the following components and coatings for the following components: boiler tubes, precipitators, fireboxes, turbines, generators, cooling towers, condensers, chutes and troughs, augers, bag houses, ducts, ID fans, coal piping, and other power generation components.

Agriculture applications include the following components and coatings for the following components: chutes, base cutter blades, troughs, primary fan blades, secondary fan blades, augers and other agricultural applications.

Construction applications include the following components and coatings for the following components: cement chutes, cement piping, bag houses, mixing equipment and other construction applications Machine element applications include the following components and coatings for the following components: Shaft journals, paper rolls, gear boxes, drive rollers, impellers, general reclamation and dimensional restoration applications and other machine element applications Steel applications include the following components and coatings for the following components: cold rolling mills, hot rolling mills, wire rod mills, galvanizing lines, continue pickling lines, continuous casting rolls and other steel mill rolls, and other steel applications.

The alloys described in this patent can be produced and or deposited in a variety of techniques effectively. Some non-limiting examples of processes include:

Thermal spray process including those using a wire feedstock such as twin wire arc, spray, high velocity arc spray, combustion spray and those using a powder feedstock such as high velocity oxygen fuel, high velocity air spray, plasma spray, detonation gun spray, and cold spray. Wire feedstock can be in the form of a metal core wire, solid wire, or flux core wire. Powder feedstock can be either a single homogenous alloy or a combination of multiple alloy powder which result in the desired chemistry when melted together.

Welding processes including those using a wire feedstock including but not limited to metal inert gas (MIG) welding, tungsten inert gas (TIG) welding, arc welding, submerged arc welding, open arc welding, bulk welding, laser cladding, and those using a powder feedstock including but not limited to laser cladding and plasma transferred arc welding. Wire feedstock can be in the form of a metal core wire, solid wire, or flux core wire. Powder feedstock can be either a single homogenous alloy or a combination of multiple alloy powder which result in the desired chemistry when melted together.

Casting processes including processes typical to producing cast iron including but not limited to sand casting, permanent mold casting, chill casting, investment casting, lost foam casting, die casting, centrifugal casting, glass casting, slip casting and process typical to producing wrought steel products including continuous casting processes.

Post processing techniques including but not limited to rolling, forging, surface treatments such as carburizing, nitriding, carbonitriding, boriding, heat treatments including but not limited to austenitizing, normalizing, annealing, stress relieving, tempering, aging, quenching, cryogenic treatments, flame hardening, induction hardening, differential hardening, case hardening, decarburization, machining, grinding, cold working, work hardening, and welding.

From the foregoing description, it will be appreciated that inventive products and approaches for non-magnetic alloys are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. An alloy comprising:

a matrix having a FCC-BCC transition temperature at or below 950K; and extremely hard particles exhibiting a hardness of 1000 Vickers or greater, the extremely hard particles having:

an extremely hard particle fraction of 5 mole % or greater; and an extremely hard particle melt range of 200K or less;

wherein the alloy comprises Fe and, in weight percent:

C: 2.25 to 4.95;

Cr: 9 to 18.15;

Mn: 7.65 to 15.95; and

V: 9.0 to 17.6.

2. The alloy of claim 1, wherein the matrix comprises at least 7 mole % chromium.

3. The alloy of claim 1, the alloy comprising:

at least 90% volume fraction austenite in the matrix;

a fraction of the extremely hard particles is 5 volume % or greater;

an ASTM G65 abrasion loss of 1.5 g or less;

a relative magnetic permeability of 1.03μ or lower; and a corrosion resistance of 5 mpy or less in salt water according to ASTM G31;

wherein the matrix does not contain any extremely hard particles that begin to form at a temperature greater than 200K above a formation temperature of the matrix.

4. The alloy of claim 1, further comprising, in weight percent:

V: 12.15 to 17.6.

5. The alloy of claim 1, wherein the alloy is a powder.

6. The alloy of claim 1, wherein a powder feedstock forming the alloy comprises Fe and, in weight %:

C: 3.0, Cr: 12.0, Mn: 12.0, V: 15.0;

C: 4.0, Cr: 16.0, Mn: 12.0, V: 15.0;

C: 4.0, Cr: 16.0, Mn: 13.4, V: 15.1;

C: 3.0, Cr: 12.1, Mn: 9.8, V: 14.9;

C: 3.8, Cr: 16.0, Mn: 13.7, V: 14.7;

C: 2.8, Cr: 12.5, Mn: 10.4, V: 15.3;

C: 3.9, Cr: 16.1, Mn: 14.0, V: 15.6;

C: 2.9, Cr: 12.1, Mn: 9.6, V: 14.4;

C: 2.6, Cr: 11.9, Mn: 11.6, V: 10.0; or

C: 2.6, Cr: 11.9, Mn: 8.5, V: 10.6.

7. A drill pipe tool joint, drill collar, down hole stabilizer or oilfield component used in directional drilling applications with the alloy of claim 1 applied as a hardfacing layer.

8. An alloy comprising:

Fe;

C: 2.25 to 4.95;

Cr: 9 to 18.15;

Mn: 7.65 to 15.95; and

V: 9.0 to 17.6 a matrix comprising at least 90% volume fraction austenite; and extremely hard particles exhibiting a hardness of 1000 Vickers or greater, the extremely hard particles having a fraction of 5 volume % or greater;

wherein the matrix does not contain any extremely hard particles that begin to form at a temperature greater than 200K above a formation temperature of the matrix.

9. The alloy of claim 8, wherein the matrix comprises at least 7 weight % chromium.

10. The alloy of claim 8, further comprising, in weight percent:

V: 12.15 to 17.6.

11. The alloy of claim 8, wherein the alloy is a powder.

12. The alloy of claim 8, wherein a powder feedstock forming the alloy comprises Fe and, in weight %:

C: 3.0, Cr: 12.0, Mn: 12.0, V: 15.0;

C: 4.0, Cr: 16.0, Mn: 12.0, V: 15.0;

C: 4.0, Cr: 16.0, Mn: 13.4, V: 15.1;

C: 3.0, Cr: 12.1, Mn: 9.8, V: 14.9;

C: 3.8, Cr: 16.0, Mn: 13.7, V: 14.7;

C: 2.8, Cr: 12.5, Mn: 10.4, V: 15.3;

C: 3.9, Cr: 16.1, Mn: 14.0, V: 15.6;

C: 2.9, Cr: 12.1, Mn: 9.6, V: 14.4;

C: 2.6, Cr: 11.9, Mn: 11.6, V: 10.0; or

C: 2.6, Cr: 11.9, Mn: 8.5, V: 10.6.

13. A drill pipe tool joint, drill collar, down hole stabilizer or oilfield component used in directional drilling applications with the alloy of claim 8 applied as a hardfacing layer.

14. The alloy of claim 1, wherein the alloy is a wire.

15. The alloy of claim 1, wherein the alloy comprises 10.8 wt. % to 13 wt. % chromium.

16. The alloy of claim 1, wherein the alloy comprises 9.4 wt. % to 12 wt. % chromium.

17. The alloy of claim 8, wherein the alloy is a wire.

18. The alloy of claim 8, wherein the alloy comprises 10.8 wt. % to 13 wt. % chromium.

19. The alloy of claim 8, wherein the alloy comprises 9.4 wt. % to 12 wt. % chromium.

* * * * *